US006743066B1

(12) United States Patent
Oguchi et al.

(10) Patent No.: US 6,743,066 B1
(45) Date of Patent: Jun. 1, 2004

(54) METHOD AND APPARATUS OF MANUFACTURING ELECTRON SOURCE, AND ADJUSTING METHOD OF THE ELECTRON SOURCE, AND METHOD OF MANUFACTURING AN IMAGE FORMING APPARATUS HAVING THE ELECTRON SOURCE

(75) Inventors: Takahiro Oguchi, Sagamihara (JP); Noritake Suzuki, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/512,349

(22) Filed: Feb. 24, 2000

(30) Foreign Application Priority Data

Feb. 24, 1999 (JP) ..... 11-045996
Feb. 24, 1999 (JP) ..... 11-047250
Feb. 22, 2000 (JP) ..... 2000-043778

(51) Int. Cl.[7] ..... H01J 9/02
(52) U.S. Cl. ..... 445/6; 445/3; 445/63
(58) Field of Search ..... 445/3, 6, 24, 63

(56) References Cited

U.S. PATENT DOCUMENTS

| | | | | |
|---|---|---|---|---|
| 5,066,883 | A | 11/1991 | Yoshioka et al. | 313/309 |
| 5,500,743 | A | 3/1996 | Sakaegi et al. | 358/403 |
| 5,593,335 | A | 1/1997 | Suzuki et al. | 445/50 |
| 5,644,653 | A | 7/1997 | Sunakawa et al. | 382/187 |
| 5,734,361 | A | 3/1998 | Suzuki et al. | 345/74 |
| 6,009,232 | A | 12/1999 | Sakaegi et al. | 386/70 |
| 6,147,449 | A | * 11/2000 | Iwasaki et al. | 313/310 |

FOREIGN PATENT DOCUMENTS

| | | |
|---|---|---|
| JP | 64-31332 | 2/1989 |
| JP | 2-257551 | 10/1990 |
| JP | 8-248920 | 9/1996 |

OTHER PUBLICATIONS

W.P Dyke, et al., "Field Emission", Advances in Electronics and Electron Physics, vol. VIII, pp. 89–185 (1956).

C.A. Spindt, et al., "Physical Properties of Thin–Film Field Emission Cathodes With Molybdenum Cones", Journal of Applied Physics, vol. 47, No. 12, pp. 5248–5263, (Dec. 1976).

(List continued on next page.)

*Primary Examiner*—Kenneth J. Ramsey
(74) *Attorney, Agent, or Firm*—Fitzpatrick, Cella, Harper & Scinto

(57) ABSTRACT

In an electron source manufacturing method and apparatus, a plurality of electron-emitting devices are commonly connected to a first wiring and to a plurality of second wirings, respectively. A voltage V1 is applied to the plurality of devices connected to the first wiring by the difference between potentials applied to the first wiring and the plurality of second wirings. The voltage V1 has a relationship with a maximum value V2 of a voltage applied as a normal driving voltage after the voltage application step, so as to satisfy: giving a current I flowing upon application of the voltage V when a voltage V falling within a voltage range causing electron emission upon application of the voltage between the two electrodes of each device is applied to the device:

$$I=f(V) \quad (1)$$

and letting f'(V) be the differential coefficient of f(V) at the voltage V, a condition:

$$f(V1)/\{V1\cdot f'(V1)-2f(V1)\}>f(V2)/\{V2\cdot f'(V2)-2f(V2)\} \quad (2)$$

In this manner, the potential applied to each second wiring is set to reduce the difference in magnitude of the voltage V1 applied to each device connected to the first wiring.

23 Claims, 68 Drawing Sheets

OTHER PUBLICATIONS

C.A. Mead, "Operation of Tunnel–Emission Devices" Journal of Applied Physics, vol. 32, No. 4, pp. 646–652 (Apr. 1961).

M.I. Elinson, et al., "The Emission of Hot Electrons and the Field Emission of Electrons From Tin Oxide", Radio Eng. Electron Phys., vol. 10, pp. 1290–1296 (1965).

G. Dittmer, "Electrical Conduction and Electron Emission of Discontinuous Thin Films", Thin Solid Films, 9, pp. 317–328 (1972).

M. Hartwell, et al., "Strong Electron Emission From Patterned Tin–Indium Oxide Thin Films", International Electron Devices Meeting, pp. 519–521 (1975).

H. Araki, et al., "Electroforming and Electron Emission of Carbon Thin Films", vol. 26, No. 1, pp. 22–29 (1983).

* cited by examiner

FIG. 8A Dx1 DRIVING WAVEFORM

FIG. 8B Dx2~Dxm DRIVING WAVEFORM

FIG. 8C Dy1 DRIVING WAVEFORM

FIG. 8D Dyn DRIVING WAVEFORM

FIG. 25A Dx1 DRIVING WAVEFORM Dx [m / 2 + 1]

FIG. 25B Dx2~Dx [m / 2] DRIVING WAVEFORM Dx [m / 2 + 2] ~ Dxm

FIG. 25C Dy1 DRIVING WAVEFORM

FIG. 25D Dyn DRIVING WAVEFORM ( DETAILS OF P PORTION )

IMMEDIATELY AFTER
START OF PRE-DRIVING

AT END OF PRE-DRIVING

PRE-DRIVING CURRENT HISTOGRAM AT chk1

VOLTAGE DISTRIBUTION IN PRE-DRIVING

METHOD AND APPARATUS OF MANUFACTURING ELECTRON SOURCE, AND ADJUSTING METHOD OF THE ELECTRON SOURCE, AND METHOD OF MANUFACTURING AN IMAGE FORMING APPARATUS HAVING THE ELECTRON SOURCE

FIELD OF THE INVENTION

The present invention relates to a method of manufacturing a multi electron source serving as an electron source having many electron-emitting devices, a method of manufacturing an image forming apparatus using the multi electron source, an apparatus for manufacturing the multi electron source, and a method of adjusting the multi electron source.

BACKGROUND OF THE INVENTION

Conventionally, two types of devices, namely thermionic and cold cathode devices, are known as electron-emitting devices. Known examples of the cold cathode devices are field emission type electron-emitting devices (to be referred to as FE type electron-emitting devices hereinafter), metal/insulator/metal type electron-emitting devices (to be referred to as MIM type electron-emitting devices hereinafter), and surface-conduction type electron-emitting devices.

Known examples of the FE type electron-emitting devices are described in W. P. Dyke and W. W. Dolan, "Field emission", Advance in Electron Physics, 8, 89 (1956) and C. A. Spindt, "Physical properties of thin-film field emission cathodes with molybdenum cones", J. Appl. Phys., 47, 5248 (1976).

A known example of the MIM type electron-emitting devices is described in C. A. Mead, "Operation of tunnel-emission devices", J. Appl. Phys., 32,646 (1961).

A known example of the surface-conduction type electron-emitting devices is described in, e.g., M. I. Elinson, "Radio Eng. Electron Phys., 10, 1290 (1965) and other examples will be described later.

The surface-conduction type electron-emitting device utilizes the phenomenon that electrons are emitted from a small-area thin film formed on a substrate by flowing a current parallel through the film surface. The surface-conduction type electron-emitting device includes electron-emitting devices using an Au thin film [G. Dittmer, "Thin Solid Films", 9,317 (1972)], an $In_2O_3/SnO_2$ thin film [M. Hartwell and C. G. Fonstad, "IEEE Trans. ED Conf.", 519 (1975)], a carbon thin film [Hisashi Araki et al., "Vacuum", Vol. 26, No. 1, p. 22 (1983)], and the like, in addition to an $SnO_2$ thin film according to Elinson mentioned above.

FIG. 67 is a plan view showing the device by M. Hartwell et al. described above as a typical example of the device structures of these surface-conduction type electron-emitting devices. In FIG. 67, reference numeral 3001 denotes a substrate; and 3004, a conductive thin film made of a metal oxide formed by sputtering. This conductive thin film 3004 has an H-shaped pattern, as shown in FIG. 67. An electron-emitting portion 3005 is formed by performing electrification processing (to be referred to as forming processing) with respect to the conductive thin film 3004. An interval L in FIG. 67 is set to 0.5 to 1 mm, and a width W is set to 0.1 mm. The electron-emitting portion 3005 is shown in a rectangular shape at the center of the conductive thin film 3004 for the sake of illustrative convenience. However, this does not exactly show the actual position and shape of the electron-emitting portion.

In the above surface-conduction type electron-emitting devices by M. Hartwell et al. and the like, typically the electron-emitting portion 3005 is formed by performing electrification processing called forming processing for the conductive thin film 3004 before electron emission. In forming processing, for example, a constant DC voltage or a DC voltage which increases at a very low rate of, e.g., 1 V/min is applied to the two ends of the conductive thin film 3004 to partially destroy or deform the conductive thin film 3004, thereby forming the electron-emitting portion 3005 with an electrically high resistance. Note that the destroyed or deformed part of the conductive thin film 3004 has a fissure. Upon application of an appropriate voltage to the conductive thin film 3004 after forming processing, electrons are emitted near the fissure.

As described above, the electron-emitting portion of the surface-conduction type electron-emitting device is formed by processing (forming processing) of flowing a current through a conductive thin film to partially destroy or deform this thin film, thereby forming a fissure. If activation processing is performed subsequently, electron-emitting characteristics can be greatly improved.

In activation processing, the electron-emitting portion formed by forming processing is electrified under appropriate conditions to deposit carbon or a carbon compound around the electron-emitting portion. For example, graphite monocrystalline, graphite polycrystalline, amorphous carbon, or mixture thereof is deposited to a thickness of 500 Å or less around the electron-emitting portion by periodically applying a voltage pulse in a vacuum atmosphere in which an organic substance exists at a proper partial pressure and the total pressure is $10^{-2}$ to $10^{-3}$ Pa. These conditions are merely an example and properly changed in accordance with the material and shape of the surface-conduction type electron-emitting device.

This processing can increase the emission current at the same application voltage typically 100 times or greater the emission current immediately after forming processing. Note that the partial pressure of the organic substance in the vacuum atmosphere is desirably reduced after activation processing. This is called stabilization processing.

The above surface-conduction type electron-emitting devices are advantageous because they have a simple structure and can be easily manufactured. For this reason, many devices can be formed on a wide area. As disclosed in Japanese Patent Laid-Open No. 64-31332 filed by the present applicant, a method of arranging and driving a lot of devices has been studied.

Regarding applications of surface-conduction type electron-emitting devices to, e.g., image forming apparatuses such as an image display apparatus and an image recording apparatus, electron sources, and the like have been studied.

As an application to image display apparatuses, as disclosed in the U.S. Pat. No. 5,066,883 and Japanese Patent Laid-Open No. 2-257551 filed by the present applicant, an image display apparatus using a combination of a surface-conduction type electron-emitting device and a fluorescent substance which emits light upon reception of electrons has been studied. This type of image display apparatus using a combination of the surface-conduction type electron-emitting device and the fluorescent substance is expected to exhibit more excellent characteristics than other conventional image display apparatuses. For example, the above display apparatus is superior to recent popular liquid crystal display apparatuses in that it does not require a backlight because of a self-emission type and has a wide view angle.

The present inventors have examined surface conduction type electron-emitting devices of various materials, various manufacturing methods, and various structures, in addition to the above-mentioned conventional surface conduction type electron-emitting device. Further, the present inventors have made extensive studies on a multi-beam electron source having a large number of surface-conduction type electron-emitting devices, and an image display apparatus using this multi-beam electron source.

The present inventors have examined a multi electron source using an electrical wiring method shown in, e.g., FIG. 68. That is, a large number of surface-conduction type electron-emitting devices are two-dimensionally arranged in a matrix to obtain a multi electron source, as shown in FIG. 68.

In FIG. 68, reference numeral 4001 denotes a surface-conduction type electron-emitting device; 4002, a row-direction wiring; and 4003, a column-direction wiring. The row- and column-direction wirings 4002 and 4003 actually have finite electrical resistances, which are represented as wiring resistances 4004 and 4005 in FIG. 68. This wiring method is called a simple matrix wiring method.

For the illustrative convenience, the multi electron source is illustrated in a 6×6 matrix, but the size of the matrix is not limited to this. For example, in a multi electron source for an image display apparatus, a number of devices enough to display a desired image are arranged and wired.

In a multi electron source in which surface-conduction type electron-emitting devices are arranged in a simple matrix, appropriate electrical signals are applied to the row- and column-direction wirings 4002 and 4003 in order to output a desired electron beam. For example, to drive surface-conduction type electron-emitting devices on an arbitrary row in the matrix, a selection voltage Vs is applied to the row-direction wiring 4002 on the row to be selected, and at the same time a non-selection voltage Vns is applied to the row-direction wirings 4002 on unselected rows. In synchronism with this, a driving voltage Ve for emitting an electron beam is applied to the column-direction wirings 4003. According to this method, so long as voltage drops across the wiring resistances 4004 and 4005 are neglected, a voltage (Ve−Vs) is applied to the surface-conduction type electron-emitting device on the selected row, and a voltage (Ve−Vns) is applied to the surface-conduction type electron-emitting devices on the unselected rows. When the voltages Ve, Vs, and Vns are set to appropriate levels, an electron beam having a desired intensity must be output from only surface-conduction type electron-emitting devices on a selected row. When different driving voltages Ve are applied to respective column-direction wirings, electrons having different intensities must be output from respective devices on a selected row. Since the surface-conduction type electron-emitting device has a high response speed, the electron beam output time can be changed by changing the application time of the driving voltage Ve.

A multi electron source obtained by arranging surface-conduction type electron-emitting devices in a simple matrix can be applied for a variety of purposes. For example, if a voltage signal corresponding to image information is appropriately applied, the multi electron source can be applied as an electron source for an image display apparatus.

The present inventors have made extensive studies on improving the characteristics of the surface-conduction type electron-emitting device to find that changes over time can be reduced by performing a step (to be referred to as pre-driving processing hereinafter) of applying a voltage which satisfies a specific relationship with a normal driving voltage before normal driving is executed for the surface-conduction type electron-emitting device.

The present applicants have proposed that changes in device characteristics upon actual driving can be suppressed by applying a voltage higher than a voltage applied in actual driving, as the manufacturing process of the surface-conduction type electron-emitting device.

SUMMARY OF THE INVENTION

It is an object of the present invention to provide a pre-driving apparatus and method and an electron source manufacturing method capable of applying pre-driving processing to an electron source having many electron-emitting devices arranged in a matrix or ladder shape on a substrate, shortening the process evaluation time, and giving uniform electron-emitting characteristics to electron-emitting devices constituting the electron source.

To achieve the above object, an electron source manufacturing method according to the first aspect of the present invention has the following steps.

That is, a method of manufacturing an electron source having a plurality of electron-emitting devices is characterized by comprising:

the voltage application step of applying potentials to each first wiring commonly connected to a plurality of devices, and a plurality of second wirings respectively connected to the plurality of devices, such that a voltage V1 is applied to the plurality of devices connected to the first wiring by the potentials applied to the first wiring and the plurality of second wirings, the voltage V1 having a relationship with a maximum value V2 of a voltage applied as a normal driving voltage after the voltage application step, so as to satisfy:

giving a current I flowing upon application of a voltage V when the voltage V falling within a voltage range causing electron emission upon application of the voltage between two electrodes is applied to the device:

$$I=f(V) \tag{1}$$

and letting f'(V) be a differential coefficient of f(V) at the voltage V, a condition:

$$f(V1)/\{V1\cdot f'(V1)-2f(V1)\}>f(V2)/\{V2\cdot f'(V2)-2f(V2)\} \tag{2}$$

wherein the potential applied to the second wiring is set to reduce a difference in magnitude of the voltage V1 applied to each device as a potential difference between the potential applied to the device through the first wiring and the potential applied to the device through the second wiring. Particularly in this aspect, the difference between application voltages to devices caused by a voltage drop on the first wiring is preferably reduced by setting different potentials to the second wirings.

If devices are connected at a plurality of positions on the first wiring, the potential applied to these devices through the first wiring varies. At this time, if the same potential is applied to the devices through the second wirings, the voltage V1 applied to the devices greatly varies. To prevent this, the present invention sets the potentials applied to the second wirings so as to reduce the differences in magnitudes of the voltage V1 applied to the devices. Accordingly, an electron source can be suitably manufactured.

In the present invention, the voltage application step is preferably performed in a high vacuum atmosphere. The voltage application step is preferably performed in an atmosphere in which deposition of a substance in the atmosphere or a substance originating from the substance in the atmosphere is suppressed at a portion serving as an electron-emitting portion of each device. For example, the voltage application step is preferably performed in an atmosphere in which a substance serving as a deposit has a partial pressure of not more than $1\times10^{-6}$ Pa.

In the present invention, it is preferable that each device have two electrodes, the two electrodes sandwich a gap, and the voltage application step be performed in an atmosphere in which the gap between the two electrodes is not narrowed by deposition of a substance in the atmosphere or a substance originating from the substance in the atmosphere.

In the present invention, the voltage application step is preferably performed in an atmosphere in which carbon or a carbon compound in the atmosphere has a partial pressure of not more than $1\times10^{-6}$ Pa.

In the present invention, the voltage application step is preferably performed after the step of depositing a deposit at a portion serving as an electron-emitting portion of each device. For example, the deposit preferably contains carbon. The deposit may be a carbon compound The manufacturing method of the present invention can be preferably adopted when the electron-emitting device is a cold cathode device. In particular, the manufacturing method can be preferably adopted when the electron-emitting device is a field emission type electron-emitting device, surface-conduction type electron-emitting device, or MIM type electron-emitting device having an insulating layer sandwiched between two electrodes.

As the manufacturing process of the surface-conduction type electron-emitting device, the activation step is known in which carbon or a carbon compound is deposited in a gap serving as an electron-emitting portion. The voltage application step of the present invention is suitable as a step performed after the activation step. The voltage application step of the present invention is preferably performed after the partial pressure of a substance serving as a deposit in the atmosphere is decreased upon the deposition step.

In the present invention, particularly, the potential applied to each second wiring is preferably updated during the voltage application step.

By updating the potential applied to the second wiring, a preferable voltage application state can be maintained in accordance with changes in device characteristics. The potential can be updated along with the progress of the voltage application step such that the application potential is changed every predetermined time. In particular, the potential can be preferably updated in accordance with a state detected by, e.g., detecting a current flowing through the wiring. Specifically, an appropriate potential can be supplied to the second wiring using a measurement circuit for measuring a current flowing through the device in the voltage application step, a calculation circuit for calculating a potential to be applied to the second wiring on the basis of an output from the measurement circuit, and a potential distribution generation circuit for setting a potential to be applied to the second wiring by the calculation circuit. Even if a current flowing through the device changes, a potential applied to the second wiring can be properly set in accordance with the change. More specifically, the potential distribution generation circuit can be constituted by a latch circuit holding the potential of each second wiring calculated by the calculation circuit, and a D/A converter for converting an output from the latch circuit into an analog value. A current flowing through the device can be detected directly or indirectly by detecting a current flowing through the wiring, as described above.

The current can be detected by a method of detecting a current flowing through the first wiring or a method of detecting a current flowing through each second wiring.

In the present invention, the voltage application step preferably comprises applying a pulse-like potential.

In the present invention, it is preferable that the voltage application step comprises applying a pulse-like voltage to each device a plurality of number of times. The pulse-like voltage is applied by applying as pulses at least one of the potential applied to the first wiring and the potential applied to the second wiring. For example, when the potential of the first wiring is in a predetermined state, a pulse-like potential is applied to the second wiring, thereby applying a pulse-like voltage to the device. While the potential of the first wiring is in a predetermined state, a pulse-like potential is applied through the second wiring a plurality of number of times, thereby applying a pulse-like voltage a plurality of number of times. Alternatively, the step of applying a predetermined potential to the first wiring may be repeated a plurality of number of times, thereby providing a chance to apply a pulse-like voltage to the device a plurality of number of times.

In the present invention, the potential applied to the first wiring is set to distribute the potentials applied to the plurality of second wirings with respect to a potential of 0 V.

In the present invention, the voltage application step includes the step of selecting some of a plurality of first wirings, and a predetermined potential is applied to the selected first wirings to apply the voltage V1 to a plurality of devices connected to the selected first wirings.

At this time, a predetermined potential different from the potential applied to the selected first wirings is preferably applied to first wirings other than the selected first wirings. In particular, the potential is preferably applied to the unselected first wiring so as to suppress a current flowing through a device which receives a potential through the unselected first wiring.

In the present invention, the predetermined potential different from the potential applied to the selected first wirings is preferably a potential smaller than a maximum value and larger than a minimum value among the potentials applied to the plurality of second wirings in order to apply the voltage V1 to a plurality of devices connected to the selected first wirings.

The voltage application step comprises applying the voltage V1 to a plurality of devices connected to each first wiring while sequentially changing the first wirings to be selected.

First wirings to be simultaneously selected in the voltage application step are some of the plurality of first wirings.

The method preferably further comprises the step of determining first wirings to be simultaneously selected.

The step of determining first wirings to be simultaneously selected comprises determining the number of-first wirings to be simultaneously selected, or selecting first wirings to be simultaneously selected. The step of determining first wirings to be simultaneously selected can be executed during the voltage application step. More specifically, first wirings to be simultaneously selected can be determined based on the wiring resistance value or a detected current value. Alternatively, first wirings to be simultaneously selected may be determined by storing, in a memory, information for determining first wirings to be simultaneously selected, and referring to the information.

In the present invention, it is preferable that first wirings to be simultaneously selected in the voltage application step be some of the plurality of first wirings, and the method further comprises the step of determining unselected first wirings from the plurality of first wirings.

An electron source manufacturing method according to the second aspect of the present invention includes the following steps.

That is, a method of manufacturing an electron source having a plurality of electron-emitting devices respectively connected to a plurality of first wirings, is characterized by comprising:

the voltage application step of selecting some first wirings from the plurality of first wirings, and applying a voltage V1 to a plurality of devices connected to each of the selected first wirings by potentials applied to the selected first wirings and a potential applied to a second wiring connected to the plurality of devices respectively connected to the selected first wirings, the voltage V1 having a relationship with a maximum value V2 of a voltage applied as a normal driving voltage after the voltage application step, so as to satisfy:

giving a current I flowing upon application of the voltage V when the voltage V falling within a voltage range causing electron emission upon application of the voltage between two electrodes each device is applied to the device:

$$I=f(V) \tag{1}$$

and letting f'(V) be a differential coefficient of f(V) at the voltage V, a condition:

$$f(V1)/\{V1\cdot f'(V1)-2f(V1)\}>f(V2)/\{V2\cdot f'(V2)-2f(V2)\} \tag{2}$$

The second wiring includes a plurality of second wirings, the pluralities of first and second wirings extend to substantially cross each other, and the pluralities of first and second wirings form a matrix arrangement. Alternatively, the first and second wirings extend substantially parallel to each other. The latter includes so-called ladder-shaped connection.

By applying the voltage V1 to a plurality of electron-emitting devices connected to first wirings while simultaneously selecting a plurality of first wirings, all the devices of the electron source can be pre-driven within a short time. As a result, a multi electron source almost free from variations in characteristics can be realized. Further, more uniform device characteristics can be obtained by combining a driving method of compensating for a voltage drop generated on the first wiring from the second wiring, and in this case, by selecting a proper combination of lines to be simultaneously selected or performing proper calculation of the compensation voltage. A high-quality image display apparatus can be realized using such electron source.

According to the third aspect of the present invention, a method of manufacturing an image forming apparatus having an electron source, and an image forming member for forming an image upon irradiation of electrons emitted by the electron source is characterized in that the electron source manufacturing method of each aspect is used as an electron source manufacturing method.

According to the fourth aspect of the present invention, a manufacturing apparatus for practicing the electron source manufacturing method of each aspect is characterized by comprising first potential application means for applying a potential to the first wiring, second potential application means for applying a potential to each second wiring, and potential determination means for determining the potential applied by the second potential application means.

An example of this electron source manufacturing apparatus is a pre-driving apparatus for a simple matrix of surface-conduction type electron-emitting devices which constitute an electron source by connecting pairs of device electrodes of the devices at intersections of row- and column-direction wirings (second and first wirings), comprising a line selection circuit and power source circuit for selecting a row- or column-direction wiring of a simple matrix and performing pre-driving processing in units of lines in forming devices, a pre-driving current detection circuit for measuring in units of lines a current flowing through the device in pre-driving processing, a control circuit for calculating, on the basis of an output value from the pre-driving current detection circuit, a voltage distribution applied to a column- or row-direction wiring perpendicular to a row- or column-direction wiring connected to the line selection circuit, a voltage distribution generation circuit for generating the voltage distribution calculated by the control circuit, and a driving circuit for driving the column or row of surface-conduction type electron-emitting devices in a simple matrix in accordance with an output from the voltage distribution generation circuit.

This arrangement can solve the problem that the electron-emitting characteristics of electron-emitting devices on a multi electron source substrate vary due to nonuniformity between the devices caused by a voltage drop by the wiring resistance from the feeding terminal to the device terminal. In addition, the device characteristics can be stably maintained. Since pre-driving processing is done in units of lines, the pre-driving processing time can be shortened.

For example, when a row- or column-direction wiring of a simple matrix is selected to perform pre-driving processing in units of lines, a voltage drop generated in the line direction by the wiring resistance can be compensated by the voltage distribution application circuit for generating a voltage distribution on a column or row crossing the row- or column-direction wiring connected to the line selection circuit. At this time, if an output from the voltage distribution application circuit is updated in accordance with the device current which changes upon application of the pre-driving voltage, nonuniformity between the pre-driving voltage values of devices caused by the difference in distance from the feeding terminal can be eliminated.

Accordingly, a multi electron source having many surface-conduction type electron-emitting devices can be uniformly fabricated.

An electron source adjusting method according to the fifth aspect of the present invention has the following steps.

That is, a method of adjusting an electron source having a plurality of electron-emitting devices is characterized by comprising:

the voltage application step of applying potentials to a first wiring commonly connected to a plurality of electron-emitting devices, and a plurality of second wirings respectively connected to the plurality of electron-emitting devices, and applying a voltage V1 to the plurality of electron-emitting devices connected to the first wiring by the potentials applied to the first wiring and the plurality of second wirings, the voltage V1 having a relationship with a maximum value V2 of a voltage applied as a normal driving voltage after the voltage application step, so as to satisfy:

giving a current I flowing upon application of a voltage V when the voltage V falling within a voltage range causing electron emission upon application of the voltage between two electrodes is applied to the device:

$$I=f(V) \quad (1)$$

and letting f'(V) be a differential coefficient of f(V) at the voltage V, a condition:

$$f(V1)/\{V1\cdot f'(V1)-2f(V1)\}>f(V2)/\{V2\cdot f'(V2)-2f(V2)\} \quad (2)$$

wherein the potential applied to each second wiring is set to reduce a difference in magnitude of the voltage V1 applied to each electron-emitting device as a potential difference between the potential applied to the electron-emitting device through the first wiring and the potential applied to the electron-emitting device through the second wiring.

This adjusting method enables adjusting after shipping, as needed.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in embodiments of the invention and constitute a part of the invention, serve to explain the principles of the invention together with the present specification.

DETAILED DESCRIPTION OF THE PREFERRED EMBODIMENTS

Figure 1:
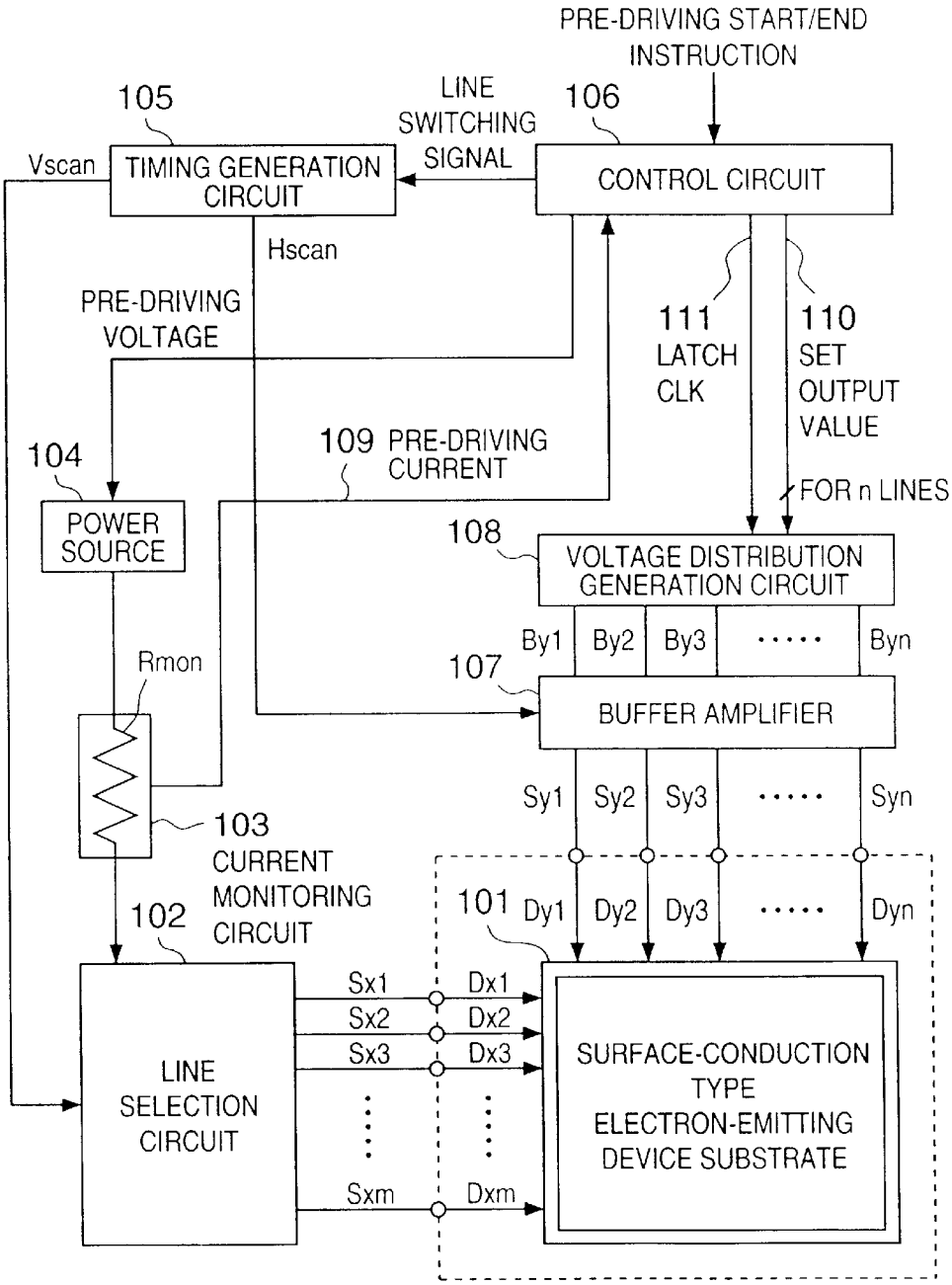
FIG. 1 is a block diagram showing the schematic arrangement of a pre-driving apparatus according to the first embodiment of the present invention.

The present invention will be described in detail below with reference to embodiments.

[First Embodiment]

As described above, the present applicants have made extensive studies on improving the characteristics of the surface-conduction type electron-emitting device to find that changes over time can be reduced by performing processing (pre-driving processing) of applying, prior to normal driving, a voltage which satisfies a specific relationship with a normal driving application voltage.

This pre-driving step will be explained.

As described above, in forming the electron-emitting portion of the surface-conduction type electron-emitting device, carbon or a carbon compound is deposited near the electron-emitting portion by activation processing after forming processing. Upon completion of activation, the stabilization step is preferably done. This is a step of exhausting an organic substance from a vacuum vessel. An evacuation apparatus for evacuating the vacuum vessel is preferably one not using any oil so as not to affect device characteristics by an organic substance such as oil produced by the apparatus. For example, this evacuation apparatus is a magnetic levitation type turbo molecular pump, cryopump, sorption pump, ion pump, or the like. The partial pressure of the organic component in the vacuum vessel is preferably $1\times10^{-6}$ Pa or less, and more preferably $1\times10^{-8}$ Pa or less so as not to newly deposit carbon or a carbon compound. To evacuate the vacuum vessel, the whole vacuum vessel is preferably heated to facilitate exhaust of organic substance molecules adsorbed in the inner wall of the vacuum vessel and the electron-emitting device. Pre-driving processing is electrification processing performed prior to normal driving in an atmosphere in which the organic substance in a vacuum atmosphere prepared by the stabilization step is at a low partial pressure.

In the electron-emitting device, the field strength near the electron-emitting portion is very high during driving. The electron emission amount gradually decreases along with long-period driving at a constant driving voltage. Changes over time near the electron-emitting portion arising from a high field strength are assumed to decrease the electron emission amount.

This will be explained. According to Fowler and Nordheim, a current I emitted by an FE type electron-emitting device, and a voltage V applied between the cathode and the gate have a relation:

$$I=A\cdot(\beta\cdot V)^2\cdot\exp(-B/(\beta\cdot V)) \quad (3)$$

where A and B are constants depending on the material and emission area near the electron-emitting portion, and β is a parameter depending on the shape near the electron-emitting portion. The value obtained by multiplying the voltage V by β represents the field strength. The FE type electron-emitting device will be exemplified because the same relation can be expressed even for the surface-conduction type electron-emitting device only by replacing the voltage V applied between a pair of electrodes with an electron current or emission current I.

Figure 62:
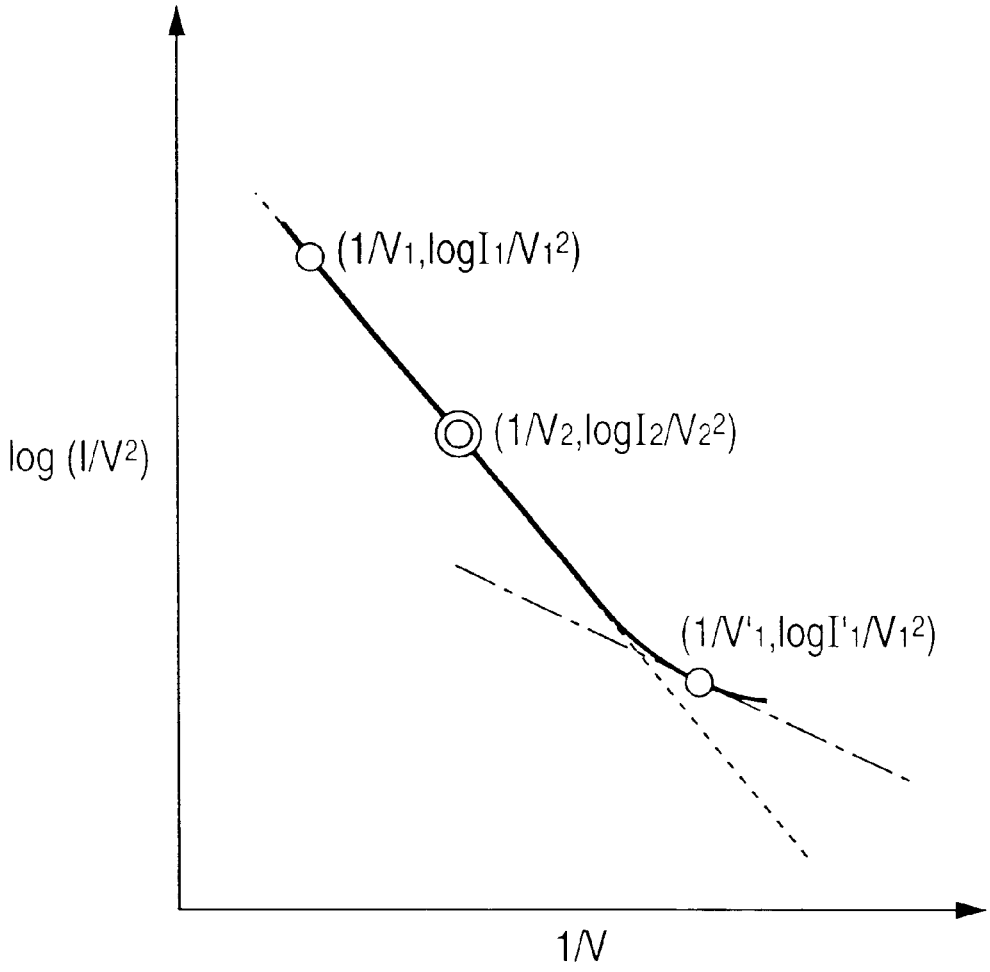
FIG. 62 is a graph showing an electrical characteristic of the electron-emitting device to which the present invention can be applied.

An electrical characteristic plotted on the graph of FIG. 62 is approximated to a straight line (broken line in FIG. 62) to find that a value obtained by adding a negative sign to a value calculated by dividing the application voltage V by a gradient S of the approximate straight line:

$$-V/S \quad (4)$$

is proportional to the strength of a field generated between a cathode 23 and a gate 24.

This relationship is generalized. If the relationship between the emission current I and the voltage V is given by a function:

$$I=f(V) \quad (5)$$

f'(V) represents the differential coefficient of f(V) at the voltage V, the field strength at the voltage V is given from equation (3) by $$F=\beta\cdot V \quad (6)$$
$$=\beta\cdot f(V)/\{V\cdot f'(V)-2f(V)\}$$

and is proportional to $$f(V)/\{V\cdot f'(V)-2f(V)\} \quad (7)$$

The representative value of the field strength in the FE type electron-emitting device is as very high as $10^7$ V/cm order. This is also applied between a pair of electrodes of the surface-conduction type electron-emitting device.

If long-period driving continues by a general method at a high field strength, constituent members irregularly change in the strong field, and the emission current value becomes unstable.

If such change irreversibly occurs, the emission current often decreases. This appears as a decrease in luminance in the image display apparatus.

Current unstableness during driving can be reduced by performing pre-driving as a driving method executed prior to normal driving.

Pre-driving of the present invention is executed by, e.g., the following procedures.

Figure 63:
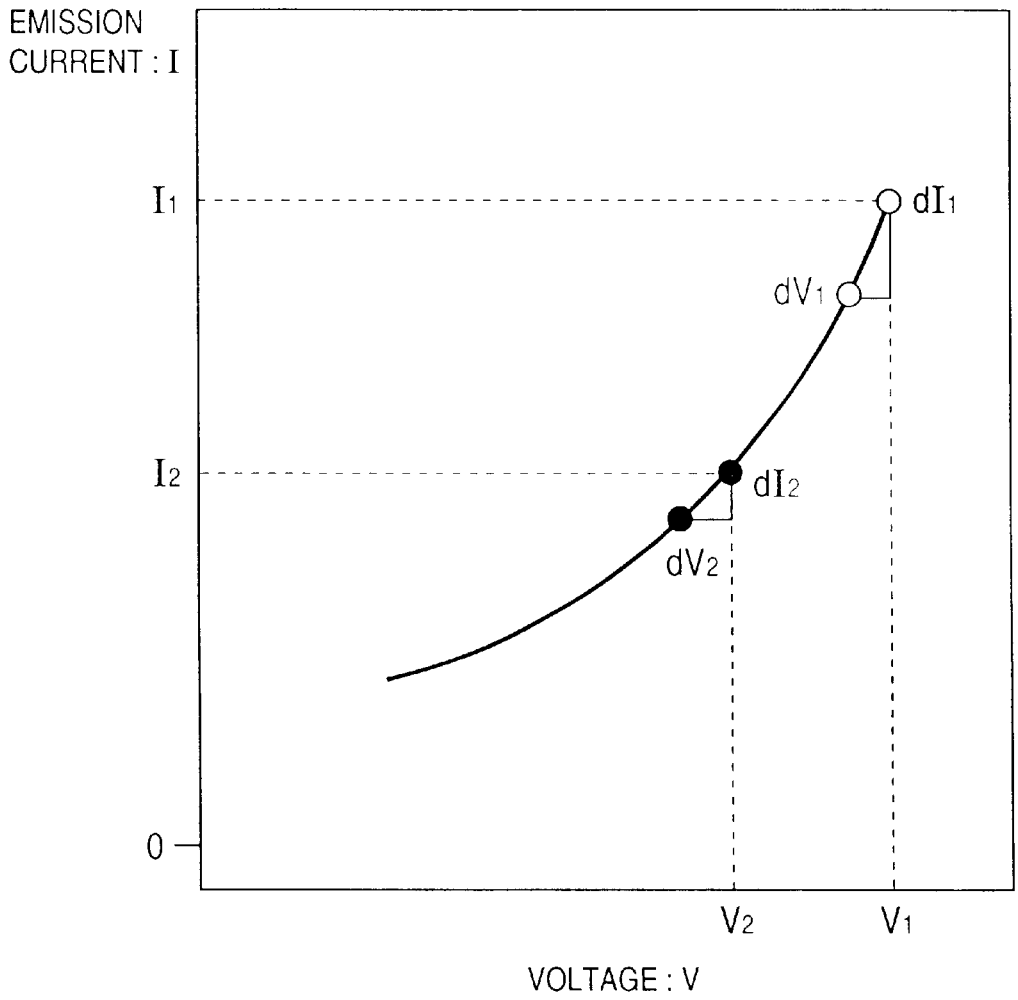
FIG. 63 is a graph showing an electrical characteristic when the scale in FIG. 62 is changed.

Application voltages and emission currents on at least two different driving voltages for an electron-emitting device to be pre-driven, and the differential coefficients of the emission currents at these application voltages are obtained. For example, a differential coefficient I'1 of the emission current is calculated by I'1=dI1/dV1 from an emission current value I1 corresponding to an application voltage V1, and an emission current change amount dI1 upon slightly changing V1 by dV1, as shown in FIG. 63. Similarly, an emission current value I2 corresponding to V2, and a differential coefficient I'2 are calculated.

I1 and I2 are substituted into f(V) in relation (7) corresponding to the application voltages V1 and V2, I'1 and I'2 are substituted into f'(V), and values calculated by relation (7) are compared. When, for example, $$I1\div(V1\cdot I'1-2\cdot I1)>I2\div(V2\cdot I'2-2\cdot I2) \quad (8)$$

is established, V1 is adopted as a pre-driving voltage (to be referred to as Vpre hereinafter), and V2 is adopted as a normal driving voltage (to be referred to as Vdrv hereinafter). To the contrary, when $$I1\div(V1\cdot I'1-2\cdot I1)<I2\div(V2\cdot I'2-2\cdot I2) \quad (9)$$

is established, V2 is adopted as a pre-driving voltage (to be referred to as Vpre hereinafter), and V1 is adopted as a normal driving voltage (to be referred to as Vdrv hereinafter).

Pre-driving desirably continues until the field strength in driving stabilizes. However, if pre-driving continues until the relative change rate of the field strength in pre-driving reaches 5% or less, the change rate of the field strength can be kept within about 5% even upon subsequent driving to satisfactorily realize the pre-driving effect. From relation (7), pre-driving is continued until the change rate of the value f(Vpre)/{Vpre·f'(Vpre)−2f(Vpre)} reaches 5% or less.

In pre-driving, the voltage is applied while monitoring the change rate of the field strength in pre-driving. The pre-driving voltage can suitably use a pulse voltage. For example, the voltage is applied while the change rate of the field strength is calculated during a pulse idle time (time interval from application of a pulse voltage to application of the next pulse voltage). When the change rate reaches 5% or less, application of the voltage is stopped.

To monitor the change rate of the field strength in pre-driving, the following method can be employed. When V1 is used as the pre-driving voltage, the pre-driving voltage V1, and a voltage V12 different from V1 by a small voltage amount dV1 are successively applied in pre-driving. Currents I1 and I12 flowing upon application of these voltages, and a difference dI1 between I1 and I12 are obtained. Since f'(V1)=dI1/dV1, and f(V1)=I1 from equation (5), f(V1)/{V1·f'(V1)−2f(V1)} is rewritten into $$Epre=I1/(V1\cdot dI1/dV1-2\cdot I1) \quad (10)$$

The change rate of the field strength can, therefore, be obtained by monitoring the change rate of the value Epre.

Figure 64A:
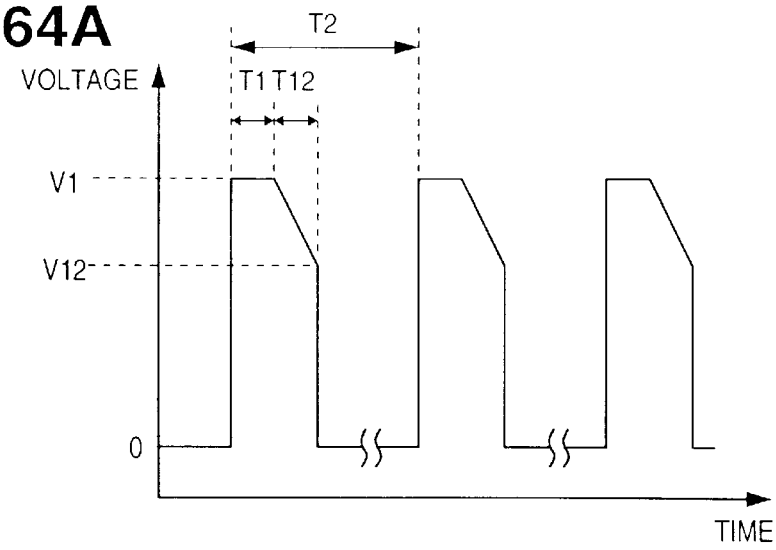
FIGS. 64A to 64C are graphs each showing a voltage waveform used in pre-driving according to the embodiment of the present invention.
Figure 64B:
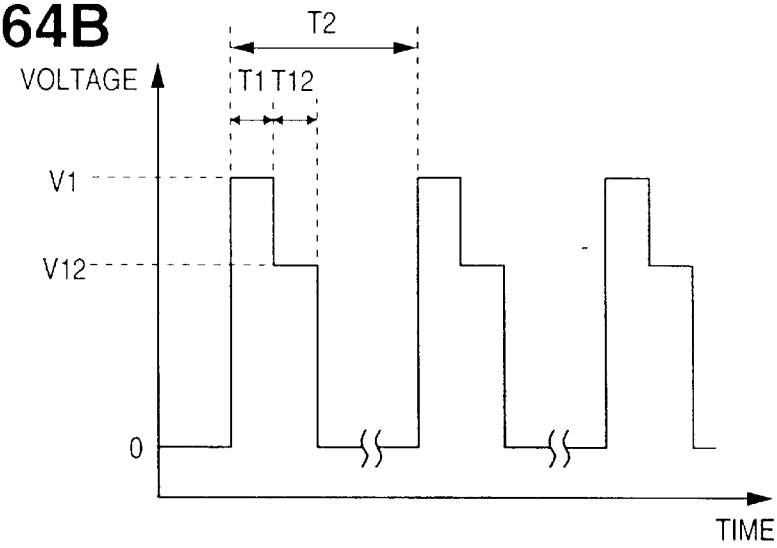
Figure 64C:
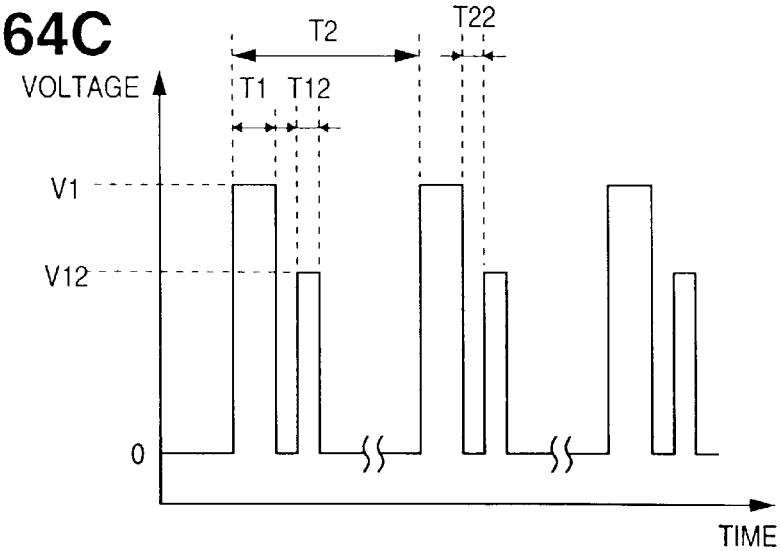

As a voltage waveform in pre-driving, voltage waveforms as shown in FIGS. 64A to 64C can be employed. FIG. 64A shows a voltage waveform representing that the voltage changes to a voltage V12 within a time T12 immediately after the pre-driving voltage V1 is applied for a time T1. FIG. 64B shows a voltage waveform representing that the voltage V12 is applied for the time T12 immediately after the pre-driving voltage V1 is applied for the time T1. FIG. 64C shows a voltage waveform representing that the voltage V12 is applied for the time T12 immediately after the pre-driving voltage V1 is applied for the time T1. The change rate of the value Epre is calculated from current values at the application voltages V1 and V12, and pre-driving is continued until the change rate reaches 5% or less.

In an electron-emitting device satisfying inequality (8) after the stabilization step, a device current If and emission current Ie exhibit an MI characteristic with respect to a device voltage Vf, and are uniquely determined with respect to the device voltage Vf. The If–Vf and Ie–Vf characteristics depend on a maximum voltage Vmax applied after the stabilization step.

Figure 65A:
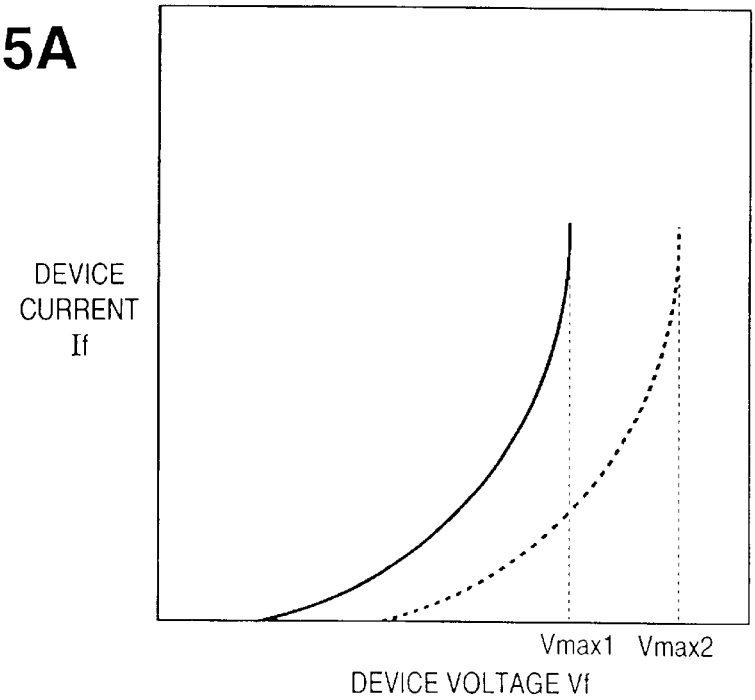
FIGS. 65A and 65B are graphs showing a relationship between an emission current Ie, device current If, and device voltage Vf in the electron-emitting device according to the embodiment of the present invention.

The I–V characteristic of the electron-emitting device will be described with reference to FIGS. 65A and 65B. FIG. 65A is a graph showing the relationship between the device current If and the device voltage Vf, and FIG. 65B is a graph showing the relationship between the emission current Ie and the device voltage Vf.

Figure 65B:
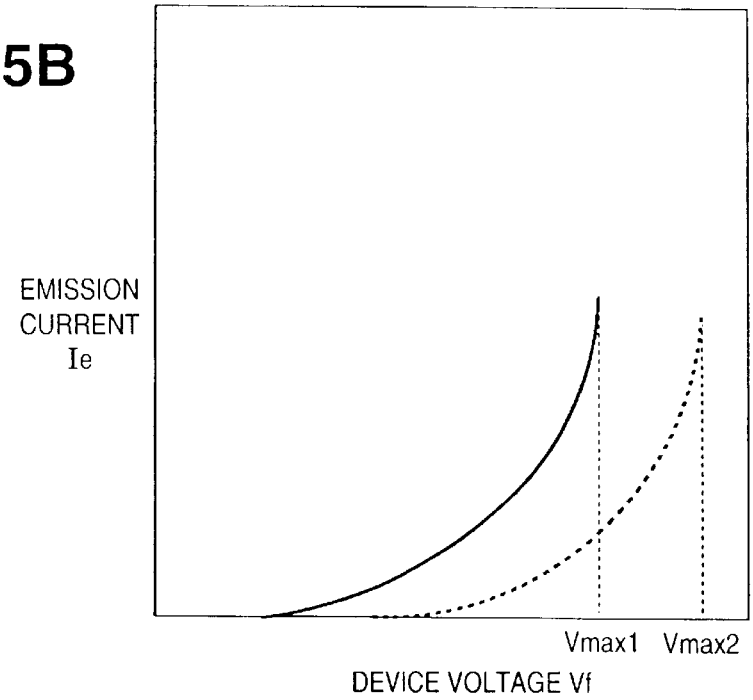

In FIGS. 65A and 65B, the solid line represents the I–V characteristic of a device driven at the maximum voltage Vmax=Vmax1. The device driven at a device voltage lower than Vmax1 exhibits the same I–V characteristic as that of the solid line. However, the device driven at a voltage Vmax2 higher than Vmax1 exhibits a different I–V characteristic, as represented by the broken line in FIGS. 65A and 65B. The device driven at a device voltage lower than Vmax2 exhibits the same I–V characteristic as that of the broken line. This can be assumed that the shape and electron emission area of the electron-emitting portion change depending on the maximum voltage Vmax applied to the electron-emitting device.

Figure 66:
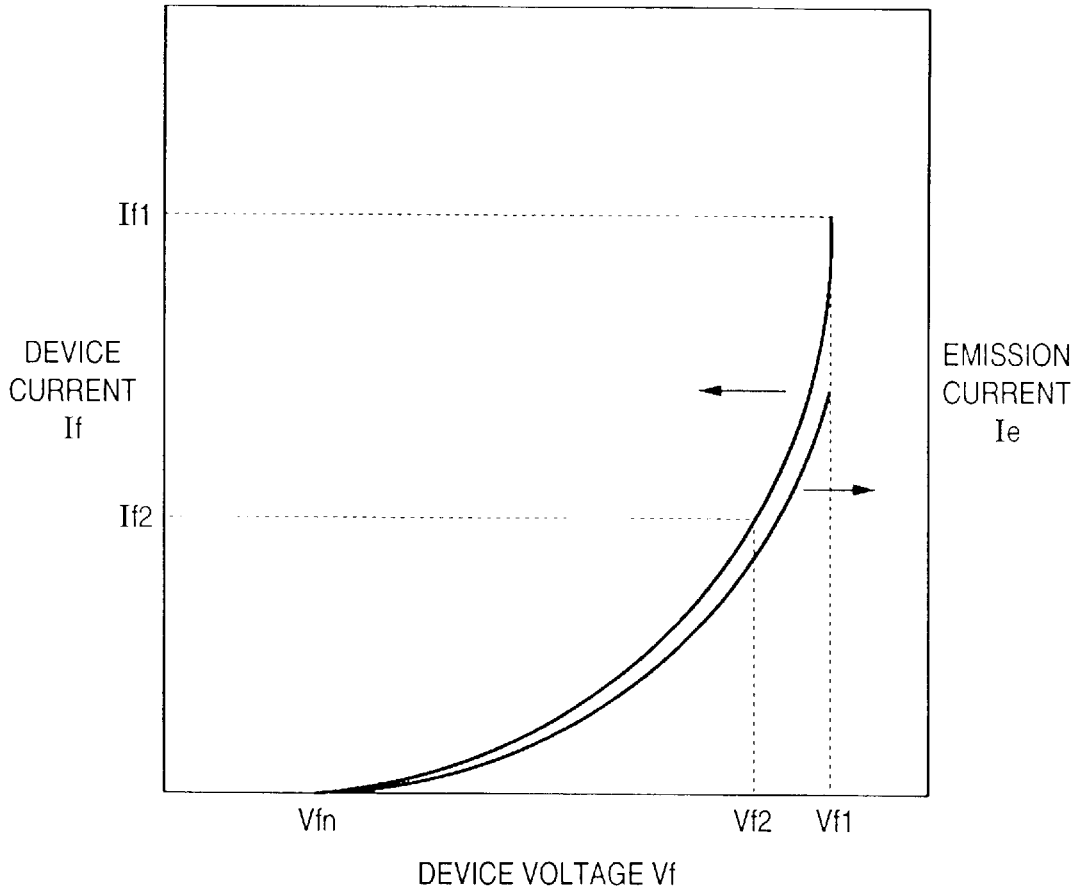
FIG. 66 is a graph showing another relationship between the emission current Ie, device current If, and device voltage Vf in the electron-emitting device according to the embodiment of the present invention.
Figure 67:
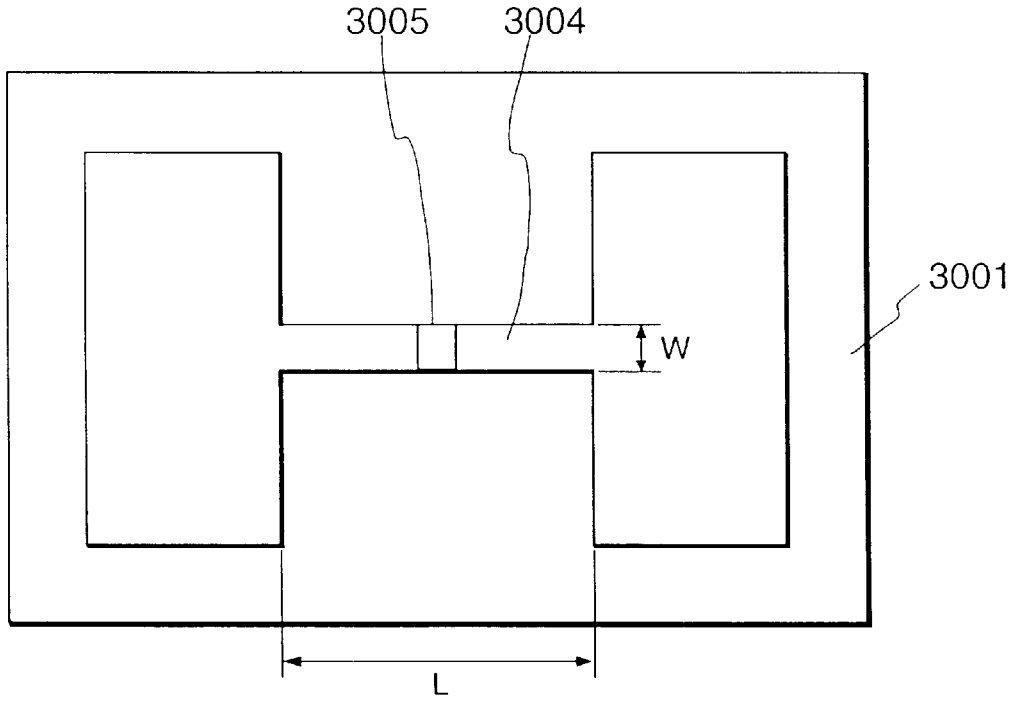
FIG. 67 is a schematic plan view showing a surface-conduction type electron-emitting device.
Figure 68:
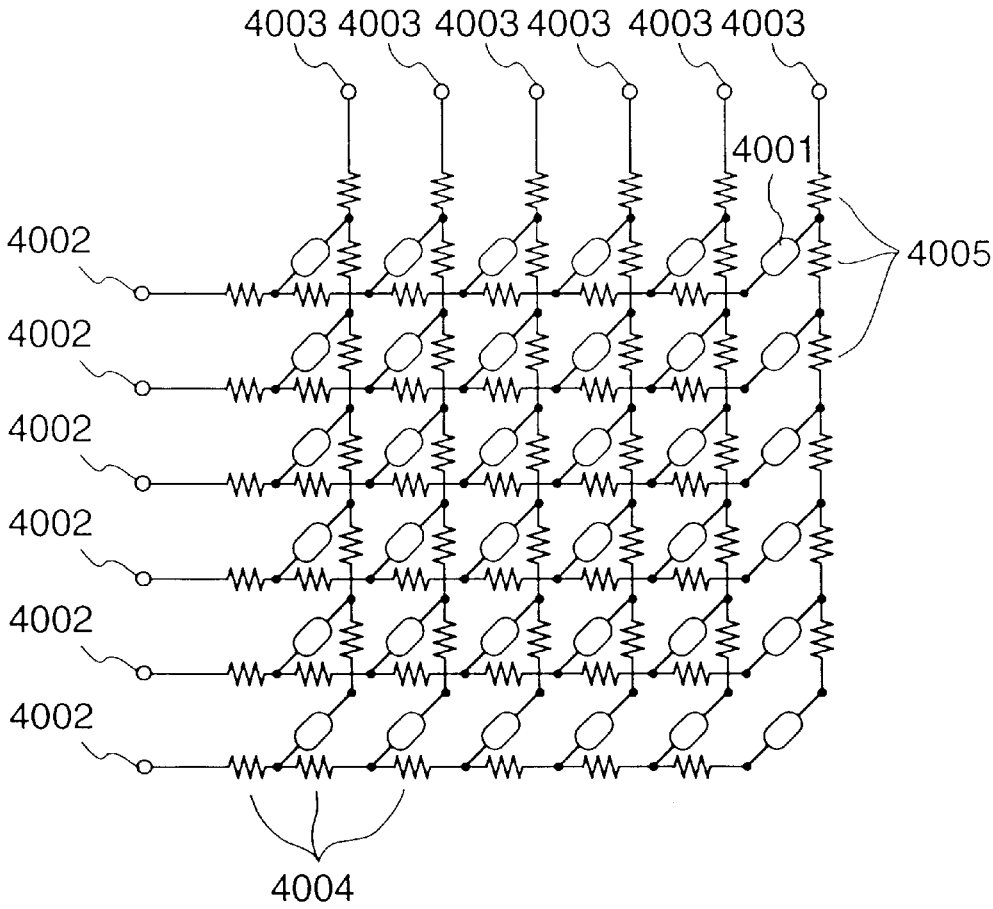
FIG. 68 is a circuit diagram showing an electron source having a simple matrix arrangement.

By pre-driving the device at the device voltage V1 in the pre-driving step, the electron-emitting device attains If–Vf and Ie–Vf characteristics uniquely determined by the voltage Vmax=V1, as shown in FIG. 66.

Letting If1 be the device current flowing at a device voltage Vf1 upon completion of pre-driving, Vf2 satisfying If2≦0.7If1 is selected as a driving voltage from the If–Vf characteristic determined by pre-driving (Vf2 in FIG. 66). Using the driving voltage satisfying If2≦0.7If1, a decrease in emission current can be suppressed for a long time.

Even if the driving voltage Vf2 satisfying If2≦0.7If1 is applied to a device pre-driven at the device voltage Vf1, the shape and emission area of the electron-emitting portion are considered to hardly change. In driving, the device is driven at the device current If smaller than in pre-driving while almost the same emission area as in pre-driving is maintained. Accordingly, the current density of a device current flowing through the electron-emitting portion in driving can be decreased to stably emit electrons for a long time while suppressing thermal deterioration of the electron-emitting portion.

Pre-driving suffices to be done for a time necessary to keep the If–Vf and Ie–Vf characteristics of the electron-emitting device unchanged in driving the device at a voltage lower than the pre-driving voltage after pre-driving. Pre-driving can be executed by applying several to several ten pulses of a pulse voltage having a pulse width of several μsec to several ten msec, and more preferably 10 μsec to 10 msec.

When an inequality like inequality (9) holds at voltages which satisfy V1>V2, the normal driving voltage Vdrv is higher than the pre-driving voltage Vpre, and a higher field strength is applied to an electron-emitting portion (to be referred to as an electron-emitting portion A) changed at the voltage Vpre upon application of the voltage Vdrv. However, the main electron-emitting source which determines the electron emission amount at this time shifts to another electron-emitting portion (to be referred to as an electron-emitting portion B), and contribution of the electron-emitting portion A to the entire emission current is small. Even in this relationship, pre-driving is effective. By applying the voltage Vpre in advance, great variation factors at the electron-emitting portion A can be reduced in advance to prevent destructive variations at the driving voltage Vdrv.

The above-described pre-driving method is also effective for electron-emitting devices such as MIM type electron-emitting devices, in addition to the FE type and surface-conduction type electron-emitting devices.

In manufacturing a multi electron source constituted by arranging many electron-emitting devices in a simple matrix, pre-driving processing is done prior to driving for all the devices constituting the multi electron source, thereby realizing a multi electron source having stable electron-emitting characteristics.

The definition of pre-driving and the calculation method of an effective driving time in a single device have been explained.

A pre-driving apparatus for the surface-conduction type electron-emitting device according to the first embodiment will be described with reference to FIG. 1.

In FIG. 1, reference numeral 101 denotes a surface-conduction type electron-emitting device substrate to be pre-driven. A plurality of surface-conduction type electron-emitting devices are arranged in a matrix on the substrate 101. The devices have already undergone forming processing and activation processing, and are undergoing stabilization processing in this embodiment. The substrate 101 is connected to an evacuation apparatus (not shown) and evacuated to about $1\times10^{-7}$ Pa or less. The substrate 101 is connected to an external electric circuit via row-direction wiring terminals Dx1 to Dxm and column-direction wiring terminals Dy1 to Dyn. Reference numeral 102 denotes a line selection circuit for selecting a line to be pre-driven. The line selection circuit 102 selects a row-direction wiring in accordance with an instruction from a timing generation circuit 105, and applies the voltage of a power source 104 to the selected row-direction wiring. Reference numeral 103 denotes a current monitoring circuit for monitoring a current flowing through the row upon applying the voltage to the selected row-direction wiring. The current monitoring circuit 103 is made up of detection resistances Rmon and measurement amplifiers for measuring a voltage generated across each resistance. Using these components, the current monitoring circuit 103 detects the pre-driving current I and outputs it as a pre-driving current value 109 to a control circuit 106. The resistance value of the detection resistance Rmon is set small enough to prevent influence on an application voltage to the surface-conduction type electron-emitting device by a voltage drop caused by flowing the pre-driving current I. The power source 104 generates a voltage to be applied to the row-direction wiring of the electron source in accordance with an instruction value from the control circuit 106.

Reference numeral 107 denotes a buffer amplifier circuit for driving the column-direction wiring terminals Dy1 to Dyn of the surface-conduction type electron-emitting device substrate 101 at a timing synchronized with a control clock signal Hscan from the timing generation circuit 105. An input value to the buffer amplifier, i.e., a voltage amplitude value for driving the terminals Dy1 to Dyn is determined by a voltage distribution generation circuit 108.

In the first embodiment, the progress of pre-driving is grasped by detecting a current amount flowing in pre-driving, i.e., (output data from the current monitoring circuit 103):(pre-driving current 109). The control circuit 106 starts pre-driving upon reception of a pre-driving start instruction, and sequentially corrects the distribution of voltages applied to devices in the column direction in accordance with changes in pre-driving current, as will be described in detail later. That is, the control circuit 106 estimates a device current flowing through each device using an output from the current monitoring circuit 103, and calculates from the estimated value a voltage distribution to be generated in the column direction of the device. A calculated voltage setting value 110 is transferred to the voltage distribution generation circuit 108, and applied to the column-direction electrode of the device via the buffer amplifier 107. This driving method corrects a voltage distribution generated on devices by the pre-driving current and row-direction wiring resistance, and applies a predetermined voltage to the two terminals of each of all the devices on a pre-driven line. Data of the voltage distribution generation circuit 108 is sequentially updated in accordance with changes in pre-driving current, thereby correcting the voltage distribution until the end of pre-driving of a designated line.

Figure 2:
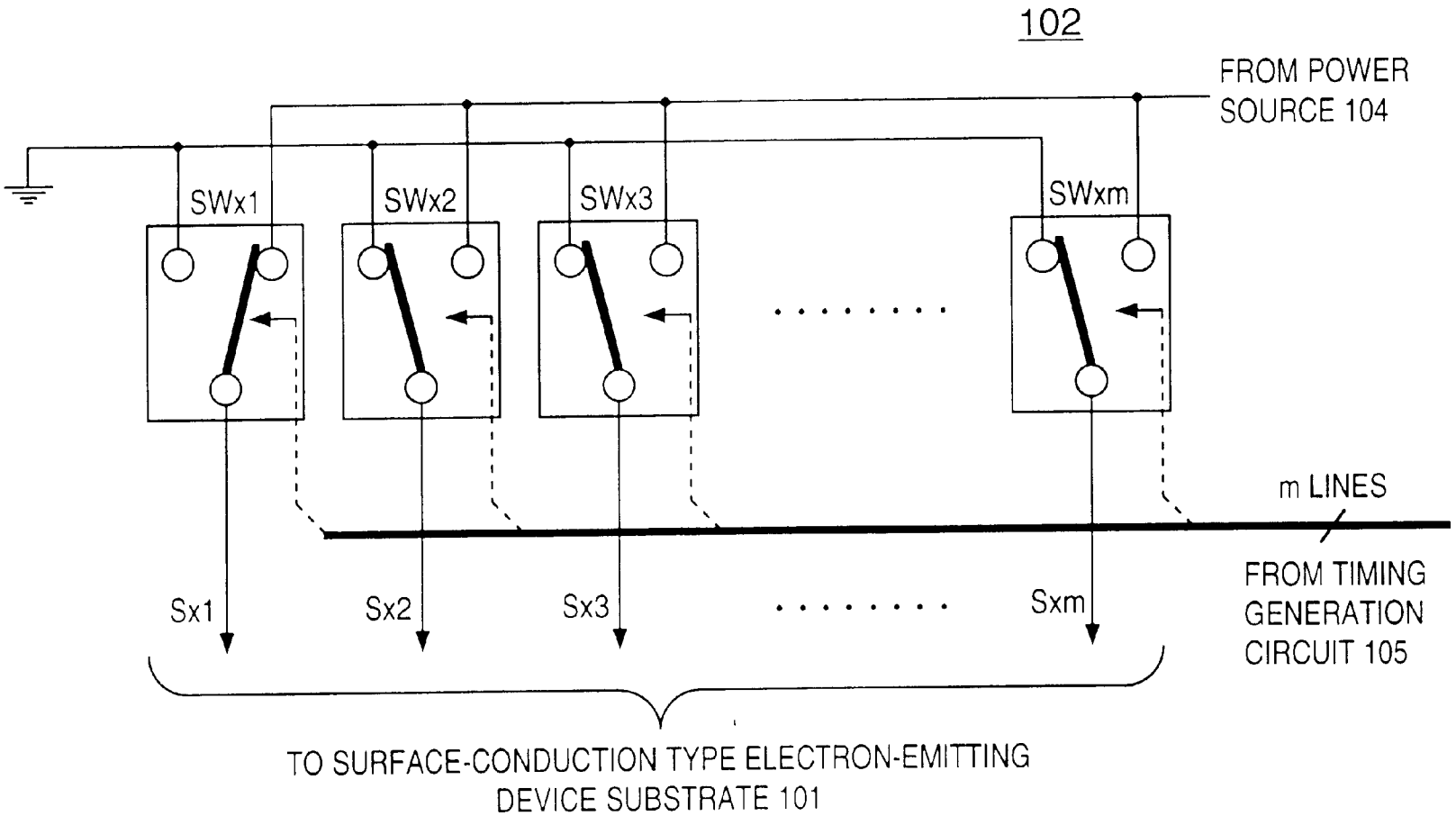
FIG. 2 is a circuit diagram showing the arrangement of a line selection circuit in FIG. 1.

The line selection circuit 102 will be described with reference to FIG. 2.

This circuit incorporates m number of switching elements (SWx1 to SWxm). Each switching element selects either one of the output voltage of the power source 104 and 0 V (ground level). The m number of switching elements are electrically connected to the terminals Dx1 to Dxm of the surface-conduction type electron-emitting device substrate 101. Each switching element operates based on a control signal Vscan output from the timing generation circuit 105. In practice, the switching elements can be easily constituted by a combination of switching elements such as FETs or relays. In FIG. 2, the first line (Sx1) is selected, the output voltage of the power source 104 is applied to only the row-direction wiring Dx1, and the remaining lines are grounded.

Figure 3:
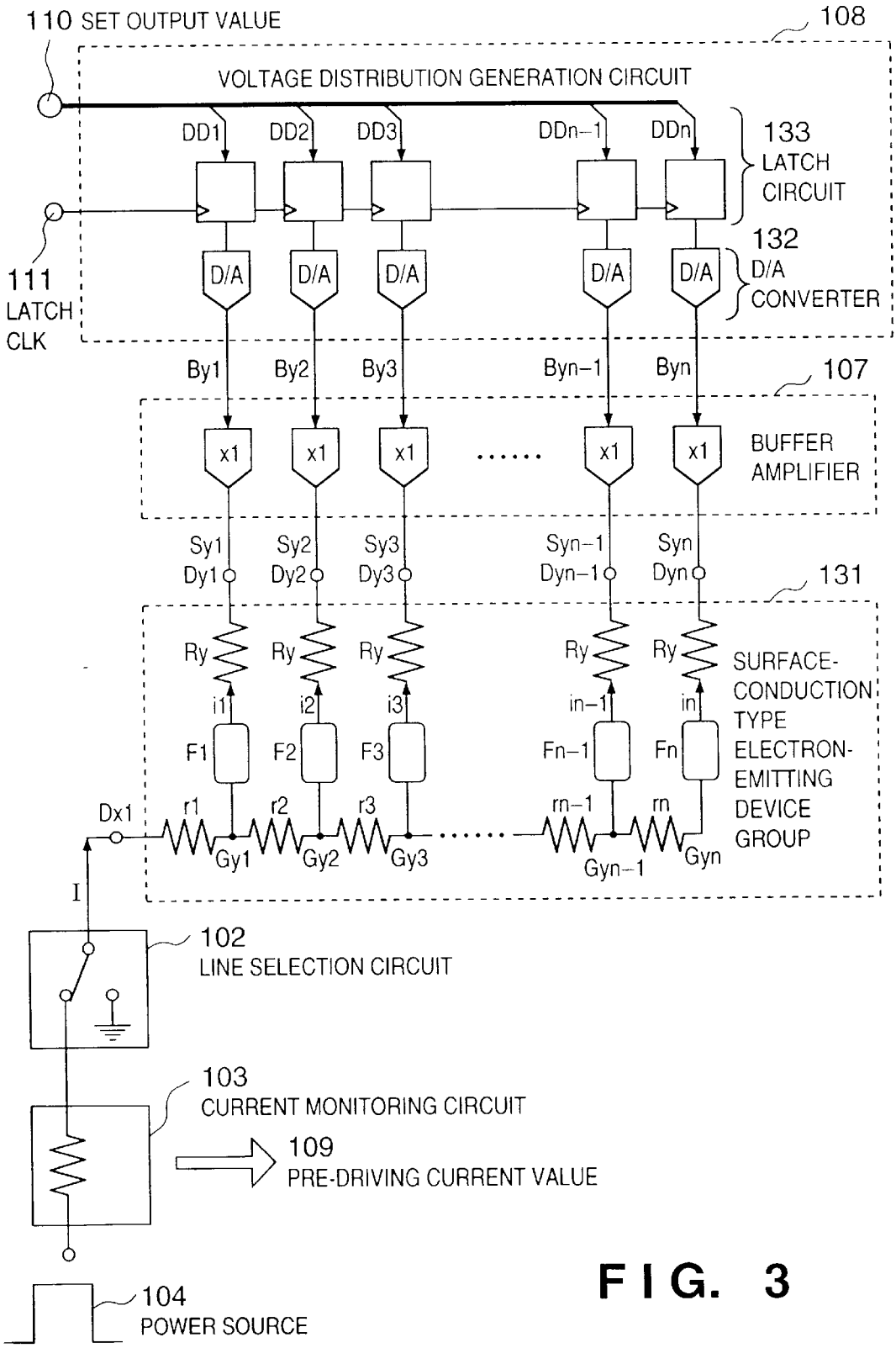
FIG. 3 is a circuit diagram showing the arrangement of a voltage distribution generation circuit in FIG. 1.

FIG. 3 shows a circuit diagram showing the arrangement of the voltage distribution generation circuit 108, and a block diagram for explaining pre-driving of a given line using the voltage distribution generation circuit 108.

The voltage distribution generation circuit 108 generates a compensation voltage amount to be applied in the column direction and outputs it to the buffer amplifier 107 in order to correct a voltage drop caused by a device current I flowing through each device and row-direction wiring resistances r1 to rn in pre-driving.

In the first embodiment, the terminals Dy1 to Dyn of the surface-conduction type electron-emitting device group 101 are driven by outputs (Sy1 to Syn) from the buffer amplifier 107 so as to cancel a voltage distribution generated upon pre-driving.

The voltage distribution generation circuit 108 is made up of n number of D/A converters 132 and n number of latch circuits 133. Digital set output values 110 corresponding to the n D/A converters are externally independently set. More specifically, the control circuit 106 in FIG. 1 calculates a voltage drop distribution amount, and sets it as the digital set output values 110. Independent voltage amounts are set in the respective D/A converters 132, and all the outputs are synchronously updated by a latch clock 111.

The procedures of pre-driving the surface-conduction type electron-emitting device substrate 101 using the apparatus of the first embodiment will be explained with reference to FIGS. 1, 3, and 4. Pre-driving is performed such that the set pre-driving voltage Vpre is applied to all the devices for a predetermined time. A target current value at this time is calculated in advance from a necessary electron emission amount and the like. In the first embodiment, the voltage Vpre having a pulse width of 1 msec and a pulse height of 16 V is applied every minute.

A pre-driving flow will be explained.

In FIG. 1, If the control circuit 106 receives a pre-driving start instruction, it controls the timing generation circuit 105 and power source 104 in order to perform electrification processing in units of rows.

The control circuit 106 sets the set current value 110 so as to set the column-direction wiring terminals Dy1 to Dyn to the ground potential, and sequentially applies pulses (pulse width of 1 msec and pulse height of 16 V) of the pre-driving voltage Vpre: to the row-direction wiring terminals Dx1 to Dxm. Then, the pulse voltage is sequentially applied to the surface-conduction type electron-emitting device substrate 101 in units of rows to start pre-driving in units of lines.

The first embodiment will exemplify pre-driving when n number of devices on the line of the row-direction wiring terminal Dx1 are to be pre-driven.

Attention is paid to a surface-conduction type device group on the first row to which a pre-driving voltage is applied. A model including the wiring resistance represents a surface-conduction type electron-emitting device group 131, and pre-driving of this device group will be explained with reference to FIG. 3. In FIG. 3, reference symbols F1 to Fn denote surface-conduction type electron-emitting devices on the line of the row-direction wiring terminal Dx1; r1 to rn, wring resistances at respective portions on a row wiring Ex1; and Ry, a wiring resistance extending from the feeding terminal of each of the wirings Dy1 to Dyn to a corresponding surface-conduction type electron-emitting device. Since the row wiring is designed to be formed from a material with a constant line width and thickness, r1 to rn can be considered to be equal except for variations in the manufacture. Since the wirings are generally designed to be uniform, the resistances Ry of the respective wirings can be considered to be equal. Although the equivalent resistance value of the surface-conduction type electron-emitting device changes (decreases) before and after pre-driving, the equivalent resistance of each device is much higher than the value Ry, and Ry is substantially negligible. The equivalent resistance value of the surface-conduction type electron-emitting device is designed higher than r1 to rn.

To pre-drive the surface-conduction type electron-emitting device group 131, the control circuit 106 controls the line selection circuit 102 via the timing generation circuit 105, and applies the pre-driving voltage Vpre to the row-direction wiring terminal Dx1 via the power source 104 and current monitoring circuit 103. Thus, the terminal Dx1 is driven by the pre-driving voltage Vpre.

The terminals Dy1 to Dyn as other electrode terminals of devices on the Dx1 line are driven by the buffer amplifier 107. The buffer amplifier 107 operates to sink or raise pre-driving currents i1 to in from the devices F1 to Fn. The output voltage amplitude of the buffer amplifier 107 is determined by the voltage distribution generation circuit 108.

In pre-driving, the terminal voltages of devices on the row wiring Dx1 are monitored to find that the voltages Gy1 to Gyn change owing to the wiring resistances r1 to rn. This voltage change increases with the progress of pre-driving and maximizes at the end of pre-driving. For example, for a pre-driving current of 2 mA/device, r1 to rn=3 mΩ, and n=1000, a voltage difference:

$$\Delta V = \tfrac{1}{2} \times 1000 \times 1001 \times 2\ \text{mA} \times 3\ \text{m}\Omega \approx 3\ V$$

occurs at the terminal Gyn of the device Fn farthest from the feeding terminal.

To prevent this, a voltage distribution identical to this voltage difference distribution is generated by the voltage distribution generation circuit 108, and the terminals Dy1 to Dyn are driven by the outputs Sy1 to Syn from the buffer amplifier 107 so as to cancel the voltage distribution generated on respective devices.

More specifically, the voltage drop distribution at the terminals Gy1 to Gyn generated by currents flowing through the devices F1 to Fn in pre-driving is reproduced by outputs By1 to Byn from the voltage distribution generation circuit 108. Assume that pre-driving of the devices F1 to Fn substantially uniformly progresses, and the device currents i1 to in flowing through the respective devices are almost equal. The current value is given using a pre-driving current amount I (109) detected by the current monitoring circuit 103:

$$iave=i1=i2=\ldots=in=I/n$$

(n is the number of column-direction devices)

The control circuit 106 calculates voltage drop amounts at respective device terminals using the value iave as a current value flowing through each device, and sets the calculated amounts in the voltage distribution generation circuit 108. Accordingly, a voltage drop distribution identical to that at the device terminals Gy1 to Gyn of the devices F1 to Fn is realized at the outputs By1 to Byn of the voltage distribution generation circuit 108. By applying the voltage amounts to the terminals Dy1 to Dyn via the outputs Sy1 to Syn of the buffer amplifier 107, voltages applied between the terminals of the devices F1 to Fn can be made uniform regardless of the device number.

In the first embodiment, the device voltage distribution generated along with the progress of pre-driving is calculated as follows.

Assuming that pre-driving substantially simultaneously progresses for respective devices, the device currents i1 to in flowing through the devices F1 to Fn are estimated from the pre-driving current I (109) detected by the current monitoring circuit 103:

$$iave=i1=i2=\ldots=in=I/n$$

At this time, the voltages By1 to Byn to be output to the output terminals of the voltage distribution generation circuit 108 are calculated using the wiring resistance values r1 to rn≈r:

$$\begin{aligned}
By1 &= -r1\times\sum\{k=1 \text{ to } n\}ik \\
&\approx -r\times n\times iave \\
&\approx -r\times I \\
By2 &= -r2\times\sum\{k=2 \text{ to } n\}ik + By1 \\
&\approx -r\times(n-1)/n\times I+(-r\times I) \\
&\vdots \\
Byn &= -rn\times in + Byn-1 + Byn-2+\ldots+By1 \\
&\approx -r\times 1/n\times I+\ldots-r\times(n-1)/n\times I+(-r\times I) \\
&\approx -1/2\times r\times(n+1)\times I
\end{aligned}$$

In pre-driving, the control circuit 106 sequentially measures the pre-driving current, and sequentially calculates the output voltages By1 to Byn from the above equation. The control circuit 106 transfers digital output data corresponding to the output voltages By1 to Byn to the latch circuits 133 of the voltage distribution circuit 108. Upon completion of a series of operations (measurement of the device current→calculation of output data→transfer of data to the latch circuit), the control circuit 106 applies the latch clock 110 to all the latch circuits 133 in order to update D/A data, and updates the data in synchronism with the application. The voltage distribution generation circuit 108 generates a voltage distribution corresponding to a voltage distribution amount generated at the terminals Gy1 to Gyn of the devices F1 to Fn.

Figure 4:
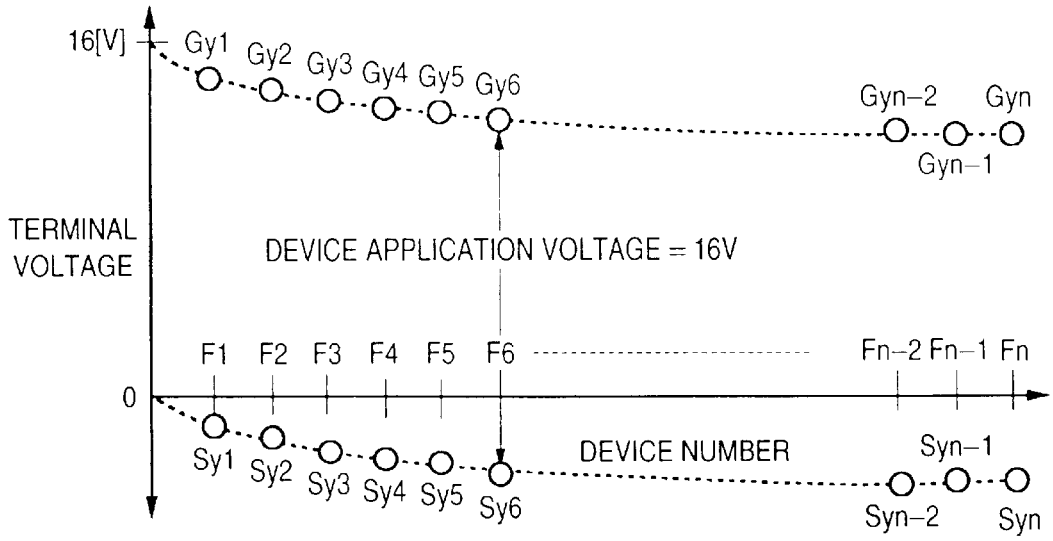
FIG. 4 is a graph showing the driving voltage distribution of devices when devices on a given line are pre-driven in the apparatus of FIG. 1.

FIG. 4 shows voltage distributions applied to the two terminals of each of the devices F1 to Fn in pre-driving. The abscissa represents device numbers F1 to Fn, which indicate device positions. The ordinate represents the terminal voltage at the two terminals of each device. The pre-driving voltage Vpre=16 V applied from the power source 104 decreases owing to a voltage drop by the wiring resistance, while the voltage Vpre is applied to the terminals Gy1 to Gyn of the respective devices. At this time, the outputs By1 to Byn of the voltage distribution generation circuit 108 and the outputs Sy1 to Syn of the buffer 107 have the same distribution as that at the terminals Gy1 to Gyn. A predetermined application voltage (almost 16 V) is applied to the respective devices to pre-drive them.

More specifically, changes in device current in pre-driving always change the voltage distribution generated at the device terminal owing to the wiring resistance. At this time, a current value corresponding to the device current is sequentially detected to sequentially update the outputs By1 to Byn of the voltage distribution generation circuit 108, thereby pre-driving all the devices at a predetermined voltage Vpre.

Devices on the row wiring Dx1 are pre-driven in the above description, and devices on another line can also be similarly pre-driven. In this way, pre-driving of the entire surface-conduction type electron-emitting device substrate 101 is completed.

A proper device was selected from the surface-conduction type electron-emitting device substrate 101 to which Vpre=16 V was applied, and equations (3) and (6) were calculated using the field strength of the device to estimate $\beta=4.5\times10^6$ (1/cm). The field strength $F=\beta\times Vpre$ upon application of 16 V was $7.2\times10^7$ (V/cm).

The device was driven at the voltage Vdrv of 14.5 V. β at 14.5 V was measured to estimate $\beta=4.5\times10^6$ (1/cm) and $F=6.5\times10^7$ (V/cm).

Another surface-conduction type electron-emitting device substrate was prepared, and driven at a driving voltage set to 14.5 V without performing pre-driving. This substrate was compared with the pre-driven substrate to find that the pre-driven surface-conduction type electron-emitting device substrate hardly decreased and varied the device current and emission current during driving, and obtained stable electron-emitting characteristics, compared to the non-pre-driven surface-conduction type electron-emitting device substrate.

If the row-direction wiring resistances r1 to rn slightly change between lines, these values may also be stored in a memory or the like. In updating the voltage distribution, the stored values are properly read out and used for calculation together with the average device current values of respective lines.

If the number n of devices increases, a series of operations (measurement of the current→calculation of output data→data transfer) may take a long time. This time can be shortened by parallel-processing respective devices. In the first embodiment, the voltage distribution generation circuit 108 is constituted by the same number of D/A converters as the number n of column-direction wirings of the surface-conduction type electron-emitting device substrate 101. However, since the compensation voltage distribution profile changes gradually, as shown in FIG. 4, the number of D/A converters may be decreased, and voltage values to be applied to the decreased number of column-direction wiring terminals may be defined by resistance division. This can realize a short calculation time and low cost.

In the first embodiment, the power source 104 applies a positive output, and the current is supplied from the terminal Dx1 to the terminals Dy1 to Dyn, thereby pre-driving devices. Alternatively, the power source 104 may apply a negative output, and the current may be supplied from the terminals Dy1 to Dyn to the terminal Dx1, thereby pre-driving devices. In this case, the voltage distribution is also inverted, and the buffer amplifier 107 is constituted as a (−1)-time inverting buffer amplifier to source the current, thereby obtaining the same effects.

In the first embodiment, the influence of the column-direction wiring resistance Ry in FIG. 3 is ignored on the assumption that the resistance of the column-direction wiring is much lower than the equivalent resistance of the surface-conduction type electron-emitting device. When, however, the resistance of the extraction wiring or the like increases to a non-negligible degree, a voltage drop caused by the column-direction wiring resistance may be compensated. More specifically, assume that as the selection line number selected by the line selection circuit 102 increases in FIG. 1, Ry increases in proportion to the line number. Ry is estimated in correspondence with a line number subjected to pre-driving, and a voltage drop on this line can also be compensated by the voltage distribution generation circuit 108.

If the row-direction wiring resistances r1 to rn slightly change between lines, these values may also be stored in a memory or the like. In updating the voltage distribution, the stored values are properly read out and used for calculation together with the average device current values of respective lines.

In pre-driving, after pre-driving of devices on a given line is completed, the line selection circuit 102 is switched to pre-drive another line. Alternatively, a plurality of pre-driving lines may be simultaneously pre-driven while pre-driving lines are sequentially switched. For example, the first embodiment executes processing at a pulse width of 1 msec and a pulse period of 10 msec, and thus enables pre-driving processing while switching 10 pre-driving lines at maximum. In this case, since the progress of pre-driving may vary between lines, the average device currents of respective lines are sequentially stored in a memory or the like, and pre-driving is done while the output of the voltage distribution generation circuit 108 is updated at a high speed using the average device currents stored in the memory in switching lines. This realizes uniform pre-driving processing at a high speed.

Figure 5:
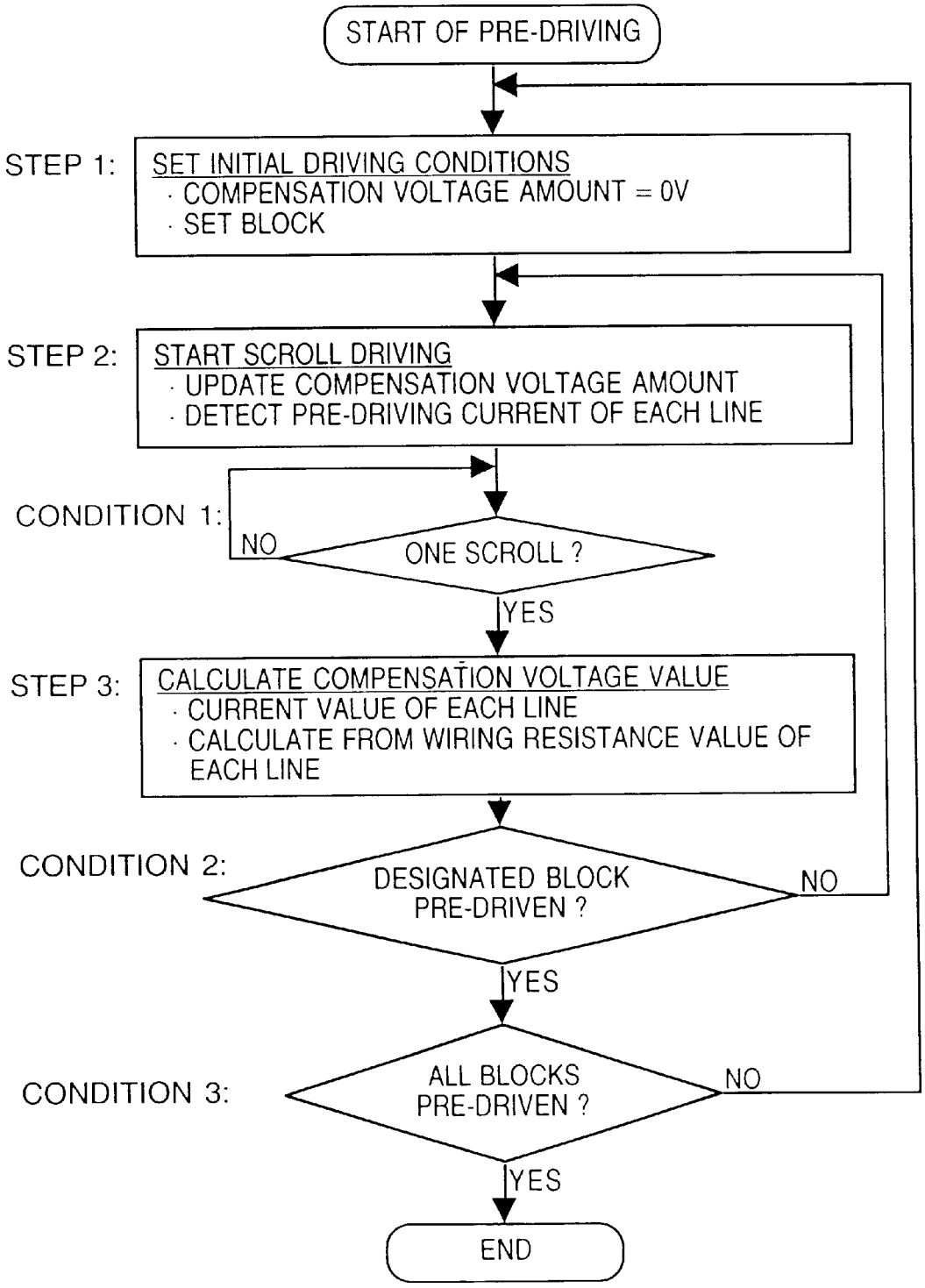
FIG. 5 is a flow chart showing an operation when a plurality of lines are selected and pre-driven in the apparatus of FIG. 1.

FIG. 5 is a flow chart for explaining this.

For descriptive convenience, the number n of row-direction wirings in the surface-conduction type electron-emitting device substrate 101 is 480.

(Step 1): Setting of Initial Driving Conditions

The control circuit 106 starts pre-driving upon reception of a pre-driving start instruction. The control circuit 106 sets initial driving conditions at the start of pre-driving. Items set as initial driving conditions are settings of blocks to be simultaneously pre-driven while being switched, and initialization (0V) of the distribution voltage.

Electrification is done for 10 lines as one block at a pulse width of 1 msec and a pulse period of 10 msec. In electrification processing, the 480 row-direction wirings are grouped into 48 blocks as electrification units. Assignment of the 48 blocks is done by "setting of blocks". In this case, blocks are combined as follows so as to uniformly apply power to the surface-conduction type electron-emitting device substrate 101 upon application of the pre-driving voltage.

TABLE 1

| BLOCK No. | |
|---|---|
| Block 1 | 10 row-direction wirings ch1, ch49, ch97, . . . , ch433 |
| Block 2 | 10 row-direction wirings ch2, ch50, ch98, . . . , ch434 |
| . | |
| . | |
| . | |
| Block 48 | 10 row-direction wirings ch48, ch96, ch144, . . . , ch480 |

(Step 2): Start of Scroll Driving

After driving conditions are set based on the settings in step 1, pre-driving starts. Driving lines are selected based on the block setting value, and a line number determined by the block setting value is transferred as a driving line setting signal to the timing generation circuit 105. The timing generation circuit 105 outputs a line select signal, and a line is driven by the line power source 104 designated by the line selection circuit 102. At this time, the progress of pre-driving is monitored to calculate a compensation amount for a voltage drop caused by the pre-driving current and wiring resistance. For this purpose, a current value flowing through each row-direction wiring is detected by the current detection circuit 103 and stored in the memory (not shown) of the control circuit 106.

(Condition 1): Detection of Completion of One Scroll

The flow waits for completion of pre-driving processing for 10 lines of one block.

(Step 3): Calculation of Compensation Voltage Value

A compensation voltage for a voltage drop caused by the pre-driving current and wiring resistance along with the progress of pre-driving is calculated. The compensation voltage value can be calculated by the above equations from the pre-driving current and wiring resistance of each line. The compensation voltage value is calculated for each line using the pre-driving current value of each line stored in the memory and the wiring resistance value also stored in the memory.

(Condition 2): Detection of Completion of Pre-Driving for Designated Block

Pre-driving is completed within 30 sec for one block. If pre-driving is not completed yet, the flow returns to (step 2) to start scroll driving again. The compensation voltage value from the voltage distribution circuit 108 uses a value calculated in (step 3).

(Condition 3): Detection of Completion of Pre-Driving for All Blocks

After pre-driving of one block is completed, the flow shifts to step 1 in order to pre-drive the next block. If pre-driving of all the blocks is completed, pre-driving of all the devices of the substrate is completed.

[Second Embodiment]

A pre-driving apparatus for the surface-conduction type electron-emitting device according to the second embodiment of the present invention will be described with reference to FIG. 6.

Figure 6:
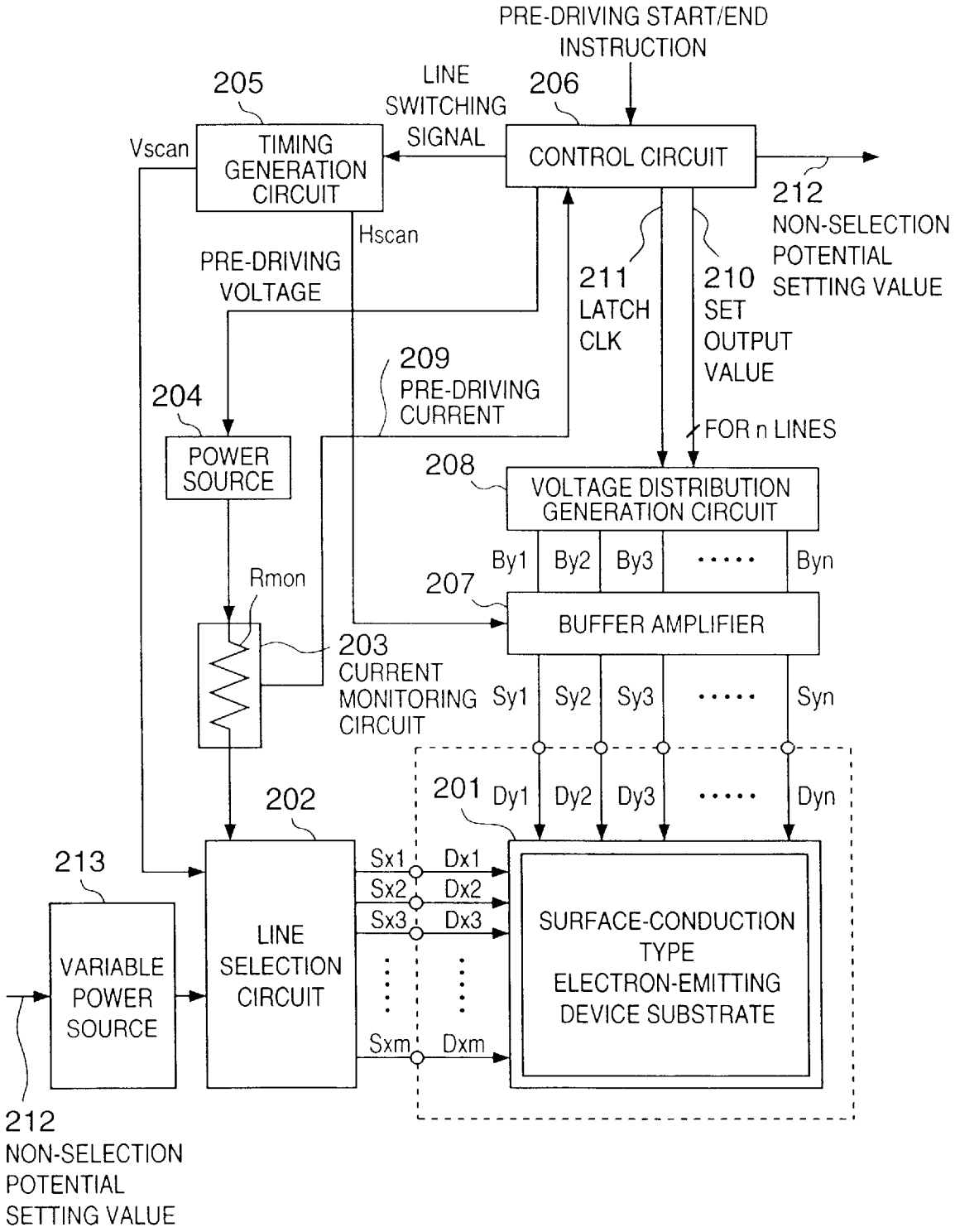
FIG. 6 is a block diagram showing the schematic arrangement of a pre-driving apparatus according to the second embodiment of the present invention.

Also in FIG. 6, a surface-conduction type electron-emitting device substrate 201 is identical to the substrate 101 in FIG. 1. The operation of the whole apparatus, pre-driving procedures, and the like are the same as in the first embodiment, and a description thereof will be omitted.

The second embodiment takes a different method of driving a line selection circuit 202 of the surface-conduction type electron-emitting device substrate 201. This method will be described.

Figure 7:
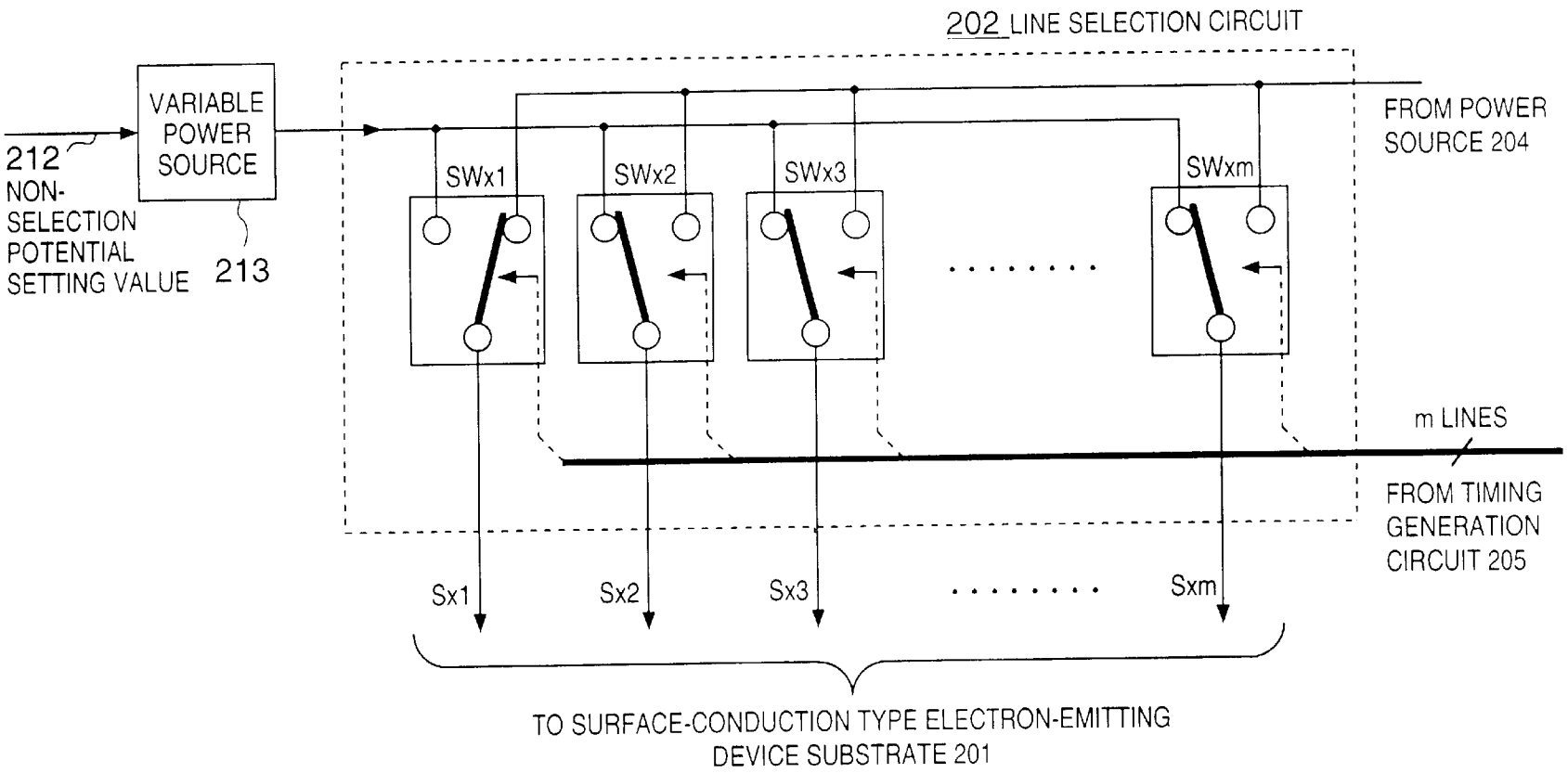
FIG. 7 is a circuit diagram showing the arrangement of a line selection circuit in FIG. 6.

The method of driving the line selection circuit 202 will be explained with reference to FIG. 7.

This circuit incorporates m number of switching elements (SWx1 to SWxm). Each switching element selects either one of the output voltage of a power source 204 and the output voltage of a variable power source 213. The m number of switching elements are electrically connected to terminals Dx1 to Dxm of the surface-conduction type electron-emitting device substrate 201.

Each switching element operates based on a control signal Vscan output from a timing generation circuit 205. In practice, the switching elements can be easily constituted by a combination of switching elements such as FETs or relays. In FIG. 7, the first line (Sx1) is selected, the output voltage of the power source 204 is applied to only the row-direction wiring Dx1, and the remaining lines (Sx2 to Sxm) are connected to the output voltage of the variable power source 213. The output voltage of the variable power source 213 is set by a non-selection potential setting value 212 output from a control circuit 206.

In the second embodiment, the voltages of unselected lines (Sx2 to Sxm) to which no pre-driving voltage is applied are set to not the ground level but a non-selection potential because of the following reason. According to the gist of the present invention, a voltage drop distribution generated in the column direction on a single row upon performing pre-driving in units of rows is compensated by applying voltages from column-direction wiring terminals Dy1 to Dyn. Since the surface-conduction type electron-emitting device substrate has a simple matrix arrangement, voltages applied from the column-direction wiring terminals Dy1 to Dyn are applied to not only devices on a pre-driven line but also devices on a line not pre-driven. The voltages from the column-direction wiring terminals Dy1 to Dyn are as low as several V at maximum. However, if a line not pre-driven is set to the GND level (0 V), voltages from the column-direction wiring terminals Dy1 to Dyn are applied to {(m−1)×n} devices connected to the line. This voltage application flows a small current through each device. In some cases, the current may flow to a noticeable degree on the whole substrate. This current is a reactive current that does not contribute to original pre-driving process evaluation. The reactive current only wastefully increases power consumed by the substrate during the process, and is desirably reduced. For this purpose, lines not pre-driven (non-pre-driven lines) are grouped, and the non-selection potential setting value 212 is applied to the grouped lines so as to minimize the absolute values of voltages applied across devices connected to these lines.

In general, the non-selection potential setting value is desirably set between the minimum and maximum values of compensation voltages from the column-direction wiring terminals Dy1 to Dyn.

In the second embodiment, the non-selection potential setting value 212 is determined by the control circuit 206 as follows.

The difference between maximum and minimum voltages generated at each terminal by the output of a voltage distribution circuit 208 is calculated as a voltage drop amount. More specifically, in FIG. 6, the maximum voltage distribution amount at outputs By1 to Byn of the voltage distribution circuit 208 is calculated by Maximum Voltage distribution Amount=Voltage *By*1−Voltage *Byn*

The non-selection potential setting value 212 is determined by

Non-Selection Potential Setting Value 212: *Voff*=½×Maximum Voltage distribution Amount In the second embodiment as well as the first embodiment, the output of the voltage distribution circuit 208 can be calculated using a pre-driving current value 209 (I) of the current monitoring circuit 203 and wiring resistance values r1 to rn≈r:

$$
\begin{aligned}
By1 &= -r1 \times \sum \{k = 1 \text{ to } n\} ik \\
&\approx -r \times n \times iave \\
&\approx -r \times I \\
&\vdots \\
Byn &= -rn \times in + Byn-1 + Byn-2 + \ldots + By1 \\
&\approx -r \times 1/n \times I + \ldots - r \times (n-1)/n \times I + \\
&\quad (-r \times \mathrm{I}) \\
&\approx -1/2 \times r \times (n+1) \times I
\end{aligned}
$$

Hence, the non-selection potential setting value 212 is calculated by $$
\begin{aligned}
Voff &= -1/2 \times \text{Maximum Voltage Distribution Amount} \\
&= -1/2\ (\text{Voltage } By1 - \text{Voltage } Byn) \\
&= -1/4 \times r \times (n-1) \times I
\end{aligned}
$$

When a line is driven at the voltage of an unselected line set in this manner, a voltage:

(*Voff*−*By*1) through (*Voff*−*Byn*)

that is, $$-\tfrac{1}{4} r \times (n-5) \times I \sim \tfrac{1}{4} r \times (n+3) \times I$$

is applied across the device on the unselected line.

If the non-selection potential setting value 212 is the ground level, a voltage: (Voff−By1)~(Voff−Byn), i.e., r×I~½×r×(n+1)×I, is applied across the device on the unselected line. By applying the non-selection potential setting value 212 to the unselected line, the absolute value of the voltage applied across the device connected to the unselected line can be almost halved. In general, n is as large as 1,000 or more, and can be regarded from the above equation to be (n−5)≈(n+3)≈(n+1)≈n.

FIGS. 8A to 8D show driving voltage waveforms applied to each terminal of the surface-conduction type electron-emitting device substrate 201 in pre-driving devices on the Dx1 line.

Figure 8:
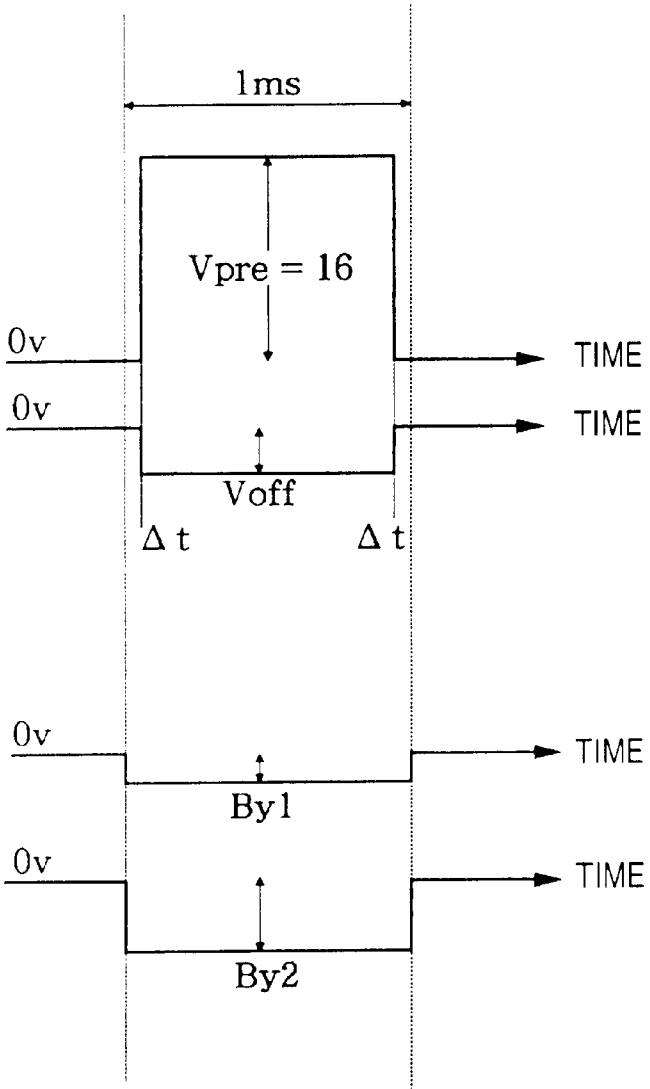
FIGS. 8A to 8D are waveform charts each showing a driving voltage waveform applied to each terminal of a surface-conduction type electron-emitting device substrate according to the second embodiment.

As described above, each device is driven by a pulse having a driving voltage Vpre=16 V and a pulse width of 1 msec. FIG. 8A shows a driving waveform to the pre-driven terminal Dx1. This terminal is driven by the power source 204 (driving voltage of 16 V and pulse width of 1 msec). FIG. 8B shows a driving waveform to the unselected line terminals Dx2 to Dxm not pre-driven. These terminals are driven by the variable power source 213 set by the non-selection potential setting value 212. The non-selection potential setting value 212 is represented by Voff. FIGS. 8C and 8D show driving waveforms to the column-direction terminals of the surface-conduction type electron-emitting device substrate 201. These terminals are driven by a buffer amplifier 207. FIG. 8C shows a driving waveform to the terminal Dy1 exhibiting the minimum voltage drop, and FIG. 8D shows a driving waveform to the terminal Dyn exhibiting the maximum voltage drop.

Even if the detection current changes during pre-driving, the compensation voltage distribution changes to always apply the set voltage Vpre=16 V to each device.

Each device is driven by pulses. The line selection circuit 202 starts outputting the pulse voltage Δt (Δt is several μsec) after a change in pulse output from the buffer amplifier 207 for generating a voltage distribution. In stopping outputting pulses, the line selection circuit 202 stops outputting them Δt before a change in pulse output from the buffer amplifier 207. This will be explained.

Δt is set to cope with an output timing delay between channels owing to variations in buffer amplifier output between amplifiers. If the line selection circuit 202 starts outputting the pulse voltage before a change in pulse output from the buffer amplifier 207 for generating a voltage distribution, the output timing may delay between channels. This delay instantaneously generates a time during which a satisfactory driving voltage is applied to only some of devices on a selected line. During this instance, all the devices on the selected line are not driven, and the flowing pre-driving current decreases. However, the buffer amplifier applies a calculated voltage on the assumption that all the devices on the selected line are satisfactorily driven. In this case, a driving voltage higher than the set voltage is applied to the devices to make their characteristics nonuniform.

To prevent this, the line selection circuit 202 starts outputting the pulse voltage Δt after a change in pulse output from the buffer amplifier 207 for generating a voltage distribution. In stopping outputting pulses, the line selection circuit 202 stops outputting them Δt before a change in pulse output from the buffer amplifier 207. Accordingly, the influence of variations in output timing of the buffer amplifier can be avoided.

Voltage application to an unselected line according to the second embodiment can reduce power applied to the surface-conduction type electron-emitting device substrate in pre-driving. Note that the offset voltage determination method is not limited to the above one. The offset voltage may be determined to minimize the power value applied to the entire surface-conduction type electron-emitting device substrate.

For example, devices may be driven by adding the offset voltage so as to minimize the absolute values of voltages applied from the column-direction wiring terminals Dy1 to Dyn without applying any voltage to an unselected line.

The applied offset voltage value can be determined as follows. The difference between the maximum and minimum voltages generated at each terminal by the output of the voltage distribution circuit 208 is calculated as a voltage drop amount 210. For example, in FIG. 6, voltage drop amounts at the outputs By1 to Byn of the voltage distribution circuit 208 are calculated by $$\text{Voltage Drop Amount } \mathbf{210} = \text{Voltage } By\mathbf{1} - \text{Voltage } Byn$$

That is,

Offset Voltage 212: $Voff = \frac{1}{2} \times$ Voltage Drop Amount 210

This offset voltage is added to distribution voltages applied to Dy1 to Dyn and the set value of the power source 213. As a result, the absolute values of voltages applied from the column-direction wiring terminals Dy1 to Dyn can be halved in comparison with the first embodiment.

[Third Embodiment]

A pre-driving apparatus for the surface-conduction type electron-emitting device according to the third embodiment of the present invention will be described with reference to FIG. 9.

Figure 9:
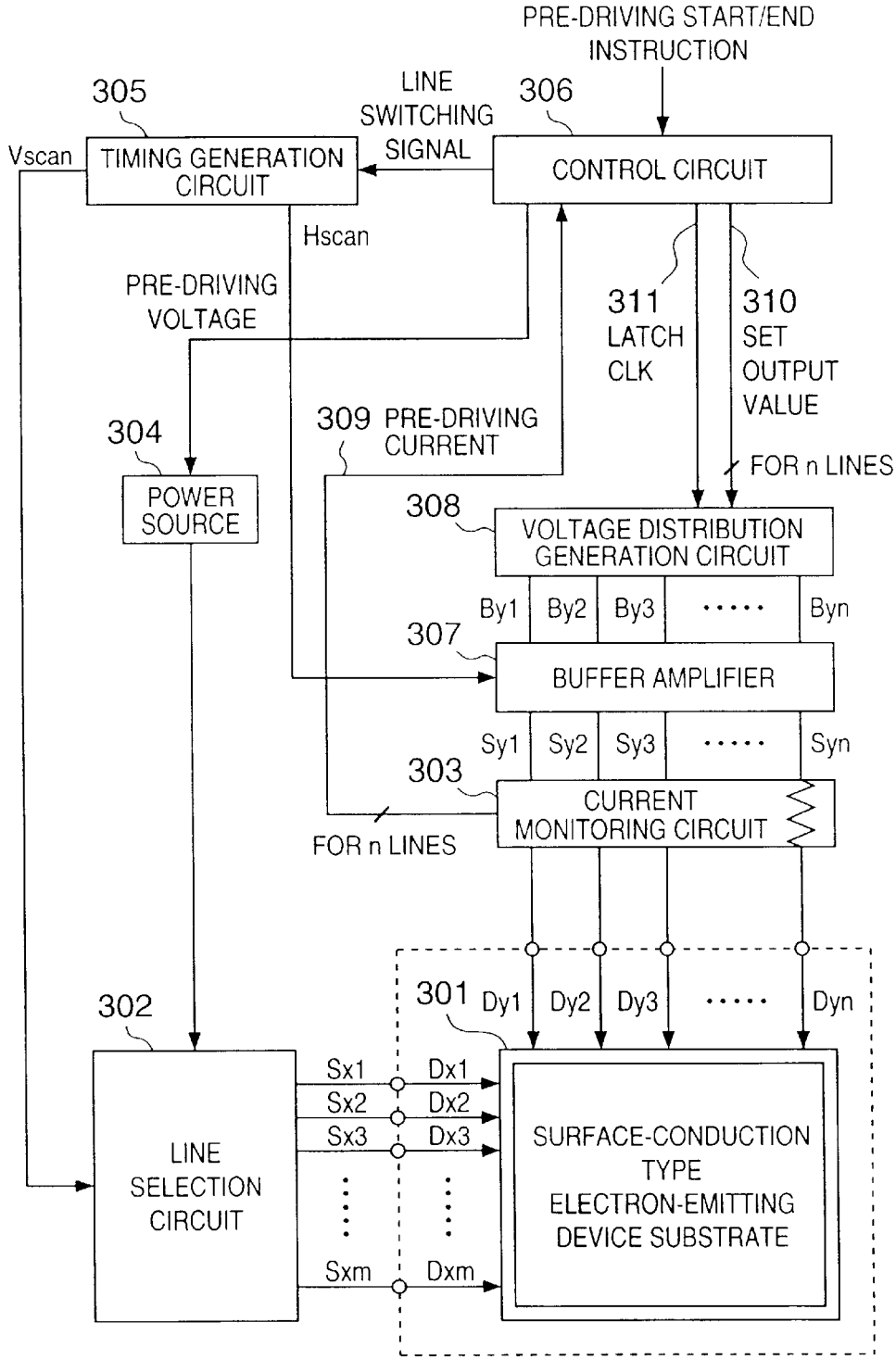
FIG. 9 is a block diagram showing the schematic arrangement of a pre-driving apparatus according to the third embodiment of the present invention.

Also in FIG. 9, a surface-conduction type electron-emitting device substrate 301 is identical to the substrate 101 in FIG. 1. The operation of the whole apparatus, pre-driving procedures, and the like are the same as in the first embodiment, and a description thereof will be omitted. The third embodiment is slightly different from the first and second embodiments in the arrangement of a current monitoring circuit 303. The current monitoring circuit 303 is interposed between column-direction wiring terminals Dy1 to Dyn and a buffer amplifier 307 to individually monitor device currents flowing through respective devices upon pre-driving. A voltage distribution circuit 308 is designed similarly to the first and second embodiments such that a control circuit 306 calculates a voltage distribution amount from pre-driving current values flowing through respective devices, and transfers the output result as an output value corresponding to the voltage distribution amount of the voltage distribution generation circuit.

Figure 10:
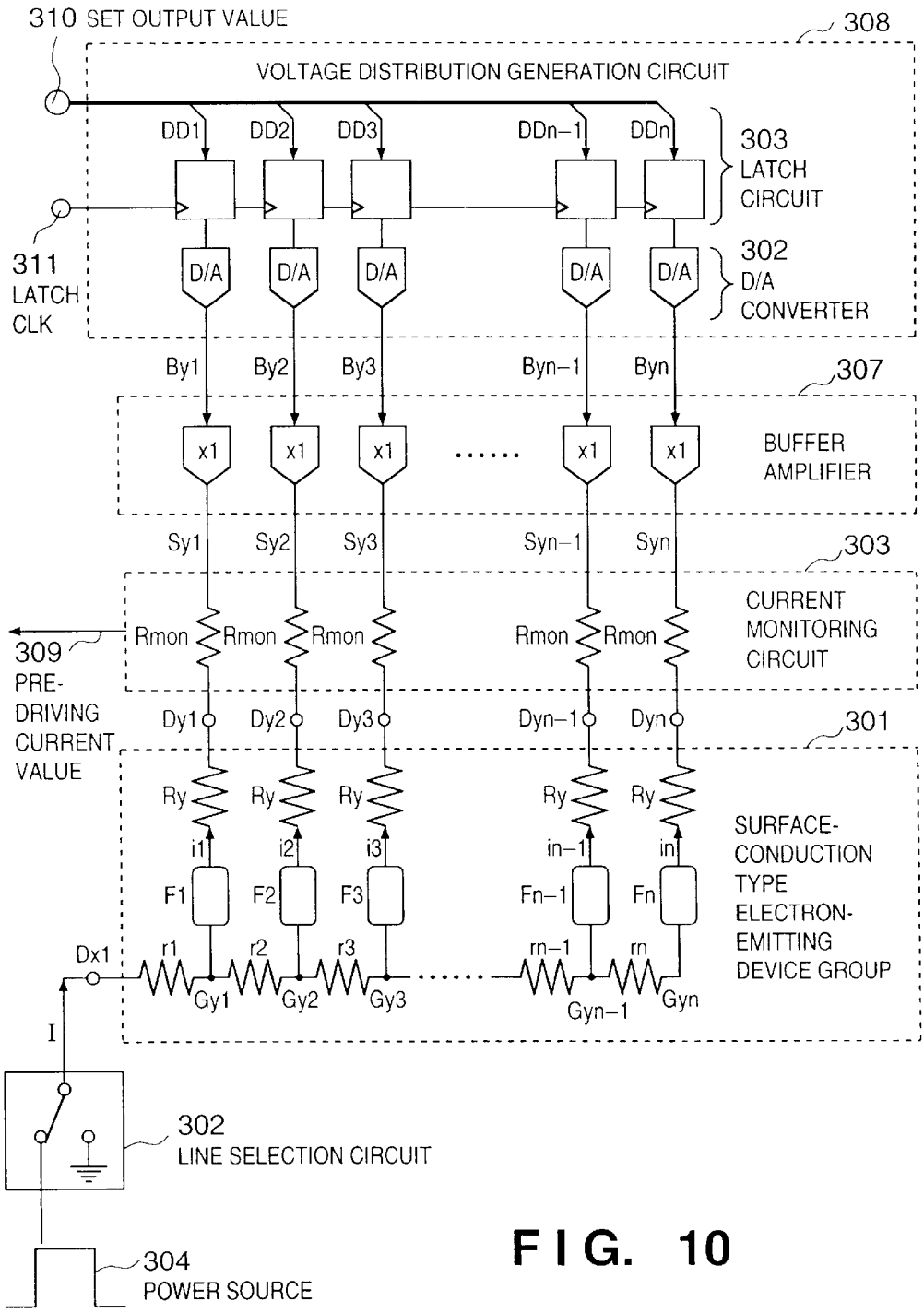
FIG. 10 is a circuit diagram showing the arrangement of a voltage distribution generation circuit in FIG. 9.

Similar to the first and second embodiments, attention is paid to a surface-conduction type device group on the first row to which the pre-driving voltage is applied. A model including the wiring resistance represents a surface-conduction type electron-emitting device group 331, and the state in which this device group is pre-driven will be explained with reference to FIG. 10.

Also in the third embodiment, the terminals Dy1 to Dyn are driven by outputs Sy1 to Syn from the buffer amplifier 307 so as to cancel a voltage distribution generated on a line in pre-driving. The voltage distribution circuit 308 is made up of n D/A converters 332 and n latch circuits 333 so as to externally apply digital set output values 310 corresponding to the n D/A converters and independently drive devices. The digital set output value 310 is set as a voltage drop distribution amount calculated by the control circuit 306. Independent voltage amounts are set in the respective D/A converters, and all the outputs are synchronously updated by a latch clock 311.

The current monitoring circuit 303 can individually monitor device currents flowing through respective devices. The current monitoring circuit 303 is made up of detection resistances Rmon and measurement amplifiers for measuring a voltage generated across each detection resistance Rmon. Using these components, the current monitoring circuit 103 detects the currents If and outputs n detected pre-driving current values 309. In the third embodiment, the pre-driving currents of respective devices can be individually monitored to reproduce a more accurate voltage distribution than in the first and second embodiments. Voltage amounts are applied from the outputs Sy1 to Syn of the buffer amplifier 307 to the terminals Dy1 to Dyn.

When the output of the buffer amplifier 307 is not 0 V, a current value detected by the current monitoring circuit 303 does not always coincide with a device current flowing through each device. This will be explained. Although not shown in FIG. 10, application voltages from the column-direction wiring terminals Dy1 to Dyn are applied to not only devices on a pre-driven line but also devices on a line not pre-driven because surface-conduction type electron-emitting devices are arranged in a simple matrix. A current I (Rmon number x) detected by the current monitoring circuit 303 is the sum of (a device current flowing through a device Fx upon application of 16 V) and (a current flowing through (m−1) devices not pre-driven that are connected to Dyx upon application of a voltage Syx). The first term is a true device current, and the current amount of the second term is an error. In practice, the voltage Syx is small, and the current amount of the second term is small to a negligible degree. To more accurately measure the current, the following steps are executed.

1) All the row-direction wiring terminals Dx1 to Dxm are set to 0 V, and the column-direction wiring terminals Dy1 to Dyn are driven by Sy1 to Syn. A current Ia measured at this time is the sum of m currents flowing through all devices connected to Dyx upon application of the voltage Syx.

2) One of the row-direction wiring terminals is selected, and the column-direction wiring terminals Dy1 to Dyn are driven by Sy1 to Syn. A current Ib measured at this time is the sum of (a device current flowing through the device Fx upon application of 16 V) and (a current flowing through the (m−1) inactivated devices connected to Dyx upon application of voltage Syx).

By the two measurements, (a device current flowing through the device Fx upon application of 16 V) is calculated by Ib−Ia. This value is used to calculate a voltage distribution, which enables more accurate voltage setting.

[Fourth Embodiment]

A pre-driving apparatus for the surface-conduction type electron-emitting device according to the fourth embodiment of the present invention will be described with reference to FIG. 11.

Figure 11:
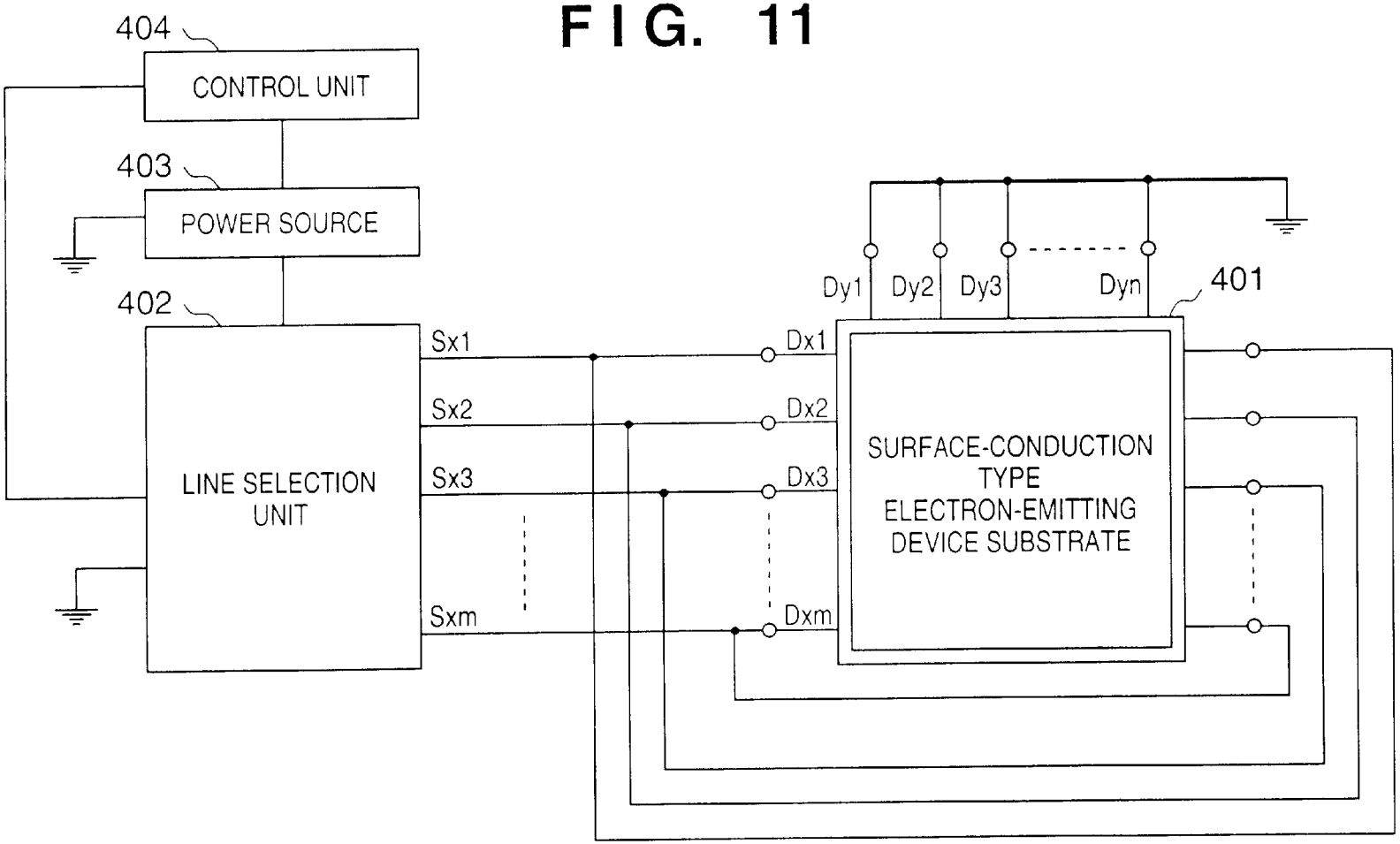
FIG. 11 is a block diagram showing a pre-driving apparatus according to the fourth embodiment of the present invention.

In FIG. 11, reference numeral 403 denotes a pre-driving power source for generating a pre-driving voltage pulse; 402, a line selection unit for applying a voltage pulse generated by the pre-driving power source 403 to a necessary line; 404, a control unit for controlling the pre-driving power source 403 and line selection unit 402; and 401, an electron source substrate having a plurality of surface-conduction type electron-emitting devices arranged in an M×N simple matrix. In the fourth embodiment, the substrate 401 has already undergone forming processing and activation processing, and are undergoing stabilization processing. The substrate 401 is connected to an evacuation apparatus (not shown) and evacuated to about $1\times10^{-7}$ Pa or less.

Figure 12:
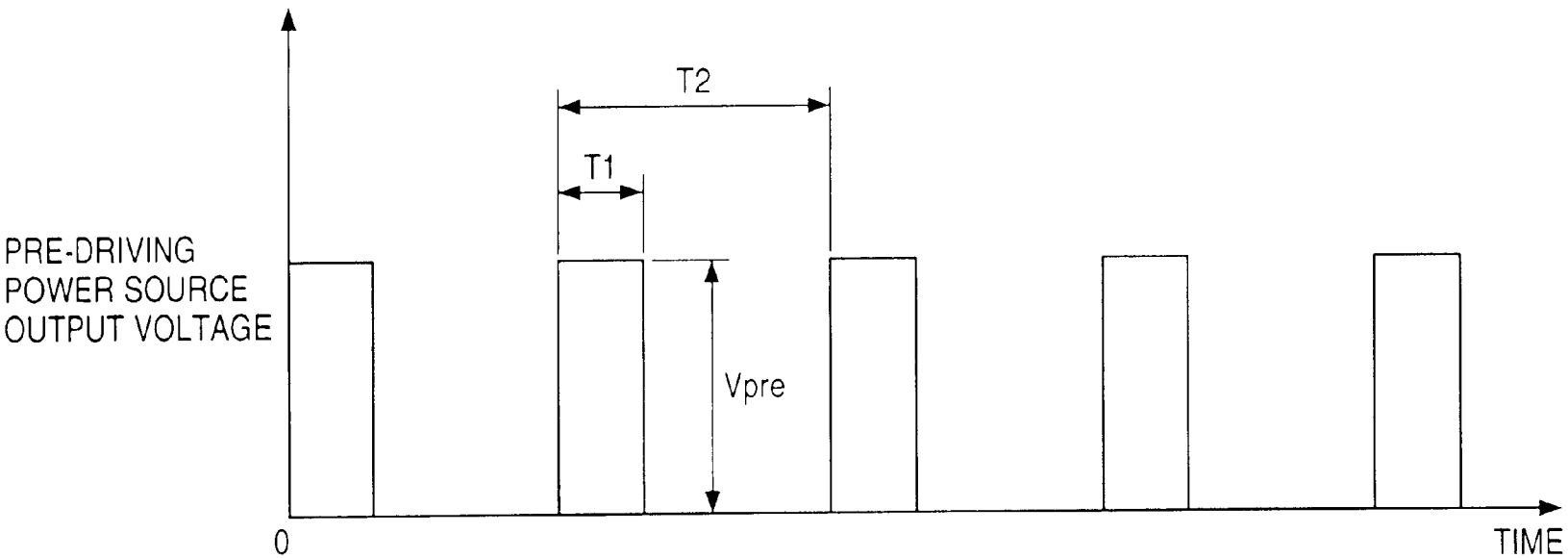
FIG. 12 is a waveform chart showing a pre-driving voltage applied to a surface-conduction type electron-emitting device in FIG. 11.

A method of pre-driving the surface-conduction type electron-emitting device in the fourth embodiment will be described with reference to FIG. 11. The pre-driving power source 403 generates a voltage pulse necessary for pre-driving. In the fourth embodiment, the pre-driving power source 403 outputs a voltage waveform shown in FIG. 12. T1 (pulse width)=1 msec, T2 (pulse interval)=10 msec, and a voltage peak value Vpre=17 V. The voltage waveform and ON/OFF operation of the output are controlled by the control unit 404. A voltage waveform output from the pre-driving power source 402 is input to the line selection unit 402 where the voltage waveform is applied to a selected line.

Figure 13:
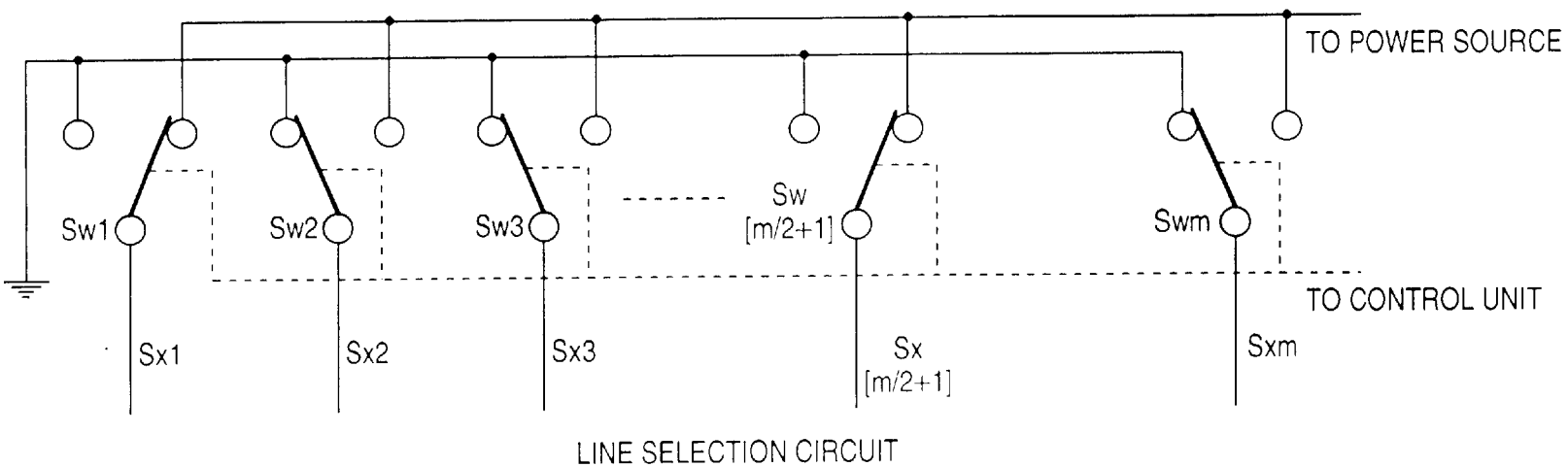
FIG. 13 is a circuit diagram showing in detail a line selection unit in the apparatus of FIG. 11.

The line selection unit 402 will be described with reference to FIG. 13. The line selection unit 402 is constituted by switches such as relays or analog switches. When the electron source substrate 401 has an n×m matrix, m number of switches Sw1 to Swm are arranged parallel, and connected to X-wiring terminals Dx1 to Dxm of the electron source substrate 401 via wirings Sx1 to Sxm. The switches Sw1 to Swm are controlled by the control unit 404, and operate to apply a voltage waveform from the pre-driving power source 403 to a line to be pre-driven. In the example of FIG. 13, Sw1 operates to select the first line Sx1, at the same time a switch Sw[m/2+1] (m is an even number) operates to select the (m/2+1)th line Sx[m/2+1], and the remaining lines are grounded.

After pre-driving is done for a predetermined time, the control unit 404 switches the first and (m/2+1)th lines to the second and (m/2+2)th lines to repeat the same driving. Similarly, up to the m/2th and mth lines are driven.

A proper device was selected from the surface-conduction type electron-emitting device substrate 401 to which Vpre=17 V was applied, and equations (3) and (6) were calculated using the field strength of the device to estimate $\beta=4.5\times10^{6}$ [1/cm]. The field strength $F=\beta\times Vpre$ upon application of 16 V was $7.2\times10^{7}$ [V/cm].

The device was driven at the voltage Vdrv of 14.5 V. β at 14.5 V was measured to estimate $\beta=4.5\times10^{6}$ [1/cm] and $F=6.5\times10^{7}$ [V/cm].

Another surface-conduction type electron-emitting device substrate was prepared, and driven at a driving voltage set to 14.5 V without performing pre-driving. This substrate was compared with the pre-driven substrate to find that the pre-driven surface-conduction type electron-emitting device substrate hardly decreased and varied the device current and emission current during driving, and obtained stable electron-emitting characteristics, compared to the surface-conduction type electron-emitting device substrate not pre-driven.

As a result, changes over time in each pre-driven surface-conduction type electron-emitting device were reduced to a negligible level for practical use. An image display apparatus manufactured using an electron source having a plurality of surface-conduction type electron-emitting devices could display a high-quality image. The time necessary for pre-driving was calculated from data of one device fabricated under the same conditions. Pre-driving processing was completed within almost ½ the time required for pre-driving in units of lines. A driving method of simultaneously selecting a plurality of lines will be called multiline driving.

The arrangement and manufacturing method of a display panel to which the present invention is applied will be exemplified.

Figure 51:
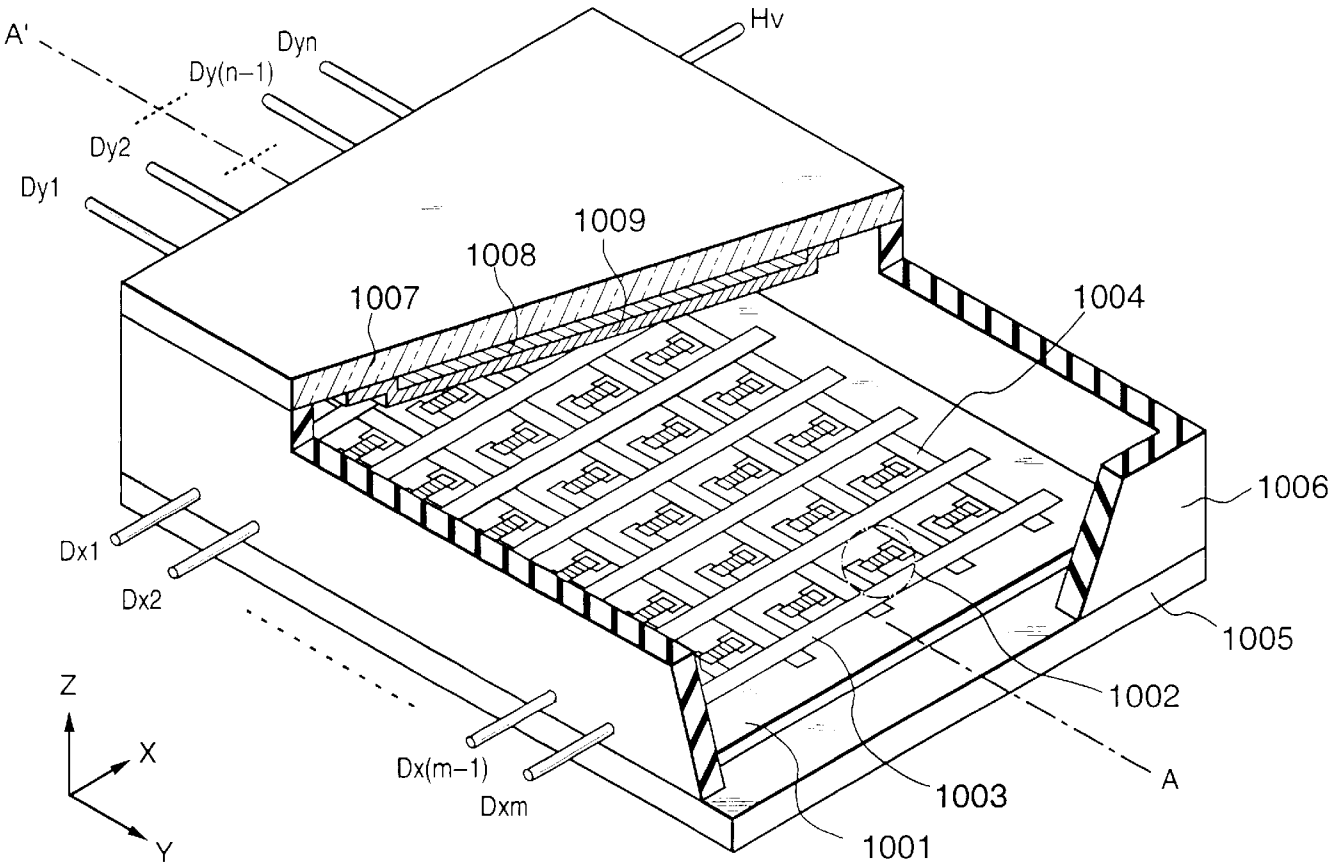
FIG. 51 is a partially cutaway perspective view showing a display panel to which the present invention can be applied.

FIG. 51 is a partially cutaway perspective view of a display panel used in this embodiment, showing the internal structure of the panel. An exhaust pipe to be described in the embodiment of the present invention is not illustrated for convenience.

In FIG. 51, reference numeral 1005 denotes a rear plate; 1006, a side wall; and 1007, a face plate. The rear plate 1005 to face plate 1007 constitute an airtight container for keeping the interior of the display panel vacuum. To construct the airtight container, it is necessary to seal-connect the respective parts to obtain sufficient strength and maintain airtight condition. For example, frit glass is applied to junction portions, and sintered at 400 to 500° C. in air or nitrogen atmosphere, thus the parts are seal-connected. A method for evacuating the container will be described later.

The rear plate 1005 has a substrate 1001 fixed thereon, on which n×m cold cathode devices 1002 are formed. In this case, n and m are positive integers equal to 2 or more, and are properly set in accordance with a target number of display pixels. For example, in a display apparatus for high-resolution television display, n=3,000 or more, and m=1,000 or more are preferable. Even a general television requires a half number of pixels. In this embodiment, n=3,072 or more, and m=480.) The n×m cold cathode devices are arranged in a simple matrix with m row-direction wirings 1003 and n column-direction wirings 1004.. The portion constituted by the components 1001 to 1004 will be referred to as a multi electron source. The manufacturing method and structure of the multi electron source will be described in detail later.

In this embodiment, the substrate 1001 of the multi electron source is fixed to the rear plate 1005 of the airtight container. If, however, the substrate 1001 of the multi electron source has sufficient strength, the substrate 1001 of the multi electron source may be used as the rear plate of the airtight container.

Figure 52A:
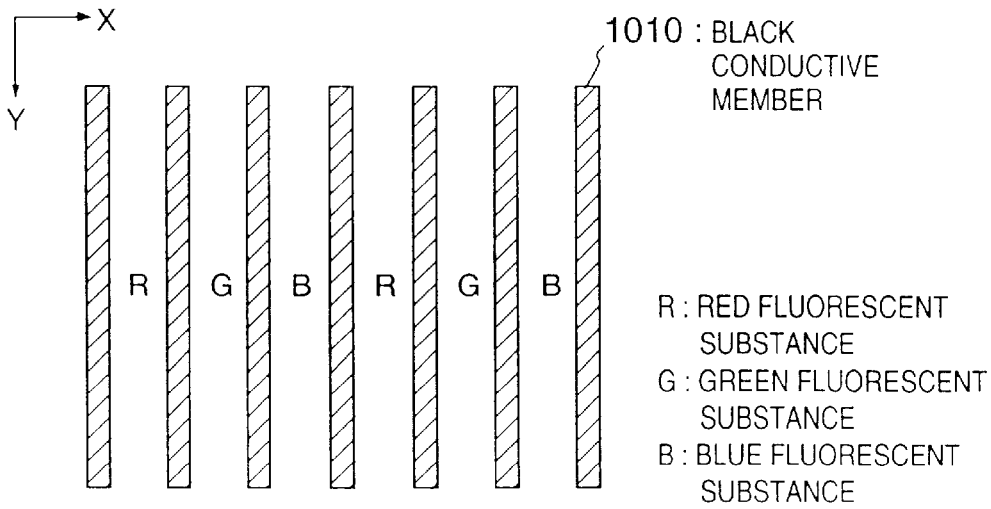
FIGS. 52A and 52B are views each showing the arrangement of a fluorescent substance and black conductive member used in the display panel to which the present invention can be applied.

A fluorescent film 1008 is formed on the lower surface of the face plate 1007. Since this embodiment is a color display apparatus, the fluorescent film 1008 is coated with three, red, green, and blue primary color fluorescent substances used in the CRT field. As shown in FIG. 52A, fluorescent substances of the respective colors are applied in stripes, and black conductive members 1010 are provided between the stripes of the fluorescent substances. The purpose of providing the black conductive members 1010 is to prevent display color misregistration even if the electron-beam irradiation position is shifted to some extent, to prevent a decrease in display contrast by shutting off reflection of external light, and to prevent charge-up of the fluorescent film by the electron beam. As a material for the black conductive members 1010, graphite is used as a main component, but other materials may be used so long as the above purpose is attained.

Figure 52B:
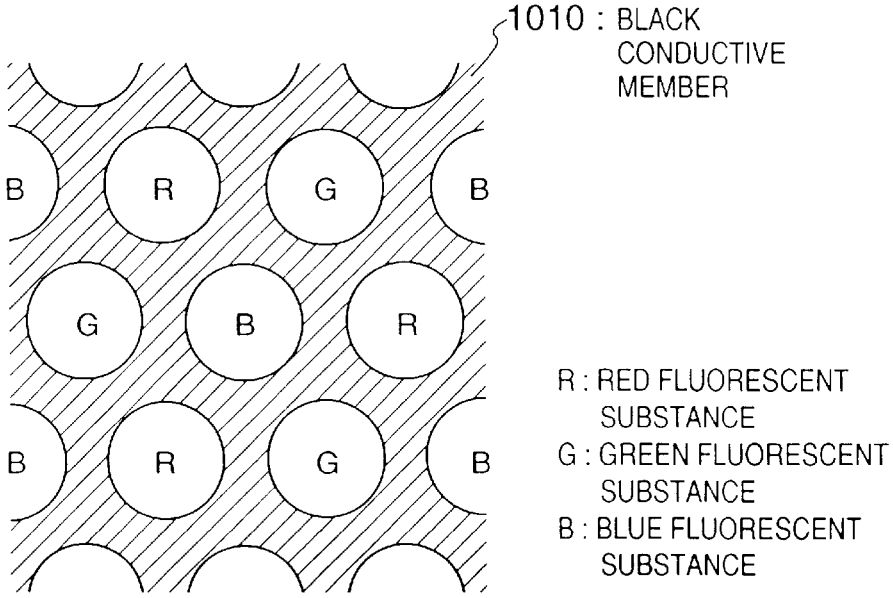

Further, fluorescent substances of the three primary colors are not limited to stripes shown in FIG. 52A. For example, fluorescent substances may be applied in a delta layout as shown in FIG. 52B or another layout.

In fabricating a monochrome display panel, a fluorescent substance material of a single color may be used for the fluorescent film 1008, and the black conductive member may be omitted. A metal back 1009, which is well-known in the CRT field, is formed on a surface of the fluorescent film 1008 on the rear plate side. The purpose of providing the metal back 1009 is to improve the light-utilization ratio by mirror-reflecting part of the light emitted by the fluorescent film 1008, to protect the fluorescent film 1008 from collision with negative ions, to be used as an electrode for applying an electron-beam accelerating voltage, and to be used as a conductive path for electrons which excited the fluorescent film 1008. The metal back 1009 is formed by forming the fluorescent film 1008 on the face plate substrate 1007, smoothing the front surface of the fluorescent film, and depositing Al thereon by vacuum deposition. If a low-voltage fluorescent substance material is used for the fluorescent film 1008, the metal back 1009 is not used.

To apply an accelerating voltage or improve the conductivity of the fluorescent film, transparent electrodes made of, e.g., ITO may be provided between the face plate substrate 1007 and the fluorescent film 1008, although such electrodes are not used in this embodiment.

Reference symbols Dx1 to Dxm, Dy1 to Dyn, and Hv denote electric connection terminals for an airtight structure provided to electrically connect the display panel to an electric circuit (not shown). Dx1 to Dxm are electrically connected to the row-direction wirings 1003 of the multi electron source; Dy1 to Dyn, to the column-direction wirings 1004 of the multi electron source; and Hv, to the metal back 1009 of the face plate.

To evacuate the airtight container, the airtight container is assembled, and then an exhaust pipe and a vacuum pump (neither is shown) are connected to evacuate the airtight container to a vacuum degree of about 10-7 Torr. Thereafter, the exhaust pipe is sealed. To maintain the vacuum degree in the airtight container, a getter film (not shown) is formed at a predetermined position in the airtight container immediately before/after sealing. The getter film is a film formed by heating and evaporating a getter material mainly consisting of, e.g., Ba, by a heater or RF heating. The suction effect of the getter film maintains a vacuum degree of $1\times10^{-5}$ or $1\times10^{-7}$ Torr in the airtight container.

The basic arrangement and manufacturing method of the display panel according to the embodiment of the present invention have been briefly described above.

A method of manufacturing the multi electron source used in the display panel of this embodiment will be described. In the multi electron source used in the image display apparatus of the present invention, the material, shape, and manufacturing method of the cold cathode device are not particularly limited as long as an electron source is constituted by arranging cold cathode devices in a simple matrix. For example, cold cathode devices such as surface-conduction type electron-emitting devices, FE type devices, or MIM type devices can be adopted.

Under circumstances where inexpensive display apparatuses having large display screens are required, the surface-conduction type electron-emitting device is especially preferable among these cold cathode devices. More specifically, the FE type device requires a high-precision manufacturing technique because its electron-emitting characteristics are greatly influenced by the relative positions and shapes of the emitter cone and the gate electrode. This is disadvantageous in attaining a large display area and a low manufacturing cost. In the MIM type device, the insulating layer and upper electrode must be made thin and uniform. This is also disadvantageous in attaining a large display area and a low manufacturing cost. In contrast to this, the surface-conduction type electron-emitting device can be manufactured by a relatively simple method, and can achieve a large display area and a low manufacturing cost.

The present inventors have also found that among the surface-conduction type electron-emitting devices, a device having an electron-emitting portion or its peripheral portion made of a fine particle film exhibits excellent electron-emitting characteristics and can be easily manufactured. Such device is most suitable for the multi electron source of a high-luminance, large-screen image display apparatus. For this reason, the display panel of this embodiment uses surface-conduction type electron-emitting devices each having an electron-emitting portion or its peripheral portion made of a fine particle film. The basic structure, manufacturing method, and characteristics of the preferred surface-conduction type electron-emitting device will be described first. The structure of the multi electron source having many devices arranged in a simple matrix will be described later.

(Preferred Structure and Manufacturing Method of Surface-conduction type Electron-Emitting Device)

Typical examples of surface-conduction type electron-emitting devices each having an electron-emitting portion or its peripheral portion made of a fine particle film include two types of devices, namely flat and step type devices.

(Flat Surface-conduction Type Electron-Emitting Device)

Figure 53A:
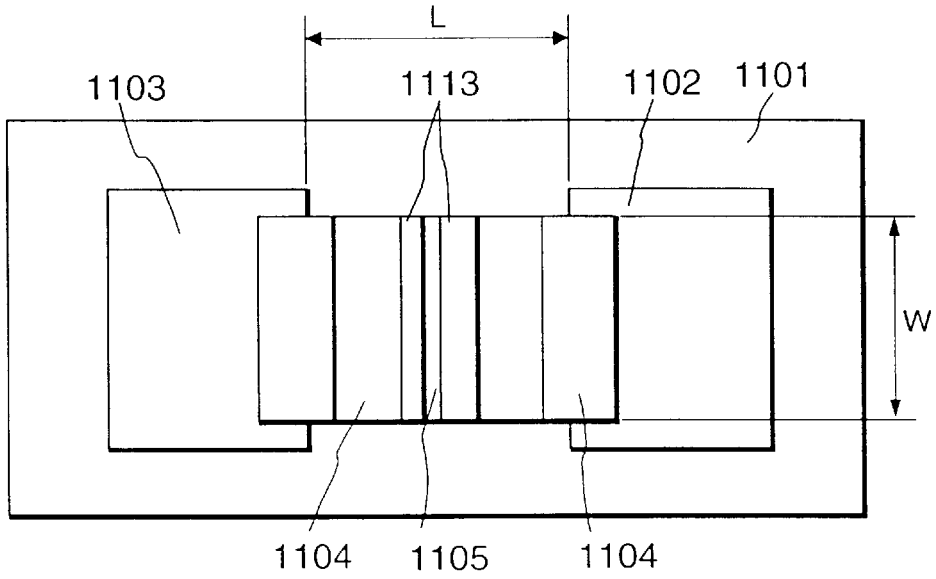
FIGS. 53A and 53B are a schematic plan view and sectional view, respectively, showing a flat surface-conduction type electron-emitting device to which the present invention can be applied.
Figure 53B:
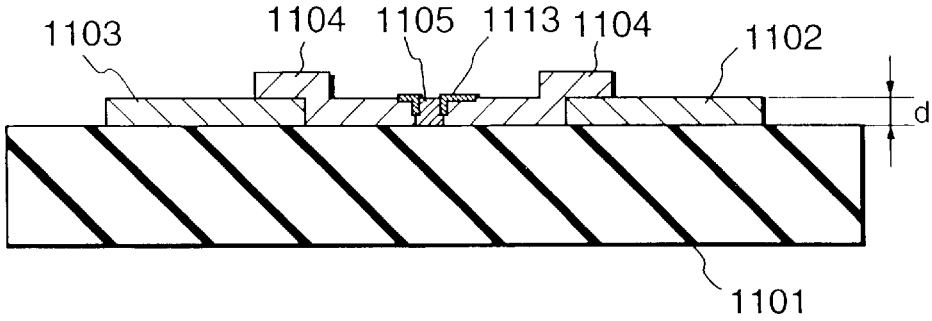

The structure and manufacturing method of a flat surface-conduction type electron-emitting device will be described. FIGS. 53A and 53B are a plan view and a sectional view, respectively, for explaining the structure of the flat surface-conduction type electron-emitting device. Referring to FIGS. 53A and 53B, reference numeral 1101 denotes a substrate; 1102 and 1103, device electrodes; 1104, a conductive thin film; 1105, an electron-emitting portion formed by forming processing; and 1113, a thin film formed by activation processing.

As the substrate 1101, various glass substrates of, e.g., quartz glass and soda-lime glass, various ceramic substrates of, e.g., alumina, or any of those substrates with an insulating layer formed thereon can be employed.

The device electrodes 1102 and 1103 facing each other in parallel to the substrate 1101 are made of a conductive material. Examples of the material are metals such as Ni, Cr, Au, Mo, W, Pt, Ti, Cu, Pd and Ag, alloys of these metals, metal oxides such as $In_2O_3$—$SnO_2$, and semiconductor material such as polysilicon. The electrodes 1102 and 1103 can be easily formed by a combination of a film formation technique such as vacuum evaporation and a patterning technique such as photolithography or etching. Another method (e.g., printing technique) may be employed.

The shape of the electrodes 1102 and 1103 is appropriately designed in accordance with an application purpose of the electron-emitting device. Generally, an interval L between the electrodes is designed by selecting an appropriate value in a range from several hundred Å to several hundred μm. Most preferable range for a display apparatus is from several μm to several ten μm. As for a thickness d of the device electrode, an appropriate value is selected in a range from several hundred Å to several μm.

The conductive thin film 1104 is formed from a fine particle film. The fine particle film is a film that contains a lot of fine particles (including masses of particles) as film-constituting members. In microscopic view, individual particles exist at predetermined intervals or adjacent to each other, or overlap each other.

One particle of the fine particle film has a diameter within a range from several Å to several thousand Å, and preferably a range from 10 Å to 200 Å. The thickness of the fine particle film is appropriately set in consideration of the following conditions. That is, conditions necessary for electrically connecting the device electrode 1102 or 1103, conditions necessary for performing forming processing (to be described later), and conditions necessary for setting the electrical resistance of the fine particle film to an appropriate value (to be described later).

For example, the film thickness is set in a range from several Å to several thousand Å, and preferably a range from 10 Å to 500 Å.

Examples of a material used for forming the fine particle film are metals such as Pd, Pt, Ru, Ag, Au, Ti, In, Cu, Cr, Fe, Zn, Sn, Ta, W and Pb, oxides such as PdO, $SnO_2$, $In_2O_3$, PbO and $Sb_2O_3$, borides such as $HfB_2$, $ZrB_2$, $LaB_6$, $CeB_6$, $YB_4$ and $GdB_4$, carbides such as TiC, ZrC, HfC, TaC, SiC, and WC, nitrides such as TiN, ZrN and HfN, semiconductors such as Si and Ge, and carbons. The material is appropriately selected from them.

As described above, the conductive thin film 1104 is formed from a fine particle film, and the sheet resistance of the film 1104 is set to reside within a range from $10^3$ to $10^7$ (Ω/□).

The conductive thin film 1104 and the device electrodes 1102 and 1103 partially overlap each other so as to electrically connect them with high reliability. In FIGS. 53A and 53B, the conductive thin film 1104 and the device electrodes 1102 and 1103 are stacked in order of the substrate, device electrodes, and conductive thin film from the bottom, but may be stacked in order of the substrate, conductive thin film, and device electrodes from the bottom.

The electron-emitting portion 1105 is a fissured portion formed at part of the conductive thin film 1104, and has an electrically higher resistance than that of the peripheral conductive thin film. The fissure is formed by forming processing (to be described later) in the conductive thin film 1104. In some cases, particles having a diameter of several Å to several hundred Å are set in the fissure. As it is difficult to exactly illustrate the actual position and shape of the electron-emitting portion, FIGS. 53A and 53B schematically show the electron-emitting portion.

The thin film 1113 made of carbon or a carbon compound covers the electron-emitting portion 1115 and its peripheral portion. The thin film 1113 is formed by activation processing (to be described later) after forming processing.

The thin film 1113 is preferably graphite monocrystalline, graphite polycrystalline, amorphous carbon, or mixture thereof, and its thickness is 500 Å or less, and more preferably 300 Å or less.

As it is difficult to exactly illustrate the actual position and shape of the thin film 1113, FIGS. 53A and 53B show the film schematically. FIG. 53A shows the device where part of the thin film 1113 is removed.

The basic structure of the preferred device has been described. This embodiment uses the following device.

That is, the substrate 1101 is made of a soda-lime glass, and the device electrodes 1102 and 1103 are made from an Ni thin film. The thickness d of the device electrode is 1,000 Å, and the electrode interval L is 2 μm.

The main material of the fine particle film is Pd or PdO. The fine particle film has a thickness of about 100 Å and a width W of 100 μm.

Next, a method of manufacturing a preferred flat surface-conduction type electron-emitting device will be described.

FIGS. 54A to 54E are sectional views for explaining the steps in manufacturing the surface-conduction type electron-emitting device. The same reference numerals as in FIGS. 53A and 53B denote the same parts.

Figure 54A:
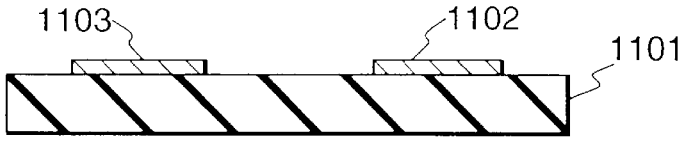
FIGS. 54A to 54E are sectional views, respectively, showing the steps in manufacturing the electron-emitting device in FIG. 53A.

1) As shown in FIG. 54A, the device electrodes 1102 and 1103 are formed on the substrate 1101.

In forming these device electrodes, the substrate 1101 is fully washed with a detergent, pure water, and an organic solvent, and the device electrode material is deposited on the substrate 1101. As the depositing method, a vacuum film formation technique such as evaporation or sputtering may be used. The deposited electrode material is patterned by photolithography etching into a pair of device electrodes (1102 and 1103) shown in FIG. 54A.

Figure 54B:
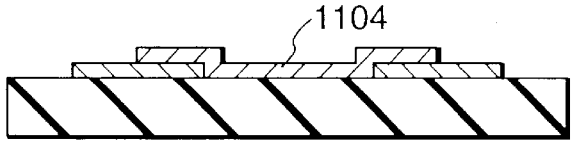

2) As shown in FIG. 54B, the conductive thin film 1104 is formed.

In formation, an organic metal solvent is applied to the substrate in FIG. 54A, dried, and sintered to form a fine particle film. The fine particle film is patterned into a predetermined shape by photolithography etching. The organic metal solvent is an organic metal compound solvent containing as a main component the fine particle material used for the conductive thin film. More specifically, this embodiment uses Pd as a main component. This embodiment uses dipping as a coating method, but may use another method such as a spinner or spraying method.

The film formation method of the conductive thin film made from the fine particle film is not limited to application of the organic metal solvent used in the embodiment, but may be another method such as vacuum evaporation, sputtering or chemical vapor deposition.

Figure 54C:
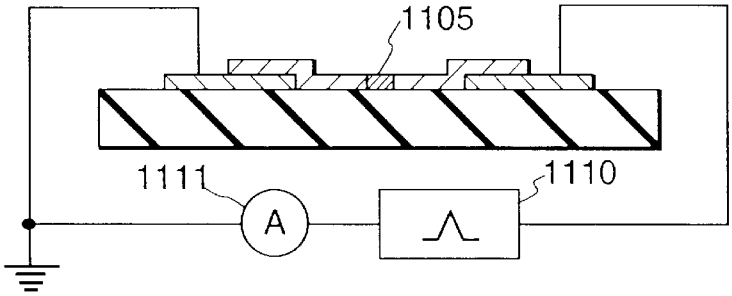

3) As shown in FIG. 54C, a proper voltage is applied between the device electrodes 1102 and 1103 from a forming power source 1110 to perform forming processing, thereby forming the electron-emitting portion 1105.

In forming processing, electrification processing is done for a conductive thin film 1104 made of the fine particle film to destroy, deform, or deteriorate part of the conductive thin film 1104 so as to change it into a structure suitable for electron emission. In the conductive thin film made of the fine particle film, an appropriate fissure is formed in the thin film at the portion changed into a structure suitable for electron emission (i.e., electron-emitting portion 1105). After the electron-emitting portion 1105 is formed, the electrical resistance measured between the device electrodes 1102 and 1103 greatly increases, compared to the electrical resistance before the electron-emitting portion 1105 is formed.

Figure 55:
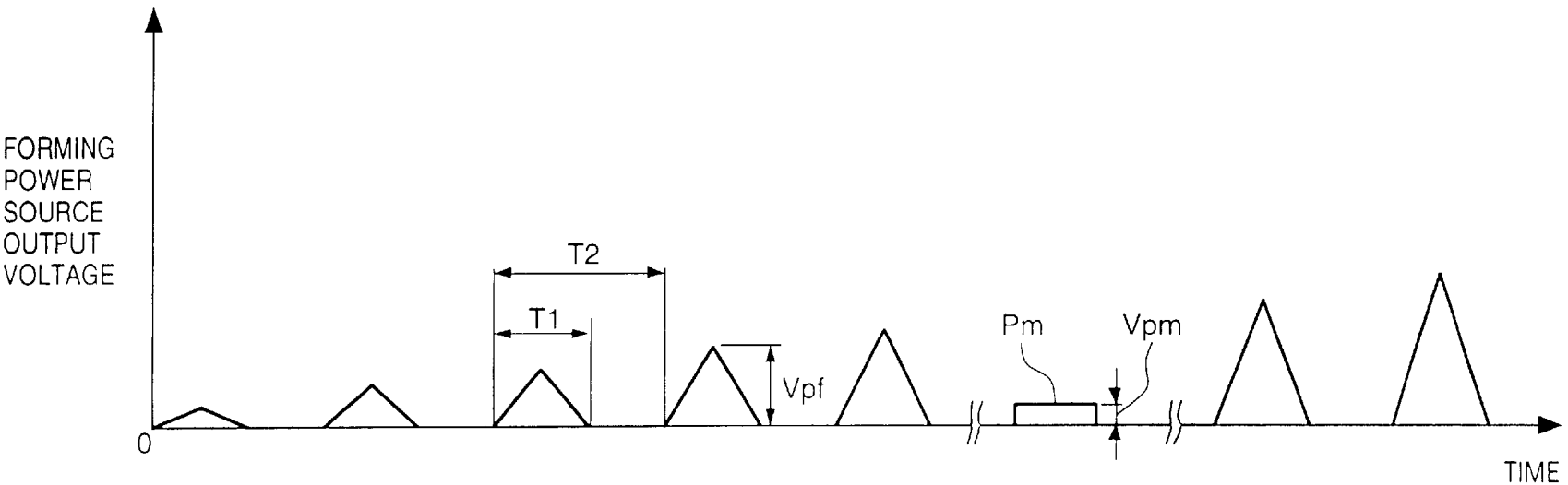
FIG. 55 is a graph showing a voltage pulse used in the forming step in the manufacturing process of FIGS. 54A to 54E.

The electrification method will be explained in more detail with reference to FIG. 55 showing an example of an appropriate voltage waveform applied from the forming power source 1110. When forming processing is done for the conductive thin film made of the fine particle film, a pulse-like voltage is preferable. In this embodiment, as shown in FIG. 55, a triangular-wave pulse having a pulse width T1 is continuously applied at a pulse interval T2. At this time, a peak value Vpf of the triangular-wave pulse is sequentially increased. Further, a monitor pulse Pm for monitoring the formation status of the electron-emitting portion 1105 is inserted between triangular-wave pulses at a proper interval, and a flowing current is measured by a galvanometer 1111. In this embodiment, the peak value Vpf is increased by 0.1 V every pulse at the pulse width T1 of 1 msec and the pulse interval T2 of 10 msec in a vacuum atmosphere of about $10^{-5}$ Torr. The monitor pulse Pm is inserted every five triangular-wave pulses. To avoid any adverse influence on forming processing, a monitor pulse voltage Vpm is set to 0.1 V. When the electrical resistance between the device electrodes 1102 and 1103 reaches $1\times10^{6}\Omega$, i.e., the current measured by the galvanometer 1111 upon application of monitor pulses reaches $1\times10^{-7}$ A or less, electrification processing for forming processing ends.

Note that the above processing method is preferable for the surface-conduction type electron-emitting device of this embodiment. In case of changing the design of the surface-conduction type electron-emitting device concerning, for example, the material or thickness of the fine particle film or the device electrode interval L, the electrification conditions are desirably changed in accordance with the changed design.

Figure 54D:
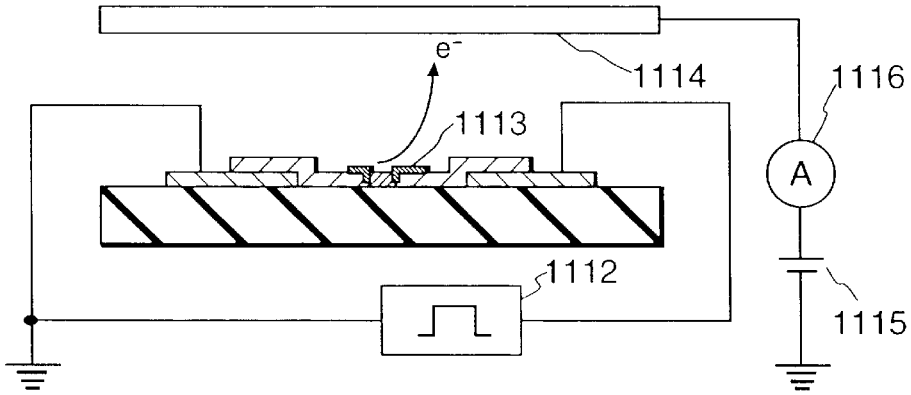

4) As shown in FIG. 54D, a proper voltage is applied between the device electrodes 1102 and 1103 from an activation power source 1112 to perform activation processing so as to improve electron-emitting characteristics.

Activation processing is processing of performing electrification for the electron-emitting portion 1105 formed by forming processing under appropriate conditions, and depositing carbon or a carbon compound around the electron-emitting portion 1105. In FIG. 54D, a deposit of carbon or a carbon compound is illustrated as a material 1113. After activation processing is done, the emission current at the same application voltage becomes typically 100 times or more than that before activation processing is done.

More specifically, a voltage pulse is periodically applied in a vacuum atmosphere of $10^{-4}$ to 10–5 Torr, thereby depositing carbon or a carbon compound mainly derived from an organic compound existing in the vacuum atmosphere. The deposit 1113 is any of graphite monocrystalline, graphite polycrystalline, amorphous carbon or mixture thereof. The thickness of the accumulated material 1113 is 500 Å or less, and more preferably 300 Å or less.

Figure 56A:
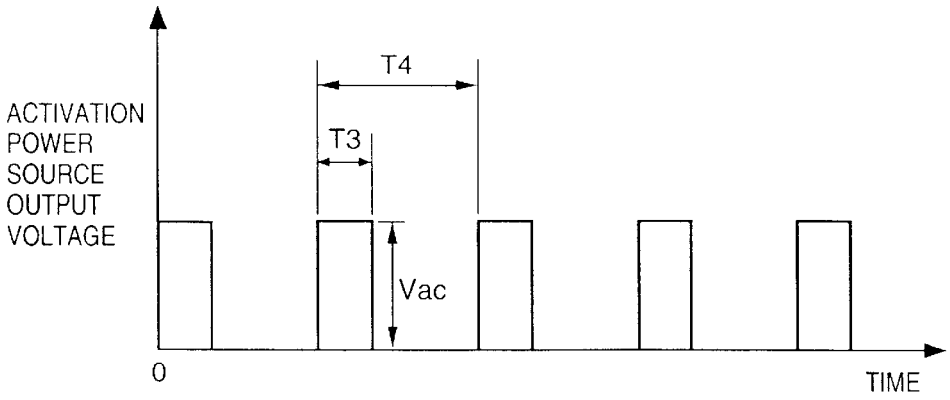
FIGS. 56A and 56B are graphs each showing a voltage pulse used in the pre-driving step in the manufacturing process of FIGS. 54A to 54E.

The electrification method will be described in more detail with reference to FIG. 56A showing an example of an appropriate voltage waveform applied from the activation power source 1112. In this embodiment, activation processing is done by periodically applying a rectangular wave at a predetermined voltage. A rectangular-wave voltage Vac is 14 V, a pulse width T3 is 1 msec, and a pulse interval T4 is 10 msec. These electrification conditions are preferable for the surface-conduction type electron-emitting device of this embodiment. In case of changing the design of the surface-conduction type electron-emitting device, the electrification conditions are preferably changed in accordance with the changed design.

Figure 56B:
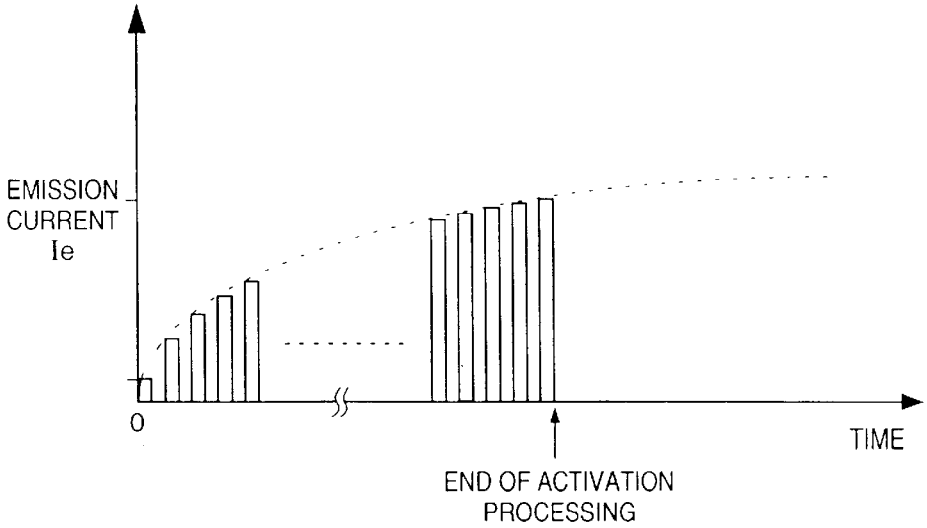

In FIG. 54D, reference numeral 1114 denotes an anode electrode for capturing an emission current Ie emitted from the surface-conduction type electron-emitting device. The anode electrode 1114 is connected to a DC high-voltage power source 1115 and a galvanometer 1116. In case of performing activation processing after the substrate 1101 is incorporated in the display panel, the fluorescent surface of the display panel is used as the anode electrode 1114. While applying a voltage from the activation power source 1112, the galvanometer 1116 measures the emission current Ie, and monitors the progress of activation processing to control the operation of the activation power source 1112. FIG. 56B shows an example of the emission current Ie measured by the galvanometer 1116. As the activation power source 1112 starts applying the pulse voltage, the emission current Ie increases with the elapse of time, gradually comes into saturation, and hardly increases. When the emission current Ie substantially saturates, the activation power source 1112 stops applying the voltage to stop activation processing.

Note that these electrification conditions are preferable to the surface-conduction type electron-emitting device of this embodiment. In case of changing the design of the surface-conduction type electron-emitting device, the conditions are preferably changed in accordance with the changed design.

Figure 54E:
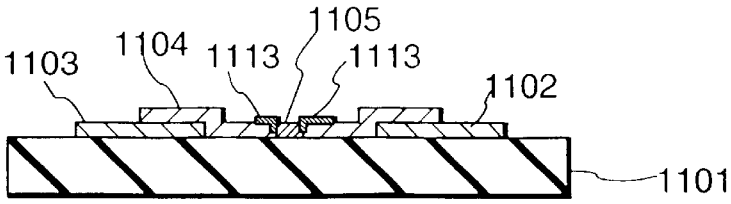

In this manner, the flat surface-conduction type electron-emitting device as shown in FIG. 54E is manufactured.

(Stepped Surface-conduction Type Electron-Emitting Device)

Next, another typical structure of the surface-conduction type electron-emitting device having an electron-emitting portion or its peripheral portion formed from a fine particle film, i.e., a stepped surface-conduction type electron-emitting device will be described.

Figure 57:
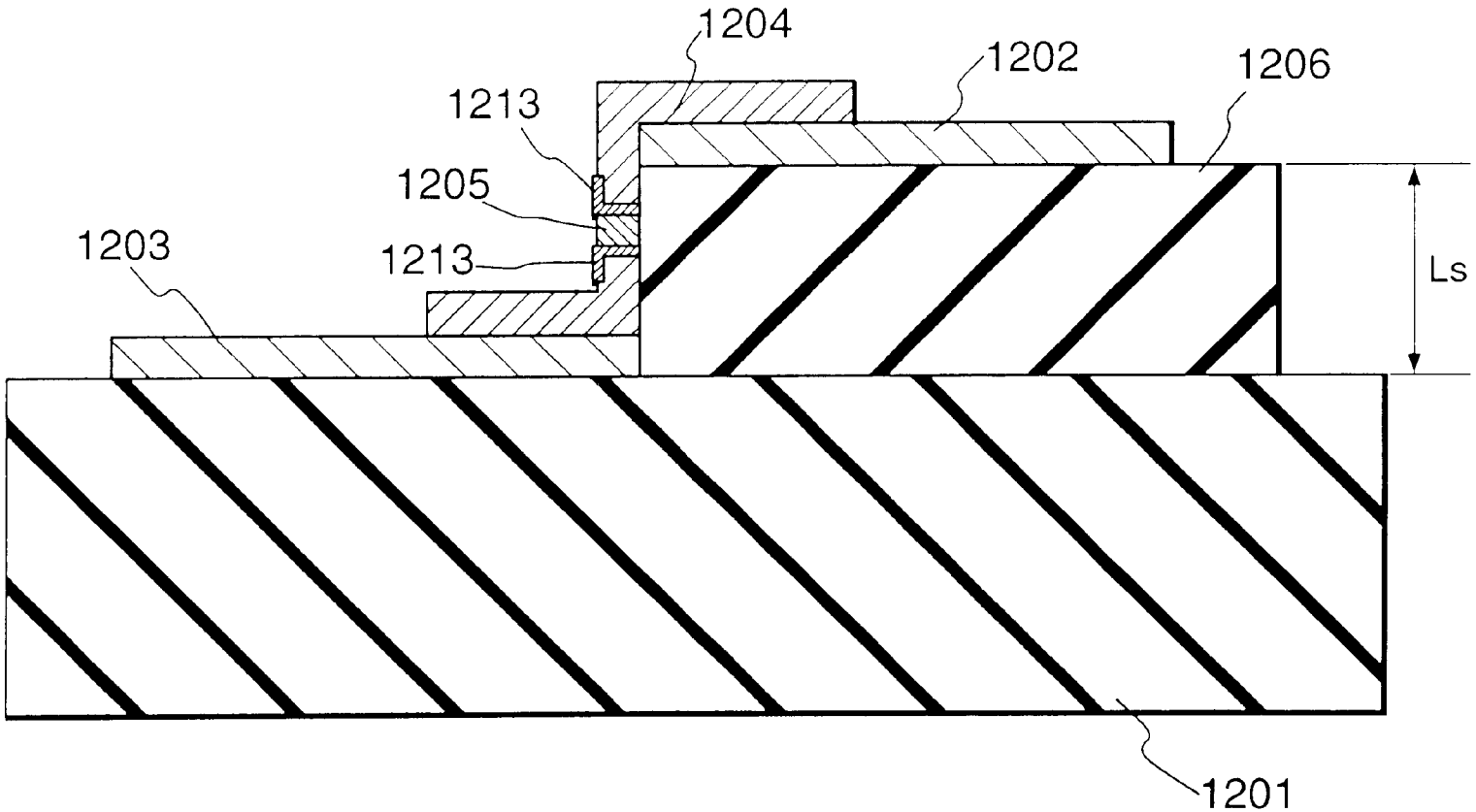
FIG. 57 is a schematic sectional view showing a stepped surface-conduction type electron-emitting device to which the present invention can be applied.

FIG. 57 is a schematic sectional view for explaining the basic structure of the stepped surface-conduction type electron-emitting device. In FIG. 57, reference numeral 1201 denotes a substrate; 1202 and 1203, device electrodes; 1206, a step-forming member for making height difference between the electrodes 1202 and 1203; 1204, a conductive thin film using a fine particle film; 1205, an electron-emitting portion formed by forming processing; and 1213, a thin film formed by activation processing.

The stepped device is different from the above-described flat device in that one of the device electrodes (1202) is formed on the step-forming member 1206 and the conductive thin film 1204 covers the side surface of the step-forming member 1206. The device interval L in FIG. 53A is set as a height difference Ls corresponding to the height of the step-forming member 1206 in this structure. The substrate 1201, device electrodes 1202 and 1203, and conductive thin film 1204 using the fine particle film can use the materials listed in the description of the flat surface-conduction type electron-emitting device. The step-forming member 1206 use an electrically insulating material such as $SiO_2$.

A method of manufacturing the stepped surface-conduction type electron-emitting device will be described. FIGS. 58A to 58F are sectional views for explaining the manufacturing steps. The same reference numerals as in FIG. 57 denote the same parts in FIGS. 58A to 58F.

Figure 58A:
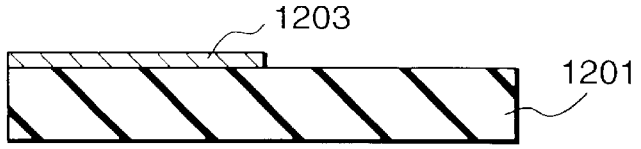
FIGS. 58A to 58F are sectional views, respectively, showing the steps in manufacturing the electron-emitting device in FIG. 57.

1) As shown in FIG. 58A, the device electrode 1203 is formed on the substrate 1201.

Figure 58B:
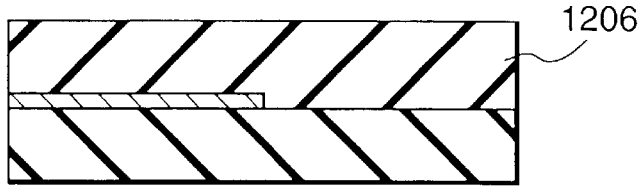

2) As shown in FIG. 58B, an insulating layer for forming the step-forming member is formed. The insulating layer may be formed by sputtering, e.g., $SiO_2$, but may be formed by another film formation method such as a vacuum evaporation or printing method.

Figure 58C:
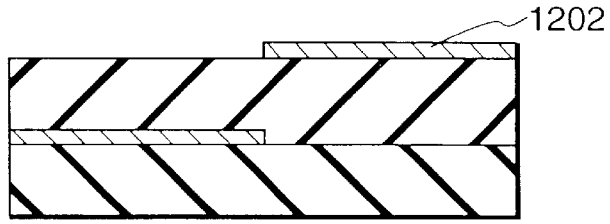

3) As shown in FIG. 58C, the device electrode 1202 is formed on the insulating layer.

Figure 58D:
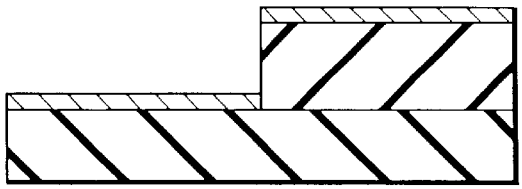

4) As shown in FIG. 58D, part of the insulating layer is removed by, e.g., etching to expose the device electrode 1203.

Figure 58E:
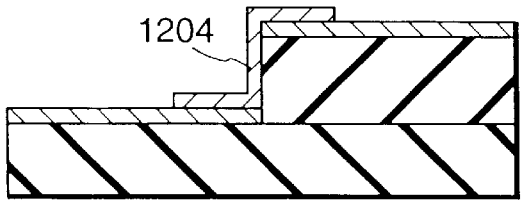

5) As shown in FIG. 58E, the conductive thin film 1204 using the fine particle film is formed. To form the film 1204, a film formation technique such as a coating method is used similar to the flat device structure.

6) Similar to the flat device structure, forming processing is performed to form an electron-emitting portion (the same forming processing as that for the flat device structure described with reference to FIG. 54C is performed).

7) Similar to the flat device structure, activation processing is performed to deposit carbon or a carbon compound around the electron-emitting portion (the same activation processing as that for the flat device structure described with reference to FIG. 54D is performed).

Figure 58F:
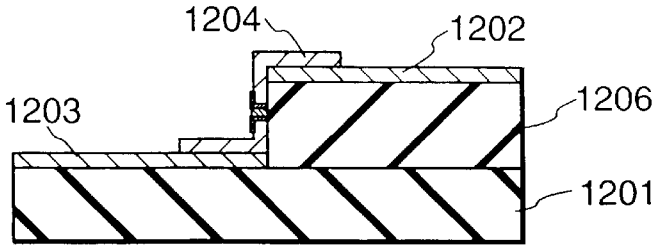

In this fashion, the stepped surface-conduction type electron-emitting device shown in FIG. 58F is manufactured.

(Characteristics of Surface-conduction Type Electron-Emitting Device Used in Display Apparatus)

The structure and manufacturing method of the flat surface-conduction type electron-emitting device and those of the stepped surface-conduction type electron-emitting device have been described above. Next, the characteristics of the device used in the display apparatus will be described.

Figure 59:
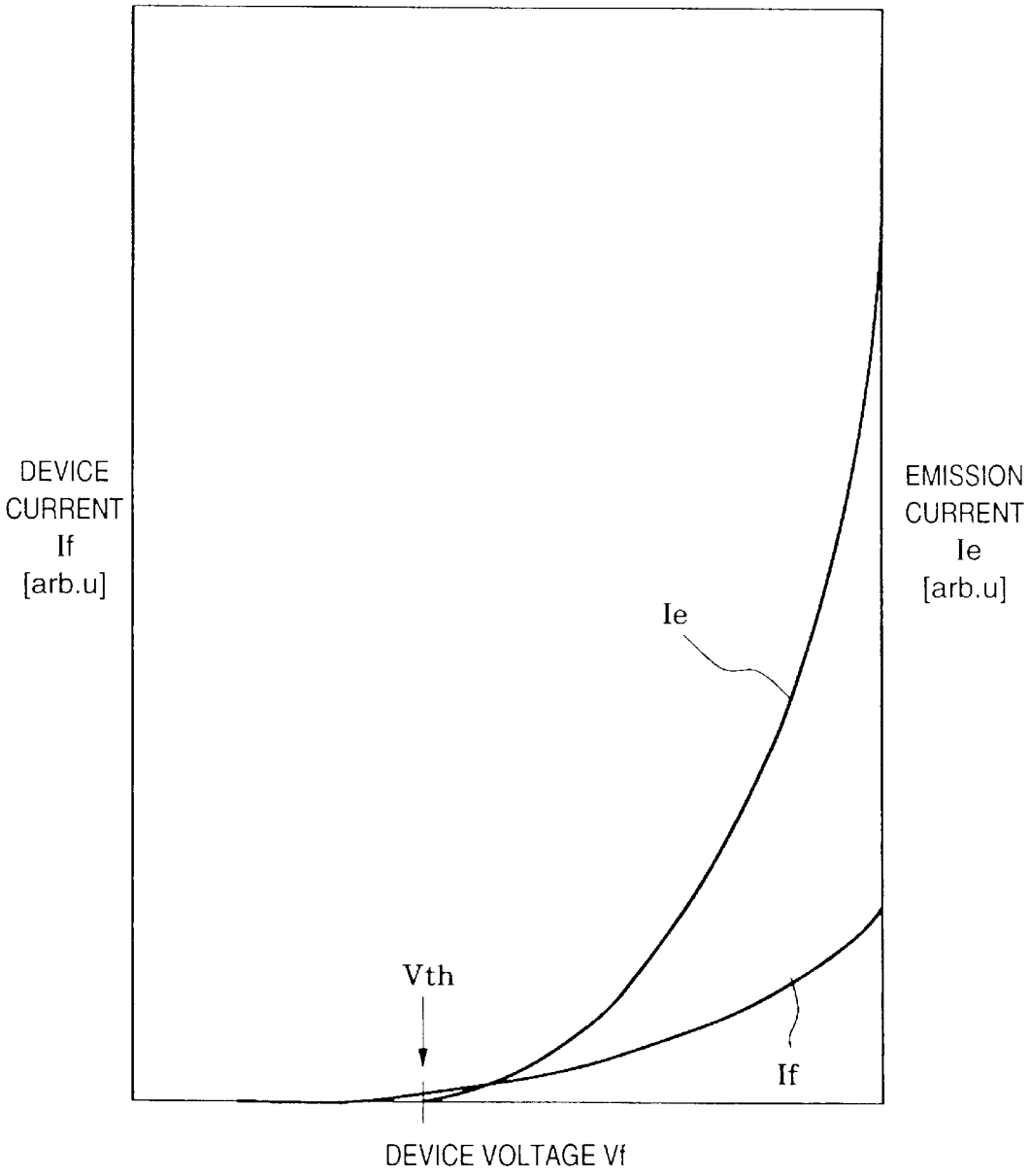
FIG. 59 is a graph showing the electrical characteristic of the surface-conduction type electron-emitting device to which the present invention can be applied.

FIG. 59 shows typical examples of the (emission current Ie) vs. (device application voltage Vf) characteristic and (device current If) vs. (device application voltage Vf) characteristic of the device used in the display apparatus. The emission current Ie is much smaller than the device current If, and it is difficult to illustrate the emission current Ie by the same measure as the device current If. In addition, these characteristics change depending on changes in design parameters such as the size and shape of the device. For these reasons, two characteristics of the graph are illustrated in arbitrary units.

Regarding the emission current Ie, the device used in the display apparatus has the following three characteristics:

First, when a voltage of a predetermined level (referred to as a threshold voltage Vth) or greater is applied to the device, the emission current Ie drastically increases. However, almost no emission current Ie is detected at a voltage lower than the threshold voltage Vth. That is, the device has a nonlinear characteristic based on the clear threshold voltage Vth for the emission current Ie.

Second, the emission current Ie changes in dependence upon the device application voltage Vf, and can be controlled by changing the voltage Vf.

Third, the emission current Ie is output quickly upon application of the device application voltage Vf. A charge amount of electrons emitted by the device can be controlled by the application time of the voltage Vf.

The surface-conduction type electron-emitting device having these characteristics can be preferably applied to the display apparatus. For example, a display apparatus having many devices in correspondence with the pixels of the display screen can display an image using the first characteristic, while sequentially scanning the display screen. This means that the threshold voltage Vth or more is appropriately applied to a driven device in accordance with a desired emission luminance, while a voltage lower than the threshold voltage Vth is applied to an unselected device. By sequentially changing devices to be driven, the display screen can be sequentially scanned to display an image.

By using the second or third characteristic, the emission luminance can be controlled to realize a multi-gradation display.

(Structure of Multi Electron Source With Many Devices Arranged in Simple Matrix)

The structure of the multi electron source having surface-conduction type electron-emitting devices arranged in a simple matrix on the substrate will be described.

Figure 60:
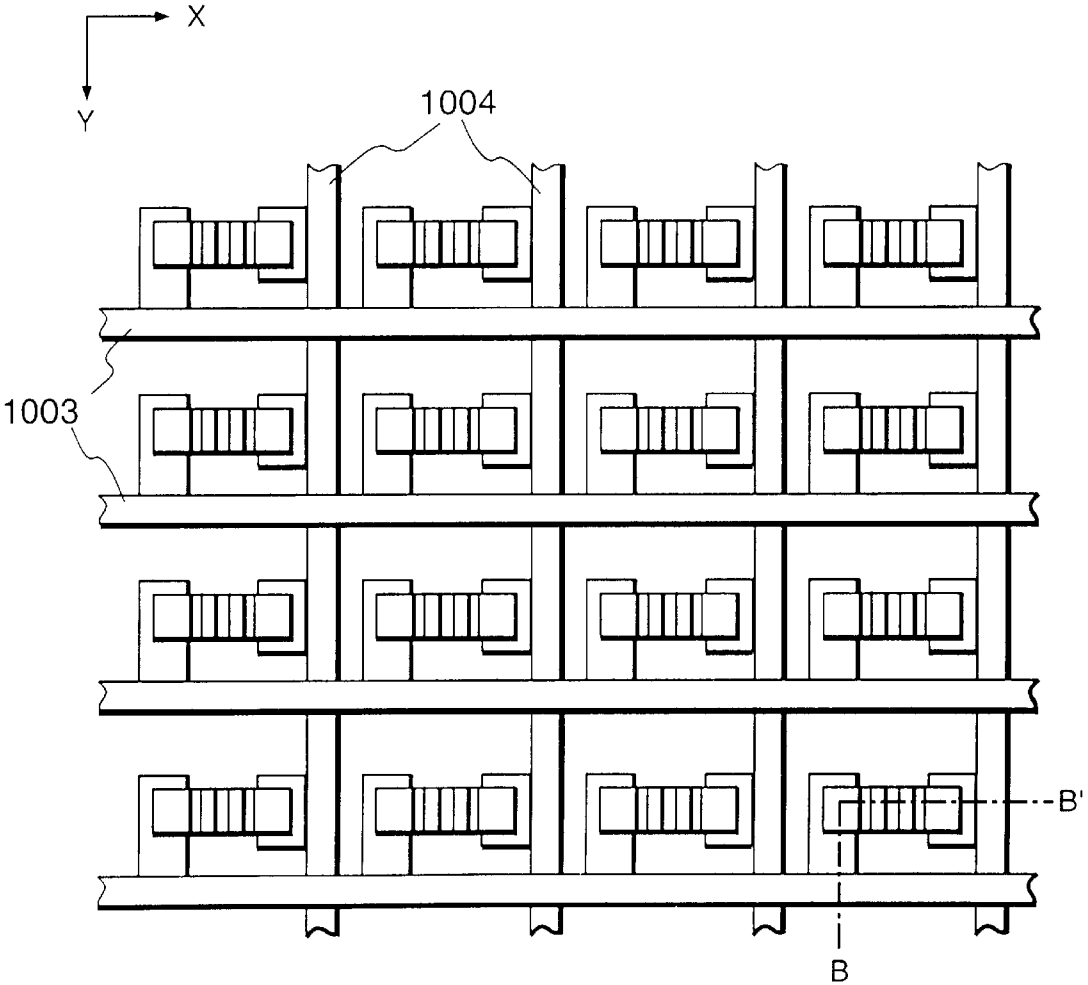
FIG. 60 is a plan view showing a multi electron source used in the display panel of FIG. 51.

FIG. 60 is a plan view of the multi electron source used in the display panel of FIG. 51. Surface-conduction type electron-emitting devices like the one shown in FIGS. 53A and 53B are arranged on a substrate, and wired in a simple matrix by the row- and column-direction wiring electrodes 1003 and 1004. At the intersection of the row- and column-direction wiring electrodes 1003 and 1004, an insulating layer (not shown) is formed between electrodes to maintain electrical insulation.

Figure 61:
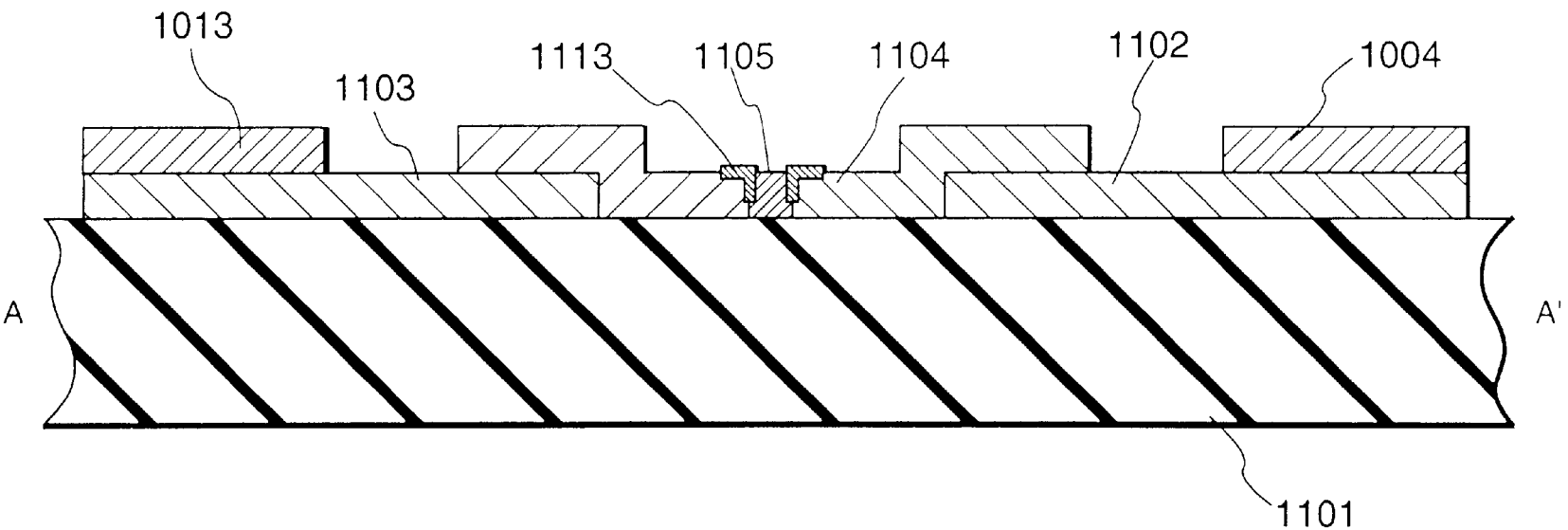
FIG. 61 is a sectional view taken along the line B–B' in FIG. 60.

FIG. 61 is a sectional view take along the line B–B' in FIG. 60.

A multi electron source having this structure is manufactured as follows. The row- and column-direction wiring electrodes 1003 and 1004, an inter-electrode insulating layer (not shown), and the device electrodes and conductive thin film of the surface-conduction type electron-emitting device are formed on the substrate. The voltage is applied to each device via the row- and column-direction wirings 1003 and 1004 to perform forming processing and activation processing.

As described above, while lines are scanned, the pre-driving voltage is applied to a plurality of surface-conduction type electron-emitting devices using the pre-driving apparatus of the fourth embodiment. This can shorten the pre-driving time and stabilize the characteristics of each device.

Figure 50:
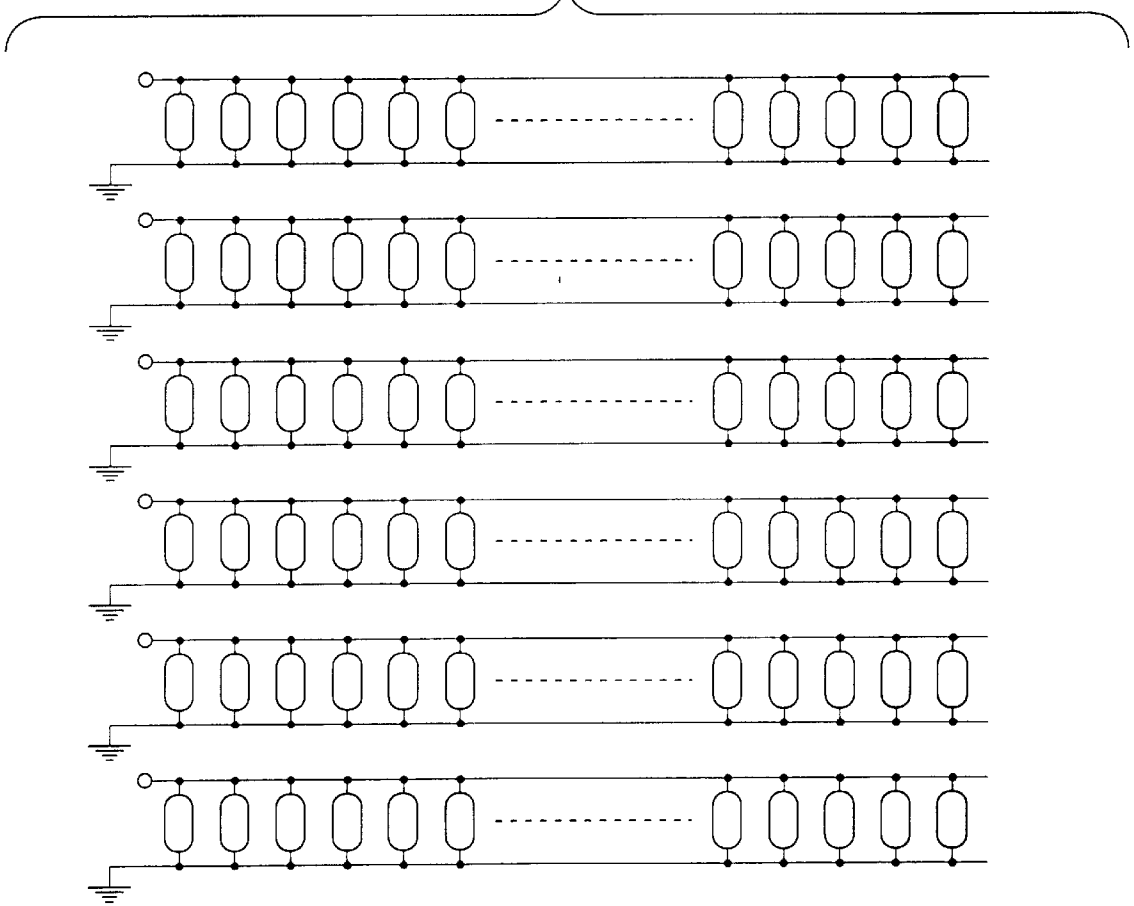
FIG. 50 is a view for explaining the arrangement of an electron source having surface-conduction type electron-emitting devices arranged in a ladder shape.

The fourth embodiment can be similarly applied to such electron source substrate 101 in which a plurality of surface-conduction type electron-emitting devices are connected like a ladder, as shown in FIG. 50.

[Fifth Embodiment]

The arrangement of a pre-driving apparatus in the fifth embodiment is the same as that of the fourth embodiment shown in FIG. 11, and a description thereof will be omitted. The feature of the fifth embodiment is control of a line selection unit 402 by a control unit 404, which will be described with reference to FIG. 14.

Figure 14:
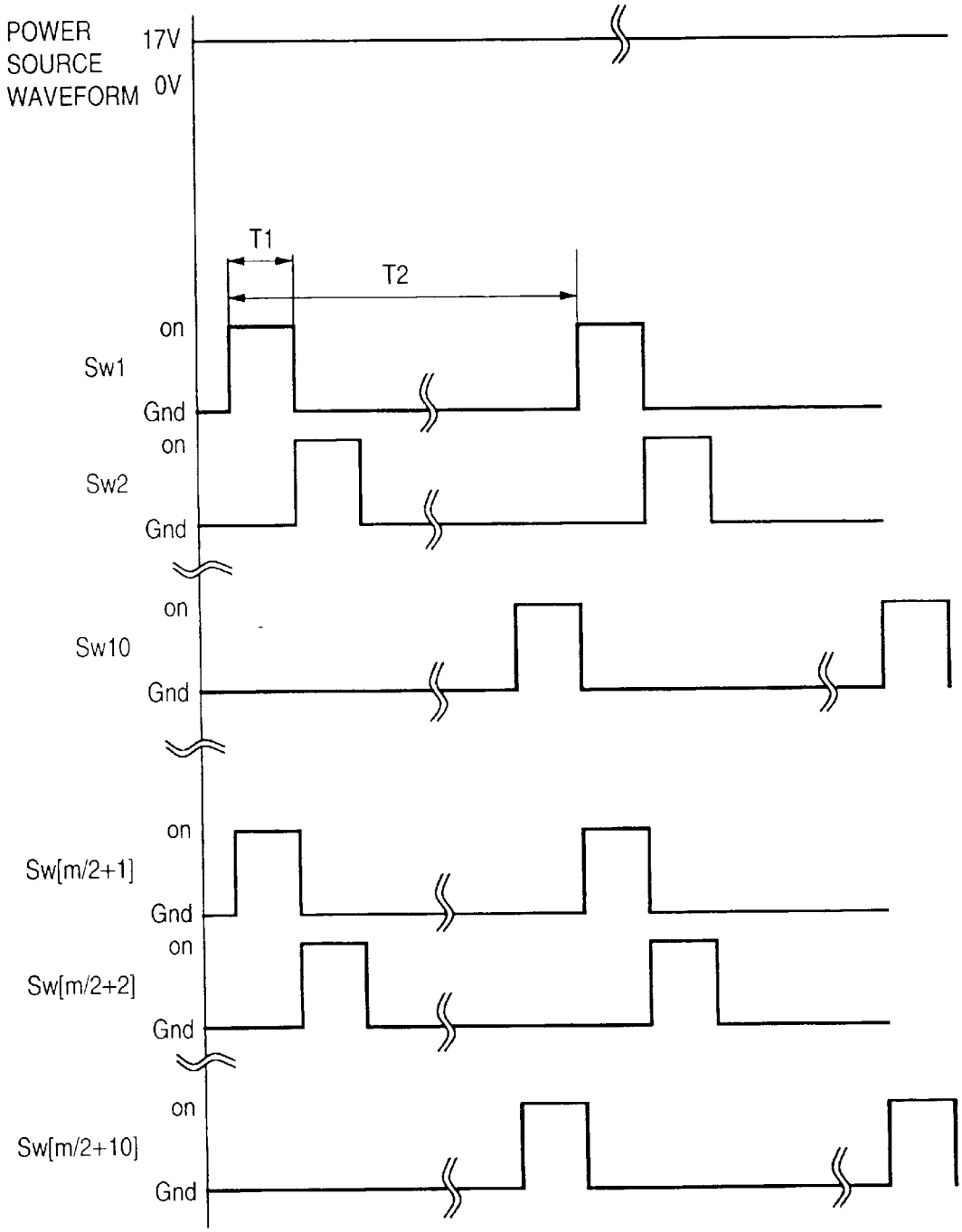
FIG. 14 is a waveform chart showing the output waveform of a power source and line selection unit according to the fifth embodiment of the present invention.

FIG. 14 is a timing chart showing the switching method of the line selection unit. The uppermost waveform is the output voltage waveform of a power source 403. As shown in FIG. 14, an output from the power source is a DC voltage, which is different from the pulse voltage in the first embodiment. The second and subsequent waveforms represent the switching timings of switches Sw of the line selection unit 402. FIG. 14 shows only switches Sw1 to Sw10 and Sw[m/2+1] to Sw[m/2+10]. The remaining switches Sw are connected to the Gnd side. In FIG. 14, T1 is 1 msec, similar to T1 in the fourth embodiment. First, the switches Sw1 and Sw[m/2+1] are simultaneously turned on, and turned off to the Gnd side after T1. Then, the switches Sw2 and Sw[m/2+2] are simultaneously turned on. This operation is repeated up to the switches Sw10 and Sw[m/2+10]. After that, the operation returns to the switches Sw1 and Sw[m/2+1]. As a result of selecting two lines and scanning every 10 lines, T2 becomes 10 msec, similar to the fourth embodiment.

After pre-driving is performed for a predetermined time, the control unit 404 switches the line selection unit 402 to the next set of Sw11 to Sw20 and Sw[m/2+11] to Sw[m/2+20] for 10-line scanning, and repeats the same driving. Similarly, up to the m/2th and mth lines are driven.

Consequently, changes over time in each surface-conduction type electron-emitting device are reduced to a negligible level for practical use. An image display apparatus manufactured using an electron source having a plurality of surface-conduction type electron-emitting devices can display a high-quality image. The time necessary for pre-driving is calculated from data of one device fabricated under the same conditions. Pre-driving processing is completed within almost 1/20 the time required for pre-driving in units of lines.

As described above, while lines are scanned, the pre-driving voltage is applied to a plurality of surface-conduction type electron-emitting devices using the pre-driving apparatus of the fifth embodiment. This can shorten the pre-driving time and stabilize the characteristics of each device.

Similar to the fourth embodiment, the fifth embodiment can also be applied to such electron source substrate in which a plurality of surface-conduction type electron-emitting devices are connected like a ladder.

[Sixth Embodiment]

A pre-driving apparatus for the surface-conduction type electron-emitting device according to the sixth embodiment will be described with reference to FIG. 15.

Figure 15:
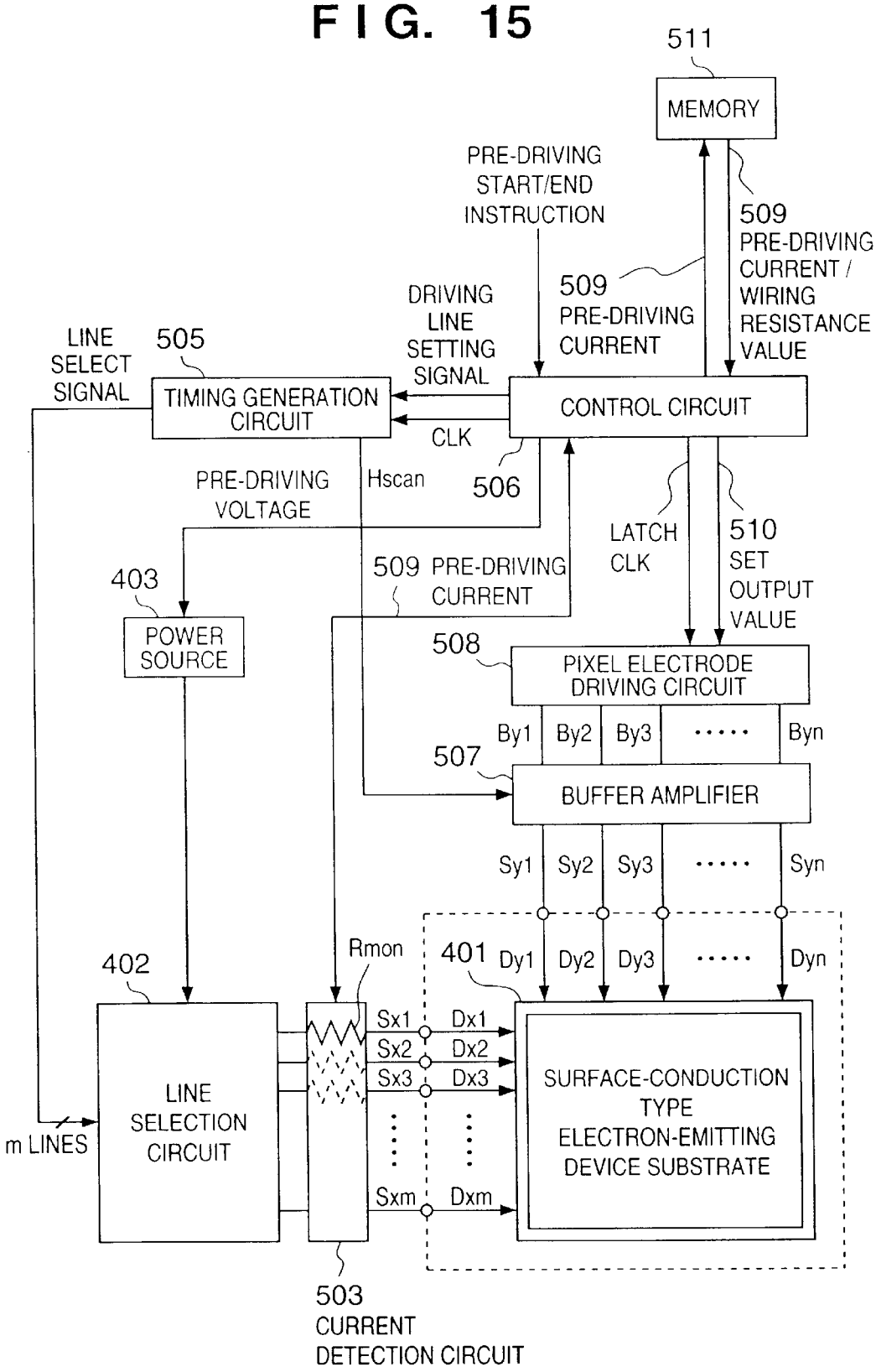
FIG. 15 is a block diagram showing a pre-driving apparatus according to the sixth embodiment of the present invention.

In FIG. 15, reference numeral 401 denotes a surface-conduction type electron-emitting device substrate to be pre-driven. The substrate 401 is identical to that described in the fourth embodiment. Similar to the fourth embodiment, the surface-conduction type electron-emitting device substrate 401 is connected to an evacuation apparatus and electrical wiring. Reference numeral 402 denotes a line selection circuit for selecting a pre-driving line. The line selection circuit 402 simultaneously selects two or more row-direction wirings in accordance with an instruction from a timing generation circuit 505, and applies the voltage of a power source 403 to the selected row-direction wirings. Reference numeral 503 denotes a current detection circuit for individually monitoring in units of rows a current flowing through a selected row upon applying the voltage to the selected row-direction wiring. The current detection circuit 503 is made up of detection resistances Rmon, sample-and-hold amplifiers for sampling and holding a voltage generated across each resistance, and measurement amplifiers for measuring a voltage generated across each resistance. Using these components, the current detection circuit 503 detects a current If flowing from the power source 403 to a selected line, and outputs the current If as a pre-driving current value 509 to a control circuit 506. The resistance value of the detection resistance Rmon is set small enough to prevent influence on an application voltage to the surface-conduction type electron-emitting device by a voltage drop caused by flowing the device current If. The power source 403 generates a voltage to be applied to the row-direction wiring of the electron source in accordance with an instruction value from the control circuit 506.

Reference numeral 507 denotes a buffer amplifier circuit for driving column-direction wiring terminals Dy1 to Dyn of the surface-conduction type electron-emitting device substrate 401 at a timing synchronized with a control clock signal Hscan from the timing generation circuit 505. An input value to the buffer amplifier, i.e., a voltage amplitude value for driving the terminals Dy1 to Dyn is determined by a pixel electrode driving circuit 508.

In the sixth embodiment, the control circuit 506 starts pre-driving upon reception of a pre-driving start instruction, and sequentially corrects the driving voltage distribution of devices in the column direction in accordance with changes in pre-driving current 509, as will be described in detail later. That is, the control circuit 506 uses wiring resistance value data stored in a memory 511 and an output from the current detection circuit 503 to calculate a voltage amount for compensating for each device. The control circuit 506 sets the calculated value as a set output value 510 in the pixel electrode driving circuit 508. The pixel electrode driving circuit 508 generates a driving voltage in accordance with the set output value 510. The voltage is applied to the column-direction electrode of a device via the buffer amplifier 507. Then, a voltage distribution generated by device currents and column-direction wiring resistances on respective devices is corrected to always apply a predetermined voltage to the devices. Data of the pixel electrode driving circuit 508 is sequentially updated in accordance with changes in pre-driving current, thereby correcting the voltage distribution until the end of pre-driving. The control circuit 506 monitors changes in pre-driving current from the pre-driving current value 509, and the line selection circuit 402 selects row-direction wirings to be simultaneously driven by the power source 403. This operation will also be described in detail below. The control circuit 506 transmits a driving line setting signal to the timing circuit 505 to set row-direction wirings to be driven. The timing circuit 505 sets, by a line select signal, lines to be connected between m row-direction wirings and the power source 403. The power source 403 drives the surface-conduction type electron-emitting device substrate 401. The memory 511 stores a pre-driving current value and wiring resistance value for calculating the driving voltage value distribution of devices in the column direction that changes in accordance with changes in pre-driving current. If necessary, the pre-driving current value and wiring resistance value are referred to.

The line selection circuit 402 is identical to that described in the fourth embodiment, and a description thereof will be omitted.

Figure 16:
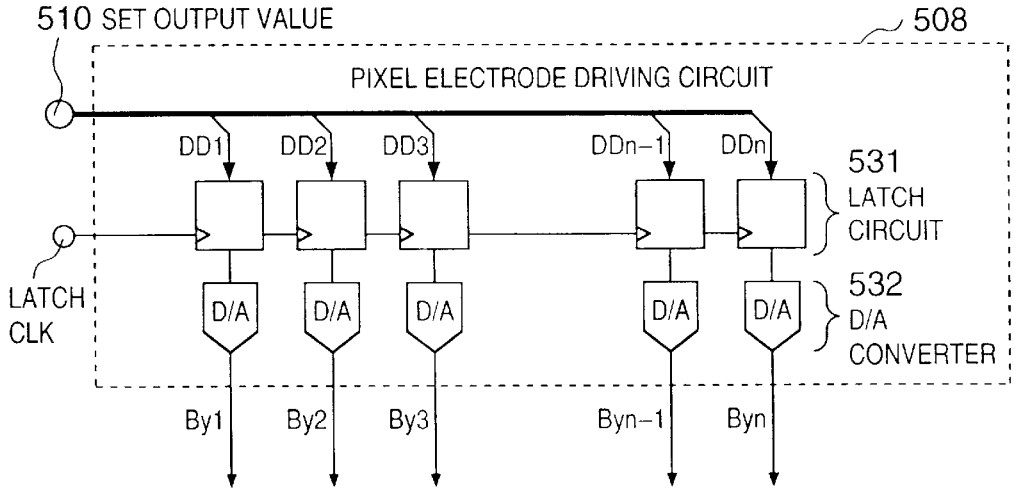
FIG. 16 is a circuit diagram showing the arrangement of a pixel electrode driving circuit in the apparatus of FIG. 15.

FIG. 16 is a circuit diagram showing the arrangement of the pixel electrode driving circuit 508.

The pixel electrode driving circuit 508 is made up of n latch circuits 531 and n D/A converters 532, and generates a driving signal for driving n column-direction wirings of the surface-conduction type electron-emitting device substrate 401 (FIG. 15). The control circuit 506 (FIG. 15) sequentially updates driving voltage values By1 to Byn for driving the respective column-direction wirings on the basis of pre-driving current values in accordance with the following procedures. The control circuit 506 transfers digital output data corresponding to the driving voltage amounts to the D/A converters 532 of the pixel electrode driving circuit 508. The D/A converters 532 convert the received data into analog values, and transfer them to the latch circuits 531. Upon completion of a series of operations (measurement of the pre-driving current→calculation of output data→transfer of data to the latch circuit), the control circuit 506 applies a latch clock to all the latch circuits 531 in order to update output data of the D/A converters 532, and updates the data in synchronism with the latch clock.

The procedures of pre-driving the surface-conduction type electron-emitting device substrate 401 using the apparatus of the sixth embodiment will be explained with reference to FIGS. 15, 17, and 18. Pre-driving is performed such that a set pre-driving voltage Vpre is applied to all the devices for a predetermined time.

A pre-driving flow will be explained.

If the control circuit 506 receives a pre-driving start instruction, it controls the timing generation circuit 505 and power source 403 in order to perform electrification processing in units of rows.

The control circuit 506 sets the set value 510 so as to set the column-direction wiring terminals Dy1 to Dyn to the ground potential, and sequentially applies pulses (pulse width of 1 msec and pulse height of 16 V) of the pre-driving voltage Vpre to the row-direction wiring terminals Dx1 to Dxm. Then, the pulse voltage is sequentially applied to the surface-conduction type electron-emitting device substrate 401 in units of rows to start pre-driving in units of lines. Similar to the fifth embodiment, pre-driving is done while 10 lines are scanned in units of two lines in order to shorten the time, as will be described later.

A method according to the sixth embodiment will be described. This method is adopted to correct variations in device characteristics arising from the distance from the feeding terminal when electrification processing is done in units of lines. In simultaneously driving the two row-direction wiring terminals Dx1 and Dx241, the sixth embodiment pays attention to one of two row-direction wirings, and exemplifies a case in which n devices on the line of the row-direction wiring terminal Dx1 are pre-driven.

Attention is paid to a surface-conduction type electron-emitting device group on the first row (Dx1 line) to which the pre-driving voltage is applied. A model including the wiring resistances of respective devices represents a surface-conduction type electron-emitting device group 541. A state in which this device group is pre-driven will be explained with reference to FIG. 17. In FIG. 17, reference symbols F1 to Fn denote surface-conduction type electron-emitting devices on the row-direction wiring terminal Dx1; r1 to rn, wiring resistances at respective portions on the row-direction wiring Dx1; and Ry, a wiring resistance from the feeding terminal of each of the wirings Dy1 to Dyn to a corresponding surface-conduction type electron-emitting device. Since the row-direction wiring is generally designed to be formed with a constant line width, thickness, and material, r1 to rn are considered to be almost equal except for variations in the manufacture. Since respective wirings are designed uniform, they are considered to have the same Ry. Although the equivalent resistance value of each surface-conduction type electron-emitting device changes (decreases) before and after pre-driving, the equivalent resistance of the device is much higher than the value Ry. Even if two lines are simultaneously driven, like the sixth embodiment, the voltage drop amount across Ry is small to a negligible degree. The equivalent resistance values of the surface-conduction type electron-emitting devices F1 to Fn are designed higher than r1 to rn.

To pre-drive the surface-conduction type electron-emitting device group 541, the control unit 506 controls the line selection unit 402 via the timing generation circuit 505 to connect the power source 403 for outputting the pre-driving voltage Vpre and the current detection unit 503 to the row-direction wiring terminal Dx1. Accordingly, the terminal Dx1 is driven by the pre-driving voltage Vpre.

The terminals Dy1 to Dyn as other electrode terminals of devices on the Dx1 line are driven by the buffer amplifier 507. The buffer amplifier 507 operates to sink pre-driving currents i1 to in from the devices F1 to Fn, and its output voltage amplitude is determined by the pixel electrode driving circuit 508.

To explain a method of setting the output of the pixel electrode driving circuit 508, a driving voltage distribution to devices in pre-driving will be explained.

Figure 18:
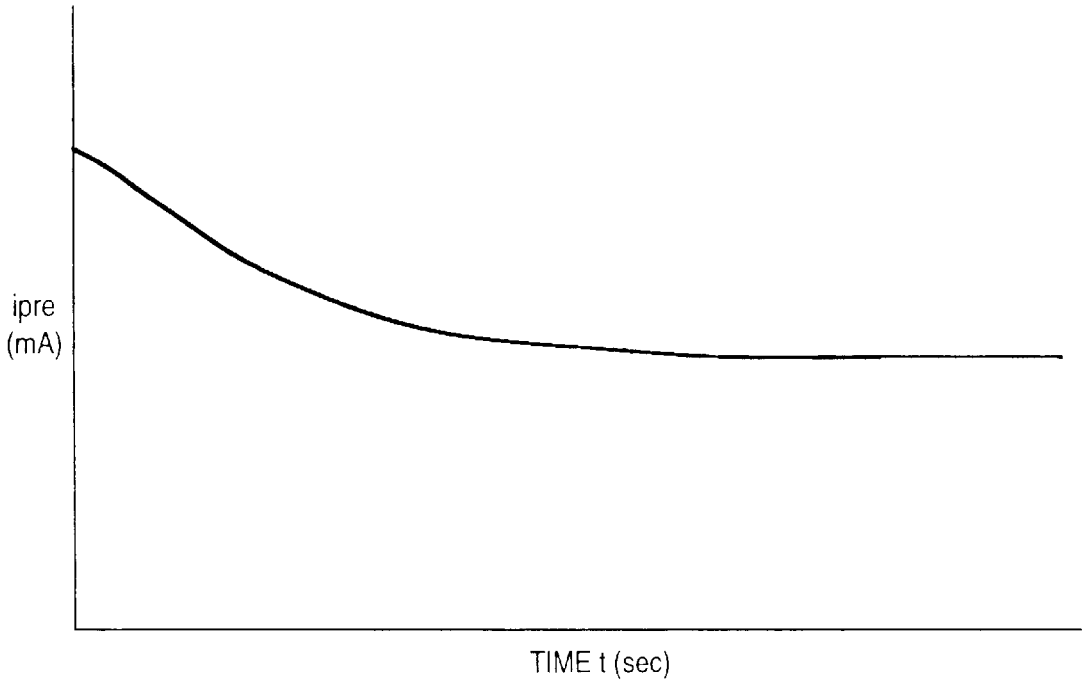
FIG. 18 is a graph showing the distribution of a voltage applied to the two terminals of an electron-emitting device at the start and end of pre-driving.

In pre-driving, the electrical characteristic of the device changes as shown in FIG. 18. The device current maximizes at the start of pre-driving, and decreases with the progress of electrification. At this time, the terminal voltages of devices on the row wiring Dx1 are monitored to find that potentials Gy1 to Gyn change owing to the wiring resistances r1 to rn. The voltage change decreases with changes in pre-driving current ipre, and maximizes at the start of pre-driving. For example, for a pre-driving current of 2 mA/device, r1 to rn=10 mΩ, and n=1000, the terminal Gyn of the device Fn farthest from the feeding terminal suffers a voltage difference:

$$\Delta V = \tfrac{1}{2} \times 1000 \times 1001 \times 2\ \text{mA} \times 10\ \text{m}\Omega \approx 5\ V$$

To prevent this, the pixel electrode driving circuit 508 generates a voltage distribution identical to this voltage difference distribution, and drives the terminals Dy1 to Dyn by outputs Sy1 to Syn of the buffer amplifier 507 so as to cancel the voltage distribution generated on respective devices.

More specifically, the control circuit 506 calculates a voltage drop distribution generated at the terminals Gy1 to Gyn by currents flowing through the devices F1 to Fn and the wiring resistances r1 to rn along with changes in pre-driving current. The control circuit 506 sets the D/A converter output values of the pixel electrode driving circuit 508, thereby reproducing the voltage drop distribution at output By1 to Byn. Assuming that pre-driving of the devices F1 to Fn substantially uniformly progresses, the device currents i1 to in flowing through these devices are almost equal, and the current values can be given using a current amount I detected by the current detection unit 503:

$$iave = i1 = i2 = \ldots = in = I/n$$

At this time, the voltages of a voltage drop distribution generated at the terminals Gy1 to Gyn by currents flowing through the devices F1 to Fn and the wiring resistances r1 to rn, i.e., the voltages By1 to Byn to be output to the output terminals of the pixel electrode driving circuit 508 are calculated using the wiring resistance values r1 to rn and iave:

$$By1 = -r1 \times n \times iave$$

$$By2 = -r2 \times (n-1) \times iave + By1$$

$$\vdots$$

$$Byn = -rn \times iave + Byn-1 + Byn-2 + \ldots + By1 \qquad (11)$$

The control circuit 506 measures changing pre-driving currents, calculates the output voltages By1 to Byn from equation (11), and transfers digital output data to the latch circuits 531 of the pixel electrode driving circuit 508. Upon completion of a series of operations (measurement of the current→calculation of output data→transfer of data to the latch circuit), the control circuit 506 applies a latch clock to all the latch circuits 531 in order to update output D/A data, and updates the data in synchronism with the latch clock. The pixel electrode driving circuit 508 generates a voltage distribution identical to the voltage distribution generated at the terminal Gy1 to Gyn of the devices F1 to Fn. As a result, voltages applied between the terminals of the devices F1 to Fn can be made uniform regardless of the device number.

Figure 19A:
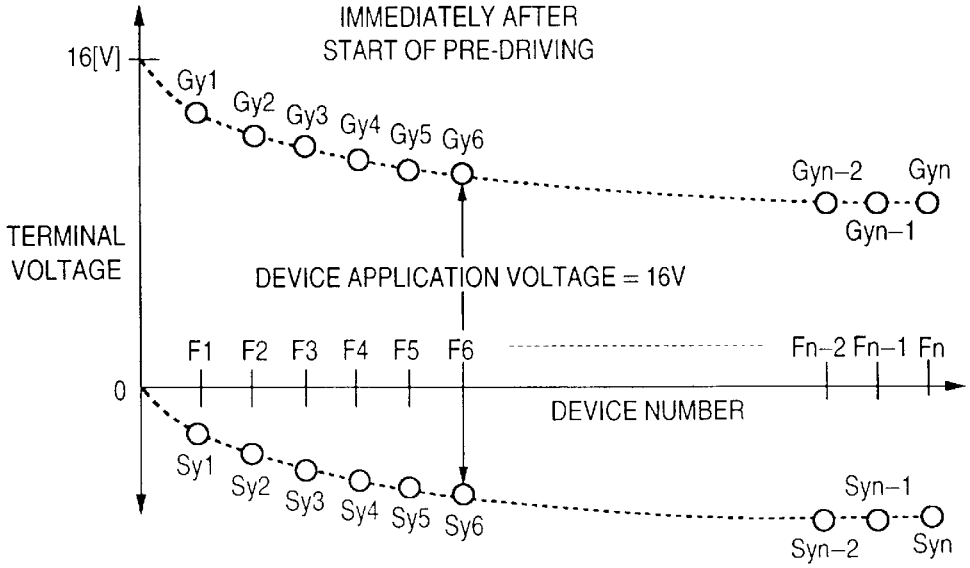
FIGS. 19A and 19B are graphs each showing changes in electrical characteristic of the electron-emitting device by pre-driving.
Figure 19B:
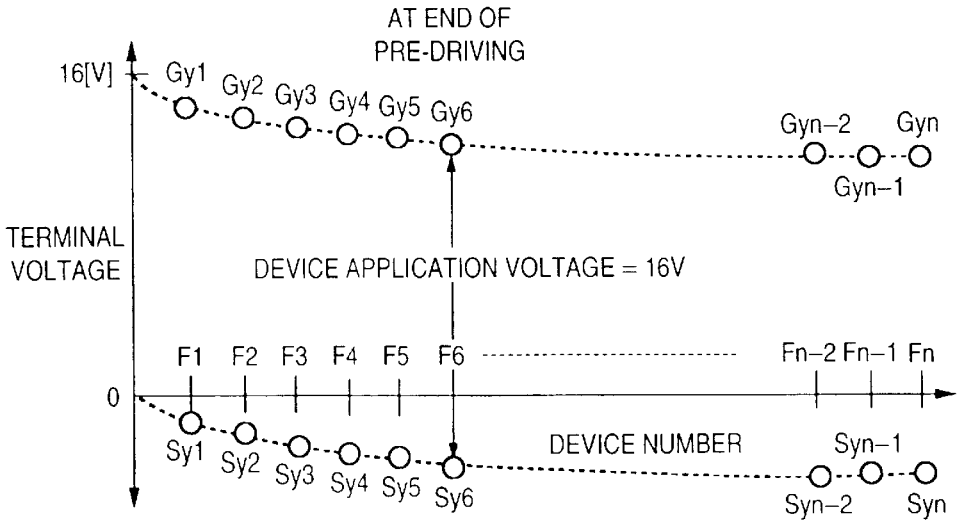

FIGS. 19A and 19B show voltage distributions applied across the devices F1 to Fn at the start and end of pre-driving. FIG. 19A shows a voltage distribution immediately after the start of pre-driving. The abscissa represents device numbers F1 to Fn, which indicate device positions. The ordinate represents terminal voltages at the two terminals of each device. As described above, currents flowing through respective devices are about 2 mA immediately after the start of pre-driving. While the pre-driving voltage Vpre=16 V is applied from the power source 403 to the terminals Gy1 to Gyn of the respective devices, the currents decrease owing to voltage drops by wiring resistances. At this time, by setting the set current value of the pixel electrode driving circuit 508 to 2 mA, the distribution at the outputs By1 to Byn of the pixel electrode driving circuit 508 and the distribution at the outputs Sy1 to Syn of the buffer 507 can be made identical to the distribution at the terminals Gy1 to Gyn. Thus, a predetermined application voltage up to 16 V is applied to the respective devices to advance pre-driving.

FIG. 19B shows a voltage distribution at the end of pre-driving. At the end of pre-driving, currents flowing through respective devices are smaller than those at the start of pre-driving. The pre-driving voltage Vpre=16 V applied to the terminals Gy1 to Gyn of the devices by the power source 403 increases. Since the pre-driving current decreases, the set current value of the pixel electrode driving circuit 508 also decreases to decrease the outputs By1 to Byn of the pixel electrode driving circuit 508 and the outputs Sy1 to Syn of the buffer 507. Accordingly, a predetermined application voltage (substantially 16 V) is applied to the respective devices to complete pre-driving.

More specifically, if the pre-driving current changes, the distribution of voltages applied to devices always changes owing to the wiring resistance. In this case, a voltage distribution amount is calculated and set as the set output value of the pixel electrode driving circuit 508 to sequentially update the outputs By1 to Byn of the pixel electrode driving circuit 508. Hence, all the devices are pre-driven at a predetermined voltage from the start to end of pre-driving. The time necessary for pre-driving is calculated from data of one device fabricated under the same conditions, and pre-driving is completed within a driving time of 1 min for each device.

Devices on the row wiring Dx1 are pre-driven in the above description, and devices on another line can also be similarly pre-driven. In the sixth embodiment, a plurality of pre-driving lines are simultaneously pre-driven while pre-driving lines are sequentially switched. Since the sixth embodiment simultaneously pre-drives two lines, selection of simultaneous pre-driving lines must be considered. This will be explained.

To end pre-driving processing within a short time, the sixth embodiment performs electrification processing for a plurality of lines at once. The sixth embodiment executes pre-driving processing while simultaneously driving two lines. As described above, in this embodiment, nonuniform device application voltages caused by pre-driving currents and wiring resistances are compensated by applying compensation voltages from the pixel electrode driving circuit 508. In the sixth embodiment, the surface-conduction type electron-emitting device substrate 401 has a simple matrix of devices. In simultaneously driving two lines, the pixel electrode driving circuit 508 is common to the two lines and can only apply the same compensation voltage amount to the driving lines. If the two lines have the same pre-driving characteristic, these characteristics can be compensated by applying the same compensation voltage. However, in practice, the wiring resistance value varies between lines due to manufacturing variations, or the change rate of the pre-driving current varies between lines. Thus, the two driving lines require different application voltage compensation amounts. To cope with the case in which different voltage compensation amounts must be applied to lines to be simultaneously driven, the sixth embodiment sequentially switches lines to be simultaneously driven upon a change in pre-driving current, and drives two lines exhibiting the same change in pre-driving current.

Figure 20:
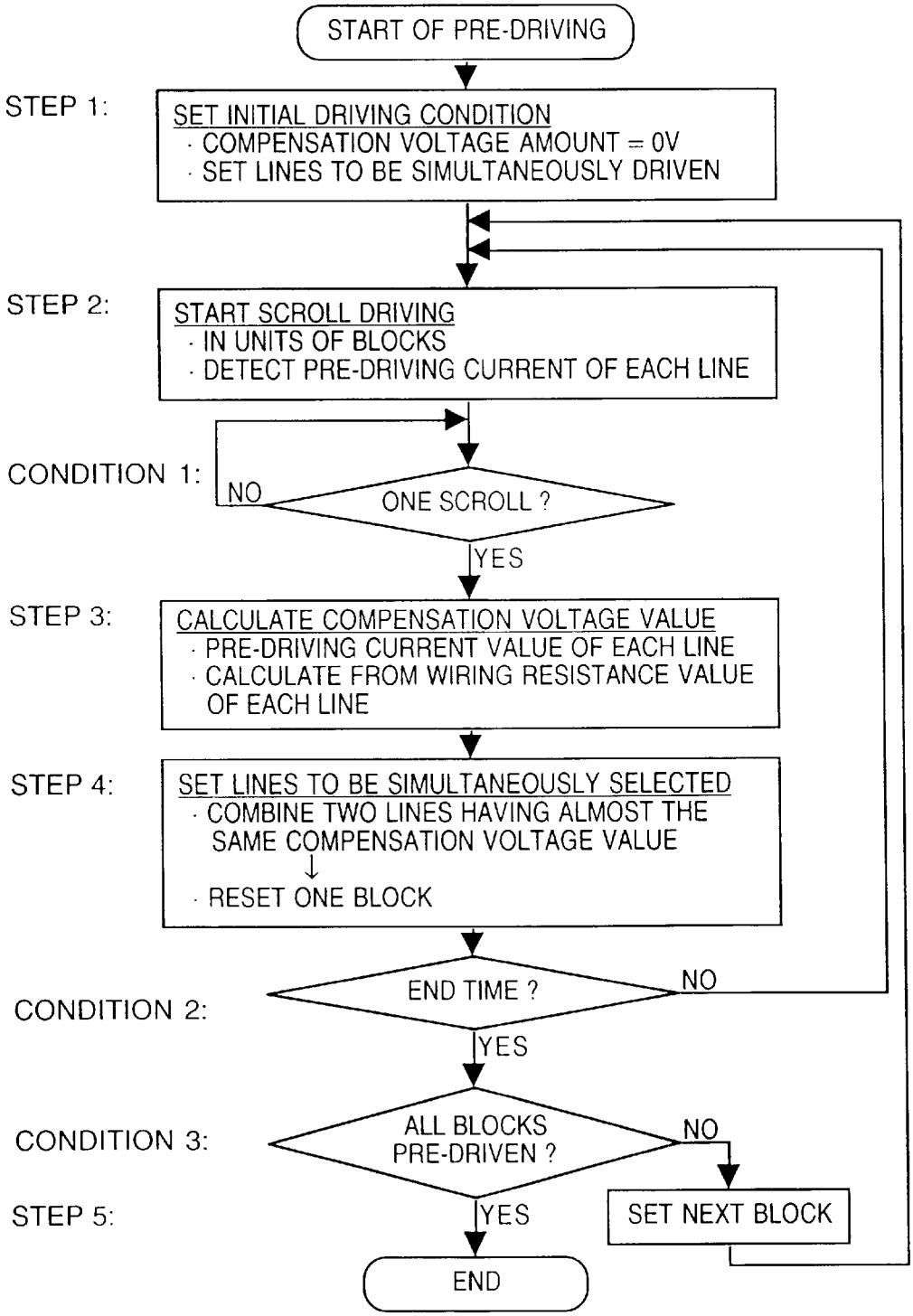
FIG. 20 is a flow chart showing pre-driving according to the sixth embodiment of the present invention.

This will be explained in detail with reference to the flow chart in FIG. 20. For descriptive convenience, the number n of row-direction wirings in the surface-conduction type electron-emitting device substrate 401 is 480.

(Step 1): Setting of Initial Driving Conditions

The control circuit 506 (FIG. 15) starts pre-driving upon reception of a pre-driving start instruction. The control circuit 506 sets initial driving conditions at the start of pre-driving. Two items are set as initial driving conditions: setting of the initial voltage value of an output voltage from the pixel electrode driving circuit 508, and setting of lines to be simultaneously driven.

The initial voltage value of the pixel electrode driving circuit 508 is set as follows. At the start of pre-driving, the pre-driving current maximizes, but its current value is unknown. Therefore, all the compensation voltage amounts applied by the pixel electrode driving circuit 508 are set to 0 V. To simultaneously drive two lines and scan 10 lines, 480 row-direction wirings subjected to electrification processing are grouped into 24 blocks as electrification units. Assignment of the 24 blocks is done by "setting of lines to be simultaneously driven". Any lines are not compensated at the start of pre-driving, and can be freely combined in units of two lines. In step 1, lines are combined as follows so as to divisionally apply power on the surface-conduction type electron-emitting device substrate 401 upon application of the pre-driving voltage.

TABLE 2

| |
|---|
| Row-Direction Wirings ch1 and ch241 |
| Row-Direction Wirings ch2 and ch242 |
| . |
| . |
| . |
| Row-Direction Wirings ch240 and ch480 |

(Step 2): Start of Scroll Driving

After driving conditions are set based on the settings in step 1, pre-driving starts from the first block (ch1 to ch10 and ch241 to ch250). Row-direction wirings are driven in units of two lines. Driving lines are selected based on the setting value for lines to be simultaneously driven, and a driving line setting signal is transferred to the timing generation circuit 505 (FIG. 15). The timing generation circuit 505 outputs a line select signal, and the line selection circuit 402 simultaneously drives two lines by the power source 403. At this time, changes in pre-driving current are monitored to calculate a compensation amount for a voltage drop caused by the pre-driving current and row-direction wiring resistance. For this purpose, the current detection circuit 503 detects a current value flowing through each row-direction wiring, and stores the detected current value in the memory 511.

(Condition 1): Detection of Completion of One Scroll

The flow waits for completion of pre-driving processing for one block and current detection on each line.

(Step 3): Calculation of Compensation Voltage Value

A compensation voltage for a voltage drop caused by the pre-driving current and wiring resistance upon changes in pre-driving current is calculated. The compensation voltage value can be calculated by equation (11) from the pre-driving current and wiring resistance of each line. The wiring resistances r1 to rn on each line can be considered to be almost equal. To correct only variations on each line, the wiring resistance value of each line is measured in advance and stored in the memory 511. Even while two lines are simultaneously driven, the pre-driving current is detected for each line by the current detection circuit 503, and the compensation voltage value is calculated for each line in step 2 using the pre-driving current value and row-direction wiring resistance value of each line that are stored in the memory 511.

(Step 4): Setting of Lines to be Simultaneously Driven

Since the compensation voltage value to be applied changes between lines upon changes in pre-driving current, a combination of lines to be simultaneously driven must be updated. In step 4, selection lines to be simultaneously driven are set. Lines to be pre-driven are rearranged from one having a larger compensation voltage value, and lines having similar compensation voltage values are set as lines to be simultaneously selected in units of two lines. In this case, if two adjacent lines are selected, power may concentrate at part of the surface-conduction type electron-emitting device substrate. To avoid this, the first to 480th row-direction wirings are grouped into a block A including the first to 240th lines and a block B including the 241st to 480th lines, and two lines to be simultaneously driven are respectively selected from the blocks A and B.

(Condition 2): Detection of Completion of Pre-Driving for One Block

Whether the driving time of the block reaches the end time is checked. If pre-driving is not completed yet, the flow returns to step 2 to start scroll driving again. A combination of lines to be simultaneously selected and the compensation voltage value from the pixel electrode driving circuit 508 use the values set in steps 3 and 4.

(Condition 3): Detection of Completion of All Blocks

Whether all the blocks have been pre-driven is checked. If all the blocks have not been pre-driven yet, scanning of the next block is set (step 5). Then, the flow returns to step 2 to repetitively pre-drive the next block.

In this way, pre-driving of the surface-conduction type electron-emitting device substrate 401 ends. Since the outputs By1 to Byn of the pixel electrode driving circuit 508 are sequentially updated to compensate for a voltage drop caused by the pre-driving current and wiring resistance, all the devices are uniformly pre-driven at a predetermined voltage from the start to end of pre-driving. Since two lines are simultaneously driven to scan 10 lines, pre-driving processing is completed within almost 1/20 the process time required to drive lines one by one.

In the sixth embodiment, the power source 403 applies a positive output, and the current is supplied from the terminal Dx1 to the terminals Dy1 to Dyn, thereby pre-driving devices. Alternatively, the power source 403 may apply a negative output, and the current may be supplied from the terminals Dy1 to Dyn to the terminal Dx1, thereby pre-driving devices. In this case, the voltage distribution is also inverted, and the buffer amplifier 507 is constituted as a (−1)-time inverting buffer amplifier to raise the current, thereby obtaining the same effects.

In the sixth embodiment, the pixel electrode driving circuit 508 is constituted by the same number of D/A converters as the number n of column-direction wirings of the surface-conduction type electron-emitting device substrate 401. However, since the compensation voltage distribution profile changes gradually, as shown in FIGS. 19A and 19B, the number of D/A converters may be decreased, and voltage values to be applied to the decreased number of column-direction wiring terminals may be defined by resistance division to define the voltage. This can reduce the cost.

If the number n of devices increases in the column wiring direction, a series of operations (measurement of the device current→calculation of output data→data transfer) may take a long time. This time can be shortened by parallel-processing respective devices, or using a look-up table (LUT) for generating a compensation voltage value from the current value, the wiring resistance value, and the position on the column-direction wiring.

The compensation voltage value need not always be updated every scroll, unlike the sixth embodiment, and may be appropriately updated in accordance with the change rate of the pre-driving current.

As described above, the pre-driving apparatus of the sixth embodiment can make the electron-emitting characteristics of all the devices more uniform than in the fourth and fifth embodiments. This electron source substrate can be used to realize a high-quality image display apparatus almost free from variations in luminance or density.

[Seventh Embodiment]

A pre-driving apparatus for the surface-conduction type electron-emitting device according to the seventh embodiment will be described with reference to FIG. 21.

Figure 21:
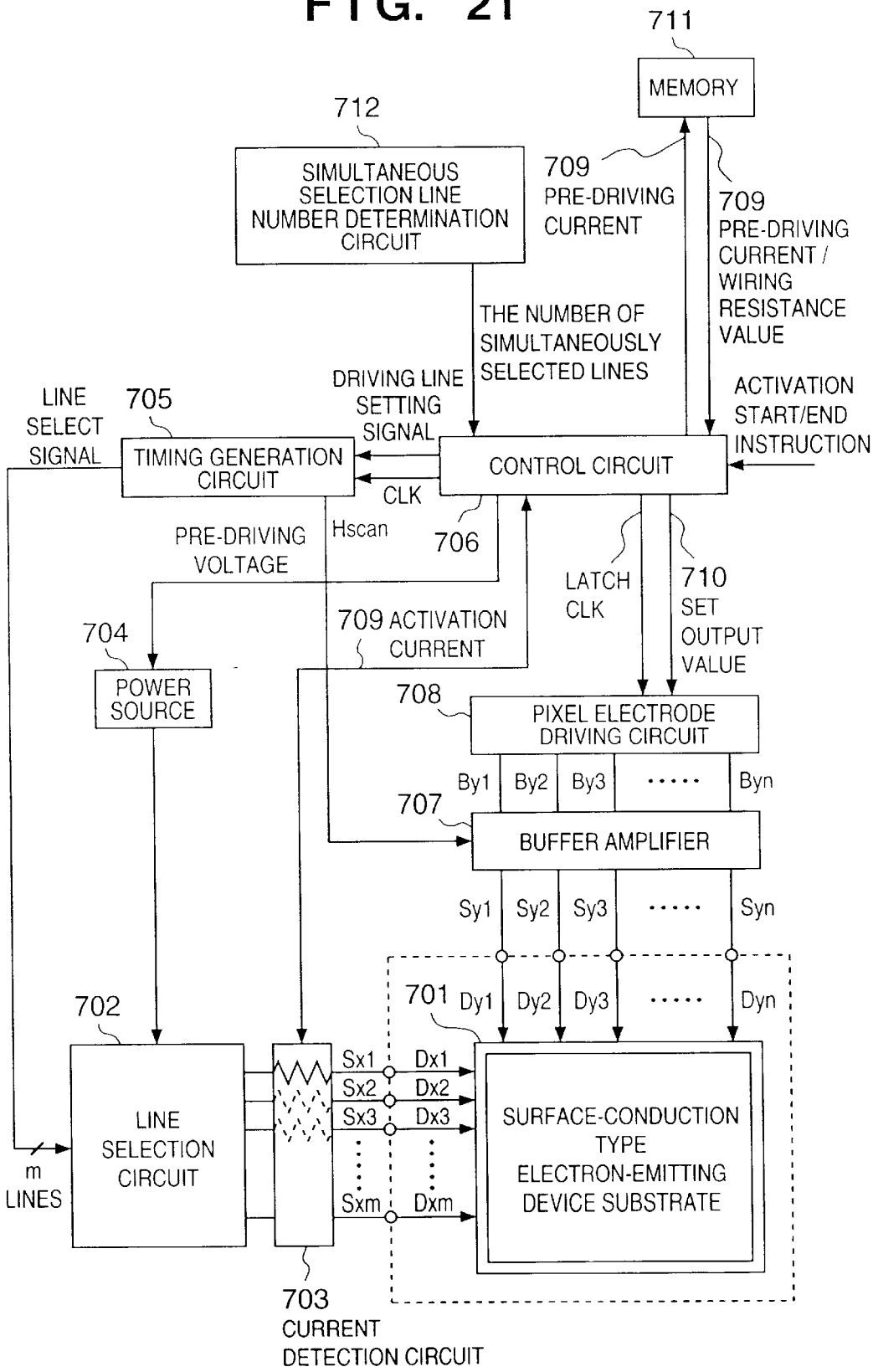
FIG. 21 is a block diagram showing a pre-driving apparatus according to the seventh embodiment of the present invention.

In FIG. 21, a surface-conduction type electron-emitting device substrate 701 is identical to the substrate 401 in FIG. 11. The operation of the whole apparatus is the same as in the fourth embodiment, and a description thereof will be omitted. The seventh embodiment adopts a different selection method of selecting lines to be simultaneously driven. This method realizes a shorter electrification time, and will be described below.

In the seventh embodiment, the number of lines to be simultaneously driven is not fixed but is sequentially changed from the start to end of pre-driving. To realize this, the pre-driving apparatus comprises a selection line count determination circuit 712.

By increasing the number of lines to be simultaneously selected in pre-driving, the electrification time can be shortened. However, the number of lines to be simultaneously selected cannot be excessively increased under the following limitations.

1. Influence of Voltage Drop on Wiring Resistance Ry

Figure 17:
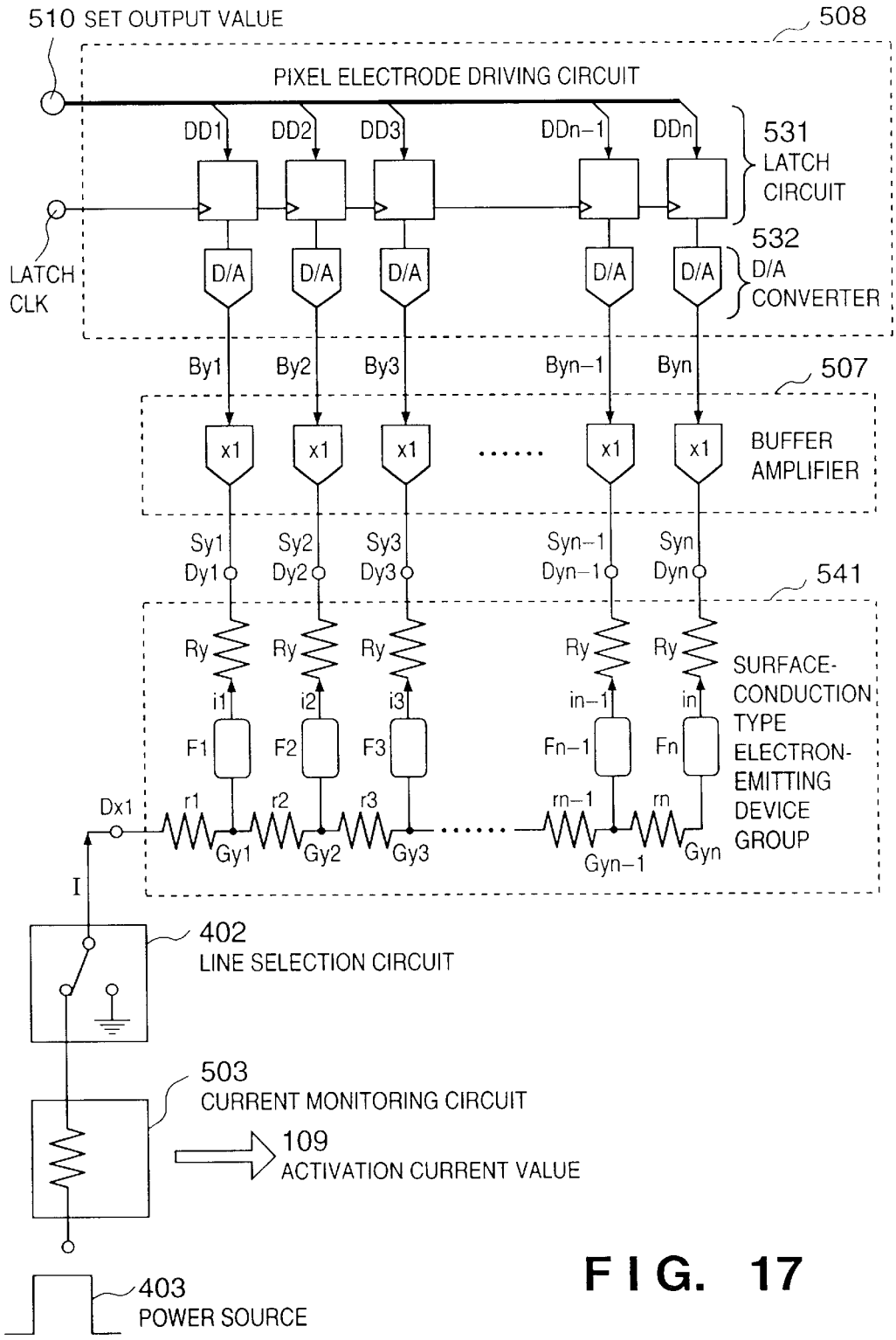
FIG. 17 is a circuit diagram for explaining the pre-driving state of a matrix type electron source.

In the above embodiments, the influence of the wiring resistance Ry in the equivalent circuit of FIG. 17 is considered to be small, and is ignored. However, as the number of lines to be simultaneously driven increases, the influence of a voltage drop across Ry cannot be ignored, and the voltage drop compensation effect is impaired.

2. Problem of Application Power to Surface-Conduction Emission Type Electron-Emitting Device Substrate In simultaneously driving a plurality of lines, a power is applied in a large amount to the surface-conduction type electron-emitting device substrate. In many cases, the surface-conduction type electron-emitting device substrate is made of a material such as glass having low thermal conductivity. If an excessively large amount of power is applied, the surface-conduction type electron-emitting device substrate may be thermally destructed.

Considering these limitations, the simultaneous selection line count determination circuit 712 determines an optimal simultaneous selection line count in accordance with changes in pre-driving current.

In the seventh embodiment, the simultaneous selection line count determination circuit 712 changes the simultaneous selection line count between the maximum of four lines and the minimum of two lines on the basis of the application power because the limitation on power application is more severe.

Figure 22:
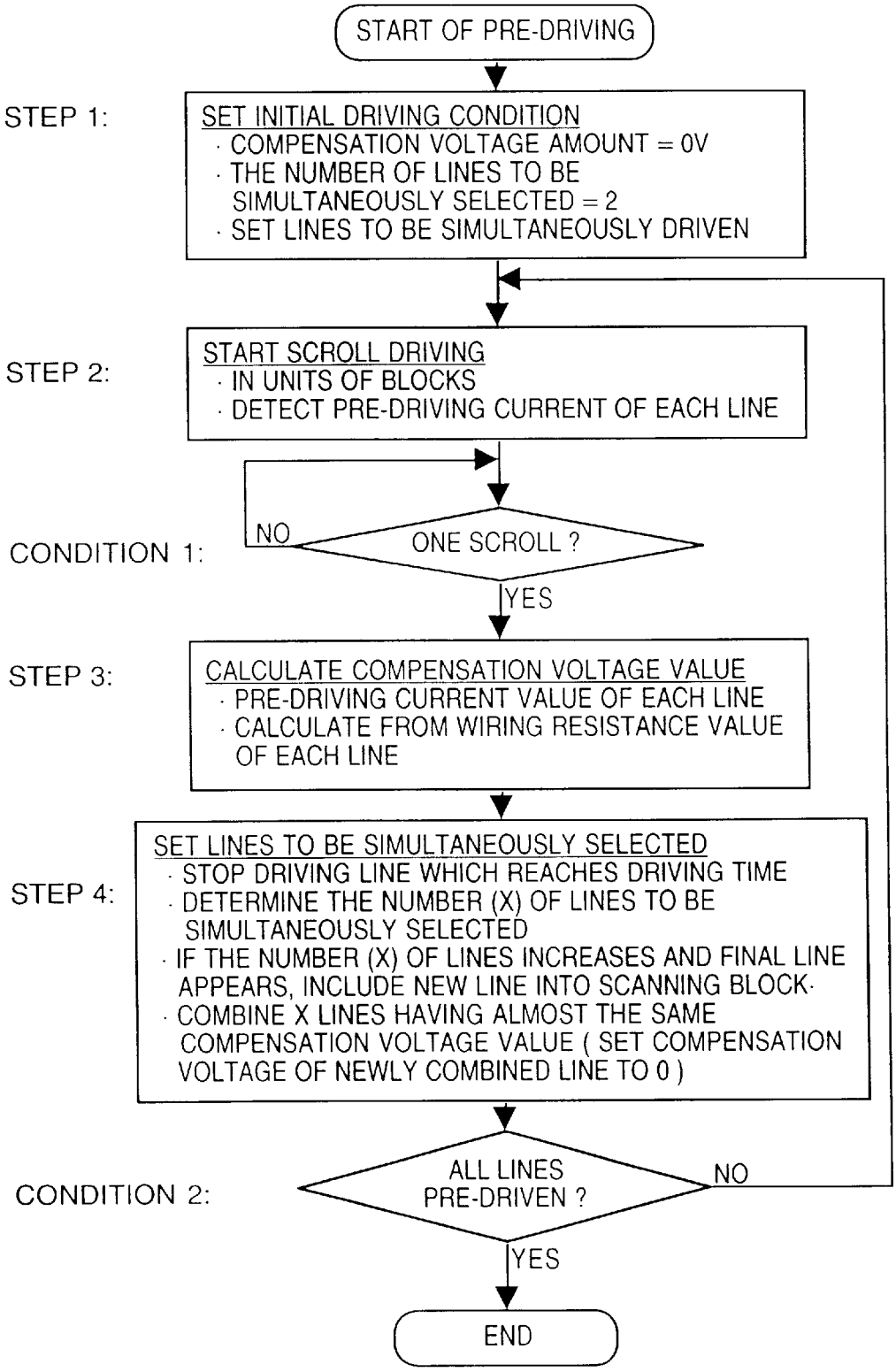
FIG. 22 is a flow chart showing pre-driving according to the seventh embodiment of the present invention.

This will be explained in detail with reference to the flow chart in FIG. 22. For descriptive convenience, the number n of row-direction wirings in the surface-conduction type electron-emitting device substrate 701 is 480.

(Step 1): Setting of Initial Driving Conditions

A control circuit 706 starts pre-driving upon reception of a pre-driving start instruction. The control circuit 706 sets initial driving conditions at the start of pre-driving. Two items are set as initial driving conditions: setting of the initial voltage value of an output voltage from a pixel electrode driving circuit 708, and setting of lines to be simultaneously driven.

The initial voltage value of the pixel electrode driving circuit 708 is set as follows. At the start of pre-driving, the pre-driving current maximizes, but its current value is unknown. Therefore, all the compensation voltage amounts applied by the pixel electrode driving circuit 708 are set to 0 V. To simultaneously drive two lines and scan 10 lines, 480 row-direction wirings subjected to electrification processing are grouped in electrification units of 24 blocks. Assignment of the 24 blocks is done by "setting of lines to be simultaneously driven". Any lines are not compensated at the start of pre-driving, and can be freely combined in units of two lines. In step 1, lines are combined as follows so as to divisionally apply power to surface-conduction type electron-emitting devices on the substrate 701 upon application of the pre-driving voltage.

TABLE 3

| |
|---|
| Row-Direction Wirings ch1 and ch241 |
| Row-Direction Wirings ch2 and ch242 |
| . |
| . |
| . |
| Row-Direction Wirings ch240 and ch480 |

(Step 2): Start of Scroll Driving

After driving conditions are set based on the settings in step 1, pre-driving starts. Row-direction wirings are driven in units of row-direction wirings determined by the simultaneous selection line count determination circuit 712. Driving lines are selected based on the setting value for lines to be simultaneously driven, and a driving line setting signal is transferred to a timing generation circuit 705. The timing generation circuit 705 outputs a line select signal, and a line selection circuit 702 simultaneously drives two lines by a power source 704. At this time, changes in pre-driving current are monitored to calculate a compensation amount for a voltage drop caused by the pre-driving current and row-direction wiring resistance. For this purpose, a current detection circuit 703 detects a current value flowing through each row-direction wiring, and stores the detected current value in a memory 711.

(Condition 1): Detection of Completion of One Scroll

The flow waits for completion of pre-driving processing for all the blocks and current detection on each line.

(Step 3): Calculation of Compensation Voltage Value

A compensation voltage for a voltage drop caused by the pre-driving current and wiring resistance upon changes in pre-driving current is calculated. The compensation voltage value can be calculated by equation (11) from the pre-driving current and wiring resistance of each line. Wiring resistances r1 to rN on each line can be considered to be almost equal. To correct only variations on each line, the wiring resistance value of each line is measured in advance and stored in the memory 711. Even while a plurality of lines are simultaneously driven, the pre-driving current is detected for each line by the current detection circuit 703, and the compensation voltage value is calculated for each line in step 2 using the pre-driving current value and row-direction wiring resistance value of each line that are stored in the memory 711.

(Step 4): Setting of Lines to be Simultaneously Driven

Since the compensation voltage value to be applied changes between lines upon changes in pre-driving current, a combination of lines to be simultaneously selected must be updated. In step 4, lines to be simultaneously driven are set. Since lines which reach the pre-driving time are not pre-driven, these lines are not selected. The simultaneous selection line count determination circuit 712 determines the simultaneously driving lines (X lines) between two lines and four lines on the basis of the panel application power amount. Lines to be pre-driven are rearranged in descending order of compensation voltage values calculated in step 2, and lines having similar compensation voltage values are set as lines to be simultaneously selected in units of X lines.

Since the device current decreases in pre-driving processing, as described above, the count X gradually increases. For a large count X, new lines are included in a single block in accordance with the large line count. For the last line, another line is included. In this case, the compensation voltage for a newly included line is initialized to 0 V.

(Condition 2): Detection of Completion of Pre-Driving for All Lines

If the pre-driving time of all the lines reaches a target value, pre-driving is completed. If pre-driving is not completed yet, the flow returns to step 2 to start scroll driving again. A combination of lines to be simultaneously selected and the compensation voltage value from the pixel electrode driving circuit 708 use the values set in steps 3 and 4.

In this manner, pre-driving of the surface-conduction type electron-emitting device substrate 701 is completed. Since outputs By1 to Byn of the pixel electrode driving circuit 708 are sequentially updated to compensate for a voltage drop caused by the pre-driving current and wiring resistance, all the devices are uniformly pre-driven at a predetermined voltage from the start to end of pre-driving. Since a plurality of lines are simultaneously driven to scan 10 lines as one block, pre-driving processing is completed within almost 1/30 the process time required to drive lines one by one.

In the seventh embodiment, the number of lines to be simultaneously driven is changed between two lines and four lines, but may be more greatly changed under the above-described limitations.

[Eighth Embodiment]

A pre-driving apparatus for the surface-conduction type electron-emitting device according to the eighth embodiment of the present invention will be described with reference to FIG. 23.

Figure 23:
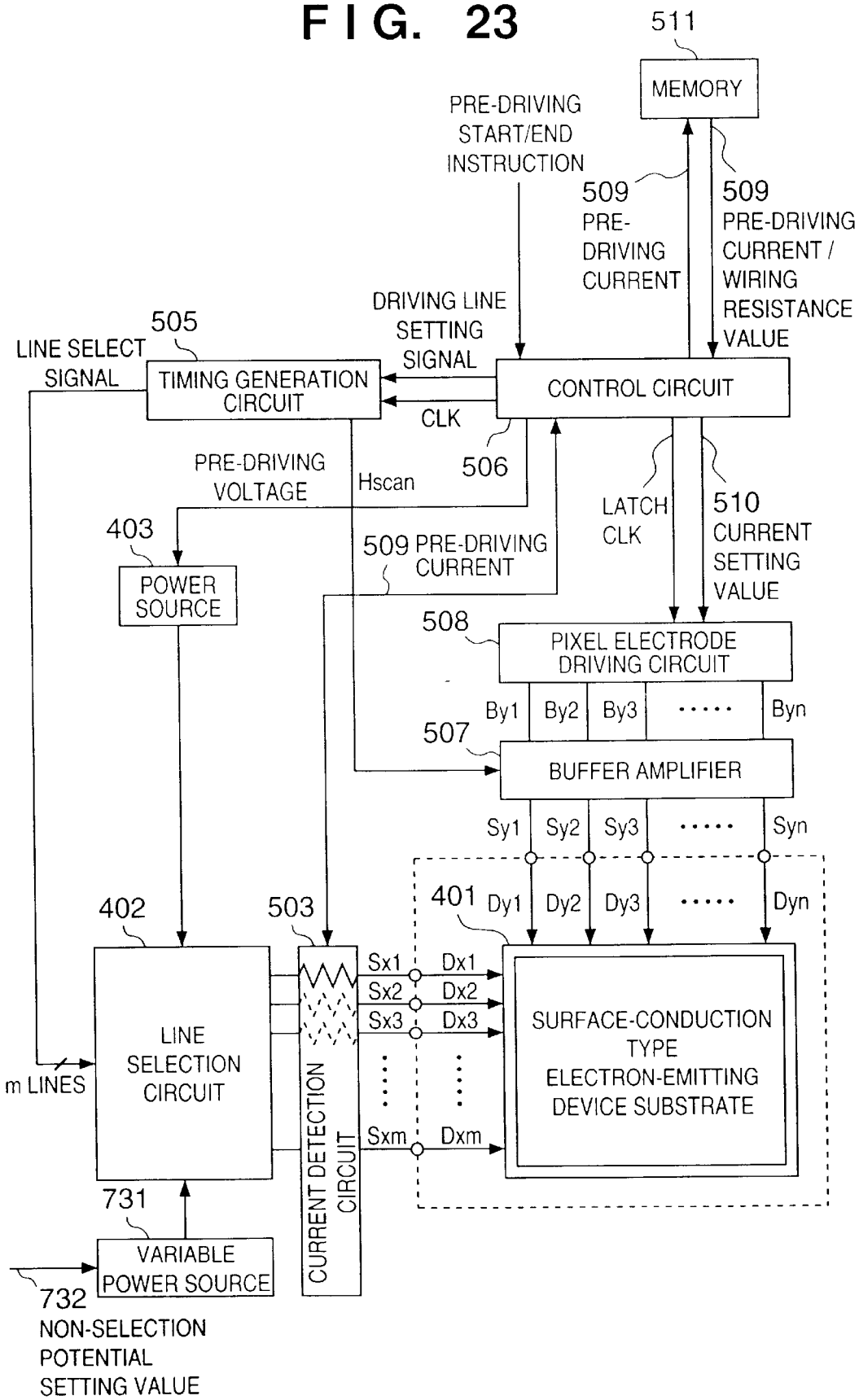
FIG. 23 is a block diagram showing a pre-driving apparatus according to the eighth embodiment of the present invention.

Also in FIG. 23, a surface-conduction type electron-emitting device substrate 401 is identical to the substrate 401 in FIG. 11. The operation of the whole apparatus, pre-driving procedures, and the like are almost the same as in the sixth embodiment, and a description thereof will be omitted.

The eighth embodiment adopts a different driving method by a line selection circuit 402 of the surface-conduction type electron-emitting device substrate 401. This method will be described.

Figure 24:
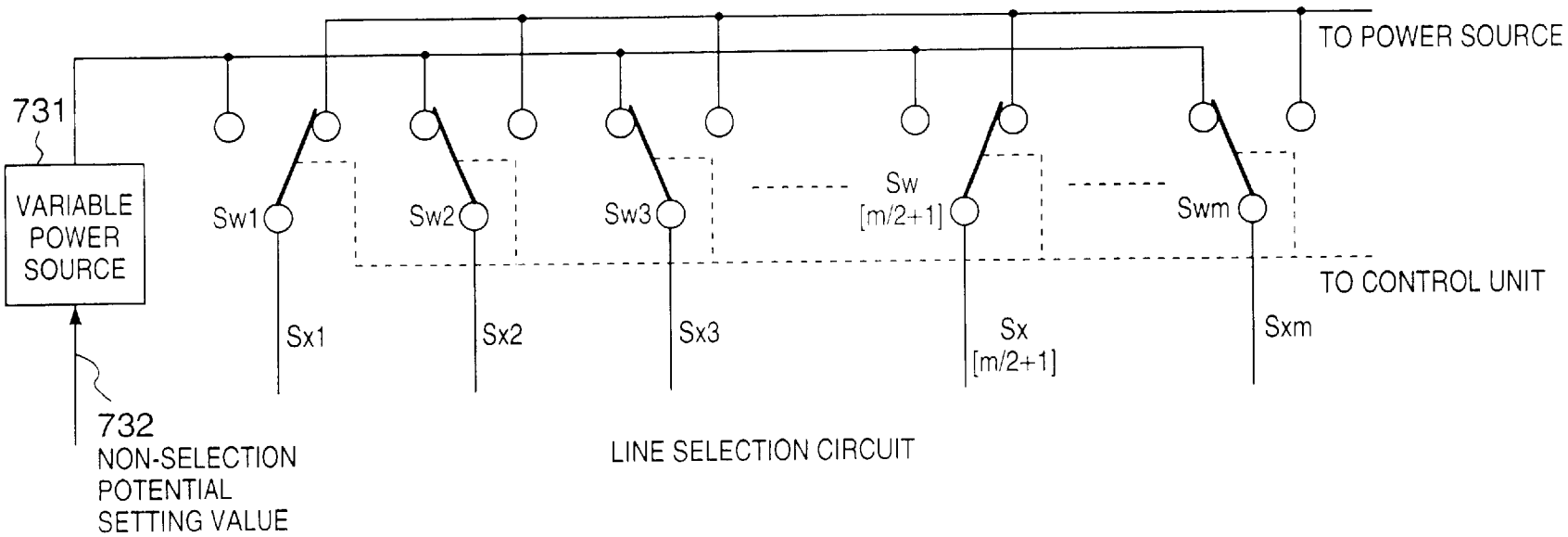
FIG. 24 is a circuit diagram showing in detail a line selection unit in the apparatus of FIG. 23.

The driving method of the line selection circuit 402 will be explained with reference to FIG. 24.

This circuit incorporates m switching elements (Sw1 to Swm). Each switching element selects either one of the output voltage of a power source 403 and the output voltage of a variable power source 731. The m switching elements are electrically connected to terminals Dx1 to Dxm of the surface-conduction type electron-emitting device substrate 401.

Each switching element operates based on a control signal Vscan output from a timing generation circuit 505. In practice, the switching elements can be easily constituted by a combination of switching elements such as FETs or relays. In FIG. 24, the first line Sx1 and (m/2+1)th line Sx[m/2+1] are selected, the output voltage of the power source 403 is applied to the row-direction wirings Dx1 and Dx[m/2+1], and the remaining lines (Sx2 to Sxm) are connected to the output voltage of the variable power source 731. The output voltage of the variable power source 731 is set by a non-selection potential setting value 732 output from a control circuit 506.

In the eighth embodiment, the potentials of unselected lines (Sx2 to Sxm) which do not receive any pre-driving voltage are set not to the ground level but to a non-selection potential. The reason is as follows.

According to the gist of the sixth and seventh embodiments, when pre-driving is performed in units of rows, a voltage drop distribution generated in the column direction on a single row is compensated by applying voltages from column-direction wiring terminals Dy1 to Dyn. Since the surface-conduction type electron-emitting device substrate has a simple matrix arrangement, application voltages from the column-direction wiring terminals Dy1 to Dyn are applied to not only devices on a pre-driven line but also devices on a line not pre-driven. The voltages of the column-direction wiring terminals Dy1 to Dyn are as low as several V at maximum. However, an increase in power consumption is desirably reduced by applying voltages to devices on a line not pre-driven. For this purpose, lines not pre-driven (non-pre-driven lines) are grouped, and the non-selection potential setting value 732 is applied to the grouped lines so as to minimize the absolute values of voltages applied across devices connected to these lines.

The non-selection potential setting value 732 is determined by the control circuit 506 as follows. The difference between maximum and minimum voltages generated at each terminal by the output of a pixel electrode driving circuit 508 is calculated as a voltage drop amount. More specifically, in FIG. 23, the maximum voltage distribution amount at outputs By1 to Byn of the pixel electrode driving circuit 508 is calculated by $$\text{Maximum Voltage Distribution Amount} = \text{Voltage } By1 - \text{Voltage } Byn$$

Thus, the non-selection potential setting value 732 is determined by $$\text{Non-Selection Potential Setting Value } \mathbf{732}\text{: } Voff = \tfrac{1}{2} \times \text{Maximum Voltage Distribution Amount}$$

In the eighth embodiment, as well as the sixth embodiment, the output of the pixel electrode driving circuit 508 can be calculated using a pre-driving current value 509 (I) of a current detection circuit 503 and wiring resistance values r1 to rn≈r:

$$\begin{aligned} By1 &= -r1 \times \sum \{k = 1 \text{ to } n\} ik \\ &\approx -r \times n \times iave \\ &\approx -r \times I \\ &\vdots \\ Byn &= -rn \times in + Byn-1 + Byn-2 + \ldots + By1 \\ &\approx -r \times 1/n \times I + \ldots - r \times (n-1)/n \times I + (-r \times \mathrm{I}) \\ &\approx -1/2 \times r \times (n+1) \times I \end{aligned}$$

Hence, the non-selection potential setting value 732 is calculated by $$\begin{aligned} Voff &= -1/2 \times \text{Maximum Voltage Distribution Amount} \\ &= -1/2\ (\text{Voltage } By1 - \text{Voltage } Byn) \\ &= -1/4 \times r \times (n-1) \times I \end{aligned}$$

When the voltage of an unselected line is set in this manner to perform driving, a voltage:

$$(Voff - By\mathbf{1}) \sim (Voff - Byn)$$

that is, $$-\tfrac{1}{4} \times r \times (n-5) \times I \sim -\tfrac{1}{4} \times r \times (n+3) \times I$$

is applied across the device on the unselected line

If the non-selection potential setting value 732 is the ground level, the voltage (Voff−By1)~(Voff−Byn) across the device on the unselected line is given by $$r \times I \sim \tfrac{1}{2} \times r \times (n+1) \times I$$

By applying the non-selection potential setting value 732 to the unselected line, the absolute value of the voltage applied across the device connected to the unselected line can be substantially halved. In general, n is as large as 1,000 or more, and can be regarded from the above equation to be (n−5)≈(n+3)≈(n+1)≈n.

FIGS. 25A to 25D show driving voltage waveforms applied to each terminal of the surface-conduction type electron-emitting device substrate 801 in pre-driven devices on the Dx1 line.

Figure 25:
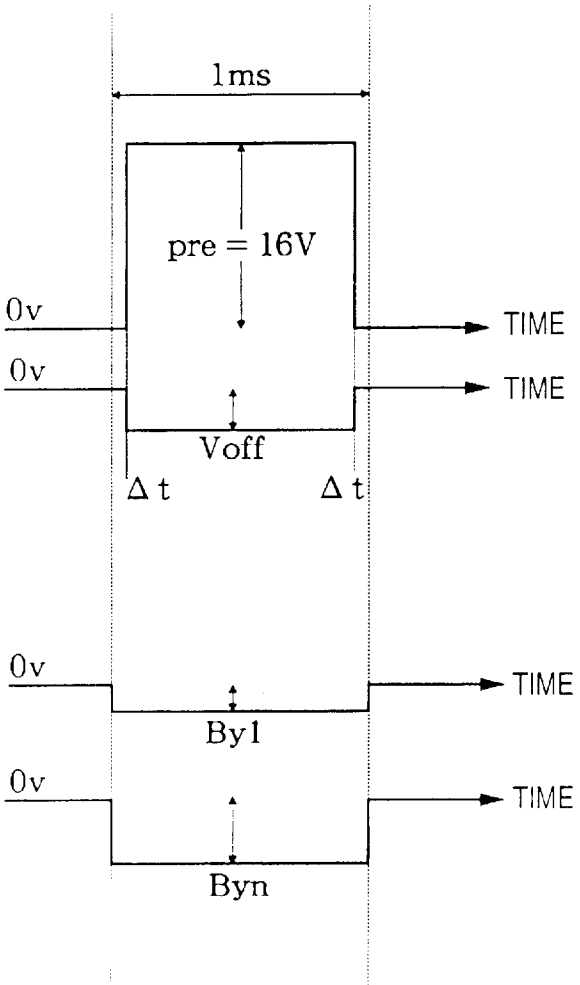
FIGS. 25A to 25D are waveform charts each showing a voltage waveform applied to each column wiring in the apparatus of FIG. 23.

As described above, each device is driven by a pulse having a driving voltage of 16 V and a pulse width of 1 ms. FIG. 25A shows a driving waveform (driving voltage of 16 V and pulse width of 1 msec) to terminals Dx1 and Dx[m/2+1] to be pre-driven. These terminals are driven by the power source 403. FIG. 25B shows a driving waveform to the terminals Dx2 to Dx[m/2] and Dx[m/2+2] to Dxm on unselected lines that are not pre-driven. These terminals are driven by the variable power source 731 set by the non-selection potential setting value 732 (FIG. 24). The non-selection potential setting value 732 is represented by Voff. FIGS. 25C and 25D show driving waveforms to the column-direction terminals of the surface-conduction type electron-emitting device substrate 401. These terminals are driven by a buffer amplifier 507. FIG. 25C shows a driving waveform to the terminal Dy1 exhibiting the minimum voltage drop, and FIG. 25D shows a driving waveform to the terminal Dyn exhibiting the maximum voltage drop.

Even if the detection current changes during pre-driving, the compensation voltage distribution changes to always apply the set voltage Vpre=16 V to each device.

Note that each device is driven by a pulse, as described above. The line selection circuit 402 starts outputting the pulse voltage Δt (Δt is several μsec) after a change in pulse output from the buffer amplifier 507 for generating a voltage distribution. In stopping outputting pulses, the line selection circuit 402 stops outputting them Δt before a change in pulse output from the buffer amplifier 507. This will be explained.

The time difference Δt is set to cope with an output timing delay between channels owing to variations in buffer amplifier output between amplifiers. If the line selection circuit 402 starts outputting the pulse voltage before a change in pulse output from the buffer amplifier 507 for generating a voltage distribution, the output timing may delay between channels. This delay instantaneously generates a time during which a satisfactory driving voltage is applied to only some of devices on a selected line. During this instance, all the devices on the selected line are not driven, and the flowing pre-driving current decreases. However, the buffer amplifier applies a calculated voltage on the assumption that all the devices on the selected line are satisfactorily driven. In this case, a driving voltage higher than the set voltage is applied to the devices to make their characteristics nonuniform.

To prevent this, the line selection circuit 402 starts outputting the pulse voltage Δt after a change in pulse output from the buffer amplifier 507 for generating a voltage distribution. In stopping outputting pulses, the line selection circuit 402 stops outputting them Δt before a change in pulse output from the buffer amplifier 507. Accordingly, the influence of variations in output timing of the buffer amplifier can be avoided.

Voltage application to an unselected line according to the eighth embodiment can reduce power applied to the surface-conduction type electron-emitting device substrate in pre-driving. Note that the offset voltage determination method is not limited to the above one. The offset voltage may be determined to minimize the power value applied to the entire surface-conduction type electron-emitting device substrate.

For example, devices may be driven by adding the offset voltage so as to minimize the absolute values of voltages applied from the column-direction wiring terminals Dy1 to Dyn without applying any voltage to an unselected line.

The applied offset voltage value can be determined as follows. The difference between the maximum and minimum voltages generated at each terminal by the output of the pixel electrode driving circuit 508 is calculated as a voltage drop amount. For example, in FIG. 23, voltage drop amounts at the outputs By1 to Byn of the pixel electrode driving circuit 508 are calculated by $$\text{Voltage Drop Amount} = \text{Voltage } By1 - \text{Voltage } Byn$$

That is, $$\text{Offset Voltage } 732\text{: } Voff = \tfrac{1}{2} \times \text{Voltage Drop Amount}$$

This offset voltage is added as an offset to distribution voltages applied to Dy1 to Dyn. As a result, the absolute values of voltages applied from the column-direction wiring terminals Dy1 to Dyn can be halved in comparison with the seventh embodiment.

[Ninth Embodiment]

A pre-driving apparatus for the surface-conduction type electron-emitting device according to the ninth embodiment of the present invention will be described with reference to FIG. 26.

Figure 26:
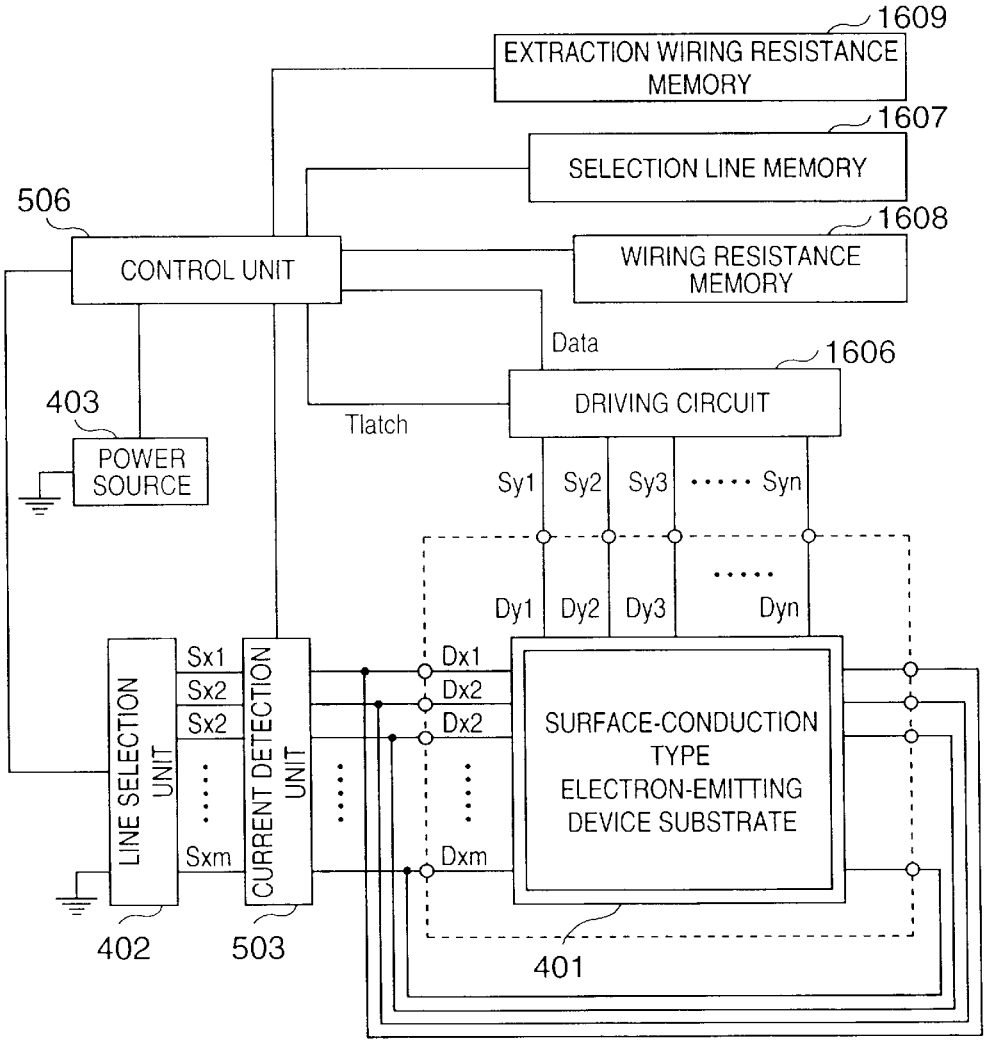
FIG. 26 is a block diagram showing a pre-driving apparatus according to the ninth embodiment of the present invention.

In FIG. 26, reference numeral 401 denotes a surface-conduction type electron-emitting device substrate to be pre-driven. The substrate 401 is identical to that described in the fourth embodiment. Similar to the fourth embodiment, the surface-conduction type electron-emitting device substrate 401 is connected to an evacuation apparatus and electrical wiring. Reference numeral 402 denotes a line selection circuit which has the same arrangement as the above-described one, and selects a pre-driving line. A control unit 506 outputs an instruction while referring to a selection line memory 1607 storing combinations determined based on the design value of the surface-conduction type electron-emitting device substrate, as will be described later. The line selection circuit 402 simultaneously selects two or more row-direction wirings, and the selected row-direction wirings receive the voltage of a power source 403. Reference numeral 503 denotes a current detection circuit whose arrangement and basic operation are the same as the above-described ones. The power source 403 generates, in accordance with an instruction value from the control unit 506, a voltage to be applied to the row-direction wiring of the surface-conduction type electron-emitting device substrate.

Reference numeral 1606 denotes a driving circuit for driving column-direction wiring terminals Dy1 to Dyn of the surface-conduction type electron-emitting device substrate 401 at a timing synchronized with a control clock Tlatch from the control unit 506.

In the ninth embodiment, the control unit 506 starts pre-driving upon reception of a pre-driving start instruction. As will be described in detail below, the control unit 506 sequentially corrects the driving voltage value distribution of devices in the column direction that changes with the progress of pre-driving. That is, the control unit 506 calculates a voltage amount for compensating for each device using wiring resistance value data stored in a wiring resistance memory 1608, extraction wiring resistance value data stored in an extraction wiring memory 1609, and an output from the current detection unit 503. The control unit 506 sets this voltage amount as a set output value in the driving circuit 1606. The driving circuit 1606 generates a driving voltage in accordance with the set output value, and applies the voltage to the column-direction electrode of a device. Thus, a voltage distribution generated by device currents and row-direction wiring resistances on respective devices is corrected to always apply a constant voltage to these devices. Data of the driving circuit 1606 is sequentially updated with the progress of pre-driving, thereby correcting the voltage distribution till the end of pre-driving. The control unit 506 monitors the pre-driving current, and selects row-direction wirings to be simultaneously driven by the power source 403 via the line selection unit 402. This operation will also be described in detail. The control unit 506 transmits a driving line setting signal to the line selection unit 402 to set row-direction wirings to be driven.

Figure 27:
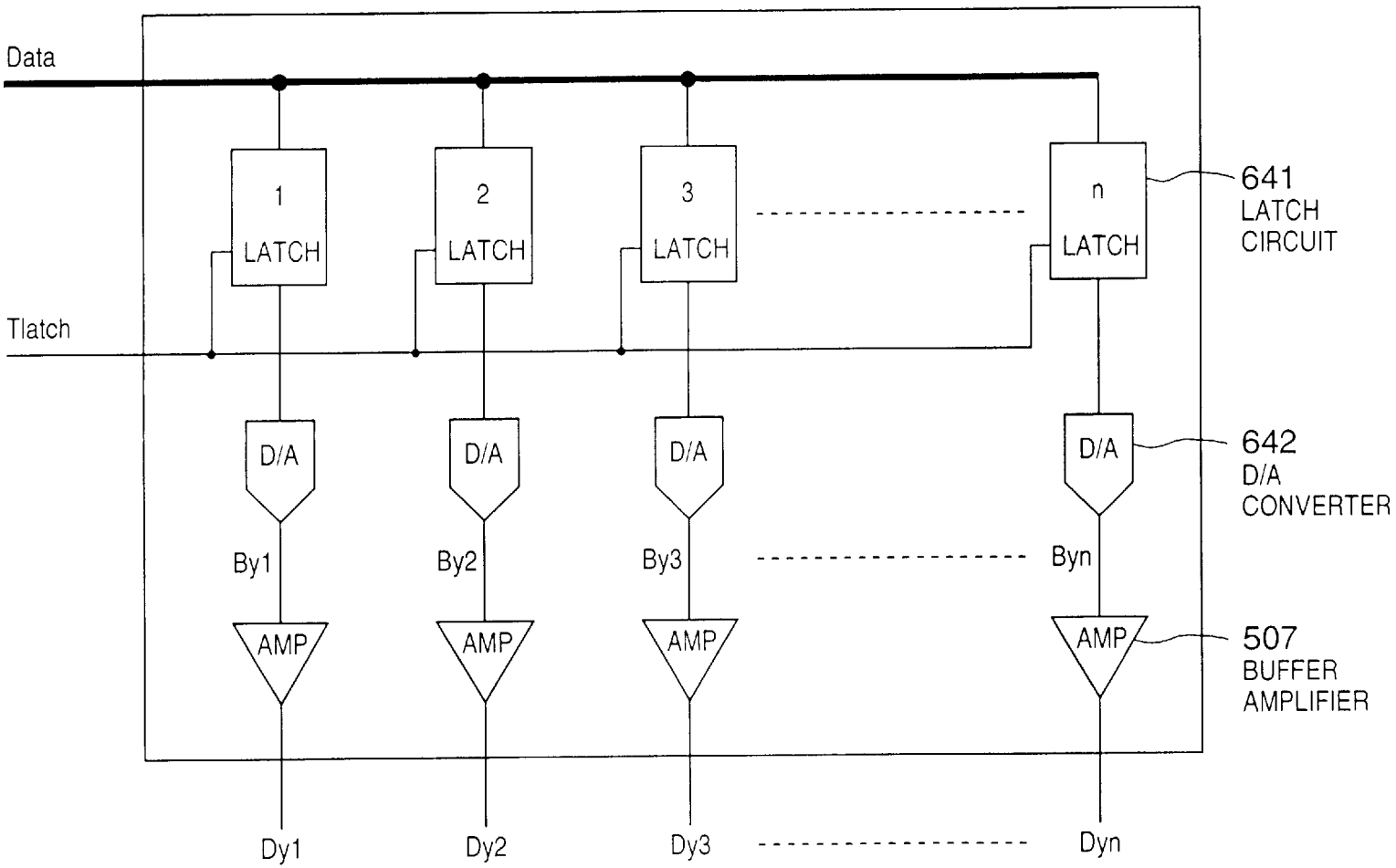
FIG. 27 is a circuit diagram showing in detail a driving circuit in the apparatus of FIG. 26.

FIG. 27 is a circuit diagram showing the arrangement of the driving circuit 1606.

The driving circuit 1606 is comprised of n latch circuits 641, n D/A converters 642, and n buffer amplifiers 507. The driving circuit 1606 generates a driving signal for driving n column-direction wirings on the surface-conduction type electron-emitting device substrate 401. The control unit 506 sequentially updates driving potential values Sy1 to Syn for driving respective column-direction wirings on the basis of the pre-driving current value by the following procedures. The control unit 506 transfers digital output data Data corresponding to the driving voltage amount to the latch circuits 641 of the driving circuit 1606. Upon completion of a series of operations (measurement of the pre-driving current→calculation of output data→data transfer to the latch circuit), the control unit 506 applies a latch clock Tlatch for updating output data of the D/A converters 642 to all the latch circuits 641, and updates the data in synchronism with the latch clock.

A method of determining lines to be simultaneously selected (a pair of lines because two lines are simultaneously pre-driven in the ninth embodiment) in the ninth embodiment will be described. One cause of the difference in voltage drop during pre-driving is variations in extraction wiring resistance. The ninth embodiment relates to a method of reducing the variations.

Figure 28A:
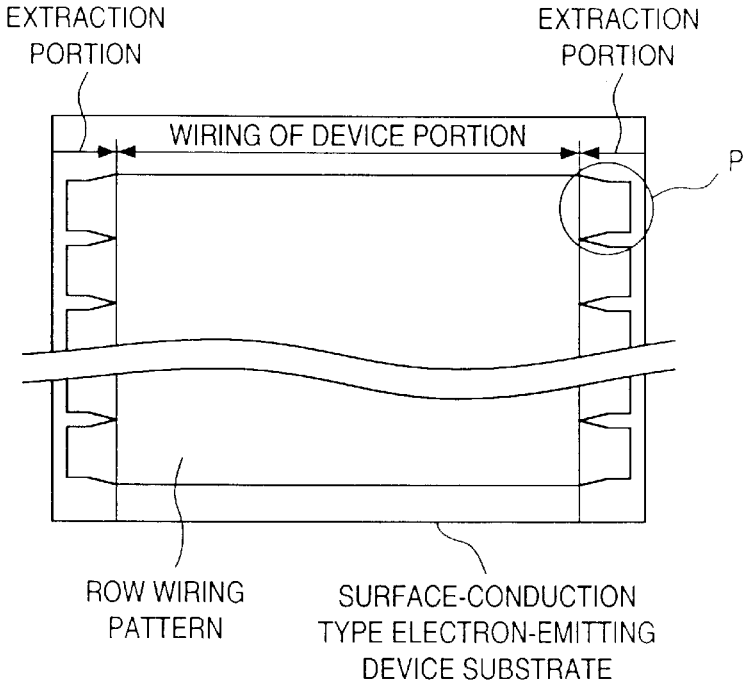
FIGS. 28A and 28B are views showing the wiring pattern state of a device substrate in the apparatus of FIG. 26.
Figure 28B:
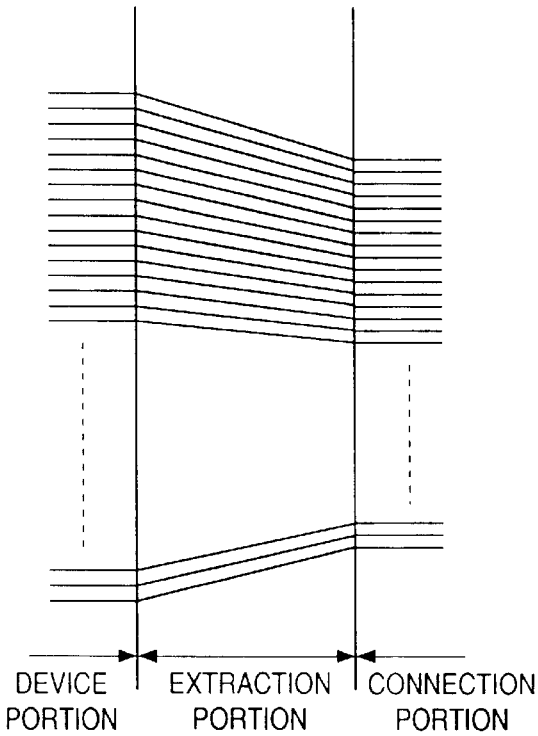
Figures 29A, 29B:
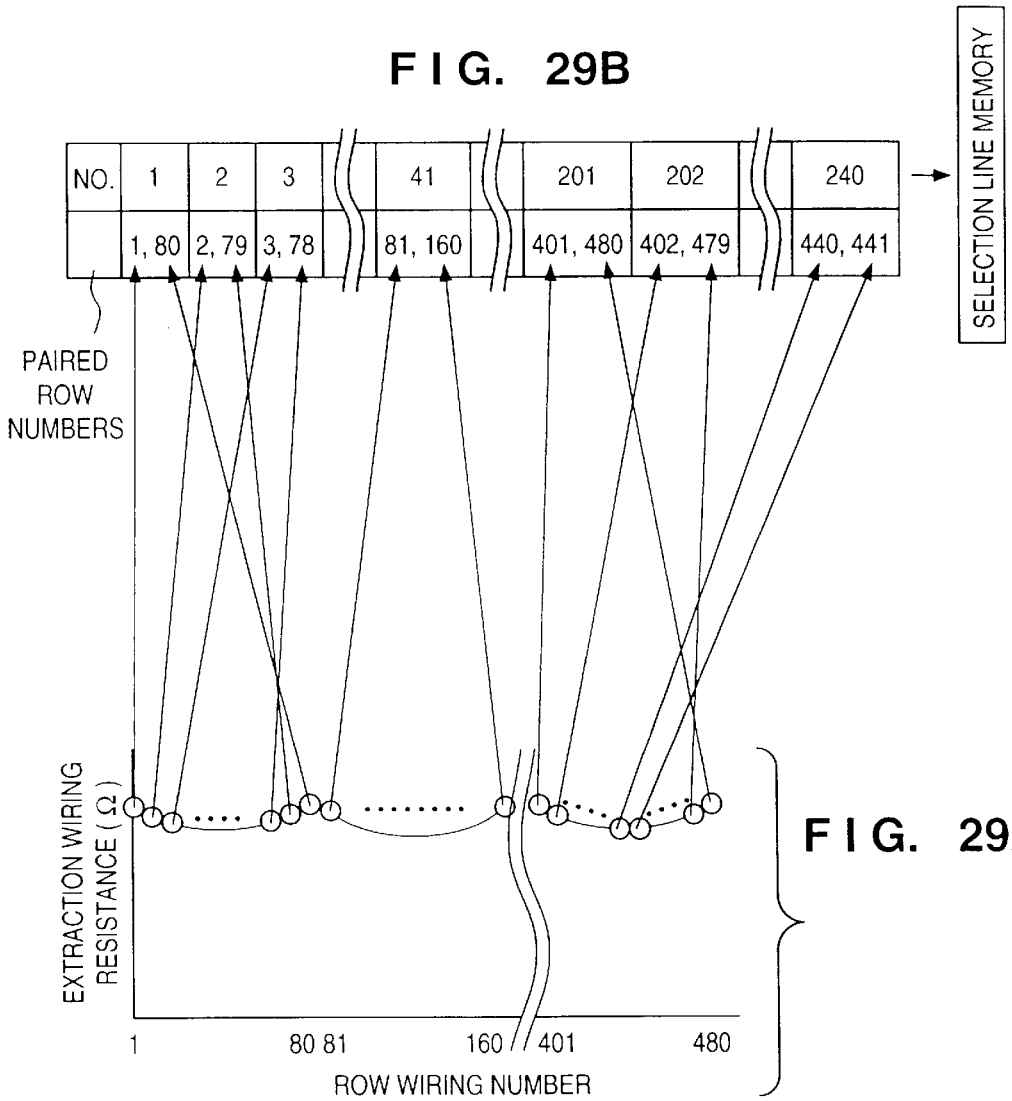
FIGS. 29A and 29B are views for explaining processing of combining lines to be simultaneously selected according to the ninth embodiment.

An example of different extraction wiring resistances between row-direction wirings will be explained with reference to FIGS. 28A and 28B. FIG. 28A schematically shows the outline of the entire row-direction wiring pattern on the surface-conduction type electron-emitting device substrate. This pattern can be roughly divided into a device wiring portion and an extraction wiring portion. The pattern of the extraction portion is narrowed in units of a predetermined number of row-direction wirings, and connected to the connection portion. FIG. 28B shows in detail a P portion as one extraction portion. This pattern is designed to contact-bond a so-called flexible wiring and the like. In general, the width of the flexible wiring which can be contact-bonded to the connection portion shown in FIG. 28B is limited because of the dimensional accuracy of the flexible wiring. The flexible wiring requires dead spaces on its two sides for each width. FIG. 29A shows the resistance of the extraction portion plotted for each row-direction wiring number. In the following description, the number m of row-direction wirings is 480, and the unit of flexible wirings is 80. The extraction wiring resistance repeats every 80 rows, similar to the wiring pattern. The combination numbers 1 to 40 and 41 to 80 are respectively symmetrical in flexible units. The resistance value shown in FIG. 29A can be easily calculated from the wiring pattern as far as the wiring material and wiring film thickness are determined, and can therefore be obtained after the pattern design is determined. Extraction wiring resistances obtained in this manner are stored as Rd1, Rd2, Rd3, . . . , Rd480 in the extraction wiring resistance memory 1609 (FIG. 26). A combination of rows to be simultaneously selected is determined based on the obtained extraction wiring resistances, as shown in FIG. 29B. That is, row-direction wirings having symmetrical wiring patterns are combined to set 240 simultaneous driving row numbers, and these row numbers are stored in the selection line memory.

The procedures of pre-driving the surface-conduction type electron-emitting device substrate 401 using the apparatus of the ninth embodiment will be described. Pre-driving is performed to apply a set pre-driving voltage Vpre to all the devices for a predetermined time.

A pre-driving flow will be explained.

If the control unit 506 (FIG. 26) receives a pre-driving start instruction (externally input by the operator), it controls the line select unit 402 and power source 403 in order to perform electrification processing in units of rows.

The control unit 506 sets the signal value Data so as to set the column-direction wiring terminals Dy1 to Dyn to the ground potential. The control unit 506 sequentially applies the pre-driving voltage to the row-direction wiring terminals Dx1 to Dxm. (For example, the pulse width is 1 msec and the pulse height is 16 V: this voltage will be defined as Vpre). The switching sequence of the line selection unit 402 is performed by scanning using 10 lines as one block, as described in the sixth embodiment. The pulse voltage is sequentially applied to the surface-conduction type electron-emitting device substrate 401 in units of row-direction wirings, and pre-driving starts in units of lines. Two lines are simultaneously pre-driven as a unit on the basis of pairs stored in the selection line memory in order to shorten the time.

The following description is directed to a method used in the ninth embodiment in order to correct variations in device characteristics arising from the distance from the feeding terminal when electrification processing is done in units of lines. In simultaneously driving the two row-direction wiring terminals Dx1 and Dx80, the ninth embodiment pays attention to one of the two row-direction wirings to pre-drive n devices on the line of the row-direction wiring terminal Dx1. When attention is given to a surface-conduction type device group on the first row (Dx1 line) to which the pre-driving voltage is applied, the equivalent circuit operates similarly to the one shown in FIG. 17 except that power is supplied to the surface-conduction type electron-emitting device substrate from the two sides, and thus a description thereof will be omitted.

To pre-drive the surface-conduction type electron-emitting device group 941, the control unit 506 controls the line selection unit 402 to connect the power source 403 for outputting the pre-driving voltage and the current detection unit 503 to the row-direction wiring terminal Dx1. Then, the terminal Dx1 is driven by the pre-driving voltage Vpre.

The terminals Dy1 to Dyn as other electrode terminals of devices on the Dx1 line are driven by the driving circuit 1606. The driving circuit 1606 operates to sink pre-driving currents i1 to in from the devices F1 to Fn.

The driving voltage distribution to respective devices in pre-driving will be described to explain a method of setting an output from the driving circuit 1606.

Figure 30:
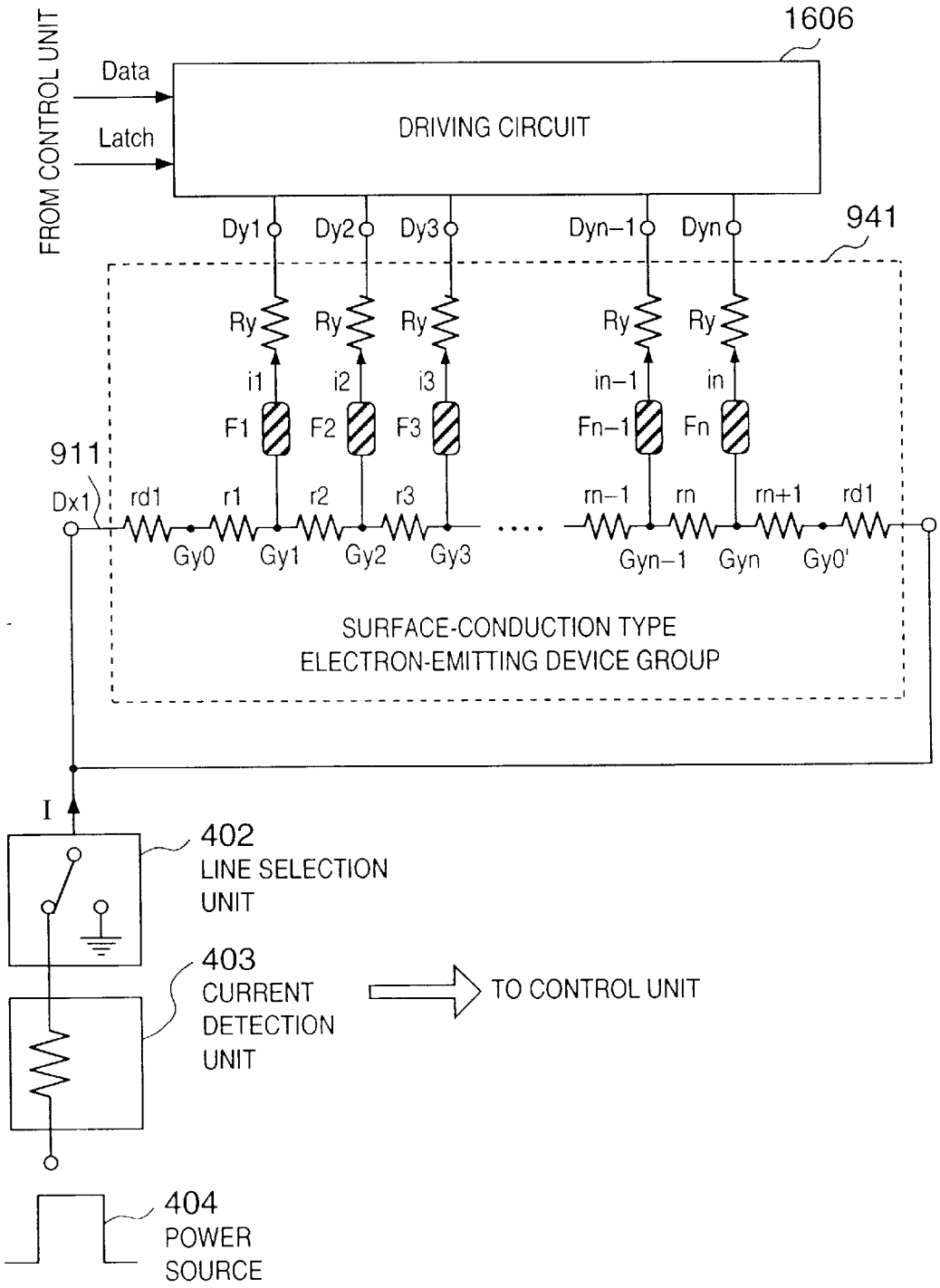
FIG. 30 is an equivalent circuit diagram showing the device substrate in the apparatus of FIG. 26.

In pre-driving, the electrical characteristic of the device changes as shown in FIG. 18. That is, the device current maximizes at the start of pre-driving, and decreases with the progress of electrification. At this time, potentials Gy0 and Gy0' on the row wiring 911 gradually change owing to the extraction wiring resistance rd1. Letting AV1 be the voltage drop amount, and I be the current flowing from the feeding terminal Dx1 to the row wiring 911, as shown in FIG. 30, AV1 is given by $$\Delta V1 = rd1 \times I/2$$

Further, the potential of the device group on the row wiring 911 is monitored to find that the potentials Gy1 to Gyn drop under the influence of the wiring resistances r1 to rn. The voltage drop changes with the progress of pre-driving and minimizes at the end of pre-driving. For example, for a pre-driving current of 2 mA/device, r1 to rn+1=10 mΩ, and n=1000, a voltage drop is $$\Delta V2 = \tfrac{1}{2} \times 500 \times 801 \times 2\ \text{mA} \times 10\ \text{m}\Omega \approx 2.5\ V$$

at the terminal Gyn/2 of the device Fn/2 farthest from the feeding terminal. For rd1=1Ω, ΔV1 is given by $$\Delta V1 = 1\Omega \times 2\ \text{mA} \times 1000/2 = 1\ V$$

The sum of ΔV1 and ΔV2 is a total voltage drop of about 3.5 V.

To prevent this, the driving circuit 1606 generates a voltage distribution identical to this voltage distribution, and drives the terminals Dy1 to Dyn so as to cancel a voltage distribution generated on respective devices.

The control unit 506 calculates a voltage drop distribution generated at the terminals Gy1 to Gyn by a voltage drop at the extraction wiring resistance rd1, currents flowing through the devices F1 to Fn, and the wiring resistances r1 to rn along with the progress of pre-driving. The output value of the D/A converter 642 of the driving circuit 1606 is set to reproduce a voltage drop distribution at the outputs Sy1 to Syn. Assuming that the devices F1 to Fn are substantially uniformly pre-driven, the device currents i1 to in flowing through respective devices are almost equal, and their current values can be given using a current amount I detected by the current detection unit 503:

$$iave=i1=i2=\ldots=in=I/n$$

At this time, the sum of ΔV1 and a voltage drop distribution generated at the terminals Gy1 to Gyn by currents flowing through the devices F1 to Fn and the wiring resistances r1 to rn+1, i.e., the voltages Sy1 to Syn to be output to the output terminals of the driving circuit 1606 are calculated using the wiring resistance values r1 to rn and iave:

$$Sy1=-r1\times n\times iave-\Delta V1$$

$$Sy2=-r2\times(n-1)\times iave+Sy1-\Delta V1$$

.

.

$$Syn/2=-rn/2\times iave+Syn-1+Syn-2+\ldots+Sy1-\Delta V1 \quad (12)$$

Since the wiring resistances r1 to rn are similarly designed and actually have almost the same value, r=R1/1 is effective (R1 is the row-direction wiring resistance value of the first row measured in advance). Equations (12) are generalized into For k<n/2

$$Syk=-\sum_{k=1}^{k} r\times iave\times(n/2-k+1)-\Delta VI$$

For k=n/2 or >n/2

$$-\sum_{k=n}^{k} r\times iave\times(k-n/2)-\Delta VI \quad (13)$$

The control unit 506 measures the pre-driving current which changes with the progress of pre-driving, sequentially calculates the output voltages Sy1 to Syn, and transfers digital output data to the latch circuit 641 of the driving circuit 1606. Upon completion of a series of operations (measurement of the current→calculation of output data→data transfer to the latch unit), the control unit 506 applies a latch clock to all the latch circuits 641 in order to update data, and updates the data in synchronism with the latch clock. The driving circuit 1606 generates a voltage distribution identical to the voltage drop distribution generated at the terminals Gy1 to Gyn of the devices F1 to Fn. Accordingly, voltages applied between the terminals of the devices F1 to Fn can be made uniform regardless of the device number and the progress of pre-driving.

Figure 31A:
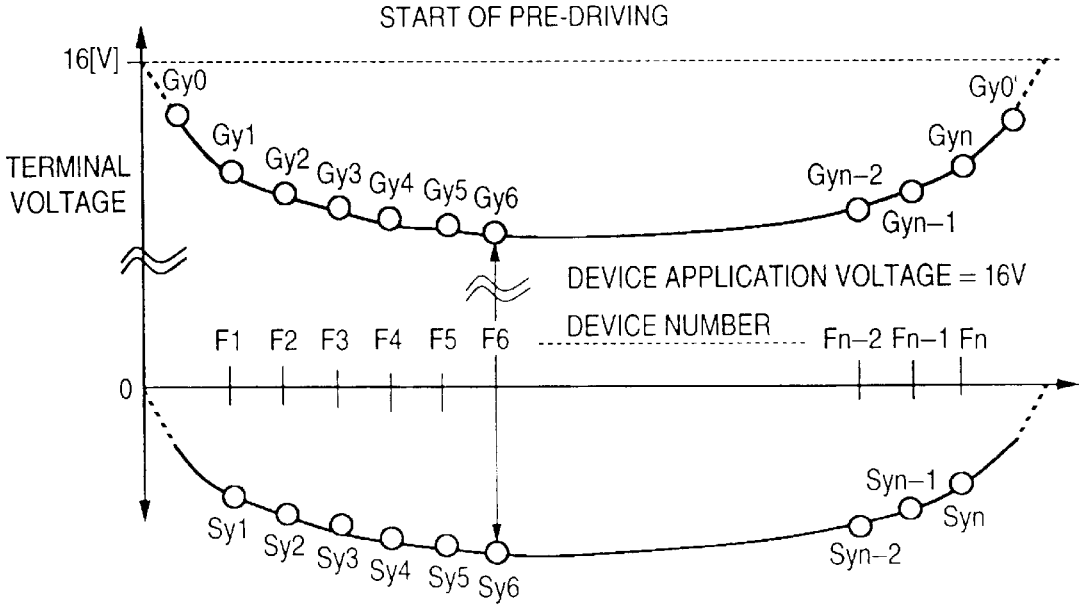
FIGS. 31A and 31B are graphs, respectively, showing the distributions of voltages applied to the two terminals of an electron-emitting device at the start and end of pre-driving in the apparatus of FIG. 26.
Figure 31B:
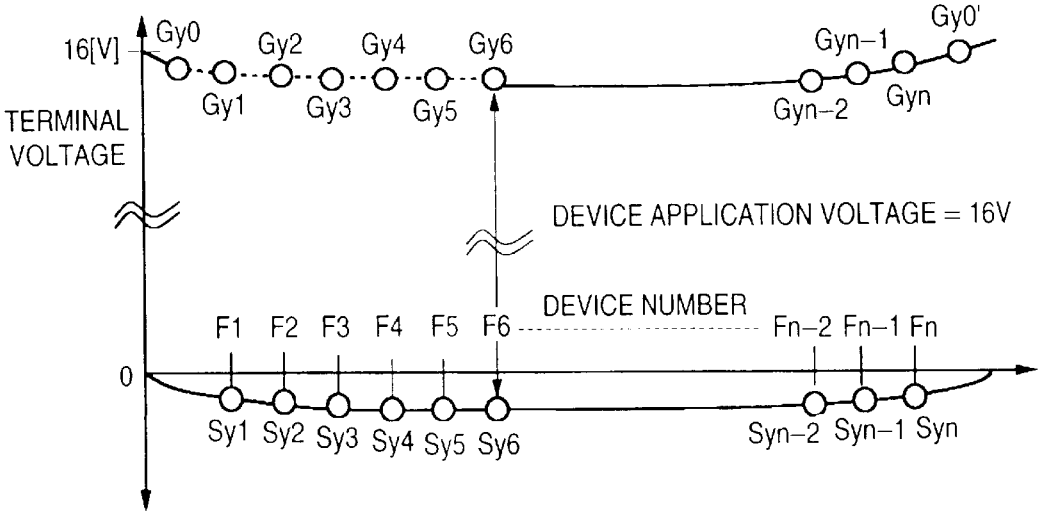

FIGS. 31A and 31B show voltage distributions applied across the devices F1 to Fn at the start and end of pre-driving, respectively. FIG. 31A shows a voltage distribution immediately after the start of pre-driving. The abscissa represents device numbers F1 to Fn, which correspond to device positions. The ordinate represents the terminal voltage across the device. The current is set at almost 2 mA. The current decreases owing to a voltage drop caused by the wiring resistance, while the pre-driving voltage Vpre=16 V is applied from the power source 403 to the terminals Gy1 to Gyn of respective devices. If the set current value of the driving circuit 1606 is set to 2 mA, a distribution at the outputs Sy1 to Syn of the driving circuit 1606 can be made identical to a distribution at Gy1 to Gyn. As a result, a predetermined application voltage (about 16 V) is applied to respective devices to pre-drive them.

FIG. 31B shows a voltage distribution at the end of pre-driving. At the end of pre-driving, currents flowing through respective devices are smaller than currents immediately after the start of pre-driving. The pre-driving voltage Vpre=16 V applied from the power source 403 to the device terminals Gy1 to Gyn rises. Since the pre-driving current decreases, the set current value of the driving circuit 1606 also decreases to decrease the outputs Sy1 to Syn of the driving circuit 1606. Hence, a predetermined voltage (about 16 V) is applied to respective devices to complete pre-driving.

In other words, when the device current changes with the progress of pre-driving, the voltage distribution applied to devices always changes under the influence of the wiring resistance. At this time, the voltage distribution amount is calculated and set as the set output value of the driving circuit 1606. The outputs Sy1 to Syn from the driving circuit 1606 are sequentially updated to pre-drive all devices by a predetermined voltage from the start to end of pre-driving. When the driving time reaches 1 min, pre-driving ends.

In the above description, devices on the row wiring Dx1 are pre-driven. The ninth embodiment can be similarly applied to pre-driving of devices on another line. In the ninth embodiment, a plurality of pre-driving lines are simultaneously pre-driven while sequentially switching pre-driving lines. Since the ninth embodiment simultaneously pre-drives two lines, selection of simultaneous pre-driving lines must be considered. Regarding this, wirings having paired row numbers stored in the selection line memory 1607 in advance are selected, as described above. These wirings have similar voltage drop amounts (i.e., similar voltage distribution amounts in the driving circuit 1606), and their device application voltage for simultaneous driving does not deviate.

In this manner, pre-driving of the surface-conduction type electron-emitting device substrate 401 ends. Since the outputs Sy1 to Syn of the driving circuit 1606 are sequentially updated to compensate for a voltage drop caused by the pre-driving current and wiring resistance, all devices can be uniformly pre-driven at a predetermined voltage from the start to end of pre-driving. Since 10 lines are scanned as one block, and two lines are simultaneously driven, pre-driving processing is completed within about 1/20 the process time required for pre-driving in units of lines.

In the ninth embodiment, the power source 403 applies a positive output to flow the current from the Dx1 to the terminals Dy1 to Dyn, thereby pre-driving devices. Alternatively, the power source 403 may apply a negative output to flow the current from the terminals Dy1 to Dyn to the terminal Dx1, thereby pre-driving devices. In this case, the voltage distribution is also inverted, so that the buffer amplifier 507 of the driving circuit 1606 is constituted as a (−1)-time inverting buffer amplifier to raise the current, thereby obtaining the same effects.

In the ninth embodiment, the driving circuit 1606 is made up of the same number of D/A converters as the number n of column-direction wirings on the surface-conduction type electron-emitting device substrate 401. However, since the compensation voltage distribution changes gradually, as shown in FIGS. 31A and 31B, the number of D/A converters may be decreased, and the voltage value applied to the decreased number of column-direction wiring terminals may be defined by resistance division. This can reduce the cost.

If the number n of devices in the column wiring direction increases, a series of operations (measurement of the device current→calculation of output data→data transfer) may take a long time. This time can be shortened by parallel-processing respective devices, or using a look-up table (LUT) for generating a compensation voltage value from the current value, the wiring resistance value, and the position on the column-direction wiring.

As described above, the pre-driving apparatus of the ninth embodiment can make the electron-emitting characteristics of all devices uniform. The electron source substrate can be used to realize a high-quality image display apparatus almost free from variations in luminance or density.

In the ninth embodiment, the extraction wiring resistance is used as a design value for setting in advance row wirings to be simultaneously selected in pre-driving. However, the design value is not limited to this so long as the difference in voltage distribution in pre-driving can be predicted, and a newly found correlation may be added. The number of lines to be simultaneously driven is two, but is not limited to this. The maximum number of lines is determined by the thermal strength of the multi surface-conduction type electron-emitting device substrate. In addition, not only row wirings having the same extraction wiring resistance are combined, but row wirings whose difference in voltage drop distribution is small to a negligible degree can also be combined for simultaneous driving.

[10th Embodiment]

A pre-driving apparatus for the surface-conduction type electron-emitting device according to the 10th embodiment of the present invention will be described.

The pre-driving apparatus in the 10th embodiment is the same as the apparatus described in the ninth embodiment shown in FIG. 26 except that the former apparatus does not use the extraction wiring resistance memory 1609. Thus, the apparatus of the 10th embodiment is not illustrated.

The operation of the constituent members of the apparatus is also the same as described in the ninth embodiment, and a description thereof will be omitted. This also applies to a surface-conduction type electron-emitting device substrate connected to the apparatus.

A method of determining lines to be simultaneously selected in the 10th embodiment (a pair of two lines because two lines are simultaneously driven in the 10th embodiment) will be explained. One cause of the difference in voltage drop during pre-driving is variations in wiring resistance, as described above. The 10th embodiment relates to a method of reducing these variations.

Figure 32:
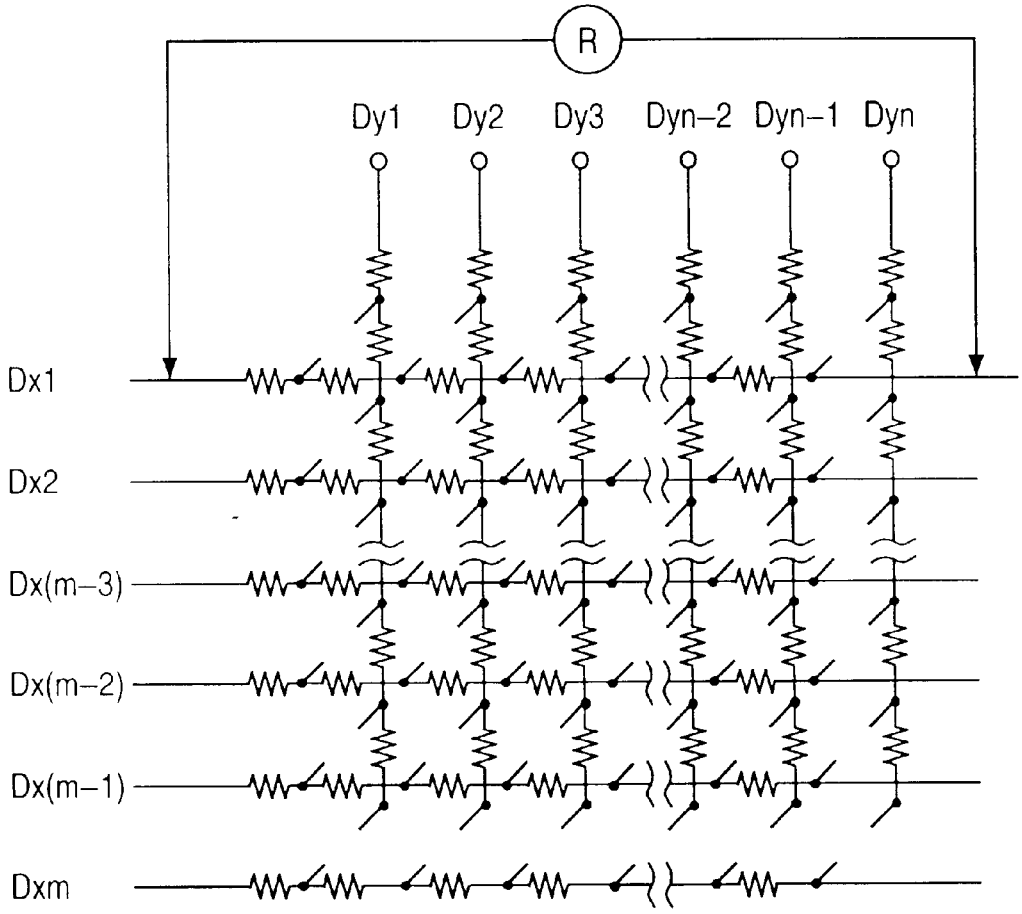
FIG. 32 is a circuit diagram for explaining measurement of the wiring resistance according to the 10th embodiment of the present invention.

The wiring resistances of row-direction wirings on the surface-conduction type electron-emitting device substrate are measured. The wiring resistances are desirably measured before conductive thin films for forming surface-conduction type electron-emitting devices are formed on the substrate. This is because, after conductive thin films are formed, a current for measuring the wiring resistance leaks to the conductive thin films, failing in accurate measurement. FIG. 32 shows an equivalent circuit in measuring the wiring resistance of the first row wiring. As shown in FIG. 32, a measurement probe is connected to the two ends of the wiring to measure the wiring resistance up to the mth rows. The row wiring resistance is measured because the 10th embodiment performs pre-driving in units of row wirings. The measured wiring resistance values are set as R1, R2, R3, . . . , Rm, and the resistance values are directly stored in a wiring resistance memory 1608.

A method of pairing selection lines having the same wiring resistance value on the basis of measured wiring resistance values will be explained with reference to FIG. 33. Wiring resistance values are rearranged in descending order, and every two rows are paired in the arrangement order. Each pair is numbered and stored in a selection line memory. This method can combine the first to mth rows into m/2 pairs each having almost the same wiring resistance.

The procedures of pre-driving a surface-conduction type electron-emitting device substrate 401 using the apparatus of the 10th embodiment will be described with reference to the accompanying drawings. Pre-driving is performed to set the If values of all devices to a target value. The target current value is determined by a necessary electron emission amount and the like. In the 10th embodiment, pre-driving processing is done while monitoring an output from a current detection unit 503 so as to set the device currents of respective devices on the surface-conduction type electron-emitting device substrate 401 to 2 mA at last.

A pre-driving flow will be explained.

If a control unit 506 (FIG. 26) receives a pre-driving start instruction (externally input by the operator), it controls a line select unit 402 and a power source 403 in order to perform electrification processing in units of rows.

The control unit 506 sets an output value Data so as to set column-direction wiring terminals Dy1 to Dyn to the ground potential. The control unit 506 sequentially applies pulses of a pre-driving voltage Vpre (e.g., pulse width of 1 msec and pulse height of 18 V) to the row-direction wiring terminals Dx1 to Dxm. The pulse voltage is sequentially applied to the surface-conduction type electron-emitting device substrate 401 in units of row-direction wirings, and pre-driving starts in units of lines. Two lines are simultaneously pre-driven as a unit on the basis of pairs stored in the selection line memory in order to shorten the time.

Calculation of the voltage distribution and the driving sequence are the same as those described above, and a description thereof will be omitted.

By sequentially updating outputs Sy1 to Syn of a driving circuit 1606 in order to compensate for a voltage drop caused by the pre-driving current and wiring resistance, all devices can be uniformly pre-driven at a predetermined voltage from the start to end of pre-driving. By scanning 10 lines as one block and simultaneously driving two lines, pre-driving processing is completed within about 1/20 the process time required for pre-driving in units of lines.

As described above, the pre-driving apparatus of the 10th embodiment can make the electron-emitting characteristics of all devices uniform. The electron source substrate can be used to realize a high-quality image display apparatus almost free from variations in luminance or density.

[11th Embodiment]

The arrangement of a pre-driving apparatus according to the 11th embodiment of the present invention is the same as that in the 10th embodiment, and a description thereof will be omitted. The 11th embodiment adopts a different number of simultaneously selected lines and a different selection/combination method, which will be described.

If a pre-driving unit of simultaneously selected lines (rows in the 11th embodiment) have different pre-driving currents, the device application voltage deviates to vary characteristics. Different pre-driving currents result from variations in ultimate current in activation that are reflected on the pre-driving current. To prevent this, the 11th embodiment records the final activation current of each row wiring and combines lines to be simultaneously selected in pre-driving on the basis of the recorded current. Iac1 to Iacm represent the final activation currents of respective row wirings.

Figure 34:
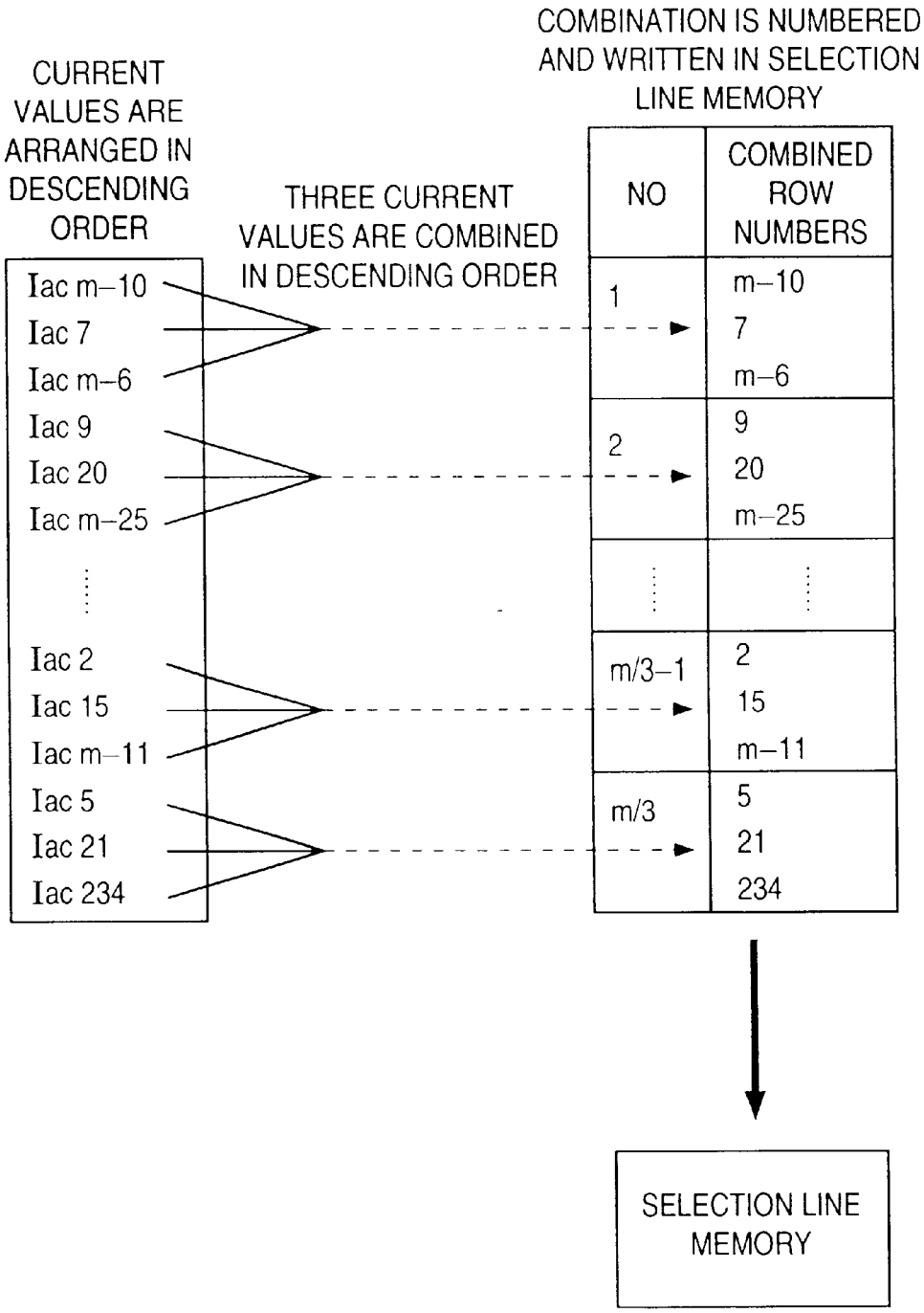
FIG. 34 is a view for explaining a selection pair combination method based on the final activation current value according to the 11th embodiment of the present invention.

A method of combining row wirings will be described with reference to FIG. 34. The measured final activation currents Iac1 to Iacm are rearranged in descending order, and every three currents are combined from the largest one. Each group is numbered and written in the selection line memory. Accordingly, m/3 groups each including three row wirings are prepared.

The grouped row wirings are simultaneously selected and pre-driven. The pre-driving apparatus according to the 11th embodiment can make the electron-emitting characteristics of all devices uniform. The electron source substrate can be used to realize a high-quality image display apparatus almost free from variations in luminance or density.

[12th Embodiment]

Figure 35:
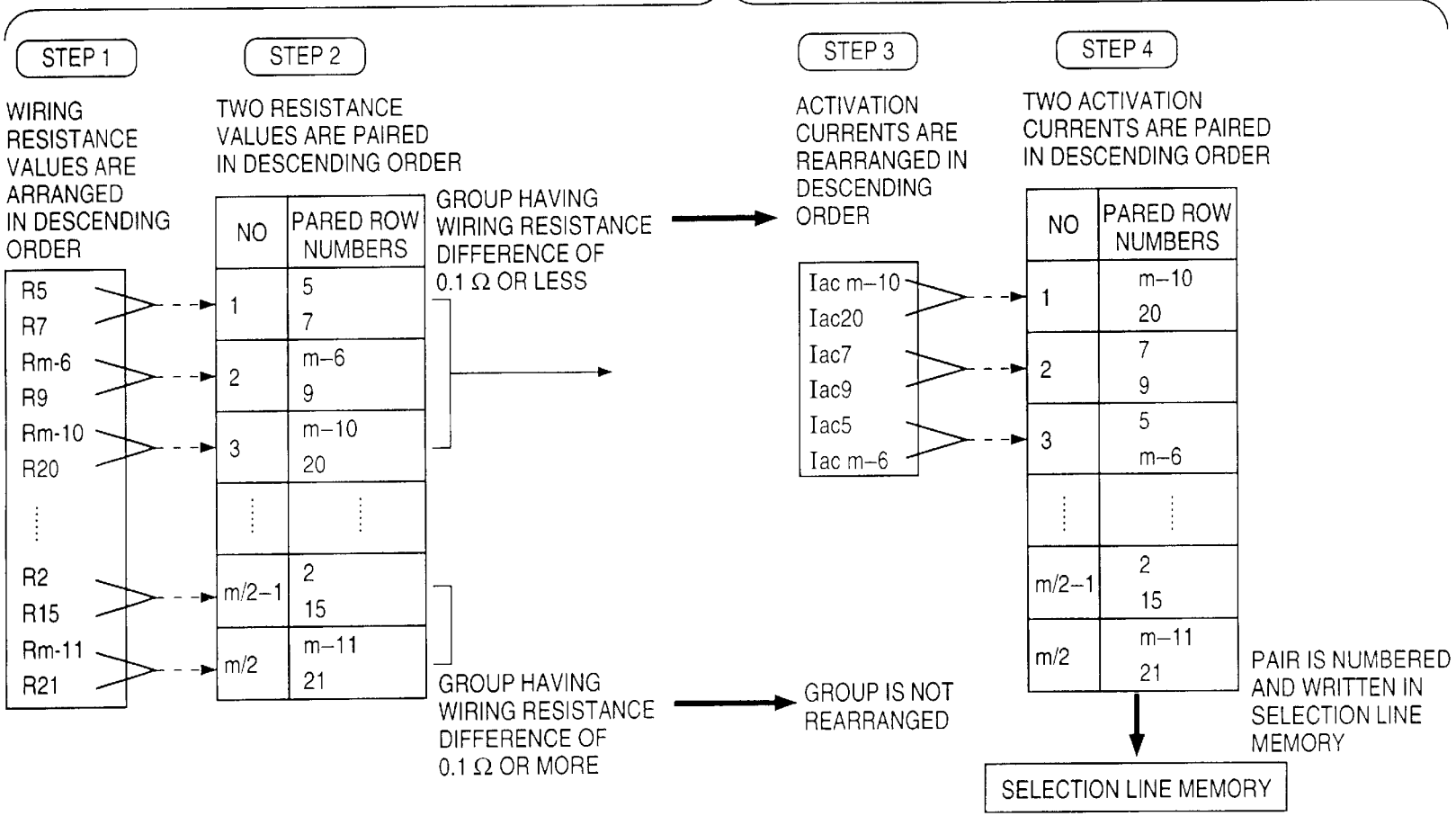
FIG. 35 is a view for explaining a selection pair combination method based on the wiring resistance value and final activation current value according to the 12th embodiment of the present invention.

The arrangement of a pre-driving apparatus according to the 12th embodiment is the same as those in the 10th and 11th embodiments, and a description thereof will be omitted. The 12th embodiment is characterized by a method of combining lines to be simultaneously selected, which will be described with reference to FIG. 35.

In the 12th embodiment, similar to the 10th embodiment, row wiring resistances are measured as R1 to Rm. Similar to the 11th embodiment, the final activation currents of respective rows are stored as Iac1 to Iacm. R1 to Rm are rearranged in descending order, and every two resistances are paired (step 1 and step 2). The wiring resistances are compared between prepared groups (pairs). Groups having a difference of less than 0.1Ω are canceled, and their activation currents (Iac1 to Iacm) are rearranged in descending order (step 3). This applies to group Nos. 1 to 3 set in step 2, which are subjected to rearrangement. A group having a difference of more than 0.1Ω in comparison with upper and lower groups is kept unchanged (this applies to groups Nos. m/2−1 and m/2 in FIG. 35). The rearranged groups are newly paired every two rows from the top. The final pairs of rows to be simultaneously selected are prepared and stored in the selection line memory (step 4).

The reason of rearranging rows on the threshold of a wiring resistance difference of 0.1Ω will be explained. In the above example, the maximum voltage drop on the row wiring is about 2.5 V for n=1000 and r =10 mΩ. The wiring resistance difference of 0.1Ω is converted into 0.1 mΩ by 0.1/1000 for r. The deviation of a voltage drop by this wiring resistance is 0.025 V at maximum. This deviation is about 0.14% for a pre-driving application voltage of 16 V, and can be ignored in practical use. For such wiring resistance difference, row wirings are effectively grouped preferentially based on the pre-driving current difference. For this reason, row wirings are regrouped based on the final activation current.

The value of 0.1Ω is merely an example. The present invention is not limited to this, and the wiring resistance difference is appropriately determined in accordance with the number n of row wirings and the absolute value of the wiring resistance.

As described above, the pre-driving apparatus according to the 12th embodiment can make the electron-emitting characteristics of all devices uniform. The electron source substrate can be used to realize a high-quality image display apparatus almost free from variations in luminance or density.

The above embodiments have described the wiring resistance, final activation current, and combinations of them, as measurement values for setting in advance row wirings to be simultaneously selected in pre-driving. However, the measurement value is not limited to them so long as the difference in voltage distribution in pre-driving can be predicted, and a newly found correlation may be added as needed. The number of lines to be simultaneously driven is two or three, but is not limited to this. The maximum number of lines is determined by the thermal strength of the multi surface-conduction type electron-emitting device substrate.

[13th Embodiment]

A pre-driving apparatus for the surface-conduction type electron-emitting device according to the 13th embodiment of the present invention will be described.

The pre-driving apparatus, surface-conduction type electron-emitting device substrate, and its connection in the 13th embodiment are the same as those in the sixth embodiment (FIG. 15), and are not illustrated. A description of constituent components will also be omitted. The voltage distribution calculation method and basic driving sequence are also the same as those in the sixth embodiment, and a description thereof will be omitted.

In the 13th embodiment, the setting algorithm for the compensation voltage applied to row-direction wirings multiline-driven actually can take several methods. Setting of the current value of the row-direction wiring for calculating the compensation voltage employs the following method.

For example, the average If value of multiline-driven row-direction wirings is calculated, and the compensation voltage is calculated based on the If value. Alternatively, attention may be paid to a specific line among multiline-driven row-direction wirings, and the If value of this line may be used. Alternatively, row-direction wiring currents may be sequentially monitored to select only currents having similar If values as multiline driving targets, and the compensation voltage may be calculated using their If values.

For example, when the average If (=Ifave) is calculated, and then the compensation voltage is calculated, the pre-driving voltage is applied to the row-direction wiring from the two sides of the F1 to Fn wirings, as shown in the equivalent circuit of FIG. 30. A voltage drop by the wiring resistance maximizes near the center of the column-direction wiring.

In this application method, the compensation voltage output is given as follows. Letting iave be Ifava/n for the average pre-driving current Ifave, voltages By1 to Byn to be output from a pixel electrode driving circuit 508 are given using wiring resistances r1 to rn and iave:

$$DyN=-\tfrac{1}{2}\times rN\times N\times(N+1)x\ iave \tag{14}$$

N=F1 to Fn/2 where a pixel number Fn/2 and subsequent pixel numbers are given by N=Fn−N'.

(N' is calculated as a pixel number ranging from Fn/2 to Fn)

By this calculation, the compensation voltage on the column-direction wiring can be determined based on the average If of the pre-driving current values of multiline-driven row wirings.

The compensation voltage is output from the pixel electrode driving circuit 508 to terminals Dy1 to Dyn via a buffer amplifier 507. The compensation voltage is kept effective till the end of the pre-driving process.

As pre-driving end conditions, a necessary driving time is obtained by pre-driving experiments on a single device using the same arrangement and same manufacturing method. A multi surface-conduction type electron-emitting device has been also driven till the driving time has elapsed. The basic compensation voltage application method in multiline driving has been described.

A sequence of screening multiline-driven lines during the pre-driving process of the 13th embodiment will be described with reference to FIGS. 36 to 39.

Figure 36:
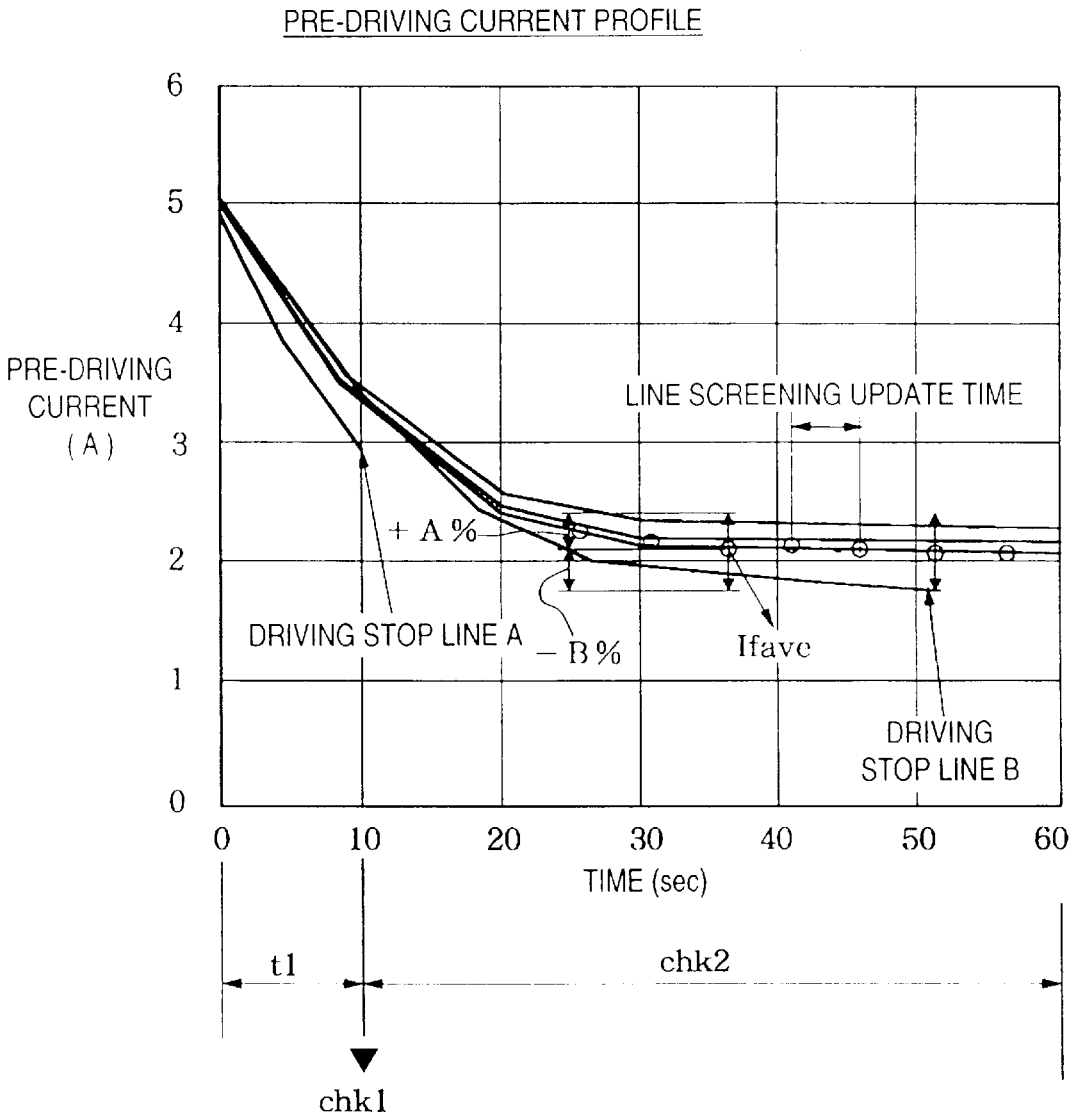
FIG. 36 is a graph showing a pre-driving current profile according to the 13th embodiment of the present invention.

FIG. 36 shows a pre-driving current profile in the pre-driving process executed in the 13th embodiment. FIG. 36 shows a state in which driving stops when the current value If of a multiline-driven line during the process represents the presence of a line which satisfies set driving stop conditions.

The pre-driving voltage is applied while being swept from about 10 V to 16 V. The pre-driving voltage is set to 16 V about 30-odd min after the start of pre-driving, and is kept constant.

In line selection during the pre-driving process, chk1 is executed T1=about 10 sec after the start of pre-driving. chk1 executes primary screening of stopping driving lines having greatly different pre-driving currents among all multi-driven lines. More specifically, the average current value of all multi-driven lines is calculated. The 13th embodiment employs a driving method of applying a voltage while sequentially scrolling a plurality of selected lines in time division when multiline driving is set as simultaneous driving of a plurality of lines. For example, the number of scroll lines is 10, the number of multiline-driven lines is 5, and the number of block lines is 5×10=50.

Primary screening performs detection for stopping driving when driving stop conditions are satisfied by a line having a small current value because of slow progress of pre-driving compared to the remaining lines, or a line having a large pre-driving current value.

This is because the compensation voltage is calculated based on the average If (=Ifave) of multiline-driven lines in the pre-driving sequence after chk1. If the pre-driving current value deviates from the current values of all lines, as described above, the Ifave value itself also deviates. In the process of calculating the compensation voltage, the Ifave value is affected by an individual iave value from equation (14). An optimal compensation voltage cannot be applied. To prevent this, screening in chk1 is necessary.

In setting the time T1, pre-driving desirably progresses to a certain degree. In the 13th embodiment, the total pre-driving time is set to 60 sec, and T1 is determined in consideration of a time during which the pre-driving current changes several Ampere for each line. Therefore, the setting time T1 is not particularly limited.

Figure 37:
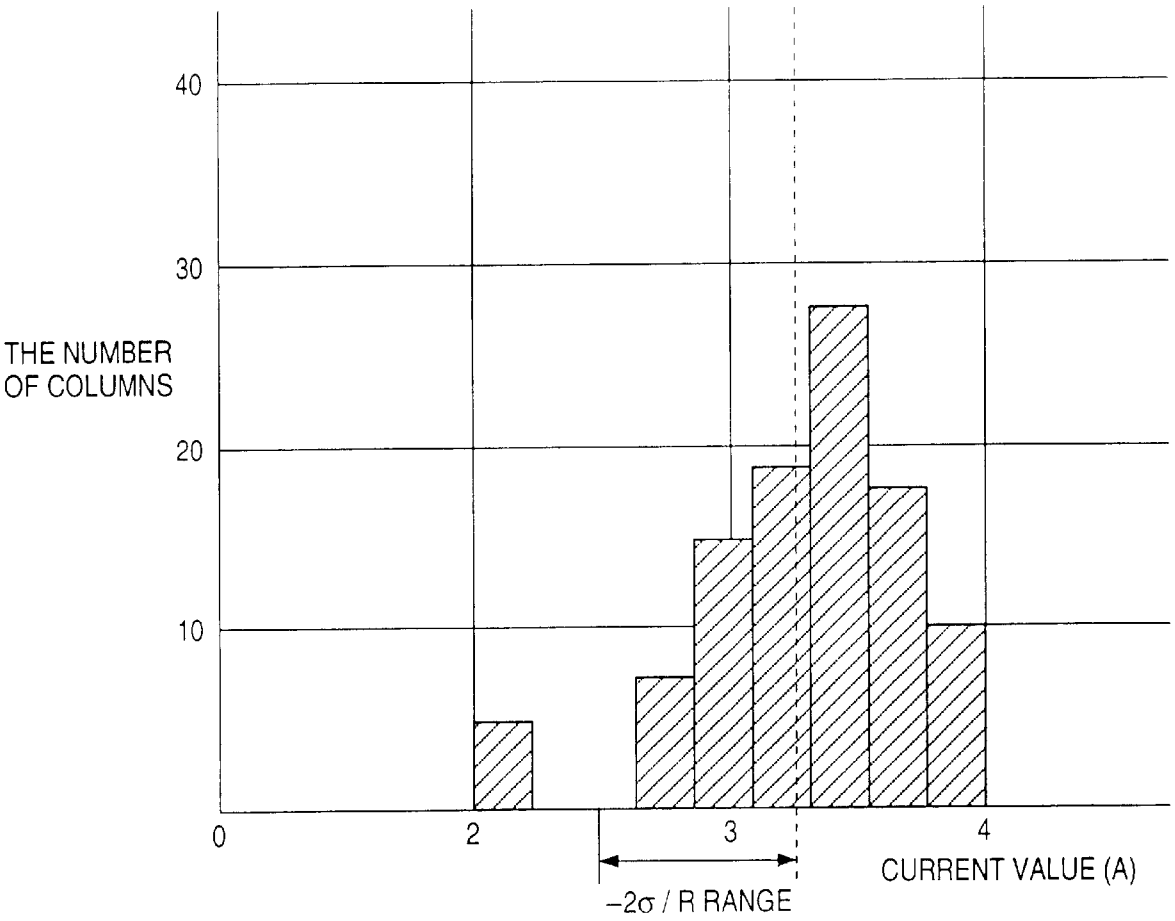
FIG. 37 is a graph showing a pre-driving current histogram according to the 13th embodiment.

The average of all obtained pre-driving currents and the standard deviation are calculated. FIG. 37 shows a histogram for all the numbers of multiline-driven lines in chk1 of the 13th embodiment.

In primary screening, conditions for a line which satisfies driving stop conditions are determined as follows. A coefficient σ/Ifave of the variation is calculated from the average Ifave obtained from all pre-driving currents and a standard deviation σ, and a line flowing a line current falling outside the double range of the variation coefficient is defined as a driving stop condition line.

By setting stop conditions using the variation coefficient, a line can be determined based on a value standardized every pre-driving process. The condition range is set double the variation coefficient because the state of each device in primary screening does not exhibit the final characteristics of pre-driving, and primary screening is done to remove originally degraded devices.

In the 13th embodiment, the above values are calculated to obtain Ifave of 3.54 A and a variation coefficient of 0.42. A line current value satisfying driving stop conditions in primary screening is If=2.2 A from FIG. 37. This current value corresponds to driving stop line A in FIG. 36.

Upon completion of primary screening in chk1, secondary screening is executed. Secondary screening in chk2 is to realize more uniform pre-driving when pre-driving progresses to some extent. As a means of secondary screening, the compensation voltage value applied to the column-direction wiring is further optimized.

For this purpose, the pre-driving currents of multiline-driven lines are ideally uniform. In chk1 and subsequent steps, as described above, the individual pre-driving current iave used to calculate the compensation voltage is calculated from the average Ifave of multiline-driven lines. If Ifave is calculated from similar pre-driving currents of respective lines, the lines can be driven at an almost optimal compensation voltage value. To realize this, chk2 of the 13th embodiment reflects the upper and lower limits of the allowable current value on Ifave of multi-driven lines during an interval from chk1 to the end of pre-driving. More specifically, as shown in FIG. 36, Ifave of multiline-driven lines is calculated every line screening update time, and the Ifave value is represented by ○. Allowable values +A % and −B % set for Ifave in advance are defined as determination setting values. Line driving is stopped for a line whose current value exceeds an allowable current value for Ifave calculated every update time. For example, line B exhibits a pre-driving current value smaller than the lower limit of Ifave in update of screening at a pre-driving time of 50 min. Upon detection of this, line B is regarded as a driving stop line.

Since the allowable current value is reflected on the optimal compensation voltage value, line currents can be made more uniform by narrowing the allowable range. However, the number of driving stop lines increases.

In the 13th embodiment, the allowable current value is set to ±10%. At this allowable current value, variations in compensation voltage value are confirmed not to greatly influence variations in pre-driving characteristic.

The line screening update time interval is set to about 5 sec in the 13th embodiment, but the setting time is not particularly limited and is longer than the application cycle of the compensation voltage. The application timing of the compensation voltage can be set separately from the line screening update time cycle. In practice, the current values of multiline-driven lines and the average Ifave are obtained, and the application cycle of the compensation voltage is set to several sec. In FIG. 36, the final pre-driving current for a pre-driving time of 60 sec decreases to about 2 A.

The pre-driving method of the 13th embodiment has been described with reference to FIG. 36.

The setting time T1 and allowable current value in primary and secondary screening control operations are input to a control circuit 506 in FIG. 15 in initial setting. Each pre-driving current in multiline driving is stored in a memory 511 via the control circuit 506. A sequence for realizing the above pre-driving process will be explained with reference to FIG. 38.

(STEP 1)

The control circuit 506 starts pre-driving upon reception of a pre-driving start instruction. The control circuit 506 sets driving line stop conditions for performing line screening. As described above, the stop conditions are the time T1 from the start of pre-driving to primary screening of chk1, the upper and lower limits of the allowable current value for the average current value Ifave of lines multiline-driven in chk2, and the update time for executing secondary screening.

(STEP 2)

As initial setting driving conditions in the pre-driving process, lines to be simultaneously driven are set. As simultaneous driving settings, the number of lines to be simultaneously driven in multiline driving, the line interval between row-direction wirings to be driven, and the thinning interval are set.

Pre-driving in the 13th embodiment adopts a method of applying a voltage while sequentially scrolling a plurality of selected lines in time division. Lines to be scrolled are processed as one block. In practice, pre-driving is done by multiline driving by designating blocks.

According to the above-mentioned driving method, the number of scroll lines to be sequentially driven is set to 10. Upon simultaneous pre-driving, the number of block lines is the product of the number of lines to be simultaneously driven by the number of scroll lines. The number of lines to be simultaneously driven is optimized in consideration of power applied to a substrate 401 and heat generated upon driving in units of blocks. Driving line intervals are desirably set by uniformly grouping the number of row-direction wirings. The thinning interval is set as a scroll interval in simultaneous driving. For example, when the first line of the row-direction wiring is selected, and the 11th line is selected by next scroll driving, the thinning interval represents 10 lines.

(STEP 3)

After initial setting driving conditions are set in STEP 2, pre-driving starts.

As multiline driving, a driving line setting signal is set in a timing circuit 505. The timing circuit 505 recognizes line numbers to be driven, and outputs a line select signal to a line selection circuit 402.

The line select signal turns on the relays of predetermined row-direction wiring numbers to connect the row-direction wirings to the power source 403 and drive them.

When pre-driving starts by scroll driving, a current detection circuit 503 detects the pre-driving currents of the driving lines of one block, and stores the detected values in the memory 511.

(STEP 4)

In STEP 4, the compensation voltage is calculated. The setting algorithm for the compensation voltage applied to row-direction wirings multiline-driven actually can take several methods. In the 13th embodiment, the average If value of multiline-driven row-direction wirings is obtained, and the compensation voltage is calculated based on the If value.

The average current Ifave is calculated as follows. Current detection sampling points are set during the progress of pre-driving over time, the currents of multiline-driven row wirings are detected every predetermined time, and the latest Ifave is stored in the memory 511. From the calculated Ifave, the compensation voltage in the column wiring direction is calculated. The compensation voltage can be calculated from equation (14). A wiring resistance R is obtained by measuring the wiring resistance of each row-direction wiring, and storing it in the memory 511. The compensation voltage is also measured every time Ifave is updated. If necessary, the compensation voltage value can be stored in the memory 511 because it changes with the progress of the process.

(STEP 5)

In STEP 5, the compensation voltage value calculated every multiline driving is sequentially applied to column-direction wirings by the pixel electrode driving circuit 508 and buffer amplifier 507 via the control circuit 506.

Since the 13th embodiment performs multiline driving in units of blocks, the number of lines in one pre-driving process is several ten. In the pre-driving process, settings in one process are not limited to one block, and a plurality of processes can be set in advance.

(STEP 6)

In STEP 6, whether pre-driving reaches a setting time for performing primary screening is checked.

In the 13th embodiment, the time for which primary screening is performed is set to T1=10 sec after the start of pre-driving.

If pre-driving has not reached the setting time yet, the flow returns to STEP 3.

(STEP 7)

In STEP 7, when the setting time has elapsed after the start of pre-driving, line selection 1 is executed for all multiline-driven lines. Line selection 1 corresponds to primary line screening.

After the time T1, the pre-driving currents of all driven lines are read out from the memory 511. The control circuit 506 executes the following calculation for the readout pre-driving current values: ① calculation of the average If value of all driven lines, ② calculation of the standard deviation from the current values of all driven lines, and ③ calculation of the variation coefficient from the average If and standard deviation. From the calculated values, the double current range of the variation coefficient serving as a driving stop condition in primary screening is set.

(STEP 8)

In accordance with settings of driving stop conditions in STEP 7, the control circuit 506 checks for all driven lines whether their pre-driving current values fall within the driving stop condition range. If a line which satisfies driving stop conditions exists, as shown in FIG. 36, driving stop settings for the line are set in the timing generation circuit 505. The timing generation circuit 505 sets a line to be stopped by the line selection circuit 402 using a line select signal on the basis of the set information.

In STEP 6, STEP 7, and STEP 8, primary screening for driven lines is executed to determine a stop line. Upon completion of the settings, the pre-driving process restarts.

(STEP 9)

Pre-driving processing is done under the same control as in STEP 3. The pre-driving currents of multiline-driven lines are detected and stored in the memory 511.

(STEP 10)

In STEP 10, the compensation voltage is calculated. As described above, the average If value of lines is calculated to perform secondary screening for multiline driving in chk2 in FIG. 36.

The average current Ifave is calculated in accordance with the same algorithm as in STEP 4, and a description thereof will be omitted.

(STEP 11)

In STEP 11, the compensation voltage value calculated every multiline driving is sequentially applied to column-direction wirings by the pixel electrode driving circuit 508 and buffer amplifier 507 via the control circuit 506.

(STEP 12)

In STEP 12, if the pre-driving process progresses to satisfy pre-driving end conditions, pre-driving ends.

If pre-driving has not ended yet, the flow advances to the secondary screening sequence of multiline driving in STEP 13.

(STEP 13)

In STEP 13, whether the elapsed time of the pre-driving has reached the update time for performing line screening is checked, and secondary screening is executed in line selection 2. If pre-driving reaches the measurement time for performing secondary screening, the flow shifts to STEP 14; and if NO, the flow returns to STEP 9 to execute the pre-driving process.

(STEP 14)

In STEP 14, secondary screening in line selection 2 is executed. As described above, secondary screening is done to further optimize the compensation voltage applied to column-direction wirings in order to make device characteristics more uniform when pre-driving progresses to some extent in the pre-driving process of multiline driving. If the elapsed time of pre-driving has reached the screening update time, Ifave of driven lines is calculated.

Ifave is calculated based on the current values of corresponding driven lines stored in the memory by the control circuit 506.

The upper and lower If limits of the allowable value are determined based on the calculated average Ifave from the upper and lower limits of the allowable value for the average If value that are set in the control circuit 506 in advance.

(STEP 15)

In STEP 15, it is checked whether the pre-driving current of each of multiline-driven lines falls within the allowable range between the upper and lower If limits calculated in STEP 14. If the line current value falls within the range, driving continues; and if NO, the line current value is determined to satisfy driving stop conditions.

This processing is executed by the control circuit 506. Similar to STEP 18, settings of a driving stop line are performed in the timing generation circuit 505 and line selection circuit 402, and reflected on a subsequent pre-driving process.

The sequence in STEP 1 to STEP 15 is executed to realize a pre-driving process adopting screening processing.

A re-pre-driving sequence for a line stopped by primary and secondary screening operations will be described with reference to FIG. 39.

(STEP 21)

Figure 39:
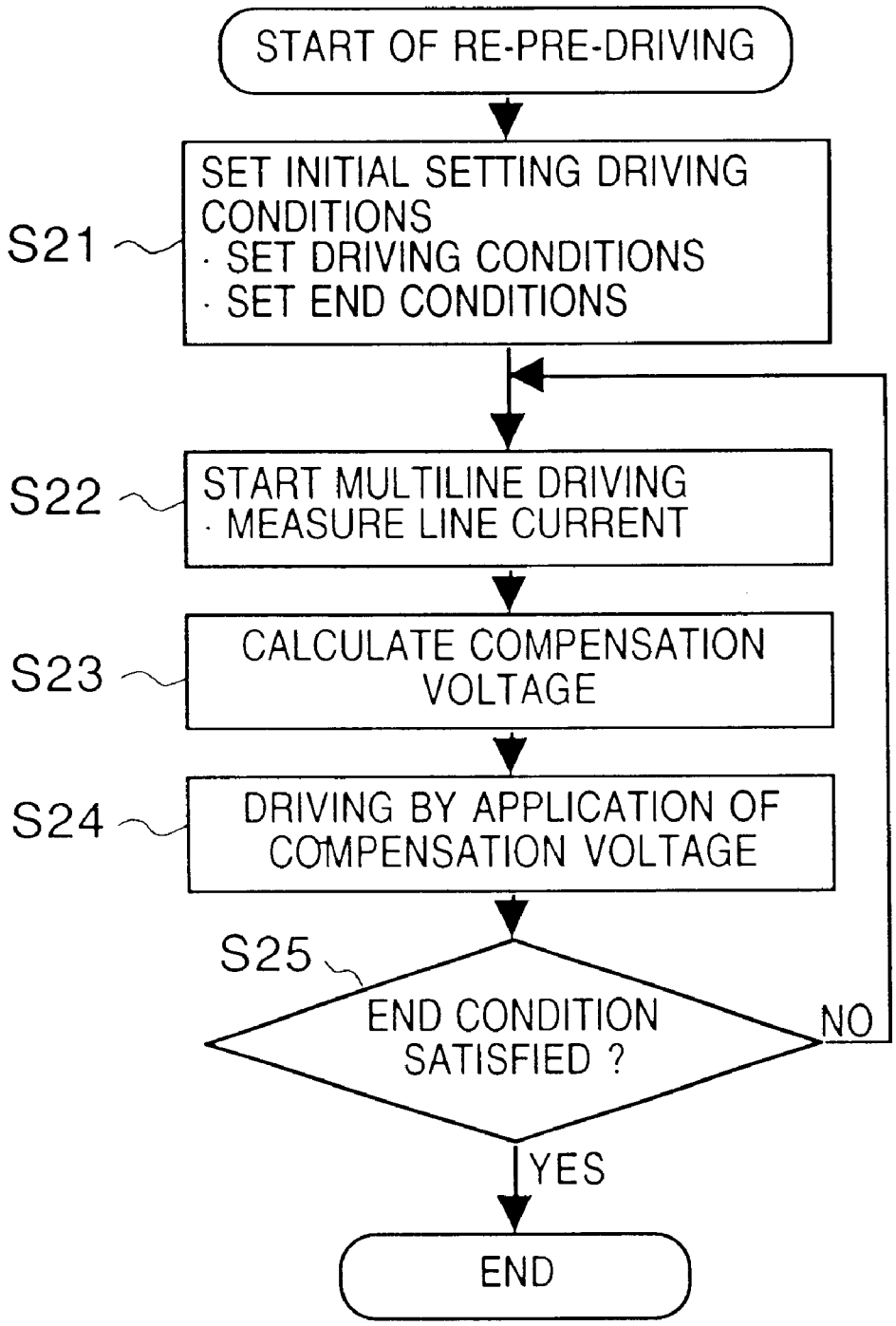
FIG. 39 is a flow chart showing re-pre-driving according to the 13th embodiment.

In FIG. 39, initial settings are done in STEP 21 before execution of the re-pre-driving sequence. In initial settings, driving conditions and pre-driving end conditions are set.

In setting driving conditions, whether the re-pre-driving process is executed as multiline driving, or single-line driving is determined. In multiline driving, lines to be simultaneously driven are determined. If the number of lines is large, the driving interval, thinning interval, and the like are set, as needed. Whether the re-pre-driving process is single-line or multiline driving is determined based on the number of stopped lines and the line positions. For example, when a plurality of stopped lines concentrate on the substrate 401, the current values of multiline-driven lines concentrate on the substrate 401 to generate heat from the substrate, and in some cases, the substrate may be destroyed by the generated heat. To prevent this, single-line driving is desirably performed at this portion so as to avoid these problems.

In single-line driving, the number of lines to be simultaneously driven that is selected in driving is one. The driving interval and thinning interval reflect settings of multiline driving. Single-line driving decreases a current value flowing through the substrate 401 to relax problems such as heat generation.

If stopped lines are distributed on the entire panel, multiline driving is performed, which can shorten the re-pre-driving process time.

Then, pre-driving end conditions are set. Re-pre-driving is performed until the minimum pre-driving current value is attained to obtain a minimum pre-driving characteristic, or is limited by the pre-driving time, as shown in the sequence of FIG. 36.

This may be determined by checking screening at which a line is stopped.

For example, a line (e.g., line A in FIG. 36) stopped in primary screening of chk1 exhibits a small increase (gradient) in pre-driving current from the pre-driving profile, and is difficult to flow a large pre-driving current. For such line, pre-driving end conditions are desirably set by the time. To the contrary, line B stopped in FIG. 36 flows a pre-driving current value to a given degree, and thus an increase in pre-driving current can be expected by performing re-pre-driving processing. For such line, end conditions are desirably set by the pre-driving current value.

(STEP 22)

In STEP 22, the re-pre-driving process starts to drive lines selected in initial settings.

Figure 38:
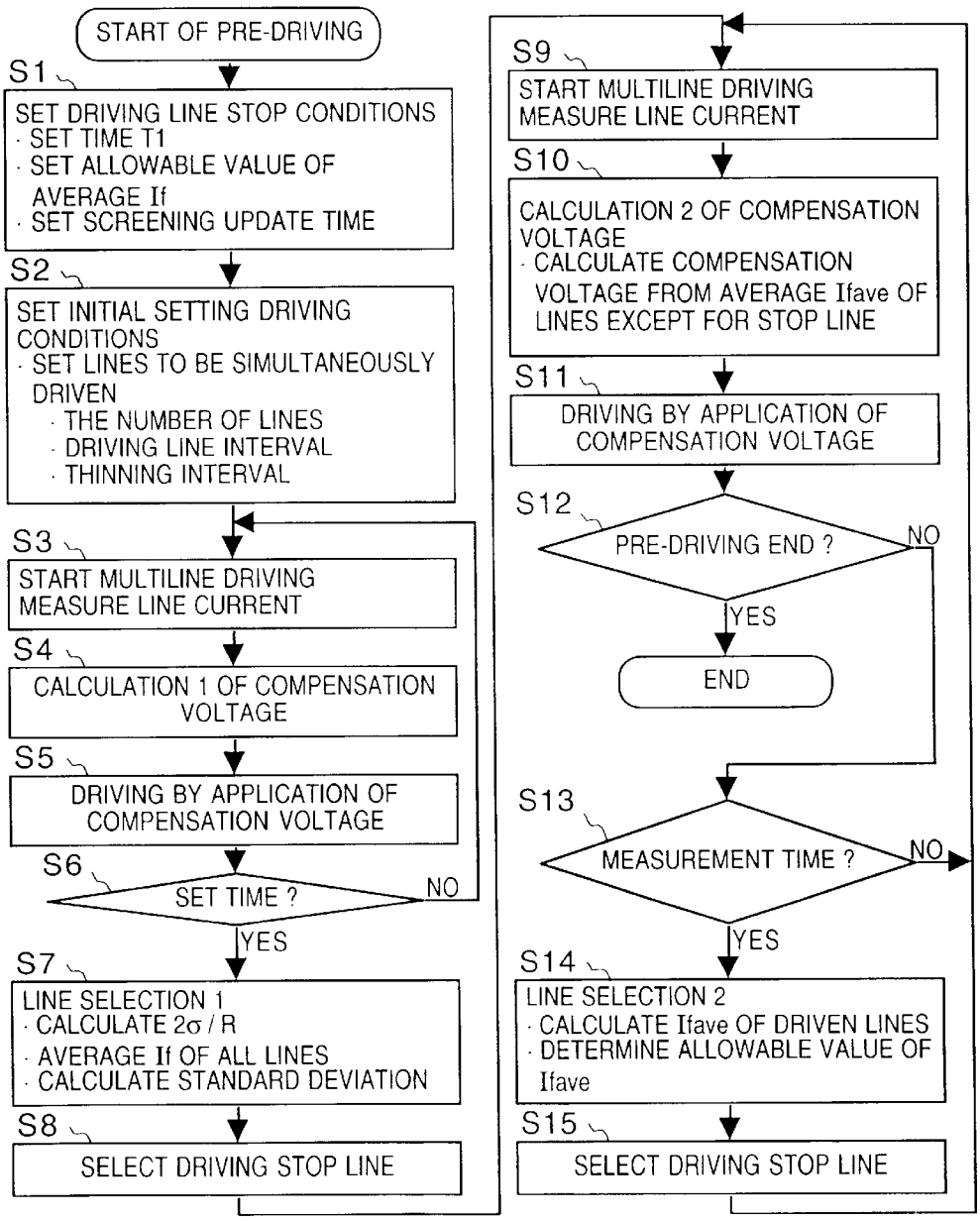
FIG. 38 is a flow chart showing pre-driving according to the 13th embodiment.

Also in re-pre-driving, the currents of lines driven similarly to FIG. 38 are measured by the current detection circuit 503. The detected data are stored in the memory 511 from the control circuit 506.

(STEP 23)

In STEP 23, a voltage value for applying the compensation voltage is calculated. Also in the re-pre-driving process, as well as the sequence in FIG. 38, the compensation voltage is calculated based on the average Ifave of line current values of multiline-driven lines.

In calculating the average Ifave, the measured line currents have already been stored in the memory 511, and the control circuit 506 reads out a predetermined current value for calculation.

When single-line driving is selected in initial settings of the pre-driving process, one line current is subjected to calculation. Hence, the selected line current value can be directly used as a target line for calculating the compensation voltage.

(STEP 24)

The compensation voltage value calculated by the control circuit 506 in STEP 23 is sequentially applied to the column-direction wirings of the substrate 401 via the pixel electrode driving circuit 508 and buffer amplifier 507.

(STEP 25)

In STEP 25, if the pre-driving process progresses to satisfy pre-driving end conditions, pre-driving ends.

If pre-driving has not ended yet, the flow returns to multiline driving in STEP 22 to continue the pre-driving sequence.

In this manner, pre-driving of the substrate 401 ends. By executing this sequence, pre-driving is completed within several fractions of the process time required to drive lines one by one.

Since target lines for calculating the compensation voltage value are determined by performing primary and secondary screening operations, lines can be driven at an almost optimal compensation voltage value, and uniformity in the pre-driving process is improved.

In multiline driving of the 13th embodiment, the number of lines to be simultaneously driven is not limited to the above one. To further shorten the pre-driving processing time, the number of lines to be simultaneously driven can be increased in consideration of heat generation in the substrate 401 or the like.

In the 13th embodiment, the power source 503 applies a positive output. Alternatively, the power source 503 may apply a negative voltage. In this case, the direction of a current flowing into the column-direction wiring is reversed, and the polarity of the compensation voltage from the buffer amplifier 507 is also inverted.

The pixel electrode driving circuit 508 is constituted by D/A converters equal in number to the column-direction wirings. However, since the compensation voltage distribution changes gradually, as shown in FIGS. 19A and 19B, the number of D/A converters may be decreased, and the application voltage may be divided by resistances or the like to define the voltage.

In the pre-driving process, the compensation voltage value need not always be updated every scroll, unlike the 13th embodiment, and may be appropriately updated in accordance with the progress of pre-driving.

As described above, the pre-driving process of the 13th embodiment can form relatively uniform devices almost free from variations in electron-emitting characteristics. A display panel is fabricated using the substrate 401 to realize a high-quality image display apparatus almost free from variations.

By increasing the number of lines to be simultaneously driven in multiline driving, the pre-driving process time can be greatly shortened.

[14th Embodiment]

The 14th embodiment of the present invention will be described with reference to FIG. 40.

In the 14th embodiment, an apparatus and driving circuit arrangement in the pre-driving process are the same as those in FIG. 15. The structure of a surface-conduction type electron-emitting device substrate is also the same as that of the substrate 401, and a description thereof will be omitted.

The 14th embodiment is different from the 13th embodiment in that driving of a line is stopped by determining whether the current value reaches a predetermined pre-driving current value in line screening.

Figure 40:
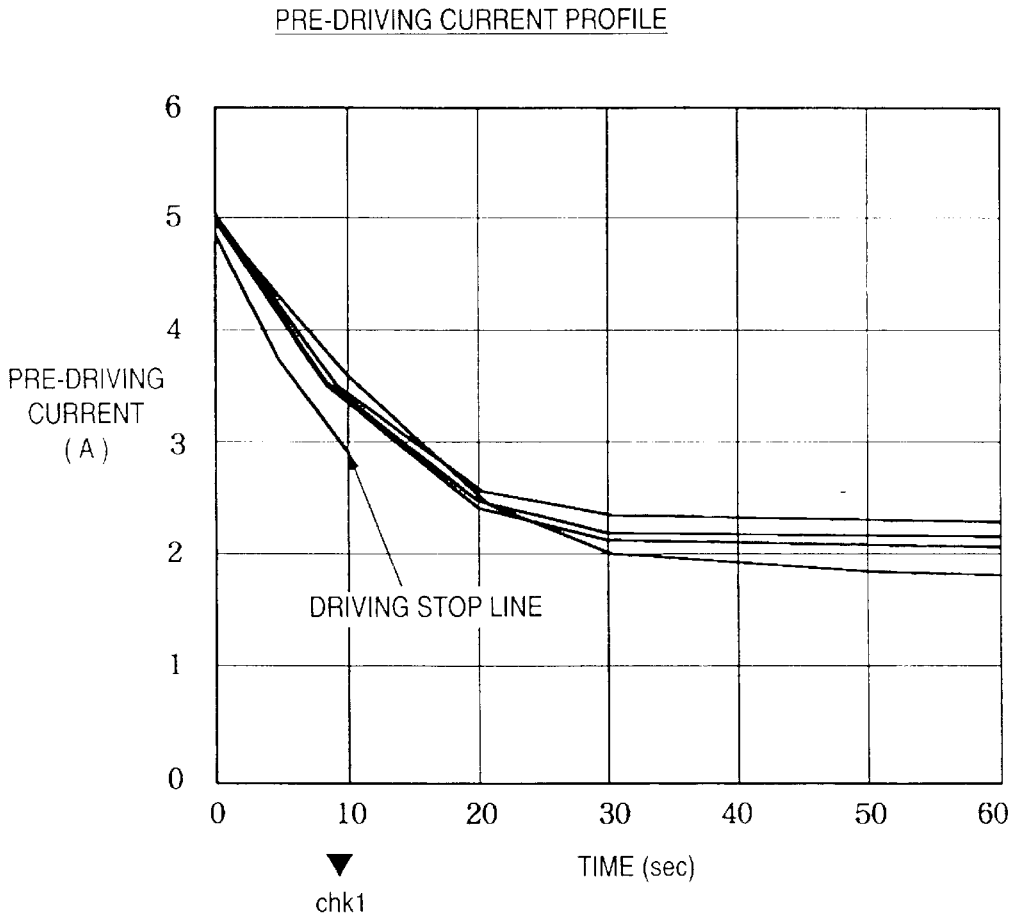
FIG. 40 is a graph showing a pre-driving current profile according to the 14th embodiment of the present invention.

More specifically, in FIG. 40, the chk sequence is executed after elapsing a setting time of 10 sec after the start of pre-driving.

The chk sequence checks whether each of the pre-driving current values of all multiline-driven lines is lower than the set current value. The set current value is a line current value when pre-driving of devices progresses to a certain degree after the start of pre-driving. The set current value is set to about several ampere, and to 3 amperes [A] in the 14th embodiment.

In FIG. 40, a line which has not reached the pre-driving set current value at the chk time is regarded as a driving stop line, and its driving is stopped at the chk time.

Figure 41:
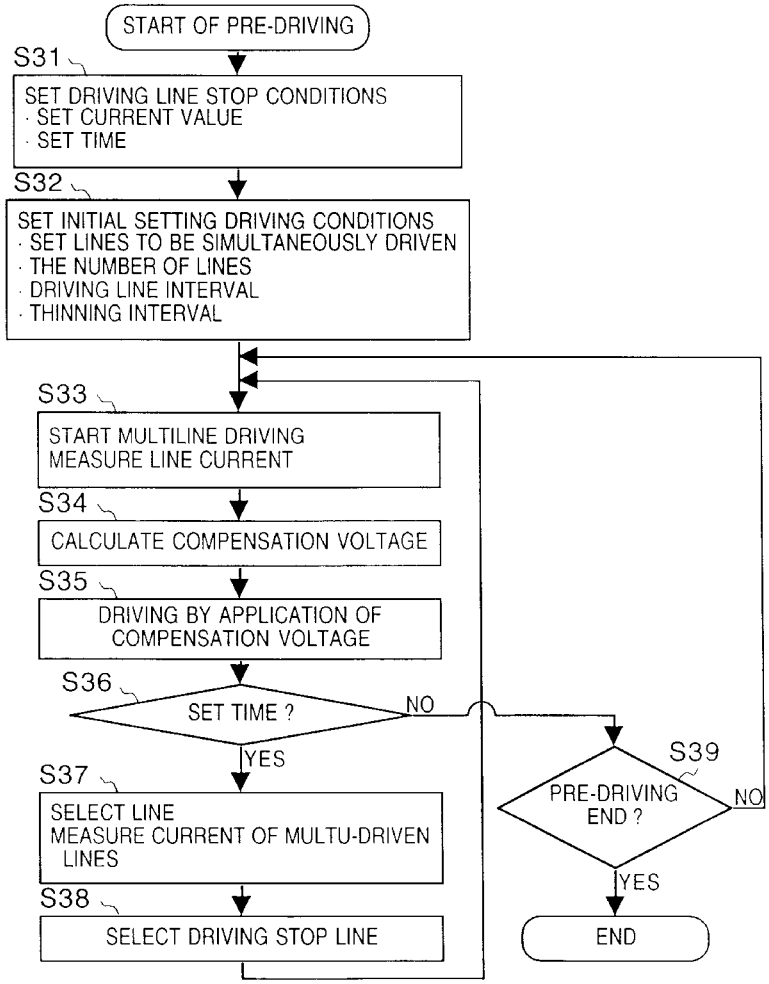
FIG. 41 is a flow chart showing re-pre-driving according to the 14th embodiment.

This operation will be explained with reference to the pre-driving sequence flow chart of FIG. 41.

(STEP 31)

Driving stop conditions are set for multiline-driven lines before execution of pre-driving.

Since driving stop conditions are executed in the chk sequence, as described above, a time for performing the chk sequence and a pre-driving current value during the chk sequence are set in a control circuit 506.

(STEP 32)

Similar to the 13th embodiment, initial setting driving conditions are set.

The control circuit 506 starts pre-driving upon reception of a pre-driving start instruction. The control circuit 506 sets lines to be simultaneously driven as initial driving condition settings at the start of pre-driving.

As simultaneous driving settings, the control circuit 506 sets the number of lines to be simultaneously driven in multiline driving, the line interval between row-direction wirings to be driven, and the thinning interval.

Pre-driving in the 14th embodiment also adopts a method of applying a voltage while sequentially scrolling a plurality of selected lines. Similar to the 13th embodiment, 10 lines are sequentially scrolled. The number of lines to be simultaneously driven is optimized in consideration of power applied to a substrate 401 and heat generated upon driving in units of blocks.

Also in the 14th embodiment, the driving line interval corresponds to a line interval between blocks to be simultaneously driven.

Driving lines must be uniformly designated on the entire substrate 401 in consideration of concentration of a thermal distribution caused by power applied to the substrate 401.

The thinning interval is set as an interval between a line driven first and a line selected next in scroll similar to the 13th embodiment. These settings are done by the control circuit 506, and set in a line selection circuit 402.

(STEP 33)

After initial setting driving conditions are set in STEP 31, pre-driving starts.

To simultaneously drive a plurality of lines as multiline driving, a driving line setting signal is set in a timing circuit 505. The timing circuit 505 recognizes line numbers to be driven, and outputs a line select signal to the line selection circuit 402. The line select signal turns on the relays of predetermined row-direction wiring numbers to connect the row-direction wirings to a power source 403 and drive them. When pre-driving starts by scroll driving, a current detection circuit 503 detects the pre-driving currents of driven lines, and stores the detected values in a memory 511.

(STEP 34)

In STEP 34, the current values of multiline-driven lines are read out from the memory 511 in order to calculate the compensation voltage. The average pre-driving current value is calculated from the measured pre-driving current values of row-wirings from the memory 511. The average Ifave is calculated as follows. Current detection sampling points are set during the progress of pre-driving over time, the currents of multiline-driven row wirings are detected every predetermined time, and the latest Ifave is stored in the memory 511.

From the calculated Ifave, the compensation voltage on the column-direction wiring side is calculated. The compensation voltage can be calculated from equation (14). A wiring resistance r is obtained by measuring the wiring resistance of each row-direction wiring, and storing it in the memory 511. The compensation voltage is also measured every time Ifave is updated. If necessary, the compensation voltage value can be stored in the memory 511 because it changes with the progress of the process.

(STEP 35)

In STEP 35, the compensation voltage value calculated in STEP 34 every multiline driving is sequentially applied to column-direction wirings by a pixel electrode driving circuit 508 and buffer amplifier 507 via the control circuit 506. Since the 14th embodiment performs multiline driving in units of blocks, the number of lines in one pre-driving process is 30. In the pre-driving process, settings in one process are not limited to one block, and a plurality of blocks can be set in advance.

(STEP 36)

In STEP 36, whether the time of pre-driving reaches a setting time for performing primary screening is checked.

If the elapsed time of pre-driving reached the setting time, the chk sequence in FIG. 40 is executed; and if NO, the flow returns to STEP 33 to continue the pre-driving sequence.

(STEP 37)

Line selection as the chk sequence is executed. As described above, line screening by line selection is a means for determining whether each of the pre-driving current values of all multiline-driven lines reaches the set current value. The control circuit 506 reads out from the memory 511 the latest current values of all lines in the chk sequence, and compares each of the readout values with the set current value.

(STEP 38)

A line whose current value has not reached the set current value yet is detected by this comparison. The control circuit 506 outputs a driving stop line select signal from the timing generation circuit 505 to the line selection circuit 402.

(STEP 39)

It is determined that the pre-driving process progresses to end pre-driving of multiline-driven lines. If pre-driving has not ended yet, the flow returns to STEP 33 to continue the pre-driving process.

Pre-driving ends when the current of each device reaches a predetermined value while the pre-driving current is detected, or by defining the end time from the start of pre-driving.

To end pre-driving when the current value of each device reaches a predetermined value, the pre-driving status must be grasped for each line by the control circuit 506 or the like. On the other hand, to control pre-driving by the time, the time must be set to unify pre-driving. In the 14th embodiment, the pre-driving time is set as an end condition.

A re-pre-driving process is executed for a stopped line. The re-pre-driving process is executed in accordance with the sequence shown in FIG. 39, similar to the 13th embodiment, and a description of the process will be omitted in the 14th embodiment.

This pre-driving processing is performed to complete pre-driving of the substrate 401. By executing this sequence, pre-driving is completed within a fraction of the process time required to drive lines one by one.

Since target lines for calculating the compensation voltage value are determined by performing line screening using the set current value, lines can be driven at an almost optimal compensation voltage value, and uniformity in the pre-driving process is improved.

In multiline driving of the 14th embodiment, the number of lines to be simultaneously driven is not limited to the above one. To further shorten the pre-driving processing time, the number of row wirings to be simultaneously driven can be increased in consideration of heat generation in the substrate 401 or the like.

[15th Embodiment]

The 15th embodiment of the present invention will be described with reference to FIG. 42.

In the 15th embodiment, an apparatus and driving circuit arrangement in the pre-driving process are the same as those in FIG. 15. The structure of a surface-conduction type electron-emitting device substrate is also the same as that of the substrate 401, and a description thereof will be omitted.

The 15th embodiment is different from the 13th embodiment in that driving of a line is stopped by determining whether the pre-driving current value changes by a predetermined amount or more within the pre-driving time during which line screening is set.

Figure 42:
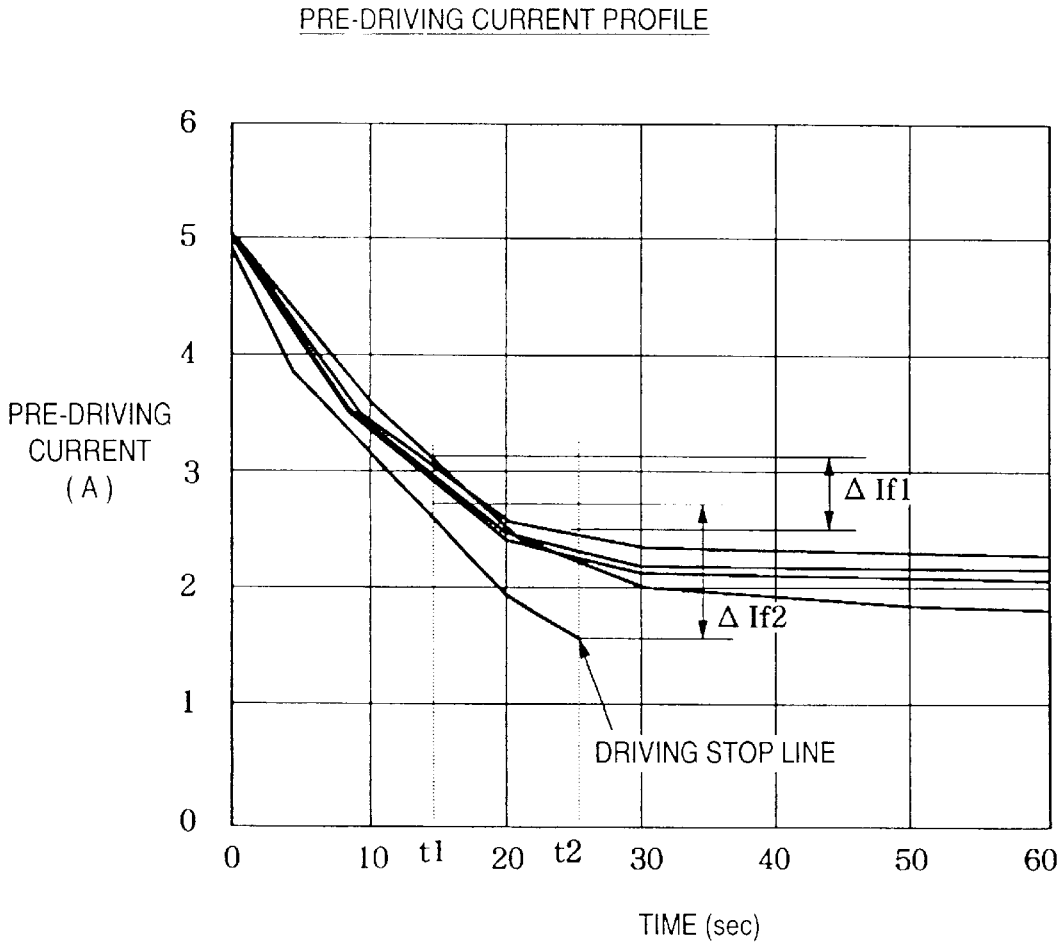
FIG. 42 is a graph showing a pre-driving current profile according to the 15th embodiment of the present invention.

More specifically, in FIG. 42, current measurement is executed for multiline-driven lines at the first measurement time t1 after the start of pre-driving. After normal pre-driving is done till the second measurement time t2, current measurement is executed again at t2 for the lines measured at t1, and a current change amount ΔIf=If change amount/(t2−t1) is calculated. The time for calculating this current change amount is considered to be suitable for checking the pre-driving state because the current change amount of a device measured during boosting of the pre-driving voltage exhibits a large change like ΔIf1. For this reason, the 15th embodiment sets the times t1 and t2 at relatively early times after the start of pre-driving. The current change amount serving as a driving stop condition may be, in advance, set as a fixed value. In practice, the current change amount of each line may be calculated by multiline driving, and a line exhibiting a large current change amount may be defined as a driving stop line.

For example, the driving stop condition may be determined based on the average value of the current change amounts of multiline-driven lines, or may be determined based on the change amount of a specific line.

In the 15th embodiment, the setting value for the change amount of the pre-driving current value is set to 1 A from the current change amount in multiline driving, and a line exhibiting a larger current change amount is defined as a driving stop line. In FIG. 42, among lines designated as driving stop lines, a line corresponding to a large change amount ΔIf2 of a pre-driving current value (t2−t1) is defined as a driving stop line.

Figure 43:
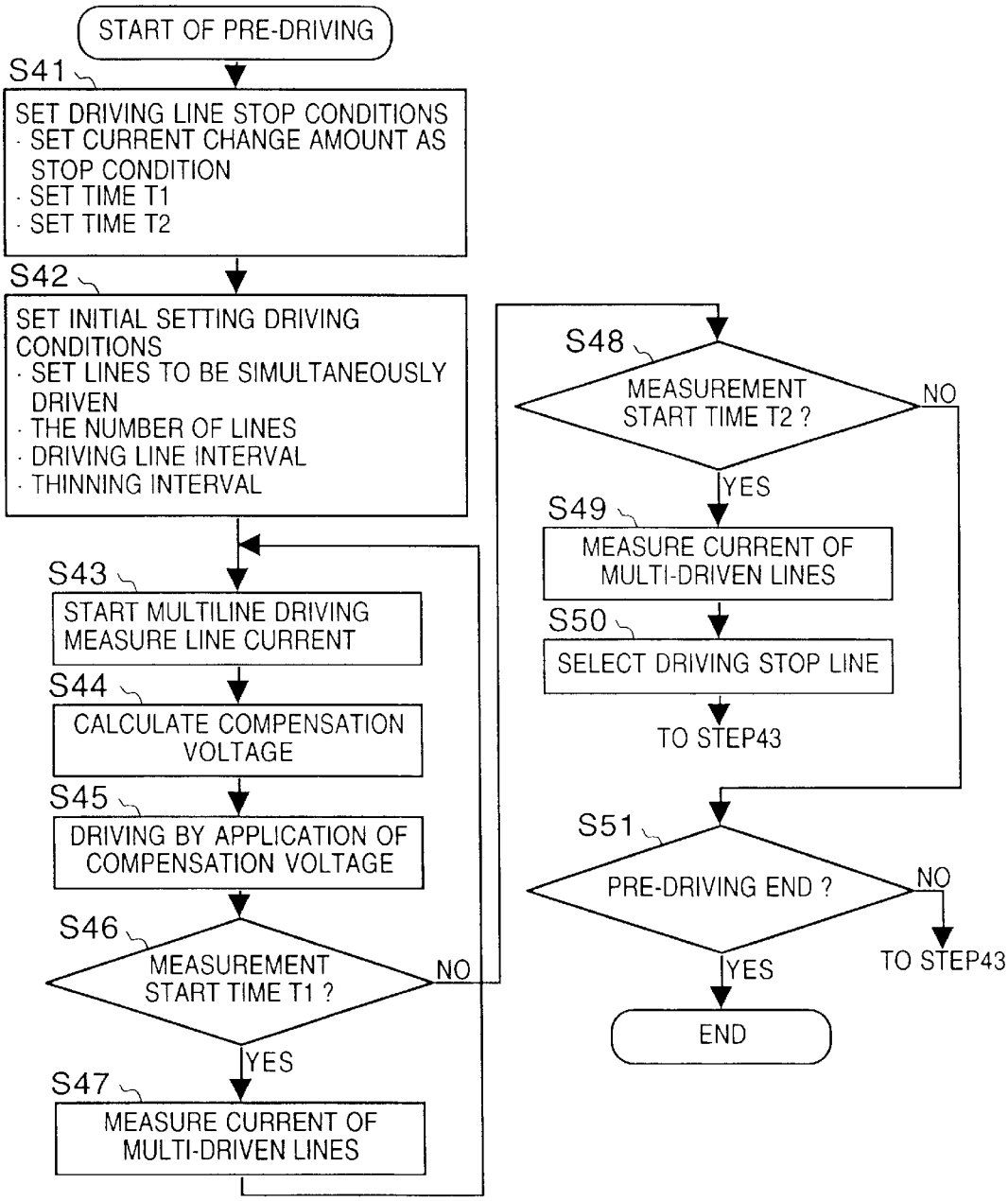
FIG. 43 is a flow chart showing pre-driving according to the 15th embodiment.

This operation will be explained with reference to the pre-driving sequence flow chart of FIG. 43.

(STEP 41)

Driving stop conditions are set for multiline-driven lines before execution of pre-driving.

As driving stop conditions, the pre-driving current measurement times t1 and t2, and the change amount of the pre-driving current value are set in a control circuit 506.

(STEP 42)

Similar to the 13th embodiment, initial setting driving conditions are set.

The control circuit 506 starts pre-driving upon reception of a pre-driving start instruction. The control circuit 506 sets lines to be simultaneously driven as initial driving condition settings at the start of pre-driving.

As simultaneous driving settings, the control circuit 506 sets the number of lines to be simultaneously driven in multiline driving, the line interval between row-direction wirings to be driven, and the thinning interval.

Pre-driving in the 15th embodiment also adopts a method of applying a voltage while sequentially scrolling a plurality of selected lines. Similar to the 13th embodiment, 10 lines are sequentially scrolled. The number of lines to be simultaneously driven is optimized in consideration of power applied to a substrate 401 and heat generated upon driving in units of blocks.

Also in the 15th embodiment, the driving line interval corresponds to a line interval between blocks to be simultaneously driven.

Driving lines must be uniformly designated on the entire substrate 401 in consideration of concentration of a thermal distribution caused by power applied to the substrate 401.

The thinning interval is set as an interval between a line driven first and a line selected next in scroll similar to the 13th embodiment. These settings are done by the control circuit 506, and set in a line selection circuit 402.

(STEP 43)

After initial setting driving conditions are set in STEP 41, pre-driving starts.

To simultaneously drive a plurality of lines as multiline driving, a driving line setting signal is set in a timing circuit 505. The timing circuit 505 recognizes line numbers to be driven, and outputs a line select signal to the line selection circuit 402. The line select signal turns on the relays of predetermined row-direction wiring numbers to connect the row-direction wirings to a power source 403 and drive them. When pre-driving starts by scroll driving, a current detection circuit 503 detects the pre-driving currents of driven lines, and stores the detected values in a memory 511.

(STEP 44)

In STEP 44, the current values of multiline-driven lines are read out from the control circuit 506 to the memory 511 in order to calculate the compensation voltage. The average pre-driving current value Ifave is calculated from respective pre-driving current values.

From the calculated Ifave, the compensation voltage on the column-direction wiring side is calculated. The compensation voltage can be calculated from equation (14) in the 13th embodiment. A wiring resistance r is obtained by measuring the wiring resistance of each row-direction wiring, and storing it in the memory 511. The compensation voltage is also measured every time Ifave is updated. If necessary, the compensation voltage value can be stored in the memory 511 because it changes with the progress of the process.

(STEP 45)

In STEP 45, the compensation voltage value calculated in STEP 44 every multiline driving is sequentially applied to column-direction wirings by a pixel electrode driving circuit 508 and buffer amplifier 507 via the control circuit 506.

(STEP 46)

In STEP 46, whether the pre-driving time period of multiline-driven lines reaches the pre-driving current measurement time t1 is checked. If the time becomes the measurement time, the flow advances to measurement of the pre-driving current; and if NO, to STEP 48.

(STEP 47)

In STEP 47, the pre-driving currents of lines driven in the pre-driving process are measured.

Similar to STEP 43, the current values of lines selected by the line selection circuit 402 are measured by the current detection circuit 503, and the measured values are stored in the memory 511.

After current measurement, the flow returns to STEP 43.

(STEP 48)

In STEP 48, whether the pre-driving time period of multiline-driven lines reaches the pre-driving current measurement time t2 is checked. If the time reaches the measurement time, the flow advances to measurement of the pre-driving current; and if NO, to STEP 51.

(STEP 49)

In STEP 49, the pre-driving currents of lines driven in the pre-driving process are measured.

Similar to STEP 47, the current values of lines selected by the line selection circuit 402 are measured by the current detection circuit 503, and the measured values are stored in the memory 511.

After current measurement, the flow proceeds to selection of a driving stop line in STEP 50.

(STEP 50)

The control circuit 506 reads out from the memory 511 the pre-driving current values measured at the setting times t1 and t2, and calculates the change amount between the pre-driving current values. Among multiline-driven lines, a line which has not reached a predetermined current change amount (increase amount) yet is determined as a driving stop line. The driving stop line is set by a line select signal from the timing circuit 505 to the line selection circuit 402.

Upon completion of the line selection sequence, the flow returns to STEP 43 to continue the pre-driving process sequence.

(STEP 51)

If pre-driving of each line progresses to satisfy pre-driving process end conditions, pre-driving ends. If pre-driving has not ended yet, the flow returns to STEP 43 to restart scroll driving.

Pre-driving ends when the current of each device reaches a predetermined value while the pre-driving current is detected, or by defining the end time from the start of pre-driving.

To end pre-driving when the current value of each device reaches a predetermined value, the pre-driving status must be grasped for each line by the control circuit 506 or the like. On the other hand, to control pre-driving by the time, the time must be set to unify pre-driving. In the 15th embodiment, the pre-driving time is set as an end condition.

A re-pre-driving process is executed for a stopped line. The re-pre-driving process is executed in accordance with the sequence shown in FIG. 39, similar to the 13th embodiment, and a description of the process will be omitted in the 15th embodiment.

This pre-driving processing is performed to complete pre-driving of the substrate 401. By executing this sequence, pre-driving is completed within several fractions of the process time required to drive lines one by one.

Line screening is done by calculating the change amount of the pre-driving current. Lines can be driven at an almost optimal compensation voltage value by determining target lines for calculating the compensation voltage value. Uniformity in the pre-driving process is improved.

In multiline driving of the 15th embodiment, the number of lines to be simultaneously driven is not limited to the above one. To further shorten the pre-driving processing time, the number of row wirings to be simultaneously driven can be increased in consideration of heat generation in the substrate 401 or the like.

[16th Embodiment]

A pre-driving apparatus, the connection method of surface-conduction type electron-emitting device's substrate, and the like in the 16th embodiment are the same as those in the sixth embodiment, and a description of the arrangement and the operation of individual components will be omitted.

Procedures of pre-driving a surface-conduction type electron-emitting device's substrate 401 using the apparatus of FIG. 15 will be explained. Pre-driving procedures will be described below.

Upon reception of a pre-driving start instruction, a control circuit 506 controls a timing generation circuit 505 and power source 403 in order to perform electrification processing in units of rows.

The control circuit 506 sets a set output 110 so as to set column-direction wiring terminals Dy1 to Dyn to the ground potential. The control unit 506 sequentially applies pulses of a pre-driving voltage Vpre (e.g., pulse width of 1 msec and pulse height of 18 V) to row-direction wiring terminals Dx1 to Dxm. The pulse voltage is sequentially applied to the substrate 401 in units of row-direction wirings, and pre-driving starts in units of lines.

In the 16th embodiment, three row-direction wirings simultaneously undergo electrification processing in order to shorten the pre-driving process time.

Assuming that the number of row-direction wiring lines on the substrate 401 is 480, three row-direction wiring terminals Dx1, Dx161, and Dx321 are determined as start lines to be simultaneously driven. The compensation voltage to be applied to the column-direction wiring is determined from the average of the three pre-driving currents.

A state in which a surface-conduction type electron-emitting device group is pre-driven will be explained with reference to FIG. 44 using a model including the wiring resistance of each device while paying attention to the Dx1 line of the three lines (Dx1, Dx161, and Dx321) to which the pre-driving voltage is applied.

Figure 44:
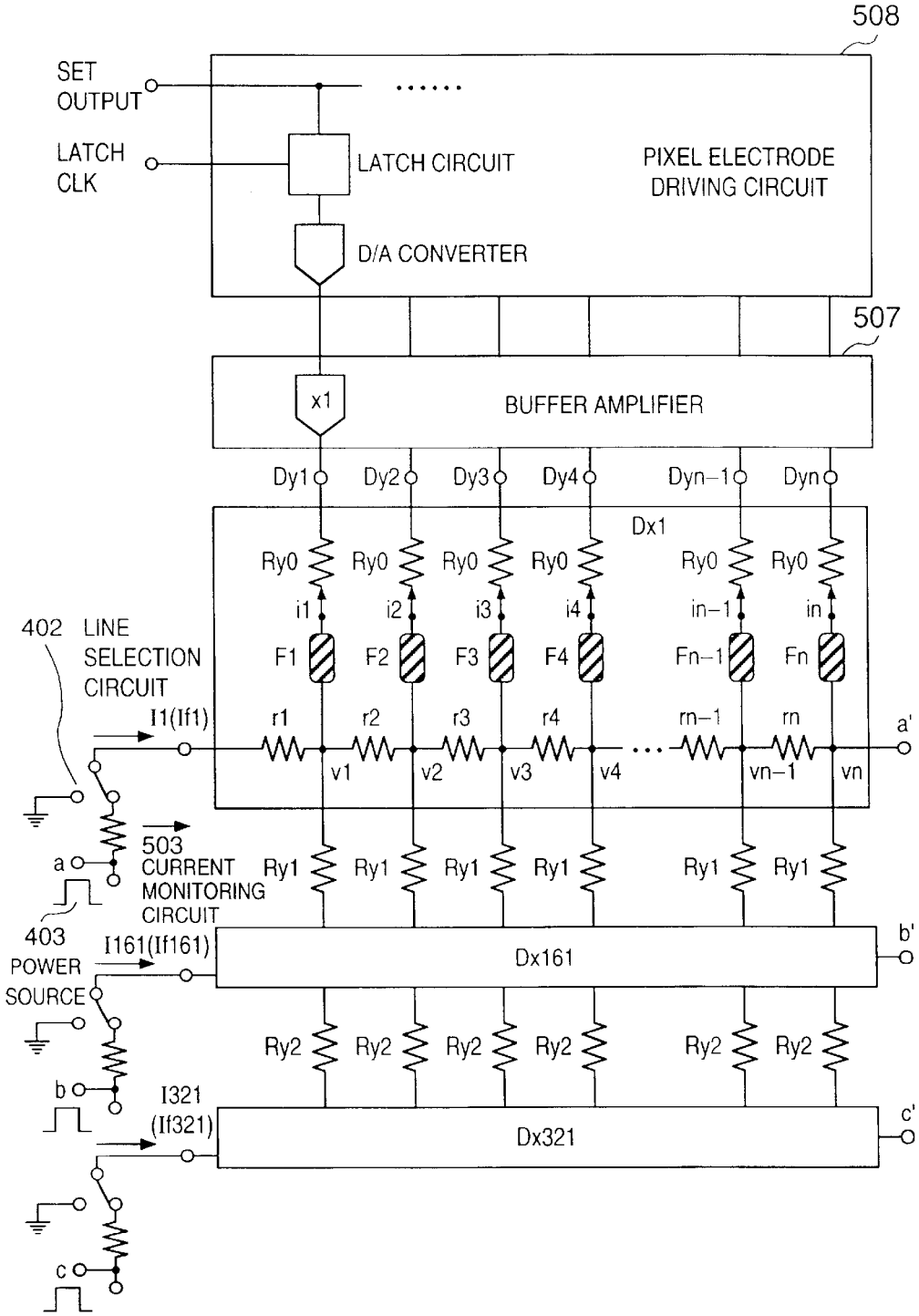
FIG. 44 is a circuit diagram showing the column wiring driving unit of a pre-driving apparatus according to the 16th embodiment of the present invention.

In FIG. 44, reference symbols F1 to Fn denote surface-conduction type electron-emitting devices on the line of the row-direction wiring terminal Dx1; r1 to rn, wiring resistances of respective portions on the row-direction wiring terminal Dx1; Ry0, wiring resistances from the feeding terminals of the column-direction wirings Dy1 to Dyn to corresponding surface-conduction type electron-emitting devices; and Ry1 and Ry2, column-direction wiring resistances between Dx1 and Dx161, and Dx161 and Dx321.

Since both the row- and column-direction wirings are generally designed with the same line width, thickness, and material, r1 to rn are considered to be almost equal except for variations in the manufacture. In addition, Ry0, Ry1, and Ry2 are also considered to be formed with almost the same resistance value. Although the equivalent resistance value of the surface-conduction type electron-emitting device changes (decreases) before and after pre-driving, the equivalent resistance of each device is much higher than the values Ry0, Ry1, and Ry2, and the influence of a voltage drop by the column-direction wiring can be ignored. The equivalent resistance values of the surface-conduction type electron-emitting devices F1 to Fn are designed higher than r1 to rn. To simultaneously pre-drive the three lines Dx1, Dx161, and Dx321, the control circuit 506 controls a line selection circuit 402 via the timing generator 505 to connect the power source 403 for outputting the pre-driving voltage Vpre and a current detection circuit 503 to the row-direction wiring terminals Dx1, Dx161, and Dx321. Then, the three lines are driven by the pre-driving voltage Vpre.

The terminals Dy1 to Dyn are driven by a buffer amplifier 507. The buffer amplifier 507 operates to sink pre-driving currents i1 to in from the devices F1 to Fn on the line Dx1 and the pre-driving currents of the lines Dx161 and Dx321. The output voltage amplitude of the buffer amplifier 507 is determined by a pixel electrode driving circuit 508.

A basic driving method according to the 16th embodiment will be described as the compensation voltage output setting method of the pixel electrode driving circuit 508.

Figure 45:
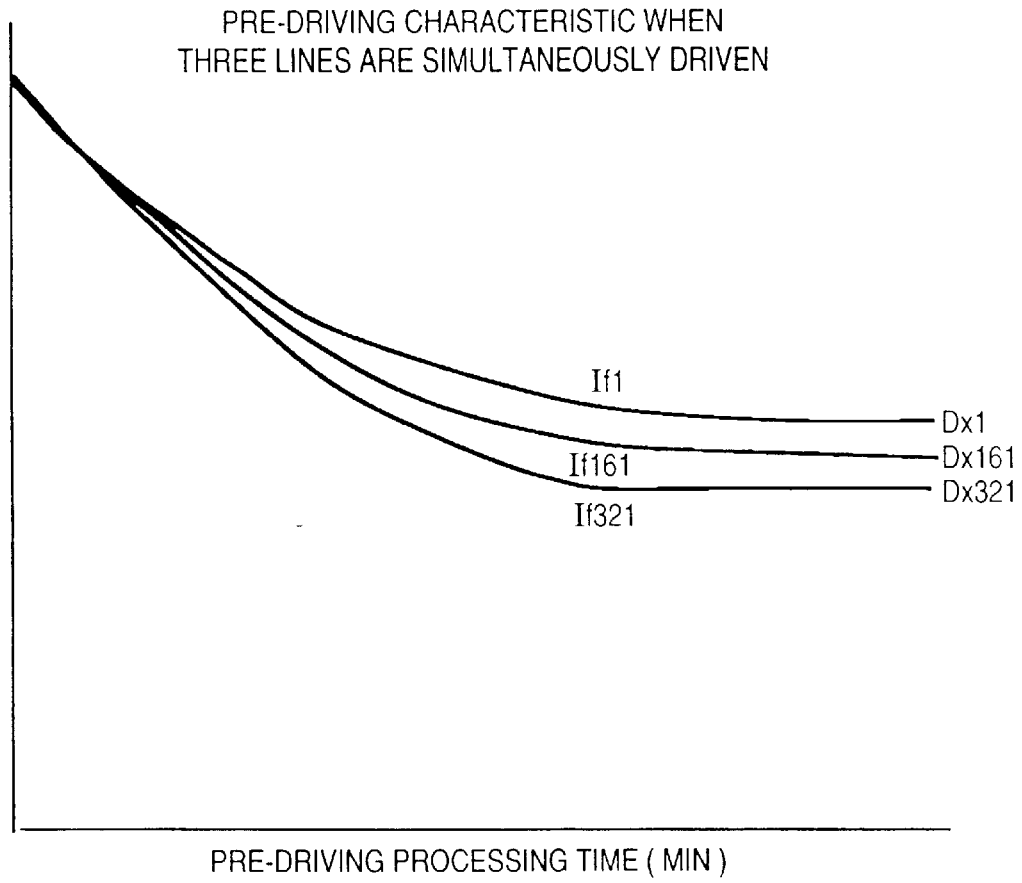
FIG. 45 is a graph showing a pre-driving characteristic when three lines are simultaneously pre-driven in the apparatus of FIG. 44.

In pre-driving, the electrical characteristic of the device changes as shown in FIG. 45. That is, the device current maximizes at the start of pre-driving, and decreases with the progress of electrification. At this time, the terminal voltages of devices on the row wiring Dx1 are monitored to find that voltages v1 to vn change owing to the wiring resistances r1 to rn. The voltage change increases with the progress of pre-driving. For example, for a pre-driving current of 2 mA/device, r1 to rn=10Ω, and n=1000, the terminal vn of the device Fn farthest from the feeding terminal suffers a voltage difference:

$$\Delta V = \tfrac{1}{2} \times 1000 \times 1001 \times 2\ \text{mA} \times 10\ \text{m}\Omega \tag{15}$$

To prevent this, the pixel electrode driving circuit 508 generates a voltage distribution identical to this voltage difference distribution, and drives the terminals Dy1 to Dyn from the buffer amplifier 507 so as to cancel the voltage distribution generated on respective devices. More specifically, the control circuit 506 calculates a voltage drop distribution generated at the terminals v1 to vn by currents flowing through the devices F1 to Fn and the wiring resistances r1 to rn along with the progress of pre-driving current. The control circuit 506 sets the D/A converter output values of the pixel electrode driving circuit 508, thereby setting a compensation voltage for the voltage drop on the column-direction wiring side.

The 16th embodiment adopts a method (to be referred to multiline driving) of simultaneously driving a plurality of row wirings. Three row wirings Dx1, Dx161, and Dx321 are simultaneously driven. The pre-driving voltage is applied to each row-direction wiring from the two sides of the wiring for F1 to Fn.

When the line selection circuit 402 selects the row wirings Dx1, Dx161, and Dx321 to connect to the power source 302 to apply a predetermined voltage to the two sides of each row wiring, pre-driving currents If1, If161, and If321 of the row wirings Dx1, Dx161, and Dx321 flow. FIG. 45 shows a pre-driving characteristic in multiline driving. All the three lines do not flow any currents in the initial state of pre-driving, and gradually flow currents along with the progress of pre-driving.

As pre-driving progresses, the pre-driving currents If1, If161, and If321 change differently from each other. These pre-driving currents vary owing to variations in forming surface-conduction type electron-emitting devices in a larger area of the substrate or variations in forming fissures in forming processing.

Figure 46:
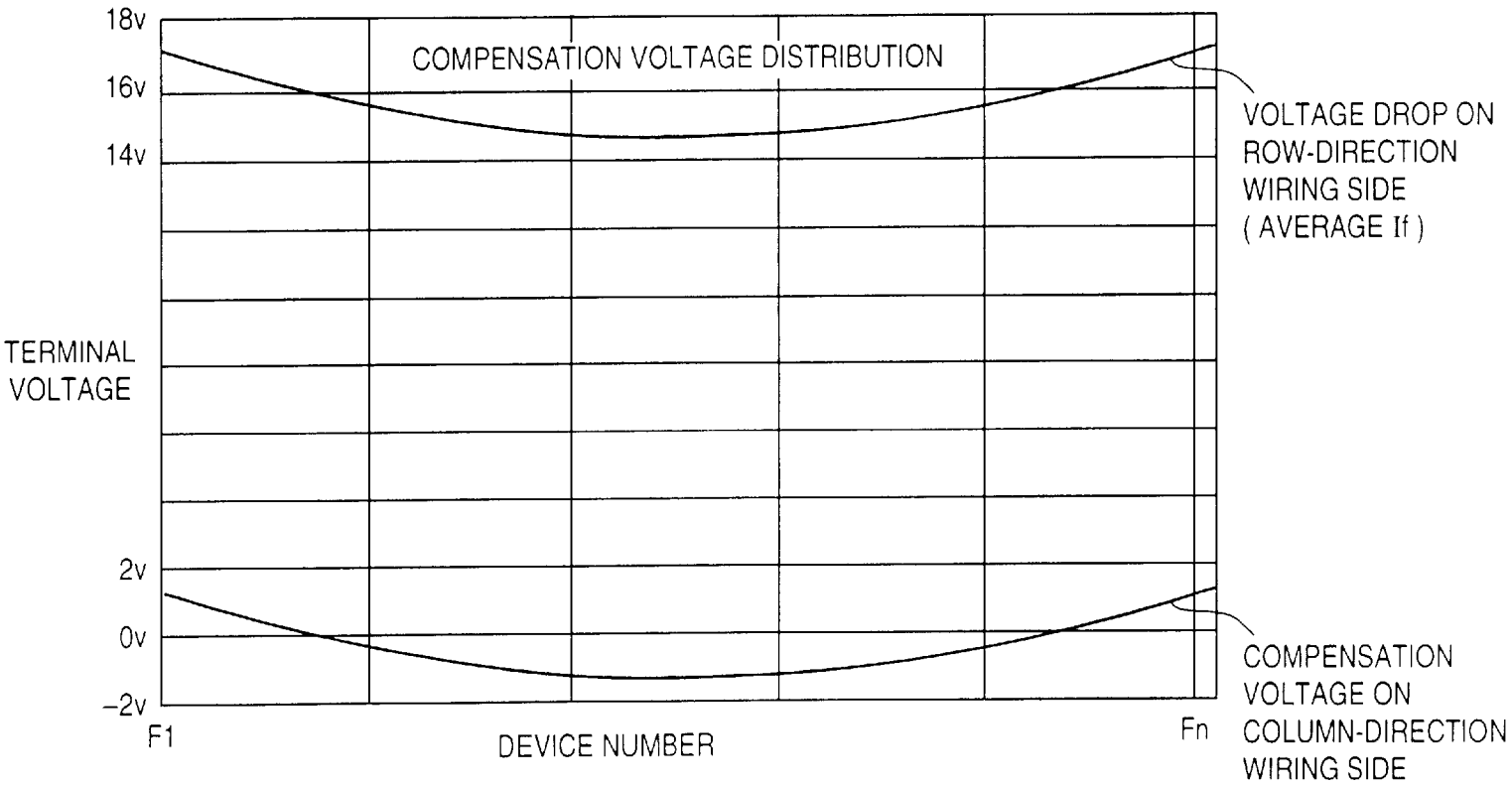
FIG. 46 is a graph showing a voltage distribution in pre-driving in the apparatus of FIG. 44.

FIG. 46 shows a voltage distribution in pre-driving. The ordinate represents the terminal voltage at the two terminals of each device. The abscissa represents device numbers F1 to Fn, which indicate device positions. The power source 403 applies the pre-driving voltage Vpre=16 V to each line. FIG. 46 shows a distribution when pre-driving progresses. In the initial state of pre-driving, the compensation voltage is set around 0 V because the pre-driving current is unknown.

The 16th embodiment employs a method of calculating the average Ifave of multiline-driven row-direction wirings, and applying a compensation voltage on the column-direction wiring side for Ifave. The average Ifave is calculated by sequentially detecting the current values of multiline-driven lines by the control circuit 506 every setting time, and inputting the detected current values as pre-driving currents 509 from the current detection circuit 503 to the control circuit 506.

After the average Ifave is calculated, the compensation potential is calculated. In the 16th embodiment, the pre-driving voltage is applied to the row-direction wiring from the two sides of the wiring for F1 to Fn, as shown in FIG. 30. Hence, a voltage drop by the wiring resistance maximizes around the center on the column-direction wiring. In applying the voltage from the two sides, the power source 403 in FIG. 44 is connected between a and a' for Dx1, b and b' for Dx161, and c and c' for Dx321.

In this application method, the compensation voltage output is given as follows. Giving iave as Ifava/n for the average pre-driving current Ifave, voltages By1 to Byn to be output from the pixel electrode driving circuit 508 are given using the wiring resistances r1 to rn and iave:

$$ByN = -\tfrac{1}{2} \times rN \times N \times (N+1) \times iave \tag{16}$$

N=F1 to Fn/2 where a pixel number Fn/2 and subsequent pixel numbers are given by N=Fn−N'.

(N' is calculated as a pixel number ranging from Fn/2 to Fn.)

By this calculation, the compensation voltage on the column-direction wiring can be determined based on the average If of the pre-driving current values of multiline-driven row wirings. The compensation voltage is output from the pixel electrode driving circuit 508 to the terminals Dy1 to Dyn via the buffer amplifier 507. The compensation voltage is kept effective till the end of the pre-driving process.

As pre-driving end conditions, a necessary driving time is, in advance, obtained by pre-driving experiments on single devices using the same arrangement and same manufacturing method. A multi surface-conduction type electron-emitting device is also driven while the driving time.

As described above, the 16th embodiment simultaneously pre-drives three row-direction wirings to shorten the process time. In the 16th embodiment, the substrate 401 is constituted by a simple matrix of devices, and the compensation voltage is common to multiline-driven row-direction wirings.

However, pre-driving characteristics (pre-driving currents) flowing through respective row-direction wirings are not always uniform, and vary. Compensation voltages calculated for respective row wirings have voltage differences. For this reason, setting of a voltage applied to the column-direction wiring side is important in multiline driving.

The compensation voltage must be set to reduce variations in voltages applied to devices to be actually pre-driven. If the compensation voltage is set in accordance with the pre-driving current of a specific row wiring, the application voltage may greatly vary.

To more uniformly pre-drive devices against variations in characteristics of row wiring lines, the 16th embodiment calculates the compensation voltage from the column-direction wiring using the average pre-driving current of multiline-driven row wirings, thereby minimizing variations in devices between row-direction wirings.

Figure 47:
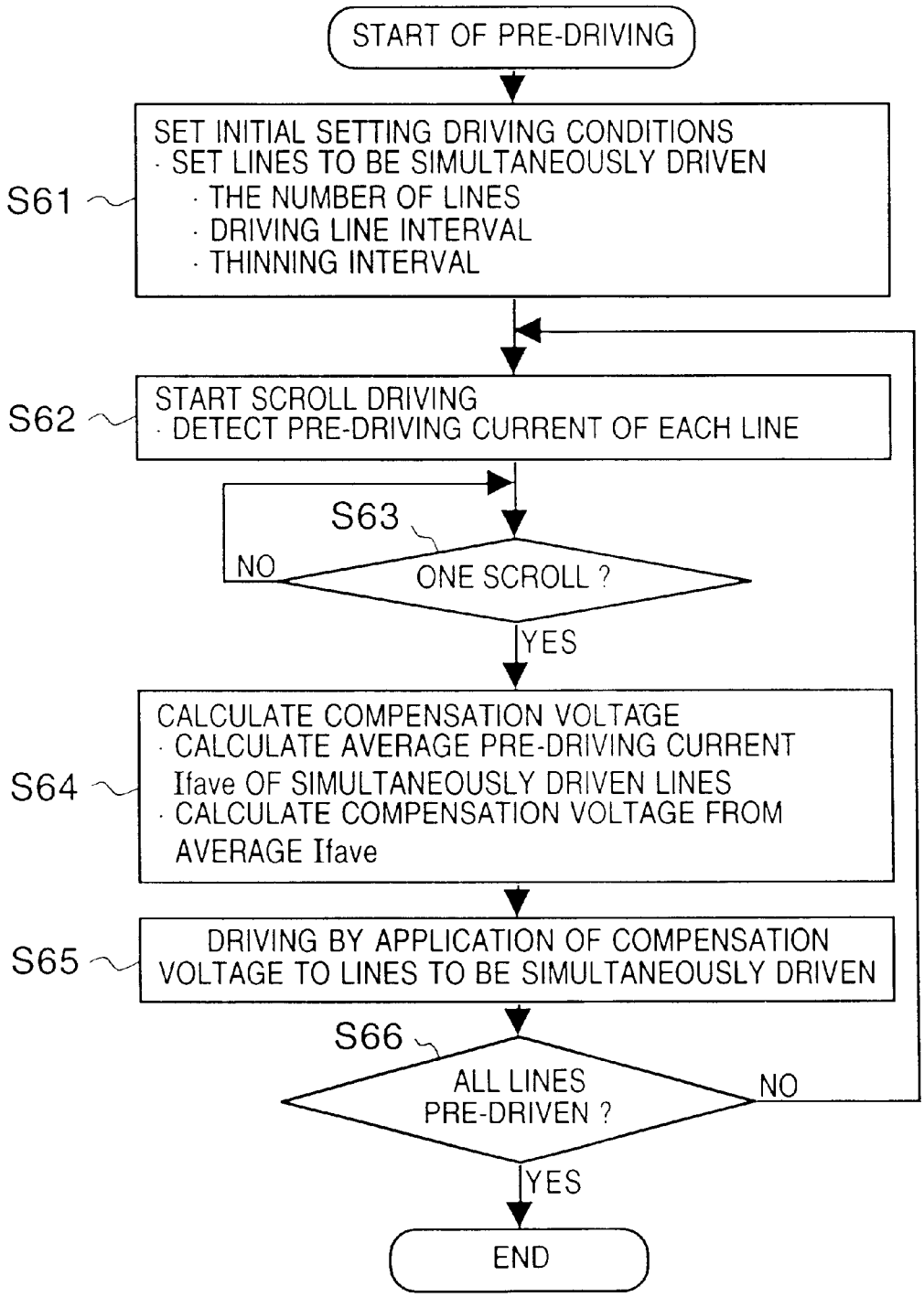
FIG. 47 is a flow chart showing pre-driving according to the 16th embodiment.

A sequence for realizing this pre-driving will be explained with reference to FIG. 47.

(STEP 61)

The control circuit 506 starts pre-driving upon reception of a pre-driving start instruction. The control circuit 506 sets lines to be simultaneously driven as initial driving condition settings at the start of pre-driving.

As simultaneous driving settings, the number of lines to be simultaneously driven in multiline driving, the line interval between row-direction wirings to be driven, and the thinning intervals are set.

Pre-driving in the 16th embodiment adopts a method of applying a voltage while sequentially scrolling a plurality of selected lines one by one. Lines to be scrolled are processed as one block. In practice, pre-driving is done by multiline driving by designating blocks.

According to this driving method, the number of scroll lines to be sequentially driven is set to 10. In simultaneously driving three lines, 3×10=30 lines are processed as a block. The number of lines to be simultaneously driven is optimized in consideration of power applied to the substrate 401 and heat generated upon driving in units of blocks.

In the 16th embodiment, driving line intervals correspond to line intervals between the three lines Dx1, Dx161, and Dx321 to be simultaneously driven. In the 16th embodiment, the driving line interval represents 160 lines.

Driving lines must be uniformly designated on the entire substrate 401 in consideration of concentration of a thermal distribution caused by power applied to the substrate 401.

The thinning interval is a scroll interval in simultaneous driving. In the 16th embodiment, a thinning interval of 10 lines is designated to select lines Dx11, Dx171, and Dx331 as next lines selected after the lines Dx1, Dx161, and Dx321 are driven.

Accordingly, lines to be simultaneously driven as a block are selected as follows:

TABLE 4

| | | | |
|---|---|---|---|
| 1 | Dx1 | Dx161 | Dx321 |
| 2 | Dx11 | Dx171 | Dx331 |
| 3 | Dx21 | Dx181 | Dx341 |
| . | | . | |
| . | | . | |
| . | | . | |
| 10 | Dx91 | Dx251 | Dx411 |

(STEP 62)

After initial setting driving conditions are set in STEP 61, pre-driving starts.

To simultaneously drive three lines as multiline driving, a driving line setting signal is set in the timing circuit 505. The timing circuit 505 detects line numbers to be driven, and outputs a line select signal to the line selection circuit 402. The line select signal turns on the relays of predetermined row-direction wiring numbers to connect the row-direction wirings to the power source 403 and drive them. When pre-driving starts by scroll driving, the current detection circuit 503 detects the pre-driving currents of driving lines, and stores the detected values in a memory 511.

(STEP 63)

The flow waits for the end of scroll in one block (30 lines in the 16th embodiment) and the end of current detection.

(STEP 64)

In STEP 64, the compensation voltage is calculated.

In STEP 62 and STEP 63, the pre-driving currents of multiline-driven row wirings are detected, and stored in the memory 511. Then, the average Ifave of the pre-driving currents is calculated. The average Ifave is calculated every multiline-driven lines. Lines selected in STEP 61 are sequentially scrolled one by one for 10 scroll lines. In simultaneously pre-driving three lines, the average Iave of one scroll is calculated. The average Ifave is calculated as follows. Current detection sampling points are set during the progress of pre-driving over time, the currents of multiline-driven row wirings are detected every predetermined time, and the latest Ifave is stored in the memory 511.

Then, the compensation voltage on the column-direction wiring side is calculated from the obtained Ifave. The compensation voltage can be calculated from equation (16). The wiring resistance r is obtained by measuring the wiring resistance of each row-direction wiring, and storing it in the memory 511. The compensation voltage is also measured every time Ifave is updated. If necessary, the compensation voltage value can be stored in the memory 511 because it changes with the progress of the process.

(STEP 65)

In STEP 65, the compensation voltage value calculated every multiline driving in STEP 64 is sequentially applied to column-direction wirings by the pixel electrode driving circuit 508 and buffer amplifier 507 via the control circuit 506. In the 16th embodiment, multiline driving is performed in units of blocks, so that the number of lines for one pre-driving processing is 30.

In the pre-driving process, setting for one process is not limited to one block, and a plurality of blocks may be set in advance.

(STEP 66)

Whether the pre-driving process progresses to end pre-driving of multiline-driven lines is checked.

If pre-driving has not ended yet, the flow returns to STEP 62 to restart scroll driving.

Pre-driving ends when the current of each device reaches a predetermined value while the pre-driving current is detected, or by defining the end time from the start of pre-driving.

To end pre-driving when the current value of each device reaches a predetermined value, the pre-driving status must be grasped for each line by the control circuit 506 or the like. To the contrary, to control pre-driving by the time, the time must be set to unify pre-driving. In the 16th embodiment, the end of pre-driving is set by defining the pre-driving time.

In this fashion, pre-driving of the substrate 401 ends. By executing this sequence, pre-driving is completed within ⅓ the process time required to driven lines one by one.

Note that in the 16th embodiment, three lines are multiline-driven. However, the number of lines to be simultaneously driven is not limited to this. To further shorten the pre-driving processing time, the number of lines to be simultaneously driven can be increased in consideration of heat generation in the substrate 401 or the like.

In the 16th embodiment, the power source 403 applies a positive output. Alternatively, the power source 403 may apply a negative voltage. In this case, the direction of a current flowing into the column-direction wiring is reversed, and the polarity of the compensation voltage from the buffer amplifier 507 is also inverted. The pixel electrode driving circuit 508 is constituted by the same number of D/A converters as the number of column-direction wirings. However, since the compensation voltage distribution changes gradually, as shown in FIGS. 19A and 19B, the number of D/A converters may be decreased, and the application voltage may be divided by resistances or the like to define the voltage.

In the pre-driving process, the compensation voltage value need not always be updated every scroll, unlike the 16th embodiment, and may be appropriately updated in accordance with the progress of pre-driving.

As described above, the pre-driving process of the 16th embodiment can form relatively uniform devices almost free from variations in electron-emitting characteristics. A display panel is fabricated using the substrate 401 to realize a high-quality image display apparatus almost free from variations.

By increasing the number of lines to be simultaneously driven in multiline driving, the pre-driving process time can be greatly shortened.

[17th Embodiment]

Figure 48:
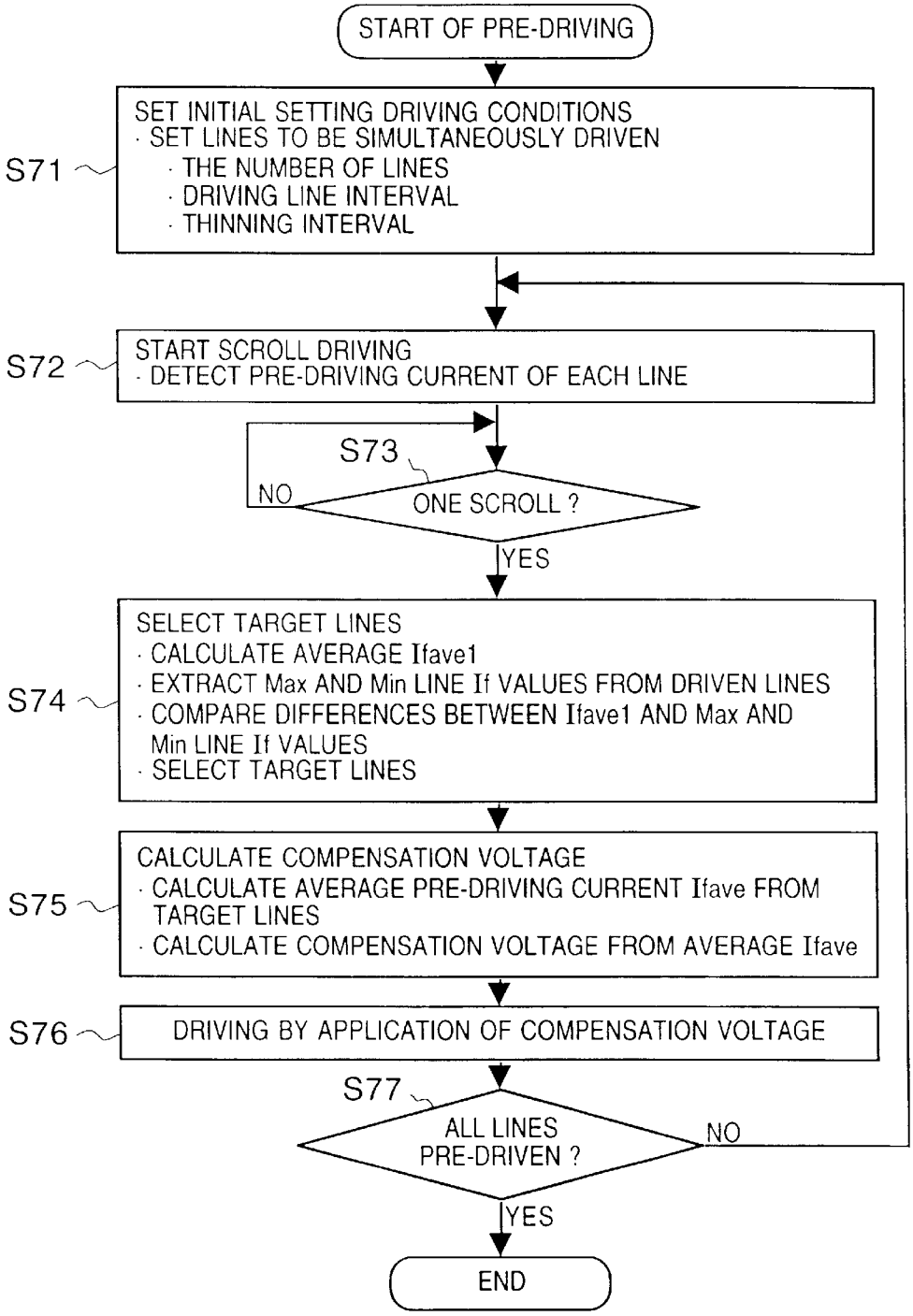
FIG. 48 is a flow chart showing pre-driving according to the 17th embodiment of the present invention.

A flow chart according to the 17th embodiment of the present invention will be described with reference to FIG. 48.

In the 17th embodiment, an apparatus and driving circuit arrangement in the pre-driving process are the same as those in FIG. 15. The structure of a surface-conduction type electron-emitting device substrate is also the same as that of the substrate 401, and a description thereof will be omitted.

Similar to the 16th embodiment, the 17th embodiment uses the average If value in order to calculate the compensation voltage. Further, the 17th embodiment inserts a procedure of selecting lines subjected to calculation in the process of calculating the average If value. This procedure can increase the precision of the compensation voltage for lines having the same characteristic.

Variations upon multiline-driving a plurality of row wirings may be caused by the following factors:

1) Original variations in characteristics of surface-conduction type electron-emitting devices on each row wiring, or variations in forming devices in forming processing, as described with reference to the 16th embodiment as well.
2) Physical defects (disconnection/short-circuiting) on the matrix wiring In actually forming a panel, variations are caused hardly by the factor 2) but dominantly by the factor 1). However, if multiline-driven lines include a line having a pre-driving current much larger or smaller than those of the remaining lines, this line affects the average If of lines to be simultaneously driven. As a result, the calculated compensation voltage value cannot be optimized.

To solve this problem, in the 17th embodiment, the pre-driving currents of respective multiline-driven row wirings are obtained to temporarily calculate the average Ifave. Then, lines corresponding to MAX and MIN values among the pre-driving currents of these multiline-driven lines are extracted, and their differences from the average Ifave are calculated. The differences between the average Ifave and the current values of the extracted lines corresponding to the MAX and MIN values are calculated to determine based on the differences whether the extracted lines are subjected to calculation of the compensation voltage. After this processing, the average Ifave for calculating the compensation voltage is newly obtained to calculate the compensation potential on the column-direction side.

This will be explained with reference to the flow chart of FIG. 48. For descriptive convenience, the number of row-direction wirings on a substrate 401 and the number of multiline driving lines are the same as those in the 16th embodiment.

(STEP 71)

Similar to the 16th embodiment, initial setting driving conditions are set.

A control circuit 506 starts pre-driving upon reception of a pre-driving start instruction. The control circuit 506 sets lines to be simultaneously driven as initial driving condition settings at the start of pre-driving.

As simultaneous driving settings, the number of lines to be simultaneously driven in multiline driving, the line interval between row-direction wirings to be driven, and the thinning interval are set.

Pre-driving in the 17th embodiment also adopts a method of applying a voltage while sequentially scrolling a plurality of selected lines one by one. Similar to the 16th embodiment, the number of scroll lines to be sequentially driven is 10. In simultaneously driving three lines, 3×10=30 lines are processed as a block. The number of lines to be simultaneously driven is optimized in consideration of power applied to the substrate 401 and heat generated upon driving in units of blocks.

Also in the 17th embodiment, driving line intervals correspond to line intervals between three lines Dx1, Dx161, and Dx321 to be simultaneously driven. The driving line interval is 160 lines.

Driving lines must be uniformly designated on the entire substrate 401 in consideration of concentration of a thermal distribution caused by power applied to the substrate 401.

The thinning interval is a scroll interval in simultaneous driving. Similar to the 16th embodiment, a thinning interval of 10 lines is designated to select lines Dx11, Dx171, and Dx331 as next lines selected after the lines Dx1, Dx161, and Dx321 are driven. Accordingly, the driving pattern of one block is the same as that in the 16th embodiment.

(STEP 72)

After initial setting driving conditions are set in STEP 71, pre-driving starts.

To simultaneously drive three lines as multiline driving, a driving line setting signal is set in a timing circuit 505. The timing circuit 505 detects line numbers to be driven, and outputs a line select signal to a line selection circuit 402. The line select signal turns on the relays of predetermined row-direction wiring numbers to connect the row-direction wirings to a power source 403 and drive them. When pre-driving starts by scroll driving, a current detection circuit 503 detects the pre-driving currents of driving lines, and stores the detected values in a memory 511.

(STEP 73)

The flow waits for the end of scroll in one block (30 lines in the 17th embodiment) and the end of current detection.

(STEP 74)

In STEP 74, target calculation lines are selected from multiline-driven lines in order to calculate the compensation voltage. In FIG. 45, an average Ifave1 of the pre-driving currents of the lines Dx1, Dx161, and Dx321 is obtained from the memory 511.

MAX and MIN values are detected among the measured pre-driving current values of the row wirings from the memory 511. The current values are detected from the latest values in measurement update. In the 17th embodiment, two of three multiline-driven lines are selected.

Based on the obtained average Ifave1, the selected MAX and MIN values undergo $$\text{MAX } Value - Ifavel = \Delta Ifa$$

$$Ifavel - \text{MIN } Value = \Delta Ifb \quad (17)$$

Whether extracted MAX and MIN lines are used as target lines for calculating the compensation voltage is checked from the obtained ΔIfa and ΔIfb. In this determination, ΔIfa and ΔIfb are compared with a predetermined allowable value in order to check whether characteristics greatly change during multiline driving.

In the 17th embodiment, the allowable value is set to, e.g., 1 A, and a line exhibiting a current difference of 1 A or more from the average Ifavel is excluded from target lines. By this determination sequence, deviation of the compensation voltage by the above-described variation factors can be reduced. The 17th embodiment is effective for a relatively large number of multiline-driven lines, whereas the method of the 16th embodiment is optimum for multiline driving of, e.g., two lines.

In the 17th embodiment, the number of multiline-driven lines is three. When the number of lines to be simultaneously driven is increased, and a line having a current value larger than the set value exhibits in addition to lines having MAX and MIN values, target line determination processing is realized by the following procedures.

As described in STEP 74, line current values corresponding to the MAX and MIN values are extracted and compared to determine target lines. When, for example, a line having the MAX value exceeds the allowable value and is excluded from target lines, a line flowing the second largest current value next to the MAX line is extracted and subjected to comparison/determination processing. Depending on whether the line is used as a target line, whether a line flowing the third largest current value is compared is determined. This determination processing is repeated. Determination processing for the MIN current value is also the same as the above processing.

By repetitively executing this sequence, target lines can be selected even for a large number of wirings to be simultaneously driven.

(STEP 75)

After this processing, the average Ifave for calculating the compensation voltage is obtained, and the compensation voltage in the column direction is calculated. In STEP 75, the compensation voltage is calculated.

The average Ifave is calculated as follows. Current detection sampling points are set during the progress of pre-driving over time, the currents of multiline-driven row wirings are detected every predetermined time, and the latest Ifave is stored in the memory 511.

From the calculated Ifave, the compensation voltage on the column-direction wiring side is calculated. The compensation voltage can be calculated from the equation (17). A wiring resistance r is obtained by measuring the wiring resistance of each row-direction wiring, and storing it in the memory 511. The compensation voltage is also measured every time Ifave is updated. If necessary, the compensation voltage value can be stored in the memory 511 because it changes with the progress of the process.

(STEP 76)

In STEP 76, the compensation voltage value calculated every multiline driving in STEP 75 is sequentially applied to column-direction wirings by a pixel electrode driving circuit 508 and buffer amplifier 507 via the control circuit 506. In the 17th embodiment, multiline driving is performed in units of blocks, so that the number of lines for one pre-driving processing is 30.

In the pre-driving process, setting for one process is not limited to one block, and a plurality of blocks may be set in advance.

(STEP 77)

Whether the pre-driving process progresses to end pre-driving of multiline-driven lines is checked.

If pre-driving has not ended yet, the flow returns to STEP 72 to restart scroll driving.

The end of pre-driving is set by defining the end time from the start of pre-driving.

[18th Embodiment]

Figure 49:
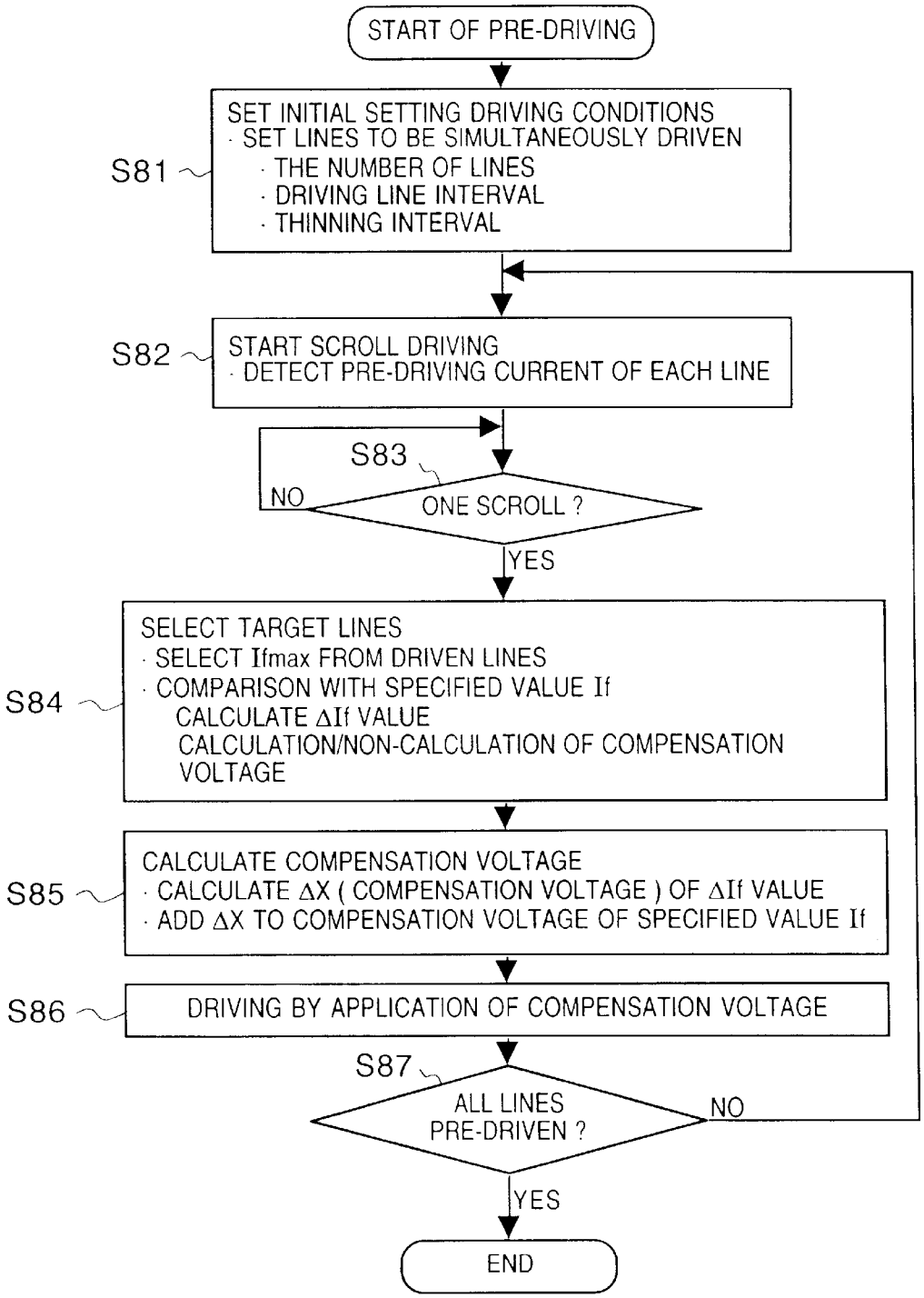
FIG. 49 is a flow chart showing pre-driving according to the 18th embodiment of the present invention.

The 18th embodiment of the present invention will be described with reference to the flow chart shown in FIG. 49.

In the 18th embodiment, an apparatus and driving circuit arrangement in the pre-driving process are the same as those in FIG. 15. The structure of a surface-conduction type electron-emitting device substrate is also the same as that of the substrate 401, and a description thereof will be omitted.

The 18th embodiment compensates for the minimum value of the pre-driving voltage applied to each device.

In the pre-driving process, a line suffering the largest voltage drop caused by a pre-driving current If flowing through the surface-conduction type electron-emitting device and the row-direction wiring resistance is selected. To compensate for the minimum pre-driving voltage, an If difference (ΔIf) from a specified If value is calculated.

ΔX (compensation voltage value on the column-direction side) corresponding to ΔIf is obtained, and added to the compensation voltage of the selected line, thereby ensuring the pre-driving voltage applied to the line as the minimum pre-driving voltage.

That is, a line suffering the largest voltage drop exhibits the largest voltage drop at the center of the row-direction wiring, and the voltage actually applied to its devices is low. In the multiline pre-driving process, device characteristics are undesirably determined by the smallest voltage value among pre-driving voltages applied by the compensation voltage obtained from a plurality of driven lines.

If lines are driven one by one in a process after the pre-driving process, devices which received a low voltage in pre-driving may receive a device voltage equal to or higher than the pre-driving voltage. In this case, the device characteristics determined by the pre-driving process are not compensated, and the panel varies in characteristics between lines or devices.

To solve this problem, the 18th embodiment selects a line having the MAX value from multiline-driven lines, and determines the compensation voltage on the column-direction wiring side so as to compensate for the minimum pre-driving voltage on the basis of the selected line.

This will be explained with reference to the flow chart in FIG. 49.

(STEP 81)

In STEP 81, initial setting driving conditions are set.

As initial driving setting conditions, the line interval between row-direction wirings, and the thinning interval are set.

Pre-driving in the 18th embodiment also adopts a method of applying a voltage while sequentially scrolling selected lines one by one. Similar to the 16th embodiment, the number of scroll lines to be sequentially driven is 10. In simultaneously driving three lines, 3×10=30 lines are processed as a block. The number of lines to be simultaneously driven is optimized in consideration of power applied to a substrate 401 and heat generated upon driving in units of blocks.

Also in the 18th embodiment, driving line intervals correspond to line intervals between three lines Dx1, Dx161, and Dx321 to be simultaneously driven. The driving line interval is 160 lines.

Driving lines must be uniformly designated on the entire substrate 401 in consideration of concentration of a thermal distribution caused by power applied to the substrate 401.

The thinning interval is a scroll interval in simultaneous driving. Similar to the 16th embodiment, a thinning interval of 10 lines is designated to select lines Dx11, Dx171, and Dx331 as next lines selected after the lines Dx1, Dx161, and Dx321 are driven. Accordingly, the driving pattern of one block is the same as that in the 16th embodiment.

(STEP 82)

After initial setting driving conditions are set in STEP 81, pre-driving starts.

To simultaneously drive three lines as multiline driving, a driving line setting signal is set in a timing circuit 505. The timing circuit 505 detects line numbers to be driven, and outputs a line select signal to a line selection circuit 402. The line select signal turns on the relays of predetermined row-direction wiring numbers to connect the row-direction wirings to a power source 403 and drive them. When pre-driving starts by scroll driving, a current detection circuit 503 detects the pre-driving currents of driving lines, and stores the detected values in a memory 511.

(STEP 83)

The flow waits for the end of scroll in one block (30 lines in the 18th embodiment) and the end of current detection.

(STEP 84)

In STEP 84, target calculation lines are selected from multiline-driven lines in order to ensure the minimum pre-driving voltage. In FIG. 45, pre-driving currents If1, If161, and If321 of the lines Dx1, Dx161, and Dx321 are measured and stored in the memory 511.

A MAX value is detected among the measured pre-driving current values of the row wirings from the memory 511. The current values are detected from the latest values in measurement update.

In FIG. 45, Dx1 is selected as an Ifmax line upon simultaneously pre-driving three lines. The If value of the selected Dx1 is compared with a specified value If for compensating for the pre-driving voltage.

This specified value If is defined such that a device voltage applied as the minimum pre-driving voltage is determined based on the maximum voltage drop value caused by the wiring resistance and individual device current. For example, letting Va be the minimum pre-driving voltage (row-direction wiring side), the difference Vpre/2−Va=ΔVd upon application of the pre-driving voltage Vpre is the maximum voltage drop value, and the individual device current IfN is given by $$\Delta Vd = \tfrac{1}{2} \times N \times (N+1) \times rN \times IfN \tag{18}$$

(where rN is the wiring resistance value between devices, IfN is the individual device current, and N is the number of devices) IfN×N (individual current× the number of devices) is calculated and determined as the specified value If.

In other words, the specified value If can be considered to be the target value of a line current value for ensuring the minimum pre-driving voltage or more for the pre-driving voltage to a device that attenuates due to a voltage drop.

In the 18th embodiment, each line current is detected by the current detection circuit 503 during the pre-driving process. The minimum pre-driving voltage value Va is changed every period to adjust the specified value If to the process state.

Particularly, the line current hardly flows in the initial stage of pre-driving, and the influence of voltage attenuation by a voltage drop can be substantially ignored. The minimum pre-driving voltage Va becomes almost equal to the pre-driving voltage Vpre/2.

In determination processing, Ifmax−specified If=ΔIf is defined. For ΔIf>0, devices on the Dx1 line are determined not to reach the minimum pre-driving voltage owing to a voltage drop or the like. For ΔIf≦0, devices on the Dx1 line are determined to receive the minimum pre-driving voltage.

Setting the specified value If requires a constant wiring resistance value between lines on the panel because a voltage drop is considered to be caused by a change in device current. Since the voltage drop on the line is determined by equation (18), the voltage drop is dominantly caused by IfN so long as rN is the same between lines.

If the wiring resistance value varies between lines, the specified value If must be individually set every multiline driving. In this case, the wiring resistance value is set in the memory 511 in advance for lines to be multiline-driven. The wiring resistance value of an Ifmax line selected in multiline driving is read out from the memory 511 to determine the specified value If using the readout value.

In STEP 84, whether the value ΔIf is calculated and the minimum pre-driving voltage is ensured from the value ΔIf is checked.

(STEP 85)

In STEP 85, the compensation voltage is calculated. The compensation voltage value changes depending on the determination result of ΔIf in STEP 84. For ΔIf>0, no minimum voltage is determined to be applied. Thus, the compensation voltage ΔX for the value ΔIf is calculated. ΔX is calculated similarly to the 16th embodiment.

Then, the compensation voltage for the predetermined specified value If is calculated. The compensation voltage for the specified value If may be calculated in advance. In this case, the calculated value is stored in the memory 511.

The calculated compensation voltage ΔX is added to the compensation voltage for the specified value If. An application voltage from the column-direction wiring side can be set by the compensation voltage obtained in this processing, so as to ensure the minimum pre-driving voltage for the Ifmax line in multiline driving. The remaining lines (Dx161 and Dx321 shown in FIG. 45) flow smaller pre-driving currents than that of the line Dx1. By applying this compensation voltage, the lines Dx161 and Dx321 receive a voltage equal to or higher than the minimum pre-driving voltage.

For $\Delta If \leqq 0$, at least the minimum pre-driving voltage is determined to be applied to the Ifmax line. Processing for $\Delta If > 0$ need not be performed. The compensation voltage on the column-direction wiring side may be calculated by obtaining the average If of multiline-driven lines.

Also in this case, the compensation voltage value determined by the average If can ensure a satisfactory pre-driving voltage for the Ifmax line.

(STEP 86)

In STEP 86, the compensation voltage value calculated every multiline driving in STEP 85 is sequentially applied to column-direction wirings by a pixel electrode driving circuit 508 and buffer amplifier 507 via a control circuit 506. Since the 18th embodiment performs multiline driving in units of blocks, the number of lines in one pre-driving process is 30.

In the pre-driving process, setting for one process unit is not limited to one block, and a plurality of blocks may be set in advance.

(STEP 87)

Whether the pre-driving process progresses to end pre-driving of multiline-driven lines is checked. If pre-driving has not ended yet, the flow returns to STEP 82 to restart scroll driving.

Pre-driving ends when the current of each device reaches a predetermined value while the pre-driving current is detected, or by defining the end time from the start of pre-driving.

To end pre-driving when the current value of each device reaches a predetermined value, the pre-driving status must be grasped for each line by the control circuit 506 or the like. To the contrary, to control pre-driving by the time, the time must be set to unify pre-driving. In the 18th embodiment, the pre-driving time is set as an end condition.

By performing the pre-driving process according to the 18th embodiment, the minimum pre-driving voltage can be applied to all devices to ensure the voltage of the specified value.

Accordingly, changes in device characteristics can be prevented by a voltage applied in the driving process after the pre-driving process. A panel comprising electron emitting devices whose characteristics are relatively compensated can be fabricated.

Three lines are multiline-driven in the 18th embodiment, too, but the number of lines to be simultaneously driven is not limited to this. To further shorten the pre-driving processing time, the number of lines to be simultaneously driven can be increased in consideration of heat generation in the substrate 401 or the like.

Similar to the 16th embodiment, the power source 403 applies a positive output. Alternatively, the power source 403 may apply a negative voltage. In this case, the direction of a current flowing into the column-direction wiring is reversed, and the polarity of the compensation voltage from the buffer amplifier 507 is also inverted. The pixel electrode driving circuit 508 is constituted by the D/A converters equal in number to the column-direction wirings. However, since the compensation voltage distribution changes gradually, as shown in FIG. 46, the number of D/A converters may be decreased, and the application voltage may be divided by resistances or the like to define the voltage.

In the above description, the present invention is applied to an electron source having surface-conduction type electron-emitting devices arranged in a matrix. Alternatively, the present invention can be applied to an electron source having surface-conduction type electron-emitting devices arranged in a ladder shape, as shown in FIG. 50. The present invention can also be applied to an electron source having another type of devices such as FE or MIM type devices, in addition to surface-conduction type electron-emitting devices.

As many apparently widely different embodiments of the present invention can be made without departing from the spirit and scope thereof, it is to be understood that the invention is not limited to the specific embodiments thereof except as defined in the appended claims.

What is claimed is:

1. A method of manufacturing an electron source having a plurality of electron-emitting devices, characterized by comprising:

the voltage application step of applying potentials to a first wiring commonly connected to a plurality of devices, and a plurality of second wirings respectively connected to the plurality of devices, such that a voltage V1 is applied to the plurality of devices connected to the first wiring by the potentials applied to the first wiring and the plurality of second wirings, the voltage V1 having a relationship with a maximum value V2 of a voltage applied as a normal driving voltage after the voltage application step, so as to satisfy:

giving a current I flowing upon application of a voltage V when the voltage V falling within a voltage range causing electron emission upon application of the voltage between two electrodes of each device is applied to the device:

$$I=f(V) \tag{1}$$

and letting f' (V) be a differential coefficient of f(V) at the voltage V, a condition:

$$f(V1)/\{V1\cdot f'(V1)-2f(V1)\}>f(V2)/\{V2\cdot f'(V2)\} \tag{2}$$

wherein the potential applied to each second wiring is set to reduce a difference in magnitude of the voltage V1 applied to each device as a potential difference between the potential applied to the device through the first wiring and the potential applied to the device through each second wiring.

2. The method according to claim 1, wherein the voltage application step is performed in a high vacuum atmosphere.

3. The method according to claim 1, wherein the voltage application step is performed in an atmosphere in which deposition of a substance in the atmosphere or a substance originating from the substance in the atmosphere is suppressed at a portion serving as an electron-emitting portion of each device.

4. The method according to claim 1, wherein each device has two electrodes, the two electrodes sandwich a gap, and the voltage application step is performed in an atmosphere in which the gap between the two electrodes is not narrowed by deposition of a substance in the atmosphere or a substance originating from the substance in the atmosphere.

5. The method according to claim 1, wherein the voltage application step is performed in an atmosphere in which carbon and a carbon compound in the atmosphere has a partial pressure of not more than $1\times10^{-6}$ Pa.

6. The method according to claim 1, wherein the voltage application step is performed after the step of depositing a deposit at a portion serving as an electron-emitting portion of each device.

7. The method according to claim 1, wherein the potential applied to each second wiring is updated during the voltage application step.

8. The method according to claim 1, wherein the voltage application step comprises applying a pulse-like potential.

9. The method according to claim 1, wherein the voltage application step comprises applying a pulse-like voltage a plurality of number of times.

10. The method according to claim 1, wherein the potential applied to the first wiring is set so that the potential applied to each of the plurality of second wirings becomes positive or negative.

11. The method according to claim 1, wherein the voltage application step includes the step of selecting at least one of a plurality of first wirings, and a predetermined potential is applied to the selected first wiring to apply the voltage V1 to a plurality of devices connected to the selected first wiring.

12. The method according to claim 11, wherein a predetermined potential different from the potential applied to the selected first wiring is applied to a first wiring other than the selected first wiring.

13. The method according to claim 12, wherein the predetermined potential different from the potential applied to the selected first wiring is a potential smaller than a maximum value and larger than a minimum value among the potentials applied to the plurality of second wirings in order to apply the voltage V1 to a plurality of devices connected to the selected first wiring.

14. The method according to claim 11, wherein the voltage application step comprises applying the voltage V1 to a plurality of devices connected to each first wiring while sequentially changing the first wiring to be selected.

15. The method according to claim 11, wherein first wirings to be simultaneously selected in the voltage application step are some of the plurality of first wirings.

16. The method according to claim 15, further comprising the step of determining first wirings to be simultaneously selected.

17. The method according to claim 1, wherein first wirings to be simultaneously selected in the voltage application step are some of the plurality of first wirings, and the method further comprises the step of determining unselected first wirings from the plurality of first wirings.

18. A method of manufacturing an electron source having a plurality of electron-emitting devices respectively connected to a plurality of first wirings, characterized by comprising:

the voltage application step of selecting some first wirings from the plurality of first wirings, and applying a voltage V1 to a plurality of devices connected to each of the selected first wirings by potentials applied to the selected first wirings and a potential applied to a second wiring connected to the plurality of devices respectively connected to the selected first wirings, the voltage V1 having a relationship with a maximum value V2 of a voltage applied as a normal driving voltage after the voltage application step, so as to satisfy:

giving a current I flowing upon application of the voltage V when the voltage V falling within a voltage range causing electron emission upon application of the voltage between two electrodes each device is applied to the device:

$$I=f(V) \quad (1)$$

and letting f' (V) be a differential coefficient of f(V) at the voltage V, a condition:

$$f(V1)/\{V1\cdot f'(V1)-2f(V1)\}>f(V2)/\{V2\cdot f'(V2)-2f(V2)\} \quad (2).$$

19. The method according to claim 18, wherein the second wiring includes a plurality of second wirings, the pluralities of first and second wirings extend to substantially cross each other, and the pluralities of first and second wirings form a matrix arrangement.

20. The method according to claim 18, wherein the second wiring includes a plurality of second wirings, and the first and second wirings extend substantially parallel to each other.

21. A method of manufacturing an image forming apparatus having an electron source, and an image forming member for forming an image upon irradiation of electrons emitted by the electron source, characterized in that the electron source manufacturing method defined in any one of claims 1 to 20 is used as a method of manufacturing the electron source.

22. An electron source manufacturing apparatus for practicing the electron source manufacturing method defined in claim 1, characterized by comprising:

first potential application means for applying a potential to the first wiring;

second potential application means for applying potentials to each second wiring; and potential determination means for determining the potentials applied by said second potential application means.

23. A method of adjusting an electron source having a plurality of electron-emitting devices, characterized by comprising:

the voltage application step of applying potentials to a first wiring commonly connected to a plurality of electron-emitting devices, and a plurality of second wirings respectively connected to the plurality of electron-emitting devices, such that a voltage V1 is applied to the plurality of electron-emitting devices connected to the first wiring by the potentials applied to the first wiring and the plurality of second wirings, the voltage V1 having a relationship with a maximum value V2 of a voltage applied as a normal driving voltage after the voltage application step, so as to satisfy:

giving a current I flowing upon application of a voltage V when the voltage V falling within a voltage range causing electron emission upon application of the voltage between two electrodes is applied to the device:

$$I=f(V) \quad (1)$$

and letting f' (V) be a differential coefficient of f(V) at the voltage V, a condition:

$$f(V1)/\{V1\cdot f'(V1)-2f(V1)\}>f(V2)/\{V2\cdot f'(V2)-2f(V2)\} \quad (2)$$

wherein the potential applied to each second wiring is set to reduce a difference in magnitude of the voltage V1 applied to each electron-emitting device as a potential difference between the potential applied to the electron-emitting device through the first wiring and the potential applied to the electron-emitting device through each second wiring.

* * * * *

UNITED STATES PATENT AND TRADEMARK OFFICE

CERTIFICATE OF CORRECTION

PATENT NO. : 6,743,066 B1 
DATED : June 1, 2004
INVENTOR(S) : Takahiro Oguchi et al.

It is certified that error appears in the above-identified patent and that said Letters Patent is hereby corrected as shown below:

Title page,
Item [56], References Cited, OTHER PUBLICATIONS, "Devices"" should read -- Devices", --.

Figure 33:
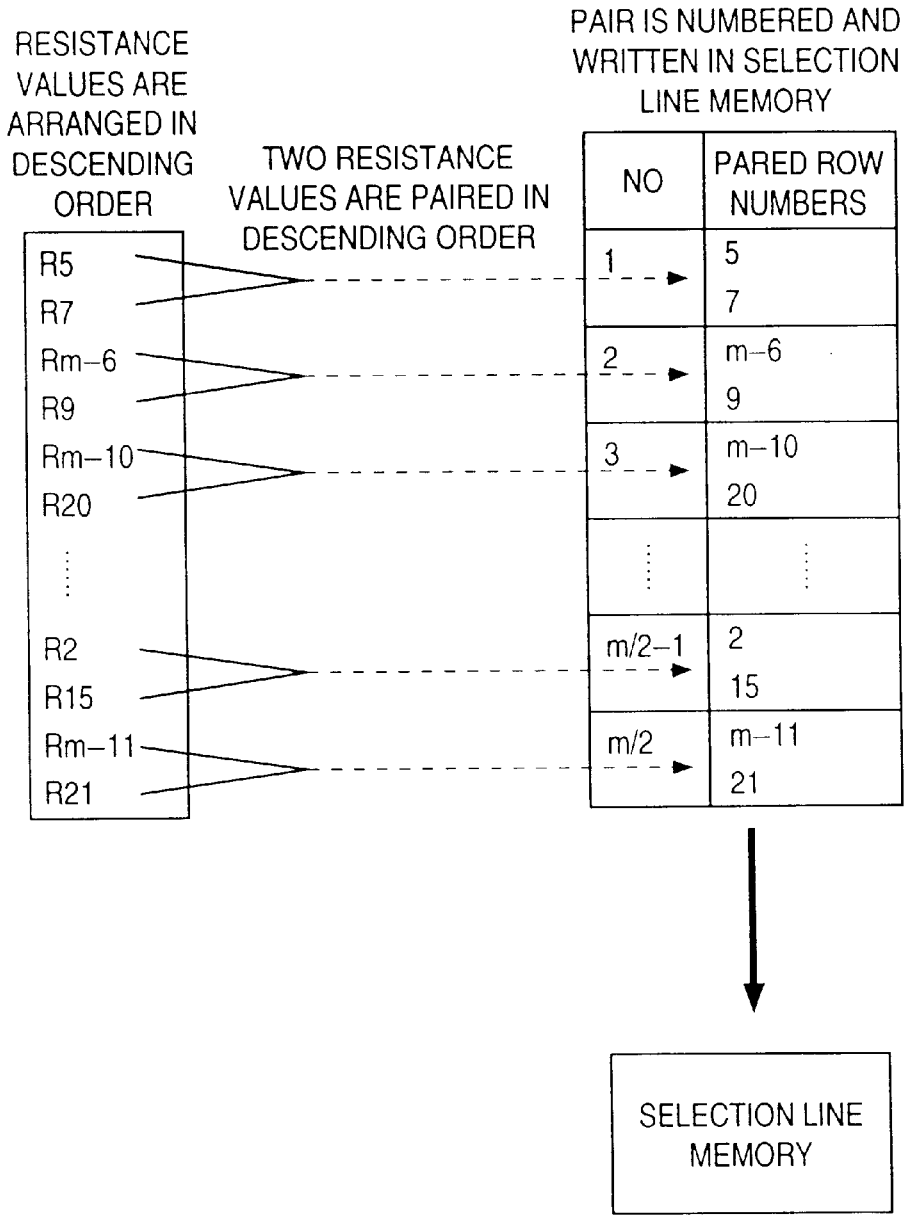
FIG. 33 is a view for explaining a selection pair combination method based on a measured wiring resistance value.

Drawings,
SHEET 33, FIGURE 33, "PARED" should read -- PAIRED --.
SHEET 35, FIGURE 35, "PARED" (both occurrences) should read -- PAIRED --.
SHEET 41, FIGURE 41, "MULTU-DRIVEN" should read -- MULTI-DRIVEN --.

Column 7,
Line 31, "electrodes each" should read -- electrodes of each --.

Column 18,
Line 4, "voltage Vpre:" should read -- voltage Vpre --.
Line 19, "wring" should read -- wiring --.

Column 24,
Line 40, "–¼r×(n-5)×I~¼×r×(n+3)×I" should read -- -¼×r×(n-5)×I~¼×r×(n+3)×I --.

Column 27,
Line 51, "source 402" should read -- source 403 --.

Column 28,
Line 61, "m=480)." should read -- m=480. --.
Line 64, "1004.." should read -- 1004. --.

Column 29,
Line 62, "10-7 Torr." should read -- $10^{-7}$ Torr.--

Column 33,
Line 52, "10-5 Torr," should read -- $10^{-5}$ Torr, --.

Column 52,
Lines 40 and 43, "AV1" should read -- ΔV1 --.

Column 58,
Line 50, "DyN=-½×rN×N×(N+1)x iave" should read -- DyN= –½×rN×N×(N+1)× iave --.
Line 56, "Fn)" should read -- Fn). --.

UNITED STATES PATENT AND TRADEMARK OFFICE

CERTIFICATE OF CORRECTION

PATENT NO. : 6,743,066 B1
DATED : June 1, 2004
INVENTOR(S) : Takahiro Oguchi et al.

It is certified that error appears in the above-identified patent and that said Letters Patent is hereby corrected as shown below:

Column 74,
Line 34, "average Iave" should read -- average Ifave --.

Column 80,
Line 8, "devices)" should read -- devices). --

Column 82,
Line 35, "f(V 1 )/{V1·f'(vl)-2f(v1)}>f(v2)/{V2·f'(V2)}" should read -- f(V1)/{V1·f' (vl) –2f (v1)}>f (v2)/{V2·f (V2)} –2f(V2)} --.

Column 83,
Line 61, "electrodes each" should read -- electrodes of each --.

Signed and Sealed this

Twenty-second Day of March, 2005

JON W. DUDAS
*Director of the United States Patent and Trademark Office*